US012715557B2

(12) United States Patent
Basile

(10) Patent No.: US 12,715,557 B2
(45) Date of Patent: Aug. 25, 2026

(54) SYSTEMS AND METHODS FOR RETRIEVING AND DEPLOYING OBJECTS ON A BODY OF WATER

(71) Applicant: Fetch Labs, LLC, Dover, DE (US)

(72) Inventor: Todd C. Basile, Dover, DE (US)

(73) Assignee: Fetch Labs, LLC, Dover, DE (US)

( * ) Notice: Subject to any disclaimer, the term of this patent is extended or adjusted under 35 U.S.C. 154(b) by 0 days.

(21) Appl. No.: 19/460,473

(22) Filed: Jan. 27, 2026

(65) Prior Publication Data

US 2026/0152263 A1 Jun. 4, 2026

Related U.S. Application Data

(63) Continuation of application No. 19/035,525, filed on Jan. 23, 2025, now Pat. No. 12,559,209.

(60) Provisional application No. 63/729,134, filed on Dec. 6, 2024, provisional application No. 63/623,999, filed on Jan. 23, 2024.

(51) Int. Cl.
*B63B 35/32* (2006.01)

(52) U.S. Cl.
CPC ..... *B63B 35/32* (2013.01)

(58) Field of Classification Search
CPC ..... B63B 35/00; B63B 35/32; B63B 35/34; B63B 35/38; B63B 34/00; B63B 34/05
USPC ..... 114/256, 351, 382
See application file for complete search history.

(56) References Cited

U.S. PATENT DOCUMENTS

| | | | | |
|---|---|---|---|---|
| 3,026,545 | A | 3/1962 | Brainard, II | |
| 3,268,081 | A | 8/1966 | Menkee et al. | |
| 3,928,206 | A | 12/1975 | Waren | |
| 4,178,247 | A | 12/1979 | Janson | |
| 4,545,315 | A | 10/1985 | Becherer | |
| 5,106,492 | A | 4/1992 | Distinti et al. | |
| 7,037,038 | B1 | 5/2006 | Haski et al. | |
| 7,101,475 | B1 | 9/2006 | Maaske et al. | |
| 7,504,027 | B2 | 3/2009 | Cosentino | |
| 10,385,582 | B2 | 8/2019 | Smith, Jr. | |
| 10,918,101 | B2 | 2/2021 | Klingenberg | |
| 11,112,799 | B2 | 9/2021 | Simik et al. | |
| 12,032,376 | B2 | 7/2024 | Simik et al. | |
| 2004/0025770 | A1* | 2/2004 | Saunoris | B63B 34/05 114/40 |
| 2005/0178043 | A1* | 8/2005 | Markley | A01M 31/00 43/26.1 |
| 2006/0060513 | A1 | 3/2006 | Craig | |
| 2006/0102532 | A1 | 5/2006 | Cadotte, Jr. | |

(Continued)

*Primary Examiner* — Daniel V Venne

(57) ABSTRACT

A watercraft for retrieving an object on a body of water, comprising (i) a containment structure having an interior defining an internal cargo area of the watercraft, an open front side, and a partially or fully submerged lower containment element through which water can freely pass while obstructing the object from exiting the internal cargo area; and (ii) one or more floatation members coupled to an exterior of, or defining at least a portion of, the containment structure. A modular watercraft comprising first and second floatation members configured to be deployed on an exterior, and stowed in an interior, of the containment structure. A system comprising a watercraft having one or more rotating capture assemblies onboard, configured to actively pull or push the object into an internal cargo area through the open front side of the containment structure.

30 Claims, 97 Drawing Sheets

(56) References Cited

U.S. PATENT DOCUMENTS

| | | | | |
|---|---|---|---|---|
| 2007/0006516 | A1 | 1/2007 | LaCroix, Jr. | |
| 2012/0305461 | A1 | 12/2012 | Verone | |
| 2017/0332621 | A1* | 11/2017 | Macias | A01M 99/00 |

* cited by examiner

SYSTEMS AND METHODS FOR RETRIEVING AND DEPLOYING OBJECTS ON A BODY OF WATER

CROSS-REFERENCE TO RELATED APPLICATION(S)

This application is a continuation patent application of U.S. Non-Provisional application Ser. No. 19/035,525, filed Jan. 23, 2025, which claims the benefit of and priority to U.S. Provisional Application No. 63/729,134, filed Dec. 6, 2024 and U.S. Provisional Application No. 63/623,999, filed Jan. 23, 2024, all of which are hereby incorporated herein by reference in their entirety for all purposes.

BACKGROUND

There is often a need to retrieve objects floating out-of-reach on a body of water; however, existing approaches for doing so can be undesirable for various reasons. For example, swimming out to the object can be uncomfortable or even dangerous depending on water and air temperatures, currents, and the possible presence of pathogens, contaminants, dangerous marine life, or hidden hazards in the water. Likewise, wading out to the object even while wearing waterproof waders can be undesirable for similar reasons, or even impossible depending on water depth and bottom composition. Sending a dog or other trained animal to retrieve the object can be a viable option but potentially exposes the animal to the same issues, and training and caring for the animal is typically time-consuming and expensive and may not even be an option if the owner is allergic to pet hair or lives where owning such an animal is prohibited or otherwise undesirable. Further, dogs tend to retrieve one object at a time and thus require multiple retrieves to collect multiple objects, which can be time consuming and tiring. Yet another approach is to paddle or motor a watercraft such as a kayak, canoe, or john boat to retrieve the object; however, such watercraft are not always readily available and can be expensive, laborious, and dangerous to transport, launch, and operate. Still further, one may attempt to retrieve the object by throwing a rope or casting a fishing lure or other implement at the object in an effort to snag it and pull it to shore, but this approach is limited by the length of rope/line, throwing/casting distance, and accuracy issues. All of the above approaches can be even more undesirable if the object is not stationary, but rather is moving with the current or trying to escape (e.g., when the object is an animal, such as a duck or goose downed while waterfowl hunting).

Radio-controlled boats have also been used to retrieve floating objects, but likewise suffer from several disadvantages. For example, using a radio-controlled boat to push the object back to shore can be difficult, as there is a tendency for the object to slide off to either side of the boat unless steered perfectly-a task made even more difficult by wind, waves, and current. Further, pushing an object along the surface of the water typically generates significant hydrodynamic drag, meaning a more powerful radio-controlled boat may be required to achieve similar performance. Generally speaking, more powerful motors require larger batteries, both of which add weight that further compounds the need for even more powerful motors and batteries to maintain a desired level of performance. All of the foregoing leads to higher unit cost and maintenance costs, and can make the radio-controlled boat more burdensome to transport and operate. Still further, an object being pushed through the water applies reaction forces to the bow of the radio-controlled boat which, in turn, generate pitching and yawing moments that may take the radio-controlled boat out of its optimal pitch and directional trim state. This can lead to increased hydrodynamic drag on the radio-controlled boat and difficulty in controlling its operation. As another example, using a radio-controlled boat to tow an object back to shore while the object remains in the water presents similar challenges. Hydrodynamic drag acting on the object can generate yawing moments when the object is towed or pushed alongside the radio-controlled boat (e.g., by snagging it with a hook projecting from the port or starboard side) and these yawing moments must be overcome with a larger keel and/or directional trim, thereby increasing power consumption and draft, and reducing controllability. Likewise, the weight and/or difference in buoyancy of the object may generate rolling moments on the radio-controlled boat which must be overcome through the use of a larger keel and/or roll trim, thereby increasing power consumption and draft, and reducing controllability. Still further, towing or pushing the object alongside the radio-controlled boat presents a wider footprint, which can make it more difficult to navigate around other objects in the water, such as debris or, in a waterfowl hunting context, floating decoys. Towing an object behind a radio-controlled boat suffers similar challenges. Still further, all such approaches are especially difficult if the object is moving or attempting to escape and the user may need to re-navigate to the object if the retrieval operation is interrupted since the object may float away or swim away from the boat during such time. All combine for a frustrating, attention-demanding, and overall inefficient experience with varying levels of effectiveness.

Additionally, there is often a need to deploy objects to one or more desired locations on a body of water. While the above approaches may be utilized for such purposes, each suffers from similar disadvantages.

Waterfowl hunting is one application in which there is a need to retrieve and/or deploy objects on a body of water. In waterfowl hunting, floating decoys are often placed in the water to attract the waterfowl and hunters shoot the waterfowl as they attempt to land amongst the decoys. As such, downed waterfowl tend to fall into the water out-of-reach from the hunter(s), who typically set up on shore or in an anchored boat. Retrieving downed waterfowl can be especially difficult if the waterfowl is merely injured (often referred to in waterfowl hunting lingo as "crippled") and able to swim away or dive under the surface of the water. Likewise, before and after the hunt, the floating decoys must be deployed and retrieved, and sometimes during the hunt a hunter may wish to rearrange the decoys if the waterfowl are reacting in such a way that they flare or attempt to land in an undesired location. The above approaches are often used when retrieving downed waterfowl, as well as for deploying (i.e., setting and/or rearranging) floating decoys, and thus suffer from many of the challenges discussed above. These challenges may be further compounded by the cold, wet, and windy conditions in which waterfowl hunting often takes place, as well as by a sense of urgency to complete a retrieve in anticipation of more waterfowl coming soon.

Accordingly, there is a need for alternative approaches for retrieving and/or deploying objects on a body of water.

SUMMARY

In one aspect, the present disclosure is directed to a watercraft for retrieving an object on a body of water. The watercraft may comprise a containment structure having an interior defining an internal cargo area of the watercraft, the internal cargo area being partially submerged in the body of water; and one or more floatation members positioned external to the internal cargo area, the one or more floatation members being coupled to an exterior of, or defining at least a portion of, the containment structure. The containment structure may comprise an open front side dimensioned to accommodate entry of the object into the internal cargo area through the open front side; and a lower containment element defining a lower side of the internal cargo area, wherein at least a portion of the lower containment element is submerged in the body of water, and wherein at least the portion or entirety of the lower containment element that is submerged in the body of water has a construction allowing water to freely pass therethrough while obstructing the object from exiting the internal cargo area therethrough.

The one or more floatation members, in various embodiments, may comprise a first elongated floatation member extending along or defining at least a port side of the containment structure and a second elongated floatation member extending along or defining at least a starboard side of the containment structure. In an embodiment, the one or more floatation members may comprise a U-shaped floatation member comprising a rear portion extending along or defining at least a rear side of the containment structure, a first elongated portion extending along or defining at least a port side of the containment structure, and a second elongated portion extending along or defining at least a starboard side of the containment structure.

The containment structure, in various embodiments, may further comprise a rear containment element. A portion of the rear containment element, in an embodiment, may be submerged in the body of water, and at least the portion or entirety of the rear containment element that is submerged in the body of water may have a construction allowing water to freely pass therethrough while obstructing the object exiting the internal cargo area therethrough. Alternatively, in an embodiment, an entirety of the rear containment element is positioned above a surface of the body of water.

The containment structure, in various embodiments, may further comprise first and second side containment elements. The one or more floatation members, in an embodiment, may define the first and second side containment elements of the containment structure.

In various embodiments, an entirety of the lower containment element may be submerged in the body of water. In one such embodiment, the lower containment element may be oriented substantially parallel to a surface of the body of water.

Alternatively, in various embodiments, only a portion of the lower containment element may be submerged in the body of water. In one such embodiment, at least the submerged portion of the lower containment element may be angled downwards in a direction towards the open front side of the containment structure. In some embodiments, at least a leading edge of the lower containment element may be submerged to a depth exceeding that of any submerged portion of the object, while in some other embodiments, at least a leading edge of the lower containment element may be submerged to a depth less than that of any submerged portion of the object, yet still be deep enough to allow the object to pass over the leading edge of the lower containment element. At least the portion or entirety of the lower containment element that is submerged in the body of water, in various embodiments, may comprise low-profile members spaced apart from one another, wherein the spacing is sufficient to allow water to freely pass therebetween and insufficient to allow the object to fully pass therebetween. Additionally or alternatively, at least the portion or entirety of the lower containment element that is submerged in the body of water may comprise one or more holes, wherein each of the one or more holes has a diameter sufficient to allow water to freely pass therethrough and insufficient to allow the object to fully pass therethrough.

The containment structure, in various embodiments, may further comprise an upper containment element. The upper containment element, in some embodiments, may comprise or define a hatch dimensioned to accommodate removal of the object from the internal cargo area through the hatch.

The watercraft, in various embodiments, may further comprise one or more semi-rigid retaining members configured to bend in a first direction to accommodate passage of the object into the internal cargo area and to bend back in a second, opposing direction to obstruct passage of the object out of the internal cargo area. Additionally or alternatively, the watercraft, in various embodiments, may comprise one or more rigid retaining members positioned at the open front side of the containment structure and configured to move, upon actuation of an electromechanical mechanism, from an open position that does not obstruct the open front side to a closed position that obstructs the open front side. The electromechanical mechanism, in an embodiment, may be a motor that powers the movement of the one or more rigid retaining members from the open position to the closed position. In another embodiment, the retainer may include a biasing member configured to bias the one or more retaining members towards the closed position, and the electromechanical mechanism comprises a latch configured to, when the latch is closed, retain the one or more rigid retaining members in the open position and to, when the latch is opened, release the one or more retaining members to move towards the closed position in response to a force applied by the biasing member.

The watercraft, in various embodiments, may further comprise an elevation mechanism configured to selectably raise at least a portion of the portion or entirety of the lower containment element that is submerged in the body of water to a position above a surface of the body of water when the object is in the internal cargo area.

The watercraft, in various embodiments, may further comprise one or more lifting members submerged in the body of water and configured to generate, in response to forward motion of the watercraft reaching a threshold speed, sufficient hydrodynamic lift to raise at least a portion of the portion or entirety of the lower containment element that is submerged in the body of water to a position above the surface of the body of water.

The watercraft, in various embodiments, may further comprise one or more passive drains, each passive drain comprising a hinged flap configured to hang downwards in a neutral position when the watercraft is at rest and to swing aft from the neutral position to cover an opening in the lower containment member in response to hydrodynamic forces generated by forward motion of the watercraft.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
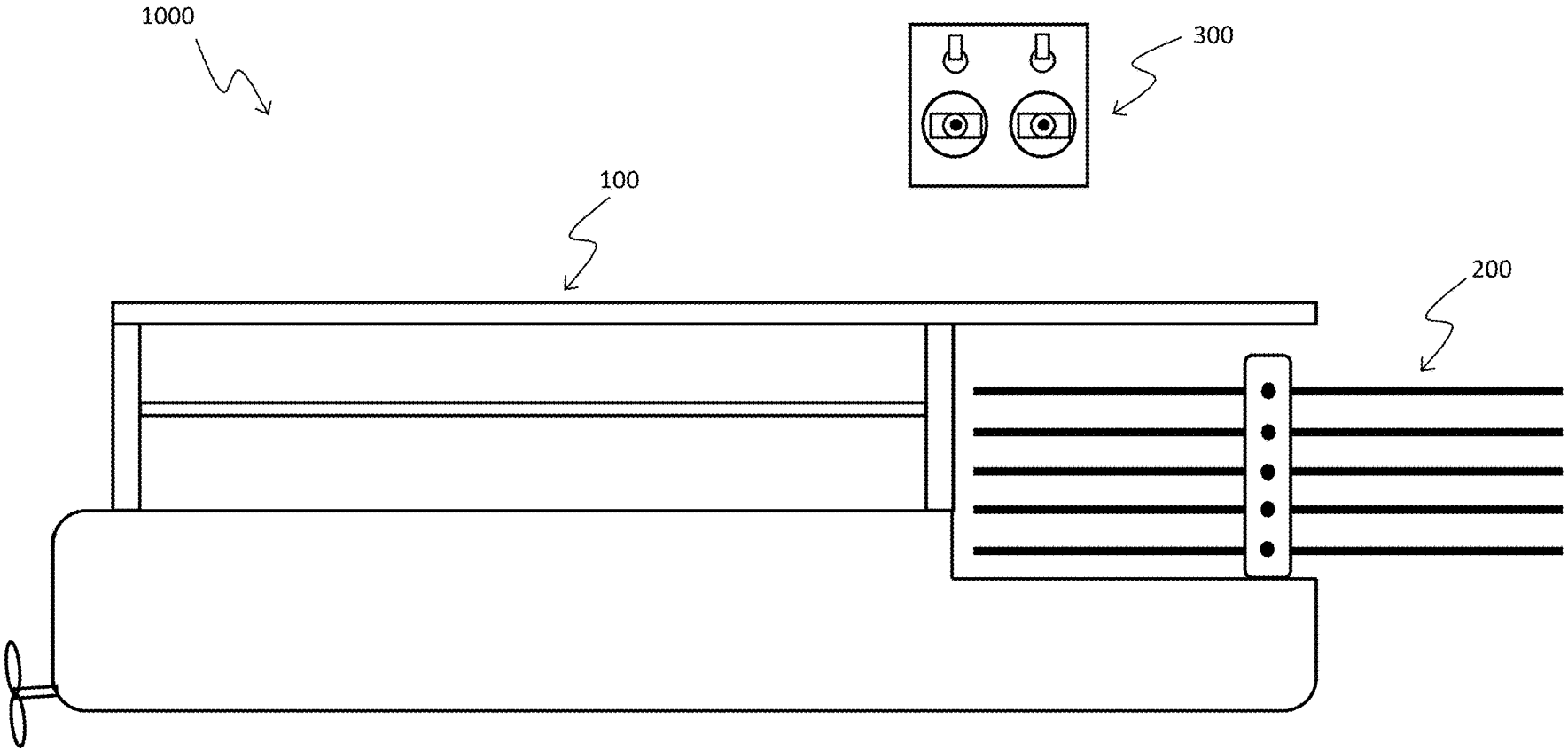
FIG. 1 illustrates a retrieval system 1000, in accordance with an embodiment of the present disclosure.

The present disclosure is directed to watercraft, and associated systems and methods, for retrieving and/or deploying objects on a body of water. Generally speaking, watercraft configured for retrieving objects leverage various combinations of unique passive and/or active design elements (e.g., watercraft architecture; rotating capture assemblies; retainers) to facilitate the intake and retainage of objects within their cargo areas during retrieval operations. Watercraft configured for deploying objects likewise leverage various combination of unique passive and/or active design elements (e.g., rotating deployment assemblies; loaders) to direct objects out of their cargo areas during deployment operations. As later described in more detail, embodiments of the present disclosure offer several benefits and advantages including, without limitation:

Load balance—Carrying objects within an internal cargo area helps maintain a favorable center of gravity and thereby avoid extreme pitching moments when laden.

Containment and retainage—Containment structure helps contain the object within the internal cargo area and retainers preventing the objects from inadvertently or intentionally escaping from the internal cargo area thereafter.

Low complexity—Many of the designs described herein contain no moving or motorized parts other than their powertrains, yet leverage unique passive design elements to facilitate the intake and retainage of the object. Active elements like the capture assembly(s) are relatively simple motor-driven mechanisms controlled by an on/off switch, thereby improving reliability in harsh marine environments and cold weather and reducing overall cost.

Low maintenance—Minimizing moving and/or active components and positioning them above the waterline in some embodiments helps minimize water intrusion and rusting, as well as fouling these mechanisms with vegetation, and allows for simple replacement when worn or damaged.

Low water drag—Positioning active components above the waterline, carrying the object(s) within the internal cargo area, and in some embodiments raising submerged components above the waterline when cruising each help minimize drag in the water.

Low aerodynamic drag—Various design elements, such as capture assemblies and retainers, provide for smaller internal cargo area dimensions and a cage-like construction allows wind to pass through portions of the containment structure positioned above the waterline.

Modularity—Various components can be disassembled and nested for ease of transport, and easily reassembled and/or reconfigured when ready to use.

Active capture—Capture assembly(s) actively pull objects into the internal cargo area during retrieval operations, thereby facilitating object retrieval especially when the object is too large to fit through open front side of the containment structure, is attempting to escape capture, and/or when a portion or entirety of the lower containment structure is raised above the surface of the water.

Active expulsion—Deployment assembly(s) actively push objects out of the internal cargo area during deployment operations, thereby facilitating the deployment of objects without excessive maneuvering of the watercraft and enabling selective deployment of multiple objects in multiple locations.

As used herein, the term "object" is used broadly and includes any physical object or physical being (e.g., animal) suitable for retrieval/deployment on a body of water via watercraft. Certain representative embodiments of the present disclosure are described in the context of waterfowl hunting and envision objects in the form of a downed duck or goose (whether dead or crippled) in retrieval operations, and floating decoys in deployment and/or retrieval operations. In each case, such objects tend to float on the surface of the water and as such various embodiments are configured to retrieve and/or deploy objects on the surface of the water. That said, systems and methods of the present disclosure may deploy non-floating objects that subsequently sink from the surface. Notwithstanding any of the foregoing, it should be recognized that systems and methods of the present disclosure may additionally or alternatively be used in other applications (e.g., trash collection; aquatic feeding or herbicide application) involving other objects (e.g., trash; blocks of bait or herbicides) and as such the present disclosure is not intended to be limited to waterfowl hunting applications nor objects in the form of downed waterfowl and floating decoys.

Likewise, certain embodiments of the present disclosure are described in the context of being radio controlled. While many potential applications benefit from radio-controlled operations, it should be understood that various embodiments can be scaled up for operations with people onboard.

Accordingly, references to radio control and associated components herein (e.g., transmitter 300) should be construed as optional.

Still further, certain embodiments of the present disclosure are described in the context having capture assemblies and/or retainers. While many potential applications benefit from the functionality afforded by these components, it should be understood that various embodiments of the watercraft itself are designed to facilitate retrieval and/or deployment without necessarily employing these features. Generally speaking, intake of objects into the cargo area can be accomplished in many cases simply by lining up the watercraft with the object and driving forwards until the object enters the cargo area. Likewise, retainage of objects within the cargo area can be accomplished in many cases simply by continuing to drive the watercraft forwards such that the force of oncoming water holds the object inside. Accordingly, capture assemblies and/or retainers should be considered optional components unless expressly stated as being required (e.g., in instances where intake is difficult or impossible without us of a capture assembly due to the inherent design of the watercraft, such as those with lower containment structures that are raised above the waterline and thus interfere with passage of the object into the cargo area).

Retrieval System 1000

FIG. 1 is a schematic view of a representative embodiment of a retrieval system 1000. Retrieval system 1000, in various embodiments, may be configured for retrieving one or more objects floating on the surface of a body of water and may generally include a watercraft 100 having one or various combinations of two or more of a capture assembly(s) 200, a lifting member(s) 500, a retainer(s) 600 or 700, an elevation mechanism 800, and a transmitter 300 for remotely controlling operation of the foregoing, as described in more detail herein. As noted above, various embodiments of watercraft 100 are designed to retrieve objects 10 without the need for these additional components or capabilities, and as such the present disclosure is not limited only to systems in which one or more of these additional components and/or capabilities are present.

Watercraft 100

FIGS. 2-9 illustrate various views and embodiments of watercraft 100. Watercraft 100, in various embodiments, may generally include two floatation members 110 (e.g., elongated members such as pontoons), a connecting structure 130 connecting floatation members 110 and maintaining parallel alignment therebetween (note: containment structure 140 may serve as connecting structure 130 in various embodiments), containment structure 140 having an interior defining a cargo area 120, and a powertrain 180 for propelling and steering watercraft 100 during retrieval operations, as described in more detail herein.

Floatation Members 110

Each floatation member 110, in various embodiments, may include a body 112. In some embodiments, each body 112 may have one or more recesses 114 (not shown) for accommodating various components of powertrain 180 therein. One or more corresponding hatches 116 may be provided on the outer surface of each floatation member 110; when open, hatch(es) 116 may allow access to recess(es) 114 and the powertrain 180 components contained therein and, when closed, hatch(es) 116 may provide a watertight seal for preventing water from entering recess(es) 114. As later described, in some embodiments, all or some of the various components of powertrain 180 are instead located offboard floatation members 110.

Body 112 of floatation member 110, in various embodiments, may have a buoyant construction so as to provide floatation for watercraft 100. To that end, body 112 may be constructed of a buoyant material or otherwise have a construction conferring buoyant properties, such as one formed of non-buoyant materials (e.g., plastic, metal) but with a hollow interior and dimensions configured to displace an amount of water greater in weight than that of body 112. In various embodiments, body 112 may be substantially rigid so as to maintain its general shape under loads applied by powertrain 180, capture assembly 200, object 10, and/or the water. In a preferred embodiment, body 112 is substantially solid (aside from optional recess(es) 114) and formed of a high density closed cell foam (e.g., polypropylene foam similar to that used in muscle recovery foam rollers) due to its lightweight, durable, rigid, and waterproof properties, though it should be understood that a person having ordinary skill in the art will recognize without undue experimentation other suitable materials and constructions consistent with the espoused properties described herein. In an embodiment, additional rigidity may be provided by one or more stiffening members (not shown) extending through or otherwise coupled to body 112.

Body 112 of floatation member 110, in various embodiments, may have an elongated shape so as to reduce hydrodynamic drag and improve directional tracking of watercraft 100. For example, in various embodiments, the elongated shape may be substantially cylindrical with a circular or ovate cross-section, or have any other elongated shape and cross-section typically associated with boat hulls, such as the common v-shaped cross-section. A front end of body 112, in an embodiment, may include further hydrodynamic shaping, such as a dome shape, tapered point, or upward-sloping front found on many boat hulls and ski tips. Body 112, in various embodiments, may have width and height dimensions (or a diameter dimension for those having circular cross-sections) suitable for accommodating the various components of powertrain 180 therein, and a length dimension defining or otherwise substantially similar to an overall length of watercraft 100, as shown.

Figure 2:
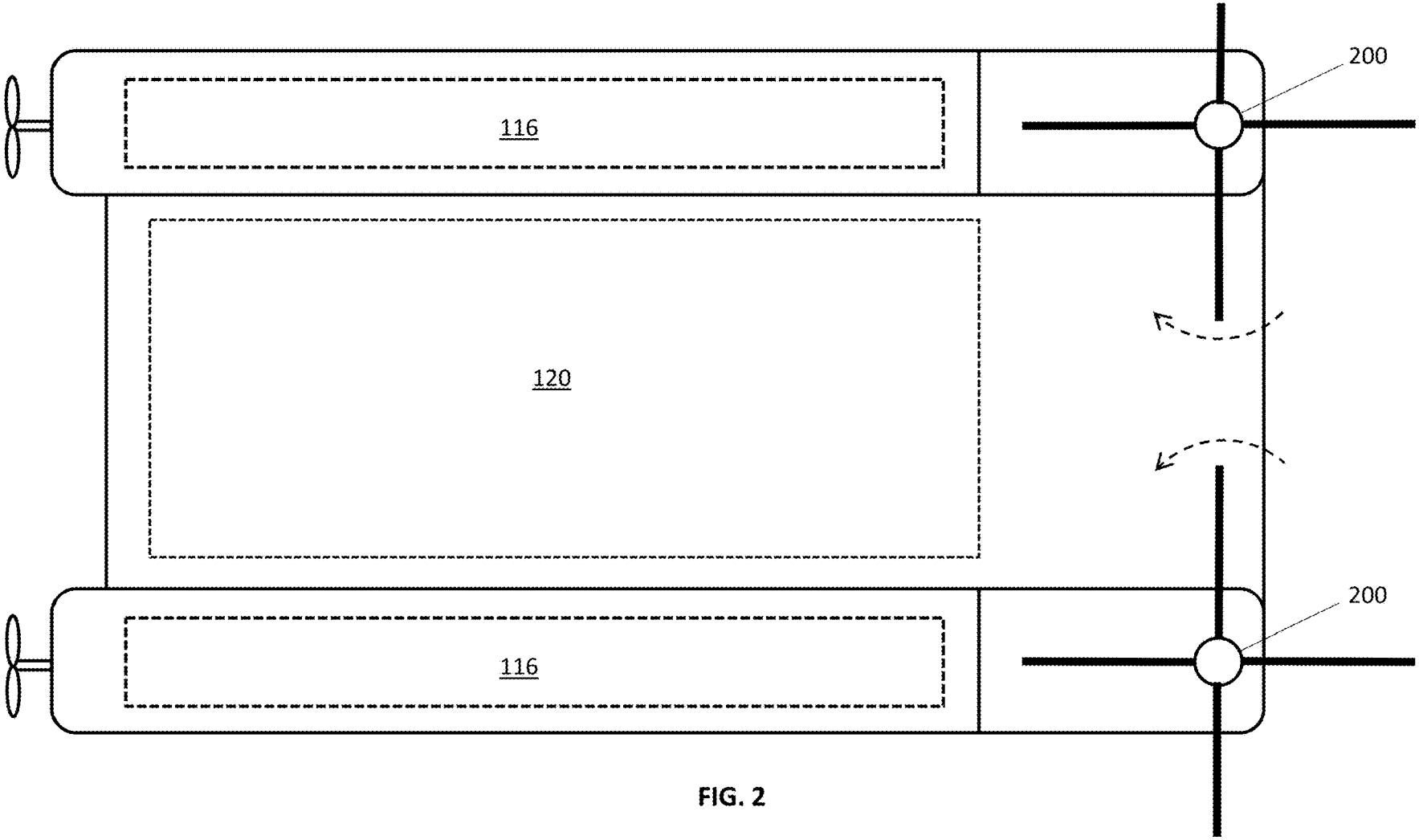
FIG. 2 is a top view of an internal cargo area 120 of a watercraft 100, in accordance with an embodiment of the present disclosure.

In various embodiments, a length of floatation member 110, may be selected based at least in part on a desired length dimension of cargo area 120. That is to say, the length of floatation member 110 may generally be equal to or longer than the desired length of cargo area 120 for embodiments in which cargo area 120 is to be fully contained within a fore/aft footprint of floatation members 110. With reference to FIG. 2, if the rotating capture member 210 is positioned with capture arm hub 214 on a fore end of body 112 as shown, then the length of floatation members 110 may exceed the length of desired cargo area 120 by at least an amount equivalent to the length of capture arms 212 such that there is clearance between a front end of cargo area 120 and the distal ends of capture arms 212. In embodiments in which rotating capture member 210 is positioned with capture arm hub 214 forward of the fore end of body 112 (e.g., on an arm mounted to the fore end and extending forward; not shown), the length of floatation member 110 need not necessarily exceed (but of course still may be chosen such that it exceeds) a desired length of cargo area 120. Likewise, spacing between the inboard edges of floatation members 110 may be selected based on a desired width dimension of cargo area 120.

Cargo Area 120

FIG. 2 illustrates a representative internal cargo area 120 of watercraft 100. Generally speaking, cargo area 120, in various embodiments, may be defined as an interior of containment structure 140. As later described in more detail, containment structure 140 may simply comprise side containment elements in the form of floatation members 110 and a rear containment element 150—in such an example, cargo area 120 may simply be the area between floatation members 110 and forward of any rear containment element 150, with the buoyancy of object 10 on the surface of the water and gravity serving to contain object 10 within cargo area 120 from a vertical standpoint. In other embodiments, containment structure 140 may include a lower containment element 160—in such an example, lower containment element 160 may define a lower side of cargo area 120 and thereby contain object 10 within cargo area 120 from below. Additionally or alternatively, in some embodiments, containment structure 140 may include an upper containment element 170—in such an example, upper containment element 170 may define an upper side of cargo area 120 and thereby contain object 10 within cargo area 120 from above. A front side of cargo area 120, in some embodiments, may be defined by open front side 141 of containment structure 141. In other embodiments, cargo area 120 may extend forward beyond open front side 141 provided other containment elements are present in that area and object 10 is too large to fit fully within the interior of a more defined containment structure 140—e.g., if portions of floatation members 110 and portions of object 10 extend forward of open front side 141 of containment structure 141, cargo area 120 may be thought to extend forward into the area between those forward-extending portions of floatation members 110 to the extent those forward-extending portions are suitable for containing those forward-extending portions of object 10 therebetween.

Cargo area 120 may be considered internal to watercraft 100 if cargo area 120 is fully contained within the footprint of watercraft 100 as opposed to being forward, aft, or outboard of the footprint of watercraft 100. With cargo area 120 situated internal to watercraft 100, the center of gravity of object 10 may be positioned at or near the center of gravity of watercraft 100 when object 10 is in cargo area 120, and any hydrodynamic drag acting on object 10 when in cargo area 120 has a vector coincident with that of hydrodynamic drag acting on watercraft 100. Such properties minimize any pitch, roll, and yaw moments acting on watercraft 100 by virtue of carrying object 10 in cargo area 120, thus improving the tracking, controllability, and propulsive efficiency of watercraft 100 during transport of object 10. This is especially true relative to existing approaches where an object is pushed in front of or towed behind a watercraft or carried alongside a watercraft. When an object is pushed in front of or towed behind a watercraft, the weight of and hydrodynamic drag on the object generate greater pitch and yaw moments on the watercraft due to the longitudinal distances between where these forces act and the center of gravity of and/or center of pressure on the watercraft. Likewise, when an object is carried alongside a watercraft, the weight of and hydrodynamic drag on the object generate greater roll and yaw moments in particular on the watercraft due to the lateral distance between where these forces act and the center of gravity of and/or center of pressure on the watercraft.

Cargo area 120, in various embodiments, may have dimensions suitable for accommodating at least one of the target object 10 and, in some embodiments, may be larger so as to accommodate two or more of the target object 10. For example, in a waterfowl hunting application, cargo area 120 may have dimensions suitable for accommodating at least one downed duck or goose. Such sizing, in some embodiments, may possibly account for the wings of the waterfowl being folded against the body and for the neck bending to tuck the head back against the body, as later shown in FIGS. 14A-14E. In some embodiments, cargo area 120 may be longer and/or wider so as to accommodate two or more downed ducks or geese, thereby allowing for multiple downed waterfowl to be retrieved in a single trip. Notwithstanding, it may be advantageous in some applications to minimize the size of cargo area 120 to only that required for the particular application, thereby helping reduce an overall footprint and weight of watercraft 100. One having ordinary skill in the art will recognize appropriate dimensions of cargo area 120 for accommodating one or more of the target object 10 in a given application.

Cargo area 120, in various embodiments, may further include a height dimension extending between any lower and upper containment elements 160, 170 (later shown and described) included as part of watercraft 100. Generally speaking, the height of cargo area 120 should be greater than or equal to a height dimension of object 10 such that object 10 can be accommodated within cargo area 120 during retrieval operations.

Connecting Structure 130

Watercraft 100, in various embodiments, may include one or more structures 130 configured to connect floatation members 110 to one another and maintain the desired positioning and alignment of floatation members 110 relative to one another. Generally speaking, connecting structure 130 may take any form and construction so long as it is rigid enough to achieve the aforementioned purposes and does not otherwise prevent entry of object 10 into cargo area 120. While in some embodiments connecting structure 130 is distinct from containment structure 140 (e.g., where netting or some other non-rigid structure is provided for containment purposes), in many embodiments connecting structure 130 and at least some elements of containment structure 140 may be one in the same. That is, in various embodiments, certain elements may serve the stated purposes of both connecting structure 130 and containment structure 140 and, as such, references to "connecting structure" and "containment structure" need not necessarily be construed as being elements separate and distinct from one another, including when construing the claims of this patent application, unless otherwise apparent or specified. For ease of explanation, the present disclosure will primarily discuss connecting structure 130 as being part of containment structure 140, though it should be readily apparent to one of ordinary skill in the art which element(s) serve the purposes of connecting structure 130, which element(s) serve the purposes of containment structure 140, and which element(s) serve both purposes.

Containment Structure 140

Figure 3A:
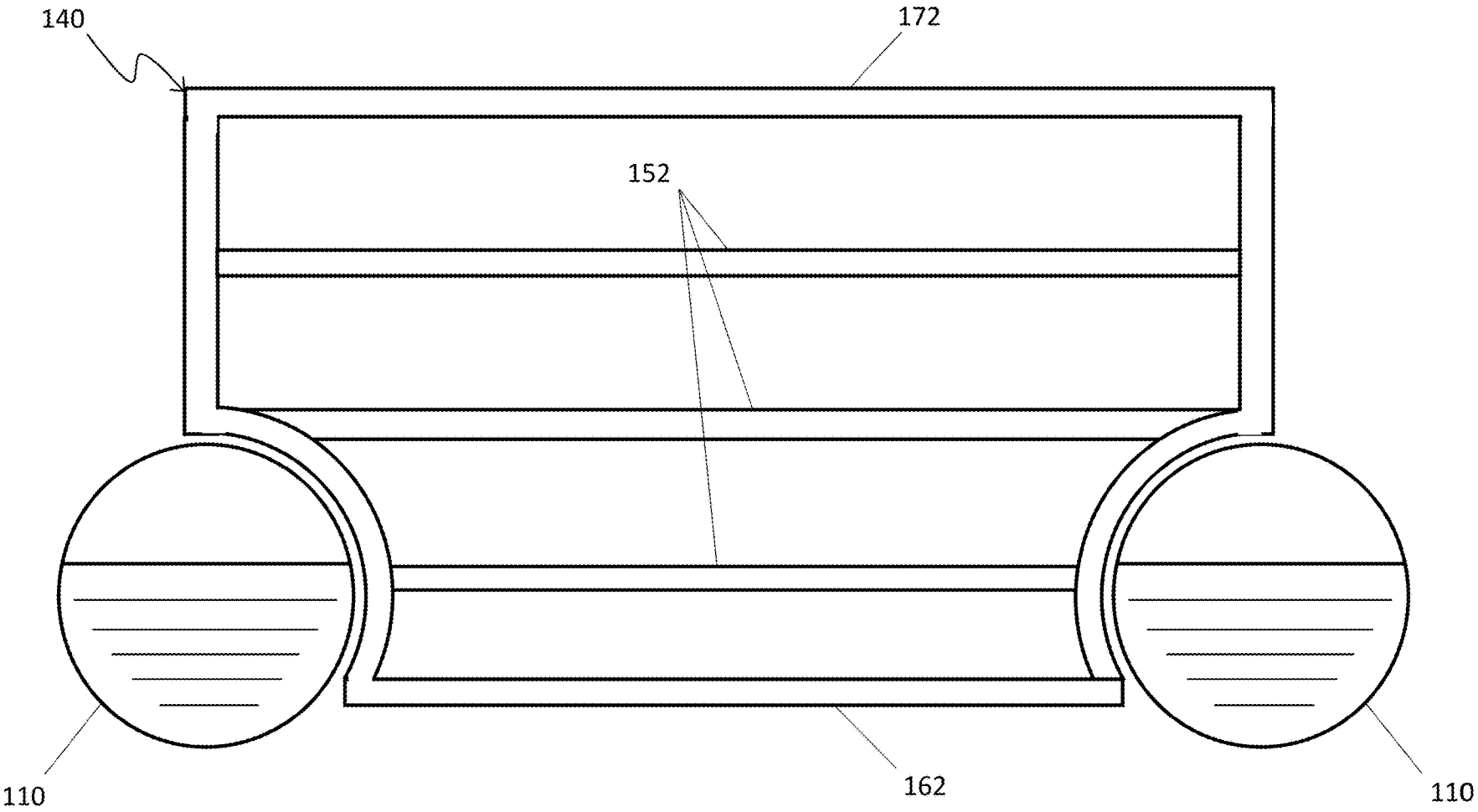
FIG. 3A is a front view of a containment structure 140 of a watercraft 100, in accordance with an embodiment of the present disclosure.
Figure 3B:
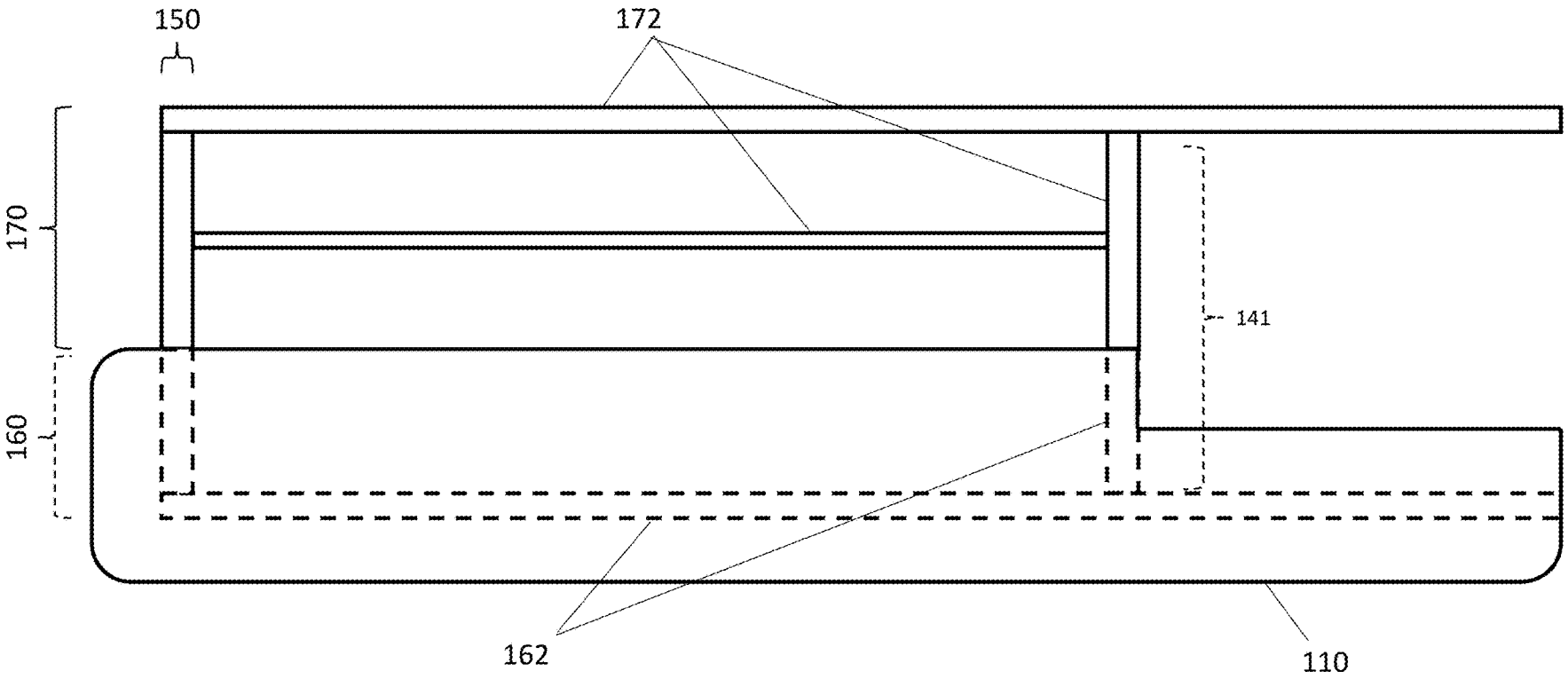
FIG. 3B is a right side view of the containment structure 140 of FIG. 3A, in accordance with an embodiment of the present disclosure.

FIGS. 3A-3B illustrate a representative embodiment of containment structure 140 of watercraft 100. Generally speaking, containment structure 140 may have an interior defining cargo area 120 such that containment structure at least partially surrounds cargo area 120 in a manner suitable to at least partially contain object 10 within cargo area 120. Containment structure 140, in various embodiments, may comprise at least side containment elements (e.g., floatation members 110 themselves or any other elements on the port and starboard sides bounding cargo area 120 in a lateral direction) and a rear containment element 150. In various embodiments, containment structure 140 may optionally include a lower containment element 160 and/or an upper containment element 170. Each of rear, lower, and upper containment elements 150, 160, 170, and side containment elements, in various embodiments, may include any structure suitable for containing object 10 within cargo area 120 and, for ease of explanation, sub-elements of these structures 150, 160, 170 may be referred to herein as containment members 152, 162, and 172, respectively. Floatation members 110, in various embodiments, may serve to contain cargo area 120 on the sides, and lower element 160 and/or upper element 170, in some embodiments, may be provided with one or more members 162, 172 positioned to further contain cargo area 120 on the sides above floatation members 110, as best shown in FIG. 3B. In the embodiment shown, containment structure 140 is cage-like (e.g., made up of multiple rigid members spaced apart from one another) and further connects floatation members 110 with sufficient rigidity to maintain the positions and alignment of floatation members 110, thereby further serving as connecting structure 130. One of ordinary skill in the art will recognize that the present disclosure is not intended to be limited to only the specific examples discussed herein.

Rear containment element 150, in various embodiments, may be positioned near an aft end of cargo area 120 and span the width of cargo area 120—e.g., between floatation members 110 in the embodiment shown. As configured, rear containment element 150 obstructs object 10 from passing all the way through cargo area 120 and out of the aft end of watercraft 100. Since object 10 either floats or is raised above the waterline by a lower containment element 160 (if equipped) when object 10 is in cargo area 120, in various embodiments, a bottom end of rear containment element 150 may extend down to the waterline or to the level of lower containment element 160, or at least extend below the top of object 10 as positioned in cargo area 120, such that object 10 is not carried out of the aft end of watercraft 100 when driving forwards, nor allowed to otherwise escape therethrough. To the extent portions of rear containment element 150 are situated close to or below the water line, it may be advantageous for at least such portions to have a construction that allows water to freely pass through so as to minimize hydrodynamic drag when watercraft 100 is moving forwards or in reverse.

Figure 4A:
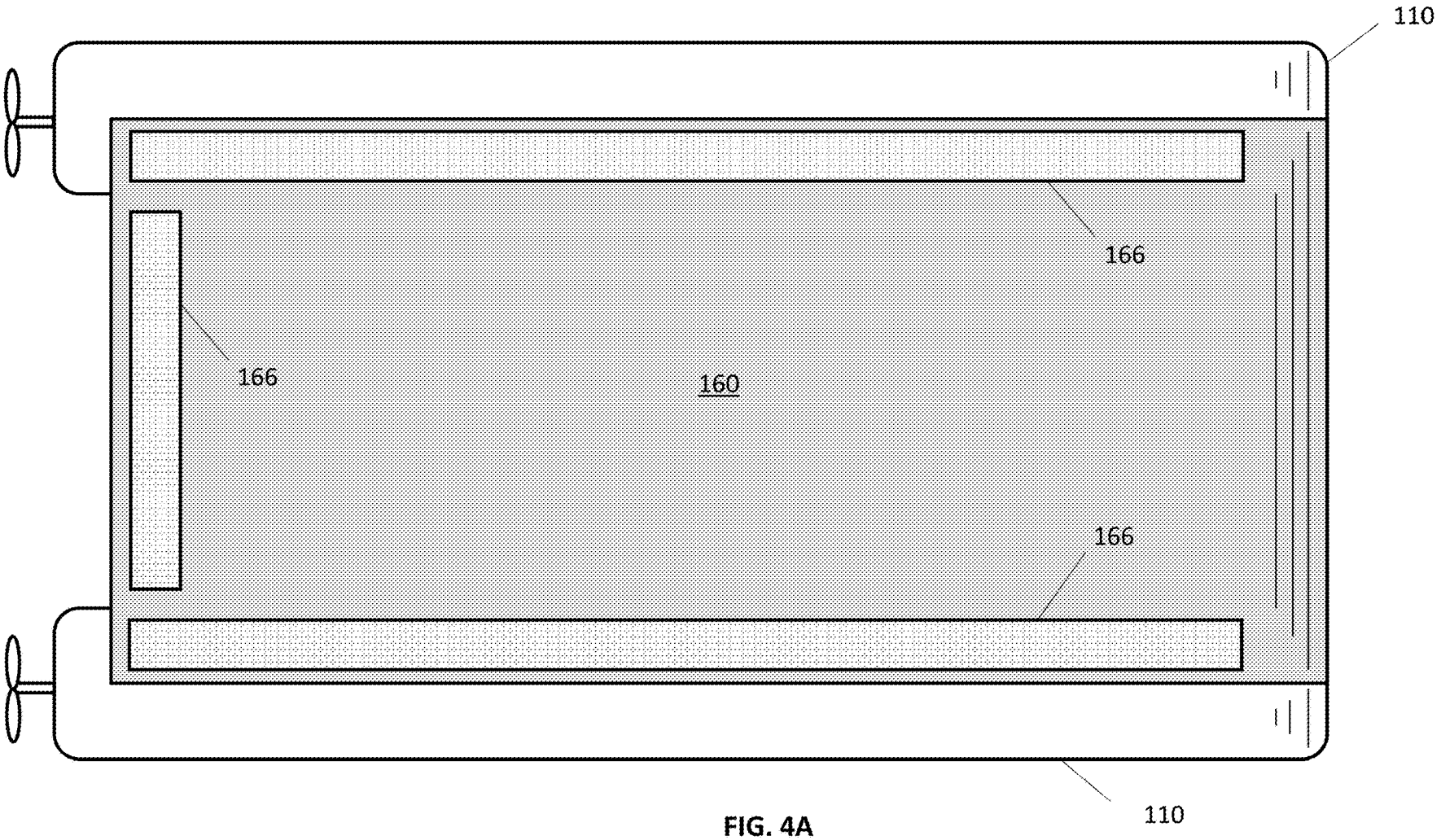
FIGS. 4A-4C are bottom views of various lower containment elements 160, in accordance with various embodiments of the present disclosure.
Figure 4B:
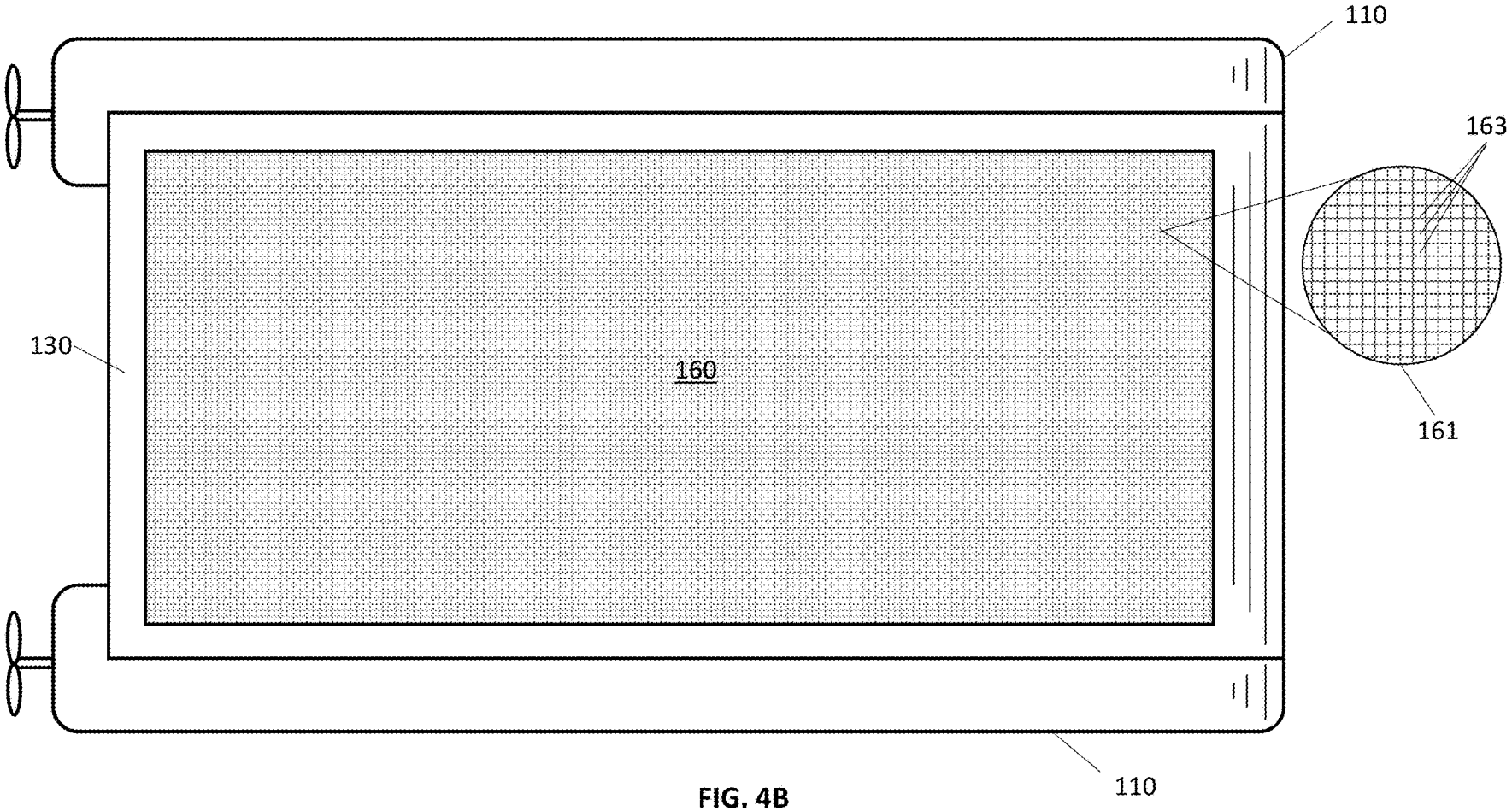
Figure 4C:
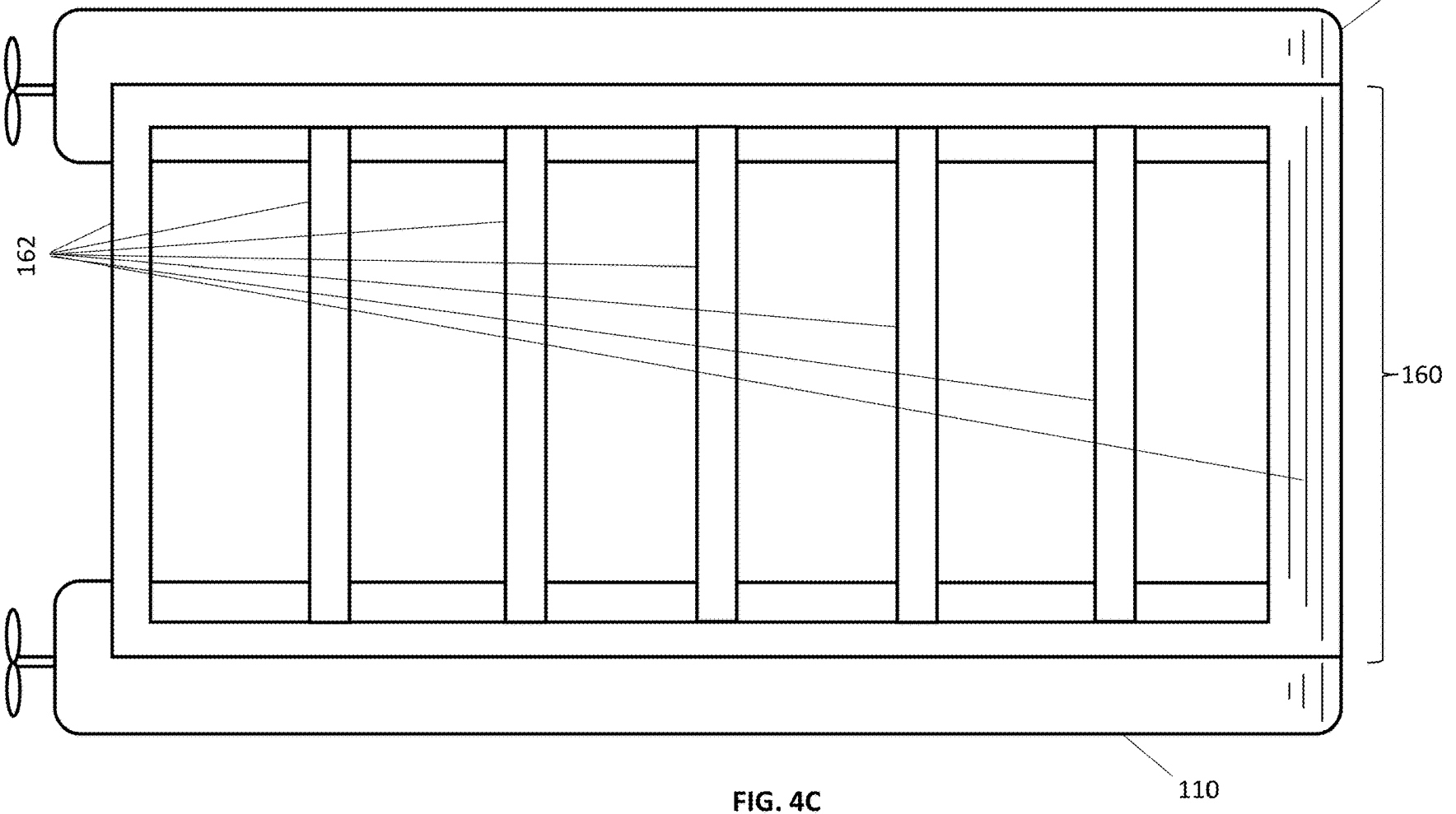

FIGS. 4A-4C illustrate several representative embodiments of a lower containment element 160. Lower containment element 160, in various embodiments, may be positioned below cargo area 120 and may span the width and length of cargo area 120 as shown. As configured, lower containment element 160 obstructs object 10 from escaping through the bottom of watercraft 100. Lower containment element 160, in various embodiments, may serve well as connecting structure 130 given that it may extend along a substantial length of floatation members 110 and thus can provide substantial rigidity to watercraft 100.

Lower containment element 160, in some embodiments, may be positioned so as to be situated at or above the water line. Such positioning may help avoid the hydrodynamic drag that may otherwise be generated were lower containment element 160 submerged below the water line. In such embodiments, lower containment element 160 may include an upward-sloped leading edge as shown in FIGS. 4A-4C to avoid "digging into" the water in the event the leading edge were to encounter a wave or otherwise dip below the water line. Additionally or alternatively, lower containment element 160, in an embodiment, may include one or more drains 166 as shown in FIG. 4A to allow water which may have crested the leading edge of lower containment element 160 to escape from cargo area 120. It should be noted; however, that positioning lower containment element 160 at or above the water line may cause the leading edge of lower containment element 160 to interfere with object 10 entering cargo area 120. To address this potential issue, in an embodiment, the leading edge of lower containment element 160 may be provided with a roller or other mechanism to facilitate object's 10 passage thereover. In another embodiment, this potential issue may be addressed by configuring capture assemblies 200 to push object 10 slightly upwards (e.g., by tilting rotating capture member 210 and/or capture arms 212 such that the force vector applied by capture arms 212 has a vertical component, as later shown in FIGS. 41C-41H).

Lower containment element 160, in various embodiments, may be positioned so as to be situated below the water line. Such positioning may facilitate intake of object 10 into cargo area 120 since a leading edge of lower containment element 160 would be less likely to interfere with object 10 approaches cargo area 120. It should be noted; however, that positioning lower containment element 160 below the water line may generate hydrodynamic drag. As such, lower containment element 160 may have a construction that allows water to freely pass through so as to minimize drag and potential nose-down moments associated with lower containment element 160 being below the water line. For example, as shown in FIGS. 4B, lower containment element 160 may include holes 163 through which water can pass but object 10 cannot (e.g., include a porous, mesh-like material 161). In another embodiment, as shown in FIG. 4C, lower containment element 160 may be comprised of multiple low-profile members 162 having a spacing suitable for containing object 10 but also for maximizing the passage of water therebetween so as to reduce hydrodynamic drag. While shown as being arranged laterally, it should be understood that in various embodiments low-profile members 162 could be arranged in other directions (e.g., longitudinally) and patterns (e.g., some lateral, some longitudinal to form a grid) and still achieve the same desired result—namely, allowing water to freely pass through lower containment element 160 while obstructing object 10 from passing therethrough.

In many applications, lower containment element 160 may not be necessary for containment purposes since object 10 typically floats on the surface of the water; however, in some applications, object 10 may become water-logged and sink or, for example in waterfowl hunting applications, object 10 (e.g., a crippled duck or goose) may be capable of diving under the water's surface and escape through the bottom of watercraft 100. In such cases lower containment element 160 may be beneficial. Further, and with this in mind, in some embodiments, lower containment element 160 may extend further forward of cargo area 120 such that a corresponding portion of lower containment element 160 is positioned under and spans capture assemblies 200 (if equipped) so as to inhibit object 10 from escaping downwards as it is being swept through capture assemblies 200.

Figure 5:
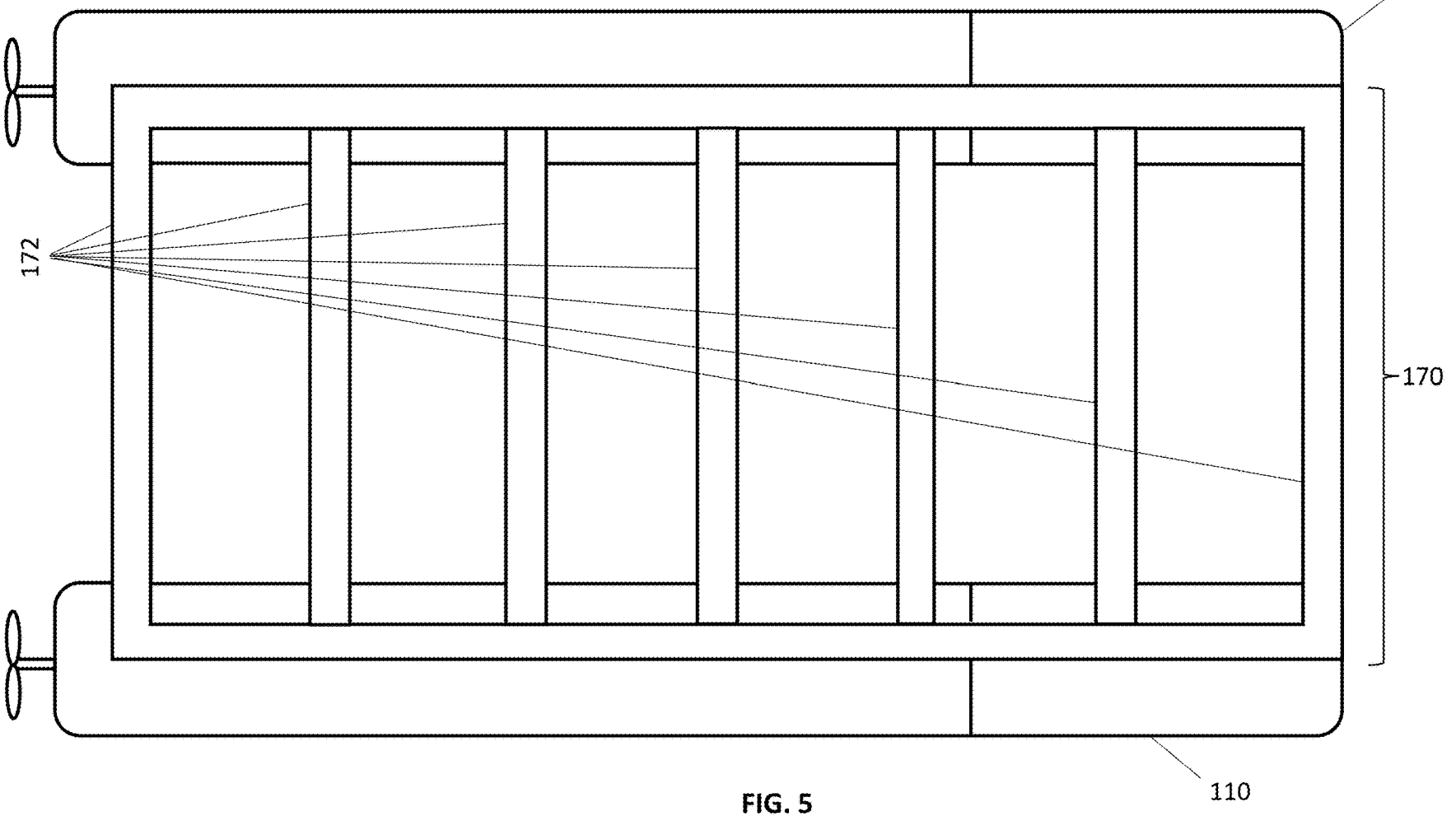
FIG. 5 is a top view of an upper containment element 170, in accordance with an embodiment of the present disclosure.

FIG. 5 illustrates a representative embodiment of an upper containment element 170. Upper containment element 170, in various embodiments, may be positioned above cargo area 120 and may span the width and length of cargo area 120. As configured, upper containment element 170 inhibits object 10 from escaping through the top of watercraft 100 or over the tops of floatation members 110. Upper containment element 170, in various embodiments, may also serve well as connecting structure 130 given that it may extend along a substantial length of floatation members 110 and thus can provide substantial rigidity to watercraft 100.

As shown in FIG. 5, in an embodiment, upper containment element 170 may be comprised of multiple low-profile members 172 having a spacing suitable for containing object 10 but also for maximizing the passage of air therebetween so as to reduce aerodynamic drag and to allow a user to better see through upper containment element 170 from a distance when navigating to and capturing object 10. Like with low-profile members 162 of lower containment element 160, it should be understood that in various embodiments low-profile members 162 could be arranged in other directions (e.g., longitudinally) and patterns (e.g., some lateral, some longitudinal to form a grid) and still achieve the same desired result—namely, allowing air to freely pass through upper containment element 170 while obstructing object 10 from passing therethrough. Such a construction may also provide for using the members 172 as handles for picking up watercraft 100.

In some embodiments, upper containment member 170 may comprise or define a hatch, the hatch being dimensioned to accommodate removal of object 10 from the internal cargo area 120. In one such embodiment, upper containment member 170 may be hinged such that upper containment member 170 can be easily opened to access object 10 once retrieved and subsequently closed to provide for upper containment during subsequent retrieval operations. In another such embodiment, the hatch may be defined by a fully detachable/reattachable upper containment member 170. Alternatively, in an embodiment, only a portion of upper containment member 170 may be hinged or fully detachable/reattachable, that portion defining the hatch. Additionally or alternatively, in some embodiments, at least one of rear containment element 150 and lower containment element 160 may comprise or define a hatch dimensioned to accommodate removal of the object from the internal cargo area through such hatch in a similar fashion. Providing a hatch may facilitate convenient removal of object 10 from internal cargo area 120 in all embodiments, especially those comprising rotating sweeper member(s) 210 since these may interfere with a user seeking to access internal cargo area through open front side 141.

In many applications, upper containment element 170 may not be necessary for containment purposes since object 10 typically floats on the surface of the water; however, in some applications, wind or waves may cause object 10 may become airborne (or otherwise crest floatation members 110 and/or rear containment element 150) or, for example in waterfowl hunting applications, object 10 (e.g., a cripped duck or goose) may be capable of climbing or flying over floatation members 110 or rear containment element 150 and escaping through the top of watercraft 100. In such cases upper containment element 170 may be beneficial. Further, and with this in mind, in some embodiments, upper containment element 170 may extend further forward of cargo area 120 such that a corresponding portion of upper containment element 170 is positioned above and spans capture assemblies 200 so as to inhibit object 10 from escaping upwards as it is being swept through capture assemblies 200.

FIGS. 6A-6C and 7A-7C illustrate representative embodiments of a modular containment structure 140 as opposed to the unitary construction previously discussed. A modular construction, in various embodiments, may permit containment structure 140 to be disassembled into two or more sections. This feature may facilitate transport by allowing watercraft 100 to be broken down and its components nested into a compact arrangement. This can be particularly beneficial in waterfowl hunting applications, as hunters tend to have a lot of gear to pack in for each hunt, whether by foot or within the limited confines of a small kayak, canoe, john boat, or all-terrain vehicle. Additionally or alternatively, this feature may also allow for containment structure 140 to be easily reconfigured for different applications. For example, in some applications it may be desirable to have both the lower and upper containment elements 160, 170 while in other applications it may be desirable to only use one or the other. Similarly, it may be desirable to swap out one particular version of a lower containment element 160 for another version depending on the application; likewise, it may be desirable to swap out one particular version of an upper containment element 170 for another version and/or swap out one particular version of rear containment element 150 depending on the application. As an illustrative example, a hunter may wish to use a cage-like upper containment element 170 (e.g., that of FIG. 5) when hunting in windy conditions given the relatively low aerodynamic drag of such a design, whereas the same hunter may wish to use a version of upper containment element 170 incorporating a decoy shell or grass mat on top (for concealment amongst the floating decoys) in less windy conditions. In another illustrative example, a user may wish to use a cage-like lower containment element 160 (e.g., that of FIG. 4C) when waves are present, whereas the same user may wish to use a more solid-bodied lower containment element 160 (e.g., that of FIG. 4A) in calmer conditions when water is less likely to crest the leading edge of lower containment element 160.

Figure 6A:
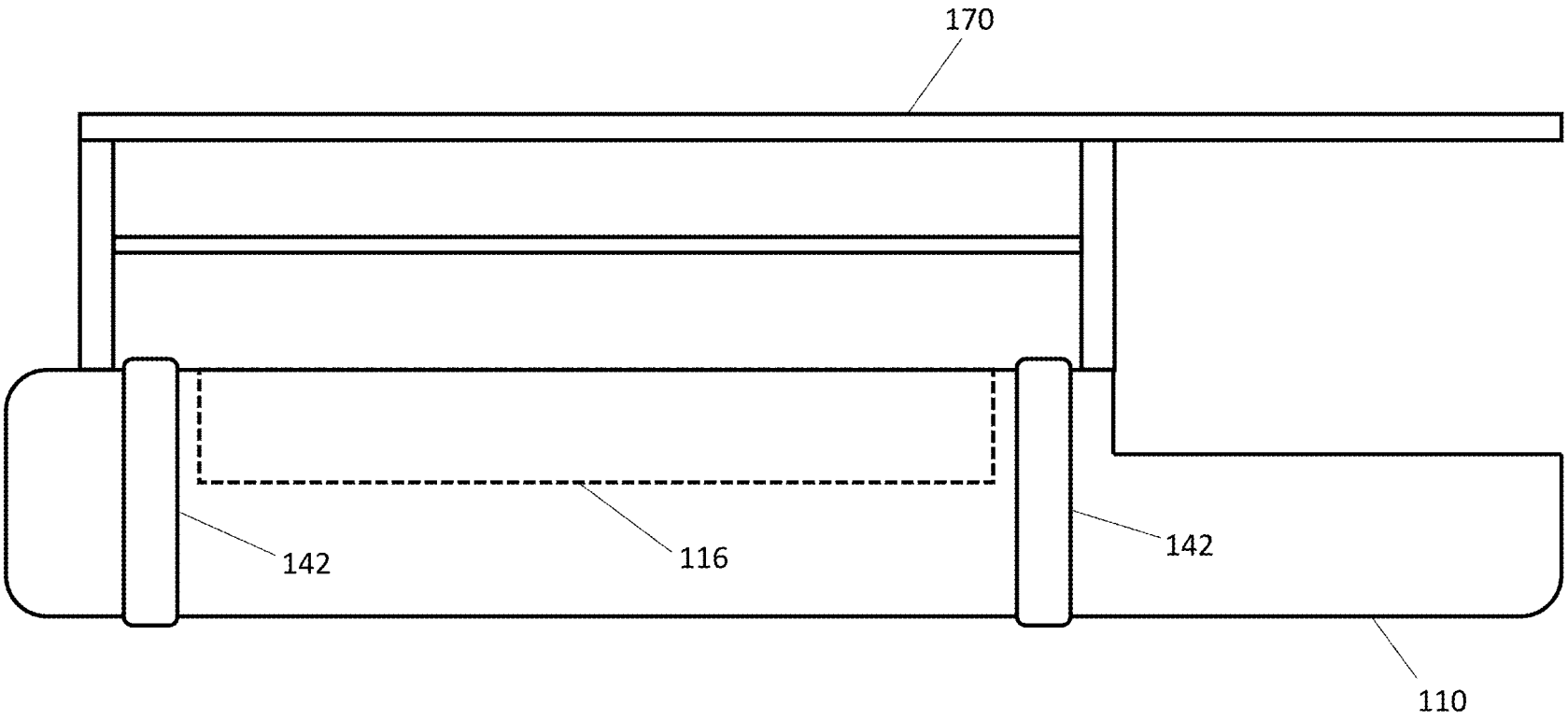
FIG. 6A is a right side view of a floatation member 110 to which a modular upper containment element 170 is attached by mounting straps 142, in accordance with an embodiment of the present disclosure.
Figure 6B:
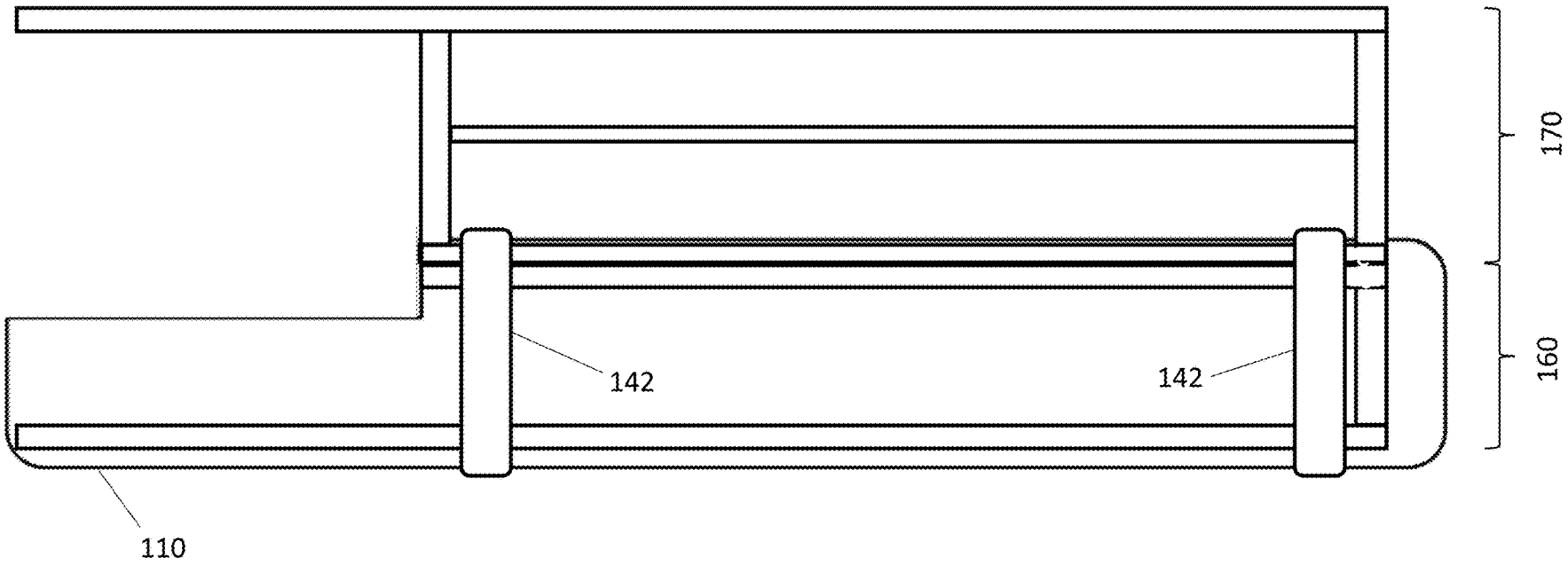
FIG. 6B is a left side view of the floatation member 110 of FIG. 6A to which modular lower and upper containment elements 160, 170 are attached by mounting straps 142, in accordance with an embodiment of the present disclosure.
Figure 6C:
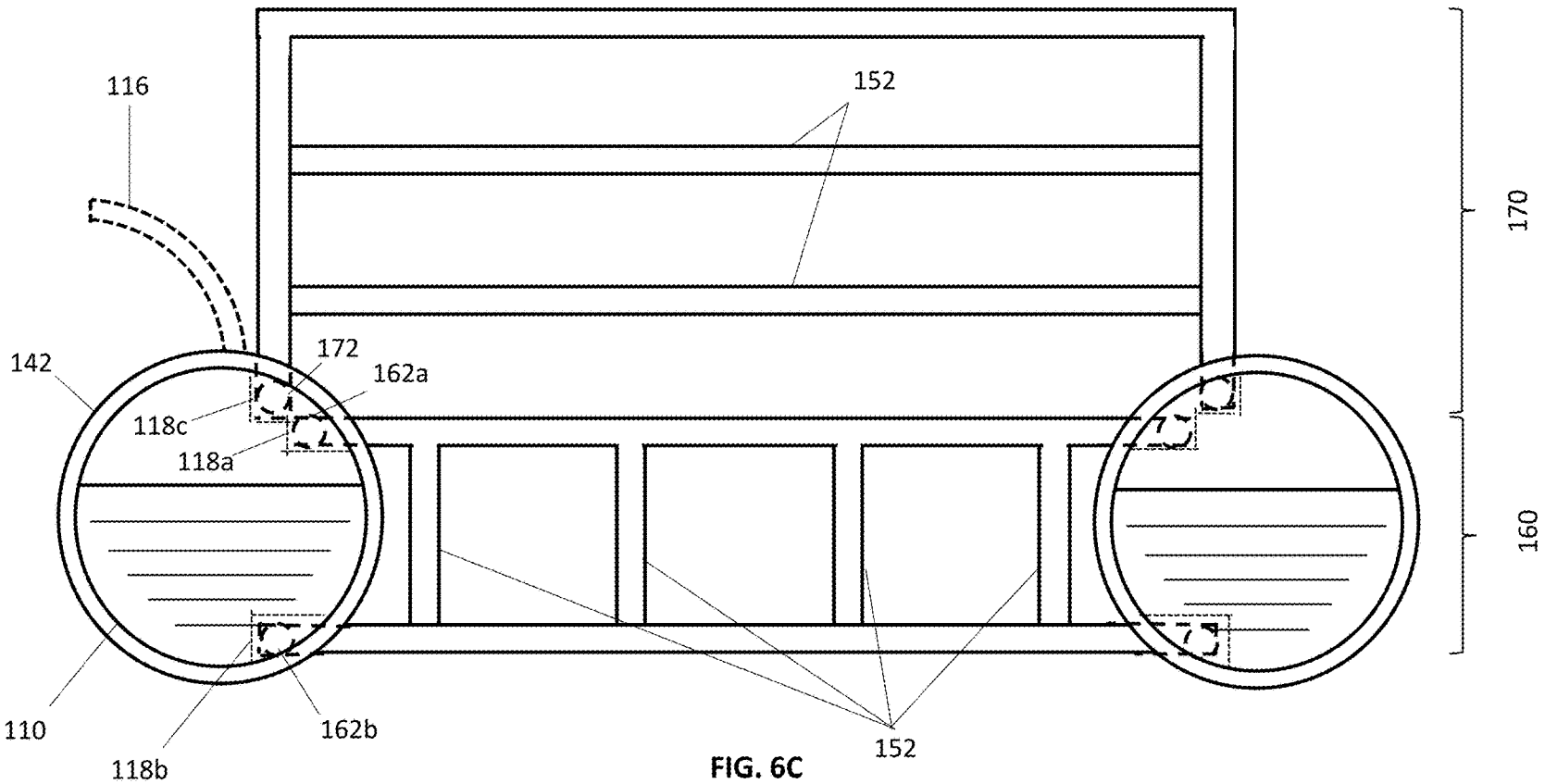
FIG. 6C is a front view of the modular lower and upper containment elements 160, 170 of FIGS. 6A and 6B as attached by mounting straps 142 to floatation members 110, in accordance with an embodiment of the present disclosure.
Figure 7A:
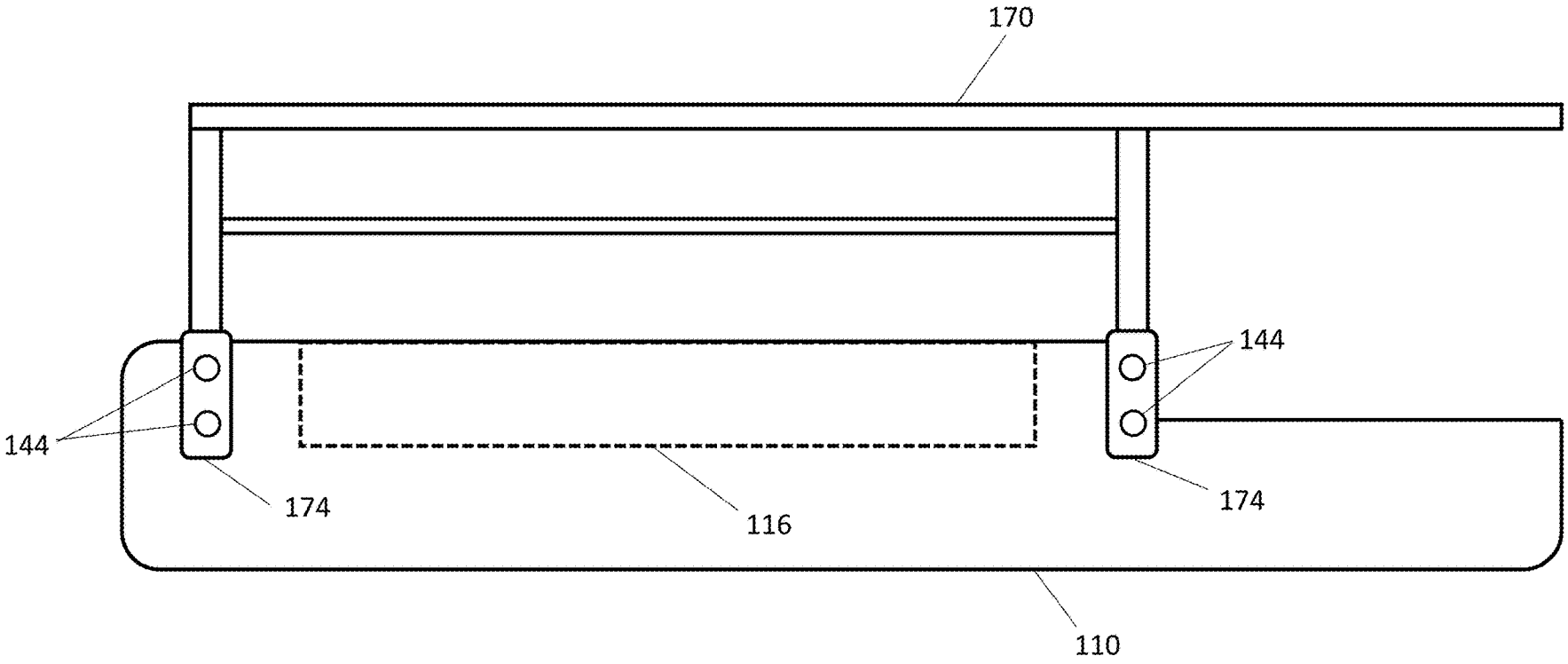
FIG. 7A is a right side view of a floatation member 110 to which a modular upper containment element 170 is attached by mounting arms 174, in accordance with an embodiment of the present disclosure.
Figure 7B:
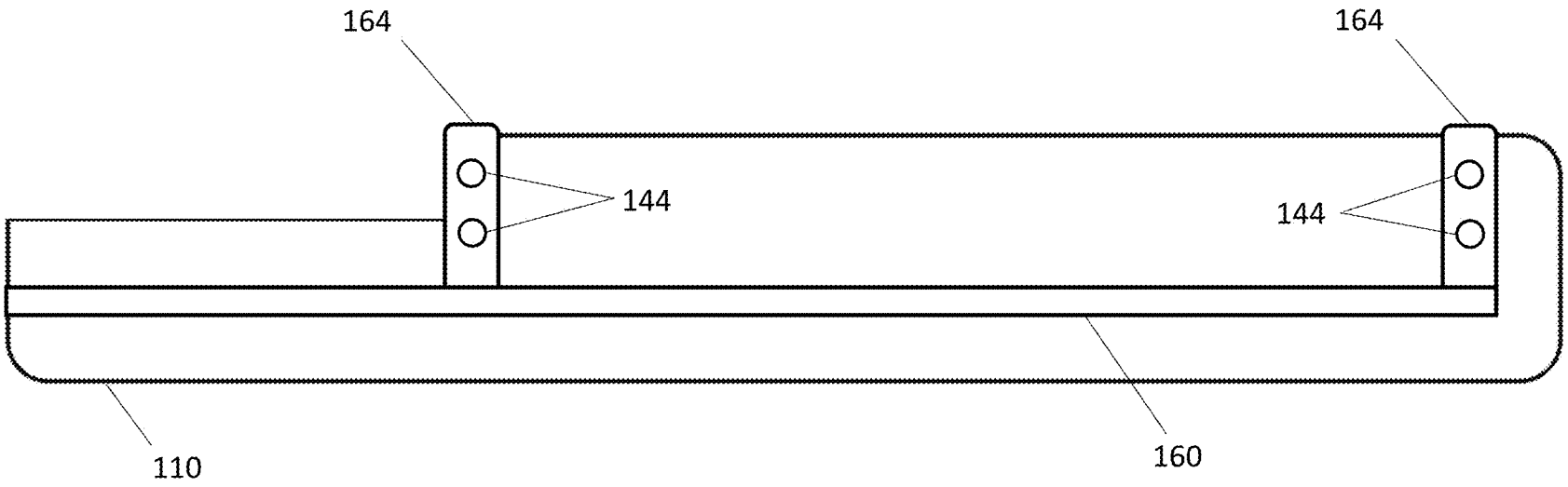
FIG. 7B is a left side view of the floatation member 110 of FIG. 7A to which a modular lower containment element 160 is attached by mounting arms 164 (modular upper containment element 170 not shown), in accordance with an embodiment of the present disclosure.
Figure 7C:
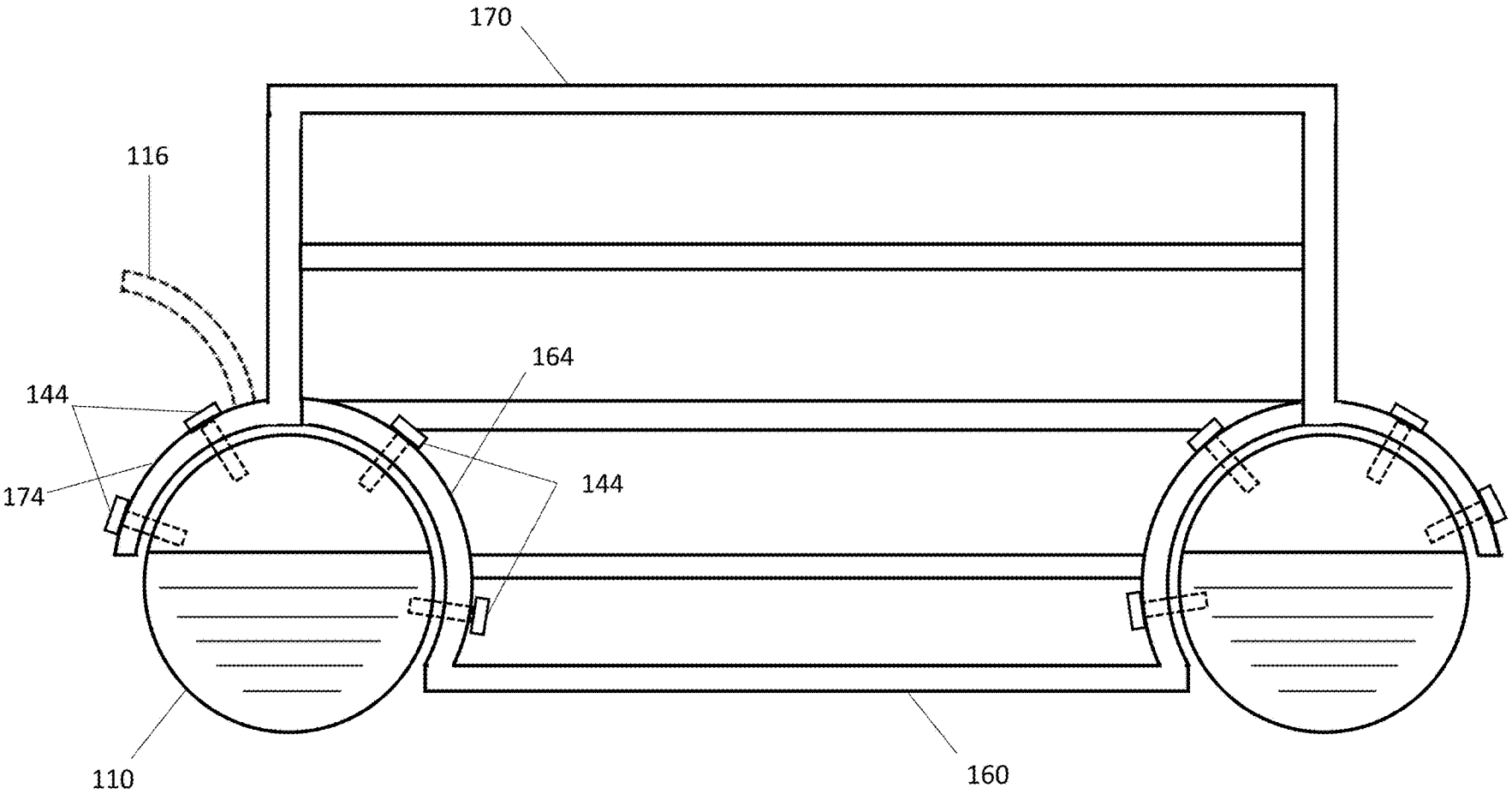
FIG. 7C is a front view of the modular lower and upper containment elements 160, 170 of FIGS. 7A and 7B as attached by mounting straps 164, 174 to floatation members 110, in accordance with an embodiment of the present disclosure.

Modular constructions of containment structure 140, in various embodiments, may include separate lower and upper containment elements 160, 170. Each may contain rear containment members 152 which, when lower and upper containment elements 160, 170 are connected to floatation members 110, combine to form rear containment element 150. In the embodiment of FIGS. 6A-6C, portions of containment structure 140 are dimensioned for insertion into channels 118 running along floatation members 110. As configured, channels 118 help maintain the position and alignment of containment structure 140 thereon. One or more mounting straps 142 may be used to hold the portions of containment structure 140 within channels 118 and thereby create a firm connection amongst these components. In this particular embodiment, lower containment element 160 may have first lower containment members 162*a* configured for insertion into first channels 118*a* running along a top half of floatation members 110, and second lower containment members 162*b* configured for insertion into second channels 118*b* running along a lower half of floatation members 110. Connecting lower containment element 160 in such a manner may provide an especially secure connection that is less likely to allow lower containment element 160 to rotate relative to floatation members 110 compared with a single-member, single-channel connection which may in practice form more of a hinged mount and thereby permit such rotation. In this way lower containment element 160 may function well as a connecting structure 130. With this robust connection in place, it may not be necessary to connect upper containment element 170 as securely; hence, in the embodiment shown, upper containment element 170 may contain a single upper containment member 172 configured for insertion into a single channel 118*c*. Of course, in an embodiment, upper containment element 170 and floatation members 110 could be configured to provide multiple connections similar to those between lower containment element 160 and floatation members 110 and thereby confer an even more stable connection amongst these components of watercraft 100. In the embodiment of FIGS. 7A-7C, lower containment element 160 and upper containment element 170 may include mounting arms 164, 174 configured to be coupled to floatation members 110 via fasteners 144. Mounting arms 164, 174, in an embodiment, may complementary designs such that mounting arm 164 wraps around a first portion of floatation member 110 (shown here as an inboard portion) and mounting arm 174 wraps around a second portion of floatation member 110 (shown here as an outboard portion), such that a distal end of mounting arm 164 abuts a proximal end of mounting arm 174 to provide even more stability to the overall structure of watercraft 100. In the embodiments of both FIGS. 6A-6C and FIGS. 7A-7C, these connections may be positioned such that hatch 116 can be located on an upper portion of floatation member 110 as shown, thereby decreasing the likelihood of water intrusion into recesses 114 as well as providing for easier access. For example, in the embodiment of FIGS. 6A-6C, channels 118 are largely confined to an inboard half of each floatation member 110, such that hatch 116 can be located on an upper outboard quarter of floatation member 110. Likewise, in the embodiment of FIGS. 7A-7C, mounting arms 164, 174 are provided on fore and aft portions of containment structure 140 such that hatch 116 can be located on an upper portion of floatation member 110 therebetween.

Containment structure 140, in various embodiments, may comprise an open front side 141. Open front side 141, in various embodiments, may be dimensioned to accommodate entry of object 10 into internal cargo area 120 through the open front side 141. In view of the various embodiments of containment structure 140 described herein, open front side 141 may similarly take many forms. For example, in embodiments comprising both a lower containment element 160 and an upper containment element 170, open front side 141 may span vertically between the leading edges of each and may span horizontally between side containment members (e.g., floatation members 110 or members of upper and/or lower containment members 160, 170 extending up along the sides of cargo area 120). As another example, in embodiments comprising a lower containment element 160 but not an upper containment element 170, open front side may extend vertically above lower containment element 160. While open front side 141 in this case may not necessarily have a finite upper boundary (e.g., one defined by an upper containment element 170), open front side 141 may be thought to reach at least as high as a height of object 10 on the surface 16 of the water such that object 10 is still thought to enter cargo area 120 through open front side 141. Conversely, in embodiments comprising an upper containment element 170 but not a lower containment element 160, open front side may extend vertically below upper containment element 170. While open front side 141 in this case may not necessarily have a finite lower boundary (e.g., one defined by a lower containment element 160), open front side 141 may be thought to reach at least as low as a depth of any portion of object 10 that is submerged below the surface 16 of the water such that object 10 is still thought to enter cargo area 120 through open front side 141. Likewise, in embodiments lacking both a lower containment element 160 and upper containment element 170, open front side 141 may be thought to reach at least as high as a height of object 10 on the surface 16 of the water and a low as a depth of any portion of object 10 that is submerged below the surface 16 of the water, such that object 10 is still thought to enter cargo area 120 through open front side 141. The upper and lower boundaries of cargo area 120 can be characterized similarly with respect to the examples described in this paragraph.

embodiment where containment structure 140 simply comprises side containment elements in the form of floatation members 110 and a rear containment element 150—in such an example, cargo area 120 may simply be the area between floatation members 110 and forward of any rear containment element 150, with the buoyancy of object 10 on the surface of the water and gravity serving to contain object 10 within cargo area 120 from a vertical standpoint. In other embodiments, containment structure 140 may include a lower containment element 160—in such an example, lower containment element 160 may define a lower side of cargo area 120 and thereby contain object 10 within cargo area 120 from below. Additionally or alternatively, in some embodiments, containment structure 140 may include an upper containment element 170—in such an example, upper containment element 170 may define an upper side of cargo area 120 and thereby contain object 10 within cargo area 120 from above. A front side of cargo area 120, in some embodiments, may be defined by open front side 141 of containment structure 141. In other embodiments, cargo area 120 may extend forward beyond open front side 141 provided other containment elements are present in that area and object 10 is too large to fit fully within the interior of a more defined containment structure 140—e.g., if portions of floatation members 110 and portions of object 10 extend forward of open front side 141 of containment structure 141, cargo area 120 may be thought to extend forward into the area between those forward-extending portions of floatation members 110 to the extent those forward-extending portions are suitable for containing those forward-extending portions of object 10 therebetween.

Powertrain 180

Figure 8:
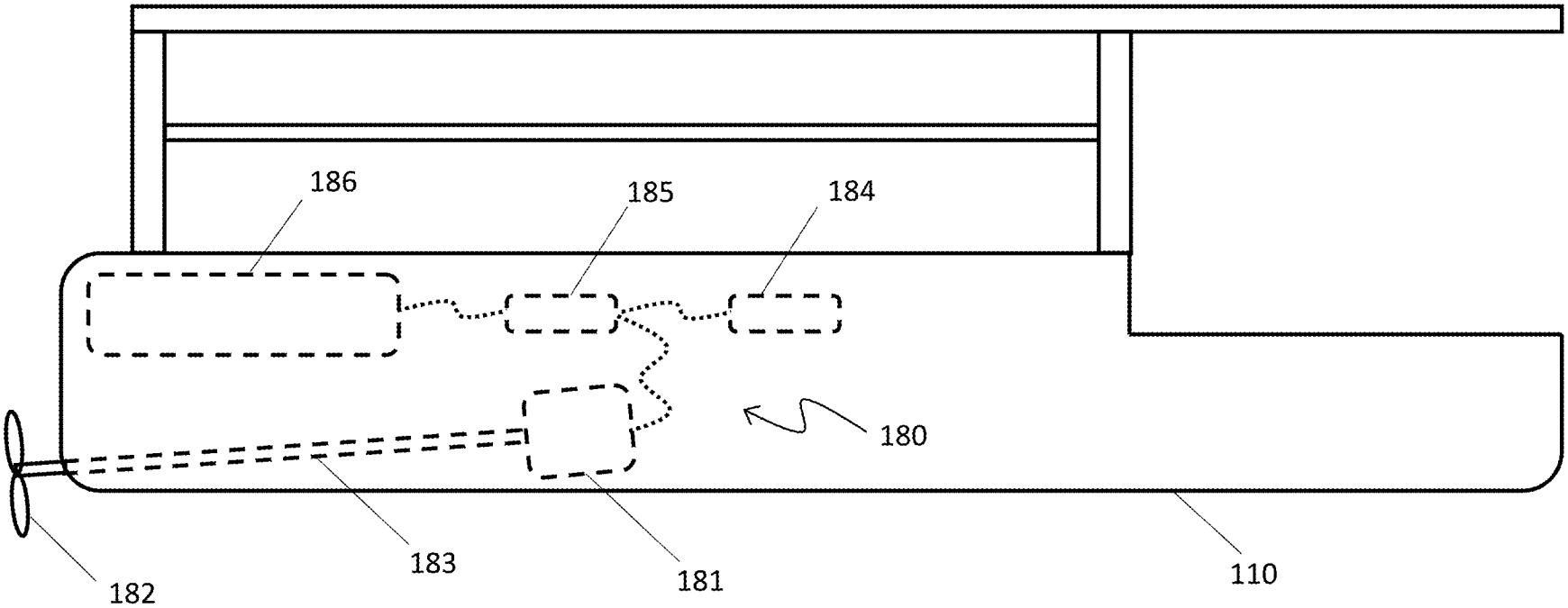
FIG. 8 is a side view of a powertrain 180 located within a floatation member 110, in accordance with an embodiment of the present disclosure.
Figure 9:
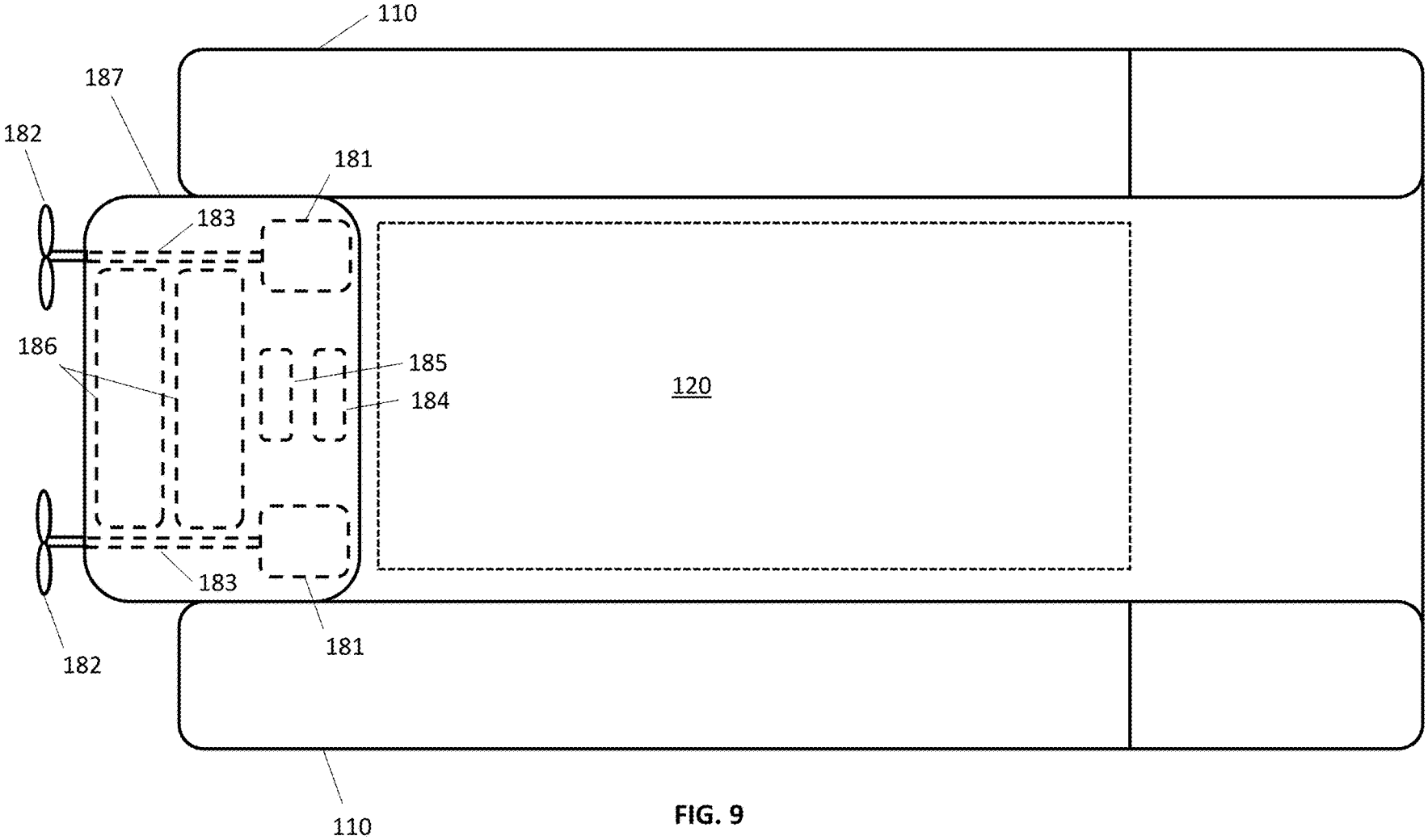
FIG. 9 is a top view of a powertrain 180 located within a modular housing 187, in accordance with an embodiment of the present disclosure.

FIGS. 8 and 9 illustrates a representative embodiment of powertrain 180 of watercraft 100. Generally speaking, powertrain 180 may be configured for propelling and steering watercraft 100 on the water. In an embodiment, powertrain may be in wireless communication with transmitter 300 for remote operation. Powertrain 180, in various embodiments, may include a motor(s) 181 for driving a propeller(s) 182 via propeller shaft(s) 183 (or, additionally or alternatively, above-water fans/propellers like a fan boat), a receiver(s) 184 for receiving signals sent by transmitter 300, an electronic speed controller(s) 185 for regulating the speed(s) of motor(s) 181, and a battery(s) 186 for powering various components of powertrain 180 (and, in some embodiments, other components of retriever system 1000 such as motor(s) 220 of capture assembly(s) 200), as described in more detail herein.

One having ordinary skill in the art (especially those in r/c boat hobbyist circles) will be familiar with the various components of powertrain 180 and will recognize without undue experimentation the appropriate numbers and parameters of each (e.g., torque, RPM, power capacity, channels, frequencies), as well as the necessary connections and arrangements of such components, for achieving the functionality described herein. As such, the present disclosure is in no way intended to be limited to the representative examples described herein. Notwithstanding, a few preferred features of various embodiments of powertrain 180 will be further discussed below.

FIG. 8 illustrates a representative embodiment in which various components of powertrain 180 are contained within and distributed between floatation members 110. In the embodiment shown, each floatation member 110 contains its own independent powertrain 180 (the combination of which is still referred to herein as a powertrain 180)—that is to say, each floatation member 110 contains each of the above-identified components in similar arrangements. Such a configuration may confer certain advantages. For example, containing the various components of powertrain 180 within floatation members 110 takes advantage of what may otherwise be unused space, thereby allowing watercraft 100 to have a more compact footprint. Further, providing the various components of powertrain 180 within floatation members 110 may allow for such components to be better protected from water damage. Still further, such components can be insulated from cold temperatures by body 112 of floatation members 110, thereby improving battery life and component reliability when system 1000 is operated in cold weather. Moreover, by containing powertrain 180 within floatation members 110, watercraft 100 may be easier to dissemble, transport, and re-assemble compared with embodiments in which electrical connections must be manually made between (or disconnected from) the components of opposing floatation members 110 when assembling/disassembling watercraft 100 (e.g., where the components of both floatation members 110 are powered by a shared battery 186 located in just one of the floatation members 110 or on connecting structure 130; where the components of each floatation member 110 to be connected to a shared receiver 184 located in just one of the floatation members 110 or on connecting structure 130). Simply stated, such a configuration provides for floatation members 110 to simply be decoupled from/recoupled to containment structure 140 for transport or reconfiguration of watercraft 100 without the complication of manually connecting/disconnecting any wires or other electrical connections between floatation members 110 and/or connecting structure 130. This can improve the user experience, as well as reduce wear and tear on and the potential for corrosion of exposed electrical connections of powertrain 180. In the embodiment shown, steering may be achieved through differential thrust (e.g., increasing power to one motor 181 and/or decreasing power to the other motor 181 to turn watercraft 100). Of course, in other embodiments, a rudder(s) may be provided (e.g., one on each floatation member 110, or a single rudder between floatation members 110; both not shown) for steering watercraft 100.

FIG. 9 illustrates a representative embodiment in which powertrain 180 is packaged within a housing 187 configured for placement between floatation members 110 near the aft end of watercraft 100. In such an embodiment, housing 187 may mount to connecting structure 130 spanning floatation members 110. Additionally or alternatively, housing 187 may mount to the aft portions of floatation members 110. As configured, powertrain 180 forms a module that can be easily attached and detached from watercraft 100 for transport or reconfiguration. Further, such a configuration may allow for sharing a common receiver amongst motors 181 without having to make manual electrical connections between floatation members 110 as may be the case in prior described embodiments. In another embodiment (not shown), watercraft 100 could be propelled by just one motor 181/propeller 182 and steered with a rudder (since differential thrust is only available with two or more propellers) given the ability to position housing 187 along a centerline of watercraft 100. This arrangement may help reduce the overall cost and maintenance requirements of watercraft 100 since fewer components are required overall.

Notwithstanding, such a configuration may require a user to detach powertrain 180 from connecting structure 130 in order to achieve packability comparable to that of the embodiment shown, thereby adding additional steps during disassembly/reassembly. Further, depending on its size and placement, such a configuration may take up space that may otherwise be used for cargo area 120, thus either reducing cargo volume or necessitating a longer footprint. However, were powertrain 180 to be provided within its own dedicated module configured to waterproof and insulate the components therein and provide for easy attachment to/detachment from connecting structure 130 and/or floatation members 110, such disadvantages may be mitigated. Further, it is possible that more of the various components of powertrain 180 could be arranged side-by-side or vertically within housing 187 in such an embodiment compared with the more longitudinal arrangement necessitated by packaging within elongated floatation members 110 which may, in turn, help with minimizing the lengthwise dimension of housing 187 (thereby freeing up cargo volume) as well as moving the center of gravity of watercraft 100 more aft in comparison. This may be desirable for keeping propellers 182 under the water line and otherwise improving the handling characteristics of watercraft 100 when laden with object 10 in cargo area 120.

Capture Assembly 200

FIGS. 10-12E illustrate various views and embodiments of a capture assembly 200 of retrieval system 1000. Capture assembly 200, in various embodiments, may be configured to actively pull objects 10 into cargo area 120 during retrieval operations. Retrieval system 1000, in various embodiments, may comprise one or more capture assemblies 200 and each capture assembly 200 may generally include a rotating capture member 210 powered by a capture motor 220, as described in more detail herein. In a representative embodiment, retrieval system 1000 may include two counter-rotating capture assemblies 200 positioned on either side of watercraft 100 near a fore end thereof such that object 10 can be captured proximate the bow of watercraft 100, allowing for the most natural navigation of watercraft 100 by a user.

Rotating Capture Member 210

Rotating capture member 210, in various embodiments, may include one or more capture arms 212 extending outwards from a central capture arm hub 214. In the embodiment shown, rotating capture member 210 has twenty capture arms 212 arranged in four groups of five arms 212 each. Each group is circumferentially offset from the next by 45 degrees and the five capture arms 212 of each group are vertically offset from one another along a height of capture arm hub 214 as shown. As capture arm hub 214 rotates, each successive group of five arms 212 sweeps about in the same direction to engage object 10 and push it into cargo area 120. Such motion may be referred to herein as a "sweeping motion" and the resulting movement of object 10 into cargo area 120 thereby may be referred to herein as being "swept" and its derivatives as appropriate.

Capture arm(s) 212, in various embodiments, may comprise any elongated member suitable for sweeping object 10 into cargo area 120, either individually or with the assistance of additional capture arms 212 depending on the embodiment.

Figure 12A:
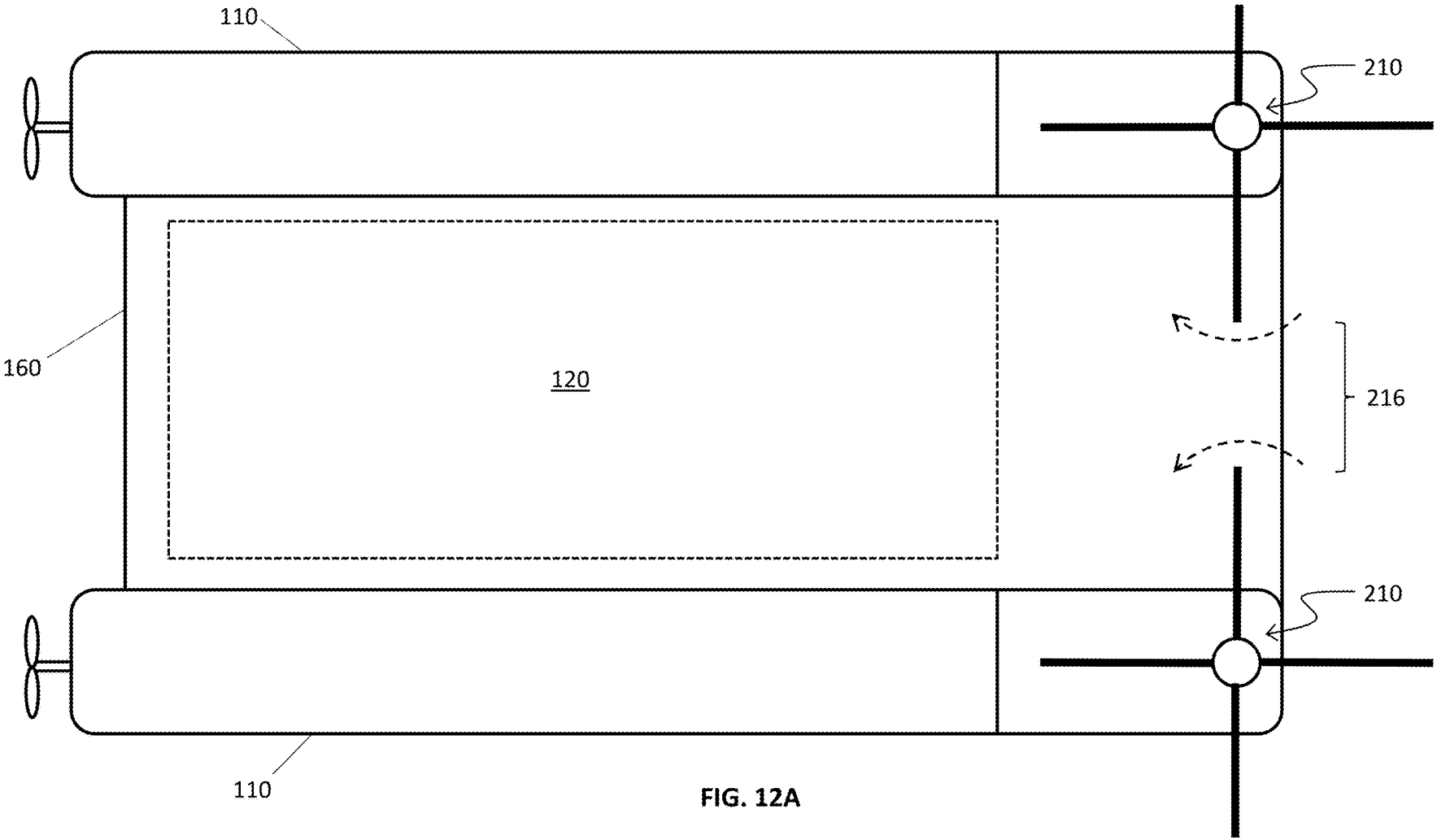
FIGS. 12A-12E illustrates various embodiments and arrangements of rotating capture member(s) 210 mounted on a watercraft 100, in accordance with an embodiment of the present disclosure.

Referring first to FIG. 12A, in various embodiments, capture arm(s) 212 may be semi-rigid—that is, rigid enough to push object 10 in the direction of rotation of capture arm hub 214, yet flexible enough to bend in response to excess forces applied in an opposing direction such as those encountered when trying to push object 10 through gap 216 (later described) between opposing capture assemblies 200. As configured, capture assemblies 200 can be positioned close enough to inhibit object 10 from escaping cargo area 120 back through capture assemblies 200, yet still bend enough to avoid jamming as object 10 is swept therebetween into cargo area 120. In the embodiment of FIG. 12, the capture arms 212 of opposing capture assemblies 200 may be shorter than the distance between the respective capture arm hubs 214 such that there is a gap 216 between capture assemblies 200. Generally speaking, the larger gap 216 is, the less capture arms 212 may need to bend in order to accommodate object 10 between capture assemblies 200 as object 10 is being swept into cargo area 120. Preferably though, gap 216 is not so wide as to allow object 10 to freely pass back out therethrough, nor wide enough to allow object 10 to push its way therethrough (e.g., in the case of crippled waterfowl) or be pushed therethrough by other external forces such as wind or waves. Accordingly, in various embodiments, it may be preferable for semi-rigid capture arms 212 to be provided with more rigidity when gap 216 is larger and less rigidity when gap 216 is smaller, though it should be recognized that this is a general rule of thumb and not a hard and fast rule per se. Further, while FIG. 12 shows the opposing rotating capture members 210 rotating in sync (that is, with opposing capture arms 212 sweeping through a given point at the same time as one another), opposing rotating capture members 210 could instead be rotated out of sync (that is, with opposing capture arms 212 sweeping through a given point at different times in an alternating fashion).

Figure 12B:
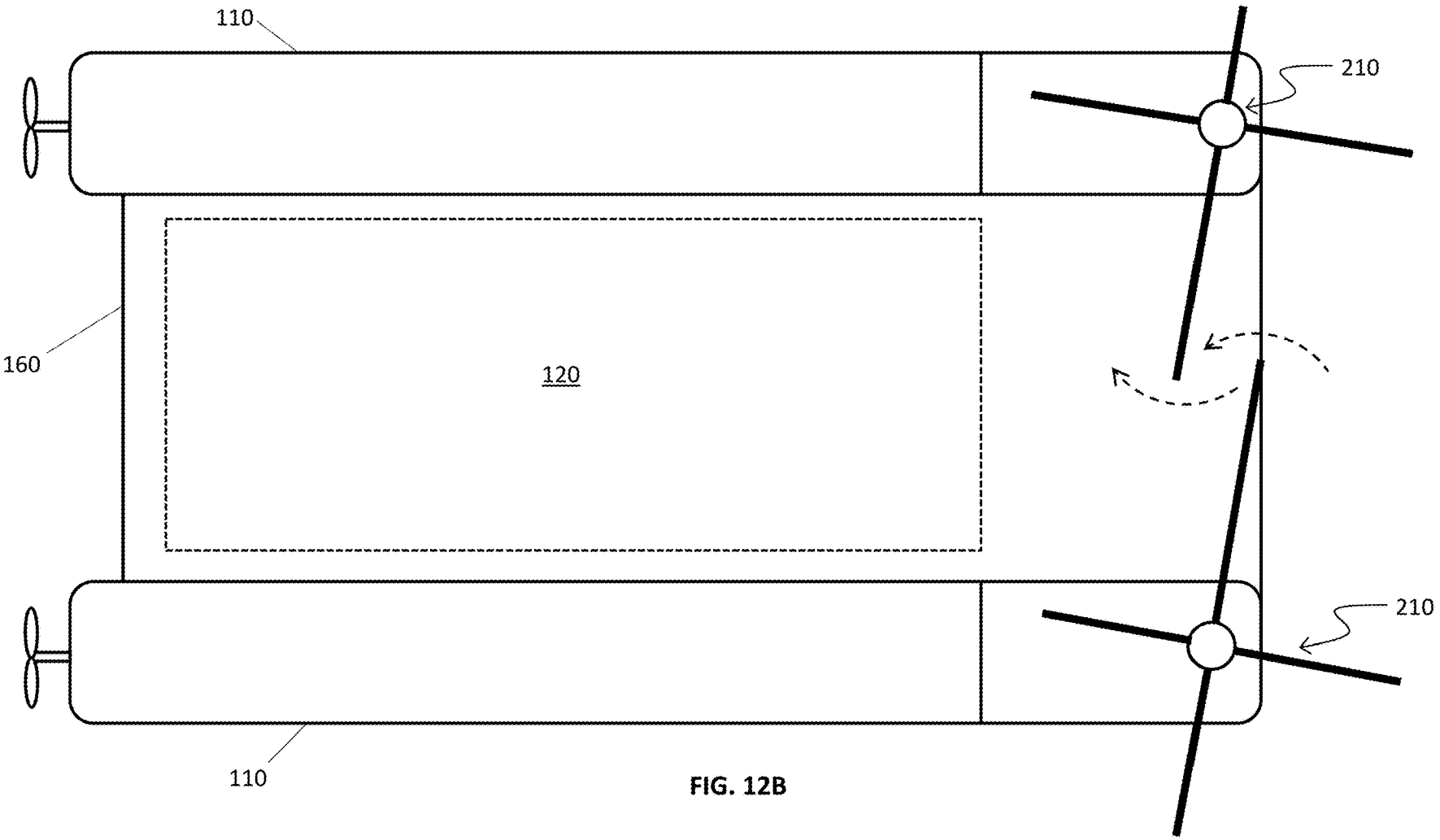
Figure 12C:
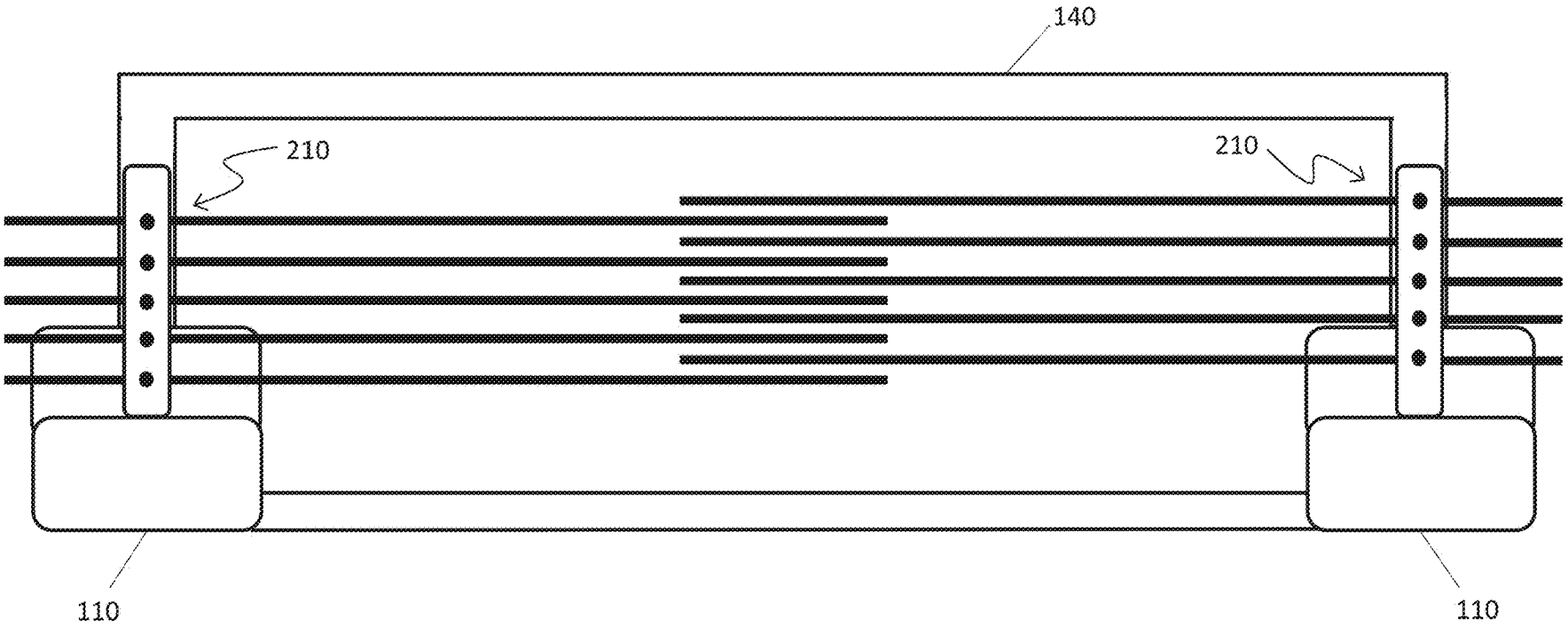

In other embodiments, capture arms(s) 212 may be rigid. To avoid jamming, any one or a combination of the following may be employed: (i) the rotation of rotating capture members 210 may be staggered such that rigid capture arms 212 of opposing capture assemblies 200 alternate as they sweep through the area between capture assemblies 200, in each case with enough space therebetween to accommodate object 10 (as shown in FIG. 12B) and (ii) the respective heights rigid capture arms 212 of opposing rotating capture members 210 may be staggered, such that a capture arm 212 of one rotating capture member 210 passes over or below a corresponding capture arm 212 of the other rotating capture member such that neither interferes with the other (as shown in FIG. 12C). In further embodiments (not shown), capture arm(s) 212 may be non-rigid and instead rely upon centrifugal force to extend outwards to sweep object 10 into cargo area 120. Such embodiments may require many capture arms 212 since each would likely provide a relatively small sweeping force to object 10 and potentially high rotation speeds. It should be recognized that, in such embodiments, it may further be desirable to continue to run capture assemblies 200 after object 10 is swept into cargo area 120, otherwise non-rigid arm members 214 will relax absent any centrifugal force and open a large gap 216 between capture arm hubs 214 through which object 10 may easily escape cargo area 120.

Figure 10:
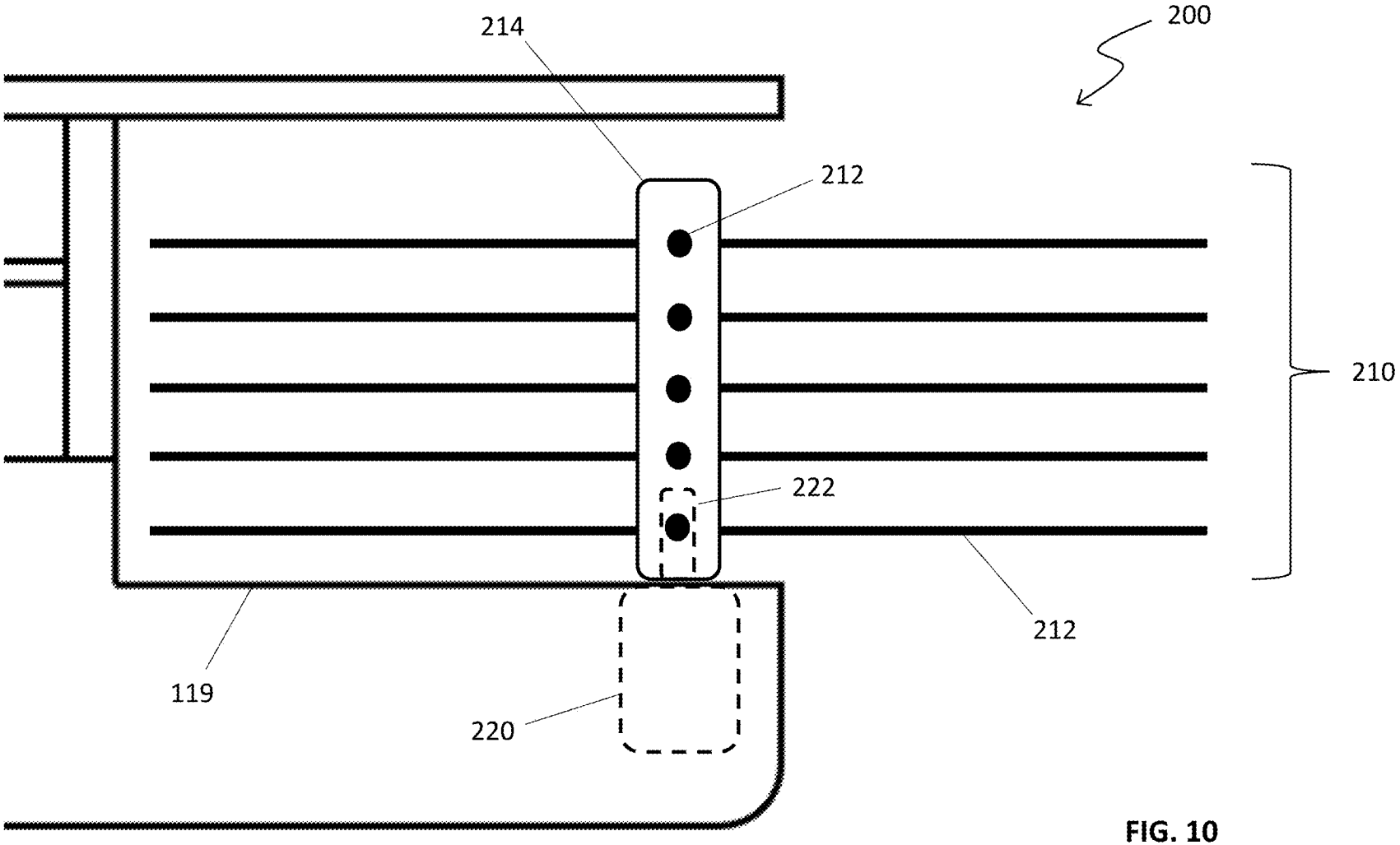
FIG. 10 is a right side view of a capture assembly 200, in accordance with an embodiment of the present disclosure.

Capture arm(s) 212, in various embodiments, may have vertical positions along capture arm hub 214 corresponding to an anticipated height of object 10 as floating on the water's surface. As configured, capture arm(s) 212 are most likely to make contact object 10 rather than simply pass over it. It should be recognize however that having one or more capture arms 212 positioned higher than object 10 may not necessarily be problematic so long as at least some capture arms 212 are positioned low enough to engage and push object 10 into cargo area 120. In fact, depending on the configuration, these higher capture arms 212 may extend over object 10 while it is being swept into cargo area 120 and thereby serve to help contain object 10 in the event object 10 is to move upwards (e.g., due to a wave or while trying to escape) during such time. Likewise, one or more capture arms 212 may be positioned lower than object 10 and thereby help contain object 10 in the event object 10 is to move downwards (e.g., while trying to escape) while it is being swept into cargo area 120, though it should be recognized that such capture arm(s) 212 may generate hydrodynamic drag given their positioning, which may be undesirable from a power consumption and maintenance standpoint. In some embodiments, as shown in FIG. 10, floatation members 110 may include a recessed foredeck area 119 to allow for capture arm hub 214 to be positioned lower to the waterline, thereby enabling it to sweep up smaller objects without necessarily having to angle capture arms 212 downwards and/or angle capture assemblies 200 inwards in order for capture arms 212 to reach closer to the waterline.

Capture arms 212, in various embodiments, may have any circumferential spacing suitable for enabling the operation of capture assembly 200 as described herein. In some embodiments, there may be little circumferential spacing between capture arms 212, while in other embodiments, there may be significant circumferential spacing. Generally speaking, more capture arms 212 with smaller circumferential spacing therebetween may provide more contact with object 10. In one sense, this may be desirable in that it may provide more "traction" with object 10; however, such traction may in turn generate more drag (opposing torque) for motor 220 to overcome. Conversely, fewer capture arms 212 with greater circumferential spacing therebetween may provide less contact with object 10. In one sense, this may be desirable in terms of reducing the power required to sweep object 10 into cargo area 120 and in terms of minimizing the amount object 10 is "handled" during such operations. The latter may be important, for example, to waterfowl hunters who wish to recover a downed duck or goose in pristine condition as opposed to with ruffled and/or broken feathers. In another sense though, such spacing may make it more difficult to successfully engage object 10 and sweep it into cargo area 120. Of course, having too many capture arms 212 with very close circumferential positioning may also make it difficult to successfully engage object 10, as object 10 may not move far enough before a successive capture arm 212 makes contact such that object 10 instead "bounces off" the tips of capture arms 212 rather than being "grabbed" by capture arms 212.

Rotating capture member(s) 210, in various embodiments, may be rotated at any speed suitable for successfully sweeping object 10 into cargo area 120 as described herein. Generally speaking, the rotation speed of rotating capture member(s) 210 need not be very fast to accomplish this purpose and may in some ways benefit from operating at lower RPMs. For example, operating rotating capture member(s) 210 at lower speeds may reduce battery consumption and noise, as well as reduce the chances of potentially causing damage to object 10 when contacted by capture arm(s) 212. Of course, relatively higher rotation speeds may be more effective at capturing object 10, especially in cases where object 10 may seek to escape as may be the case with crippled downed waterfowl.

One having ordinary skill in the art will recognize without undue experimentation a desirable number, size, stiffness, and arrangement of capture arms 212 on capture arm hub 214, as well as an appropriate speed at which to rotate rotating capture member 210, for a given application.

Figure 12D:
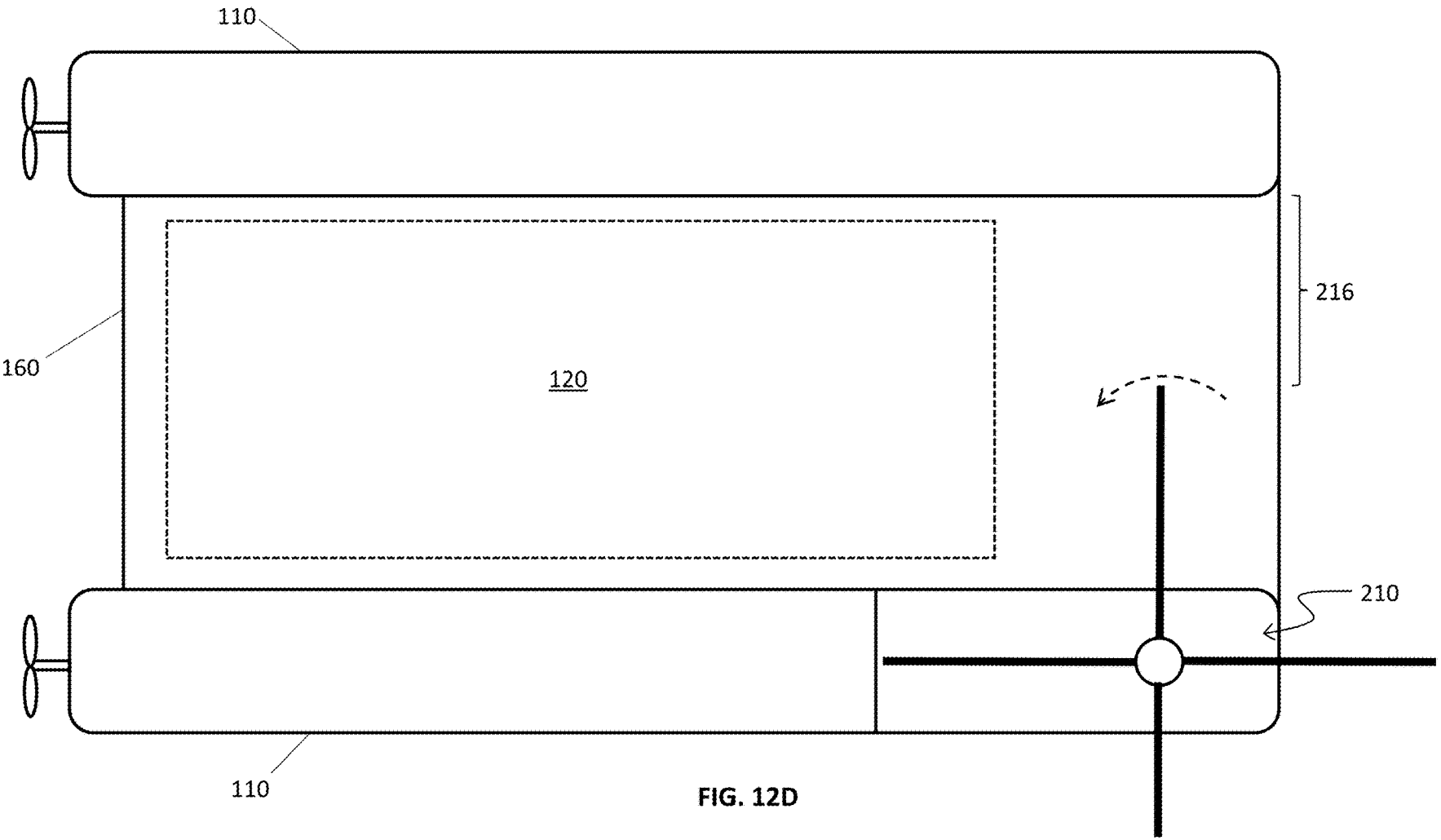
Figure 12E:
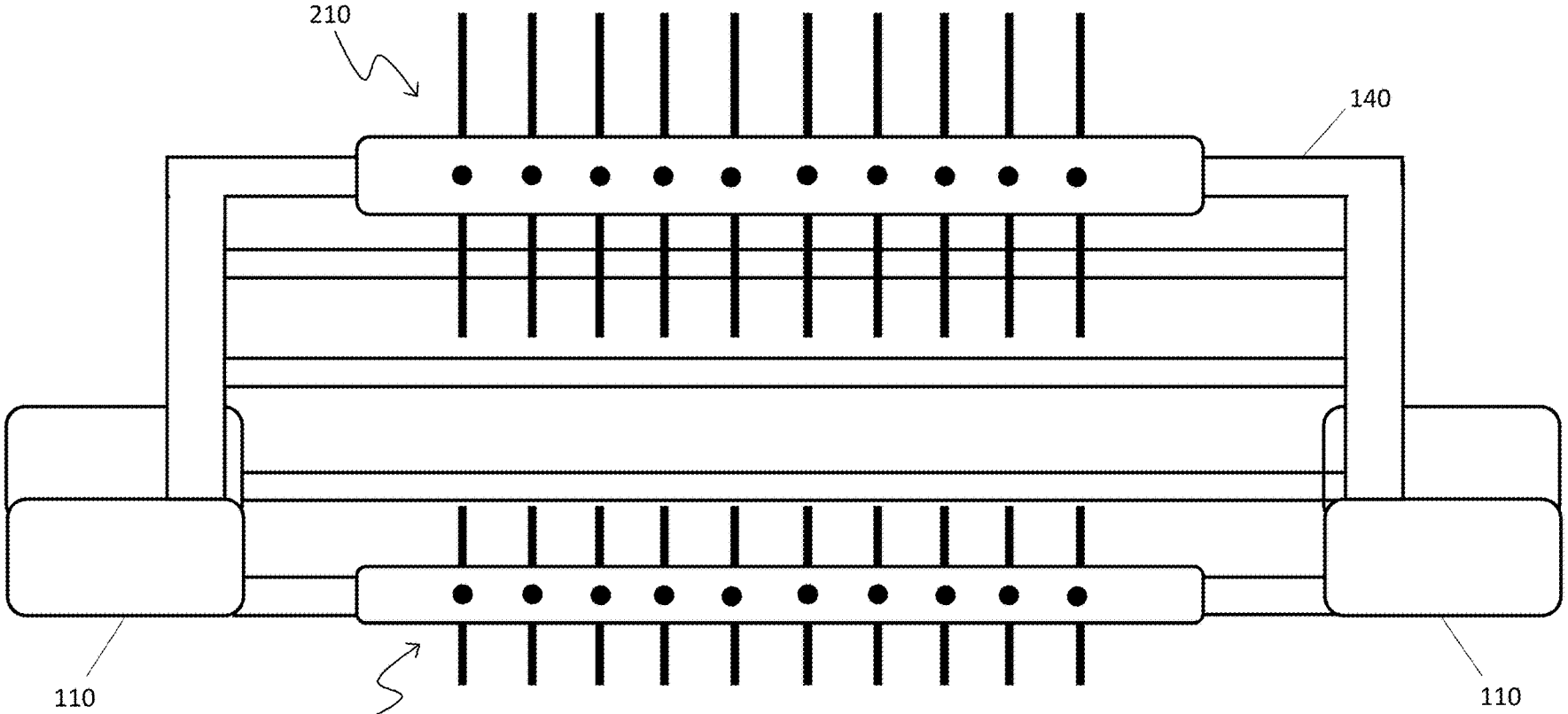

While the present disclosure has largely described retrieval system 1000 as having two opposing rotating capture members 210, it should be recognized that other numbers and configurations of rotating capture members 210 may be suitable for sweeping object 10 into cargo area 120. For example, in the embodiment shown in FIG. 12D, system 1000 may include a single semi-flexible rotating capture member 210 positioned on one floatation member near a fore end of watercraft 100, with some sort of structure on an opposing side of watercraft 100 (e.g., the opposing floatation member 110 or a member extending forwards therefrom) serving to contain any sidewards movement of object 10 induced by contact with capture arms 212 while sweeping object 10 into cargo area 120. Rotating capture member 210 may be positioned further aft than as shown in prior embodiments such that the opposing floatation member 110 can act as the aforementioned sideways containment structure, as shown in FIG. 12D. In another embodiment, one or more rotating capture members 210 may instead be oriented horizontally and positioned towards the bow of watercraft 100 at heights above and/or below object 10, as shown in FIG. 12E. As configured, these horizonal rotating capture member(s) 210 will sweep object 10 into cargo area 120, albeit from above and/or below rather than from the sides.

Motor 220

Figure 11:
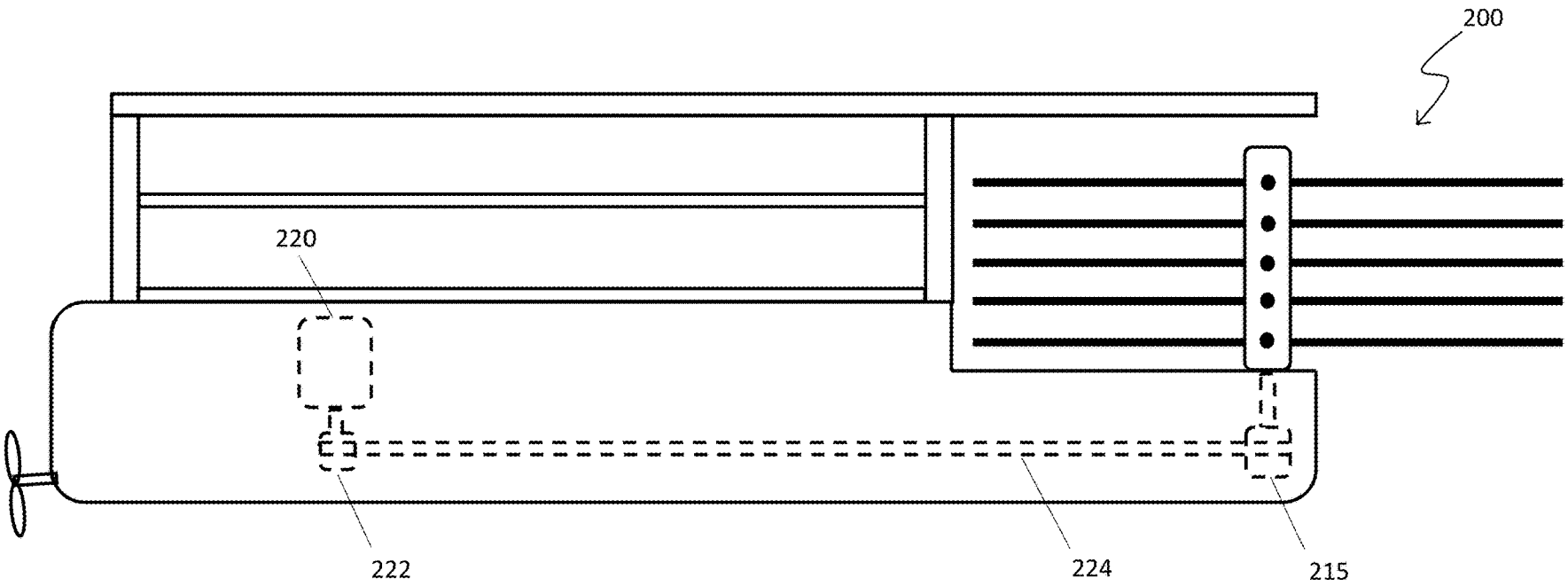
FIG. 11 is a right side view of another capture assembly 200, in accordance with an embodiment of the present disclosure.

Rotating capture member 210, in various embodiments, may connect to and be driven by motor 220. Motor 220, in various embodiments, may be any motor suitable for such purpose and one of ordinary skill in the art will recognize motors having suitable torque, RPMs, and related parameters. As shown in FIG. 10, in some embodiments, an output 222 of motor 220 may directly (or through an integrated gear set) connect to capture arm hub 214 of rotating capture member 210. In most such embodiments, motor 220 may be positioned proximate to capture arm hub 214, either in-line or offset depending on any intermediate gearing. Certain advantages of this configuration may include compact packaging of these components and low transmission losses. Alternatively, as shown in FIG. 11, motor 220 may be positioned away from capture arm hub 214 and drive the rotation of capture arm hub 214 via a belt 224 or other similar transmission element connecting output 222 of motor 220 and input 215 of capture arm hub 214. Certain advantages of this configuration may include moving the center of gravity of capture assembly 200 rearwards, thereby helping move the overall center of gravity of retrieval system 1000 rearwards. It may also be possible to access motor 220 via the aforementioned hatches in this latter configuration, whereas it may be more involved to access motor 220 in the former configuration since one may need to remove or work around rotating capture member 210 in order to access a hatch therebelow covering motor 220.

FIG. 12 illustrates a representative embodiment of retrieval system 1000 having two capture assemblies 200 positioned on either side of watercraft 100 near a fore end thereof. Capture assemblies 200, may rotate in opposite directions from one another (a.k.a. counter-rotating) as shown, such that each directs object 10 towards gap 216 and sweeps it into cargo area 120. By positioning capture assemblies 200 near the bow of watercraft 100, a user may navigate watercraft 100 to object 10 for capture in the most natural way possible, potentially enhancing the user experience.

In various embodiments, capture assembly 200 may either include one or more batteries (not shown) for powering motor 220 or additionally or alternatively may tap into power supplied by battery(s) 186 of powertrain 180. Likewise, capture assembly 200 may either include a receiver (not shown) for receiving control transmissions from transmitter 300, or additionally or alternatively, may tap into one or more channels of receiver 184 of powertrain 180 and receive control inputs from transmitter 300 therethrough. To the extent necessary or desirable, one or more electronic speed controllers may be used to control power to motor(s) 220 though, in many embodiments, capture assemblies 200 are configured to rotate at a constant speed so such additions may not be necessary. In a preferred embodiment, capture assemblies 200 run at a constant, predetermined RPM and tap into channels of receiver 184 to receive on/off control inputs via switches 330 of transmitter 300.

To recap, in various embodiments, system 1000 may comprise a watercraft 100, the watercraft 100 comprising a containment structure 140 having an interior defining an internal cargo area 120 of the watercraft 100, the containment structure 140 comprising an open front side 141 dimensioned to accommodate entry of the object 10 into the internal cargo area 120 through the open front side 141 and one or more containment elements (e.g., any one or combination of rear, lower, and upper containment elements 150, 160, 170 and side containment elements) configured to contain the object 10 within the internal cargo area 120; and one or more rotating capture assemblies 200 onboard the watercraft 100, the one or more rotating capture assemblies 200 comprising a rotating capture member 210 having one or more capture arms 212 extending outwards from a rotating capture hub 214 and a motor 220 configured to rotate the rotating capture member 210, wherein rotation of the rotating capture member 210 by the motor 220 is configured to actively pull or push the object 10 into the internal cargo area 120 through the open front side 141 of the containment structure 140. The containment structure 140, in some embodiments, may comprise a lower containment element 160 defining a lower side of the internal cargo area 120, wherein the lower containment element 160 is submerged in the body of water, and wherein the lower containment element 160 has a construction allowing water to freely pass therethrough while obstructing the object 10 from exiting the internal cargo area 120. The one or more rotating capture assemblies 200, in an embodiment, may be configured to actively pull or push the object 10 in a direction substantially parallel to a surface 16 of the body of water.

The containment structure 140, in some other embodiments, may comprise a lower containment element 160, wherein at least a portion of the lower containment element is positioned above a surface of the body of water, and wherein the one or more rotating capture assemblies are configured to actively pull or push the object onto the portion of the lower containment element positioned above the surface of the body of water. At least one of the one or more rotating capture assemblies 200 may be configured to apply a force having a vertical component to the object 10 to facilitate pushing or pulling the object 10 onto the raised portion of (or entirely raised) lower containment element 160. A forward portion **160*a* of the lower containment element, in an embodiment, may be submerged and may be angled downwards in a direction towards the open front side of the containment structure; and the one or more rotating capture assemblies 200 may be configured to actively pull or push the object 10 in a direction substantially parallel to a surface 16 of the body of water such that the object 10 moves up the angled portion of the lower containment element 160***a* that is submerged and onto a rear portion 160*b* of the lower containment element 160 that is raised above a surface of the body of water.

The one or more rotating capture assemblies 200, in some embodiments, may further comprise a spring-loaded arm 201 configured to bias the one or more rotating capture members 210 towards a center of the open front side 141 and to move away from the center of the open front side 141 in response to reaction forces applied by the object 10 to the respective rotating capture member 210 while pushing or pulling the object 10 into the internal cargo area 120 through the open front side 141 of the containment structure 140, so as to accommodate passage of the object 10 between (i) the respective rotating capture member 210 and (ii) the containment structure 140 and/or other rotating capture assemblies 140.

The one or more rotating capture assemblies, in an embodiment, may comprise first and second rotating capture members 210 positioned near a port side and a starboard side, respectively, of the open front side 141 of the containment structure 140 and configured to rotate in opposing directions relative to one another. The first and second rotating capture members 210, in an embodiment, may be configured to rotate about substantially vertical axes. In another embodiment, the first and second rotating capture members 210 may be configured to rotate about axes tilted towards a center of the open front side 141 such that the first and second rotating capture members 210 apply forces having a vertical component to the object 10. The one or more rotating capture assemblies 210, in an embodiment, may comprise a first rotating capture member configured to rotate about a substantially horizontal axis and positioned above the open front side 141 of the containment structure 140.

Various embodiments may further comprise a passive feeder 240, the passive feeder 240 comprising one or more feeder arms 242 extending outwards from a rotating feeder hub 244, wherein the rotating feeder hub 244 is configured to rotate in a first direction in response to forces applied by the object 10 as the object 10 moves towards the open front side 141 of the containment structure 140, and wherein the rotating feeder hub 244 is configured to not rotate in a second, opposing direction, such that the feeder arms 242 apply reaction forces to the object 10 in a direction towards the open front side 141 of the containment structure 140 in response to attempted movement of the object 10 away from the open front side 141 of the containment structure 140.

In an embodiment, the one or more rotating capture assemblies 200 may comprise semi-rigid capture arms 212 and the passive feeder 240 may comprise rigid feeder arms 242.

In an embodiment, containment structure 140 may comprise any one or combination of an upper containment element 167, a rear containment element 150, and a lower containment element 160, and at least one of the upper containment element 170, a rear containment element 150, and a lower containment element 160, as so equipped, may comprise or define a hatch dimensioned to accommodate removal of the object 10 from the internal cargo area 120 through the hatch.

Transmitter 300

Figure 13:
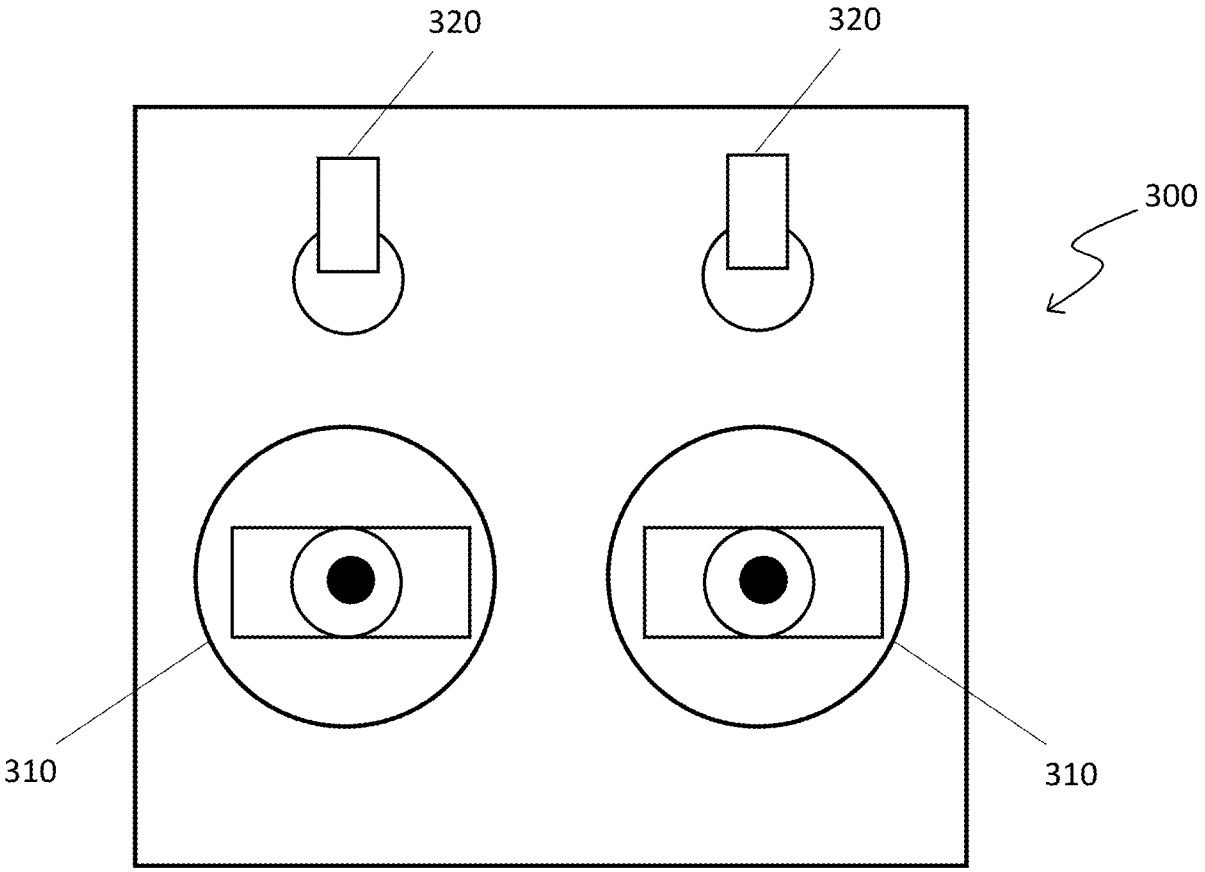
FIG. 13 is a top view of a transmitter 300, in accordance with an embodiment of the present disclosure.

FIG. 13 illustrates a representative embodiment of transmitter 300 of retrieval system 1000. Generally speaking, transmitter 300 may be configured to receive control inputs from a user and transmit them wirelessly to receiver 184 for controlling operation of watercraft 100 and capture assembly(s) 200. Transmitter 300, in various embodiments, may include one or more control interfaces 310 for controlling motor(s) 181 of powertrain 180 (and a rudder(s) thereof, if so equipped) and one or more control interfaces 320 for controlling capture motor(s) 220 of capture assembly(s) 200, as described in more detail herein.

Transmitter 300, in various embodiments, may include any commercial off-the-shelf radio transmitter suitable for performing the functionality described herein. One representative embodiment is a FlySky FS-i6X 6 channel 2.4 GHz transmitter paired with a FlySky FS-iA6B 6 channel 2.4 GHz receiver 184 on watercraft 100. Transmitter 300, in various embodiments, may include one or more control interfaces 310 such as control sticks for controlling motor(s) 181 of powertrain 180 (and a rudder(s) thereof, if so equipped) and one or more control interfaces 310 such as switches for controlling motor(s) 220 of capture assembly(s) 200. Each control interface 310, 320 may be associated with one or more channels as appropriate to control motors 181, 220 in the desired manner. For example, side-to-side and up-and-down motions of each control stick 310 may be associated with different channels (e.g., channels 1-4) and up-and-down settings of each control switch 320 may be associated with additional channels (e.g., channels 5 and 6). Motors 181, 220 may be wired to corresponding channel ports of receiver 184 so as to receive the corresponding control inputs from transmitter 300. Various channels can be assigned and/or mixed (e.g., via hardwiring or programmable control) as appropriate for a desired control format. For example, certain control stick 310 channels can be mixed as appropriate to provide for intuitive control of motors 181 for differential thrust steering control. Of course, in another embodiment, each control stick 310 may be assigned to a different motor 181 for a "tank style" control format. It should be recognized that all necessary motor 181 controls may be assigned to a single control stick 310 in some embodiments, thereby freeing up the other control stick 310 for other optional functionality or deleting it entirely from transmitter 300. Control switches 320, in various embodiments, may be configured to simply turn on/off a predetermined amount of power to motor(s) 220 of capture assembly(s) 200 by flipping such switches to an up or down position while, in other embodiments, control interfaces 320 may be provided as dials, sticks, or other interfaces capable of adjusting an amount of power supplied to motor(s) 220 in embodiments where variable speed control is desired when operating capture assembly(s) 200. As with control interface 310, only one control interface 320 may be required in some embodiments, such as those having only one capture assembly 200, or those having multiple capture assemblies 200 configured to operate at the same (or proportionally same) speeds via a single controls input. For example, in an embodiment, first and second capture assemblies 200 could be connected to channel ports 5 and 6 of receiver 184, and transmitter channels 5 and 6 mixed such that flipping control switch 320 to an "on" position supplies power to both capture assemblies 200 and flipping control switch 320 to an "off" position cuts power to both capture assemblies 200. Motors 220 of capture assemblies 200 could be connected with opposite polarities such that capture assemblies 200 rotate in opposing directions (e.g., both towards the centerline of watercraft 100) and thereby cooperate in sweeping object 10 into cargo area 120 when control switch 320 is flipped to an "on" position. One having ordinary skill in the art (especially those in r/c boat hobbyist circles) will recognize without undue experimentation various arrangements and configurations of control interfaces 310, 320 of transmitter 300 and their corresponding associations with the channel ports (and corresponding electrical connections with motor(s) 181, 220 of powertrain 180 and capture assembly(s) 200, and any rudders if so equipped) of receiver(s) 184 on watercraft 100 and the present disclosure is not intended to be limited to any one particular embodiment of transmitter 300 so long as it is capable of controlling operation of watercraft 100 and capture assembly(s) 200 as described herein.

Methods for Retrieving an Object

FIG. 14A-14E illustrate a representative method for retrieving an object 10 with the embodiment of FIG. 12A. In the embodiment shown, object 10 is a downed duck and retrieval system 1000 includes two counter-rotating capture assemblies 200 positioned on the fore ends of floatation members 110, each with semi-rigid capture arms 212.

The method, in various embodiments, may begin with navigating watercraft 100 to object 10. This step is not shown as it should be readily understood. In a representative example, a user may place watercraft 100 in the water and use control sticks 310 of transmitter 300 to drive watercraft 100 to a location proximate object 10. As watercraft 100 approaches object 10, the user may maneuver watercraft 100 such that object 10 is positioned just off the bow where it can subsequently be engaged by capture assemblies 200.

Figure 14B:
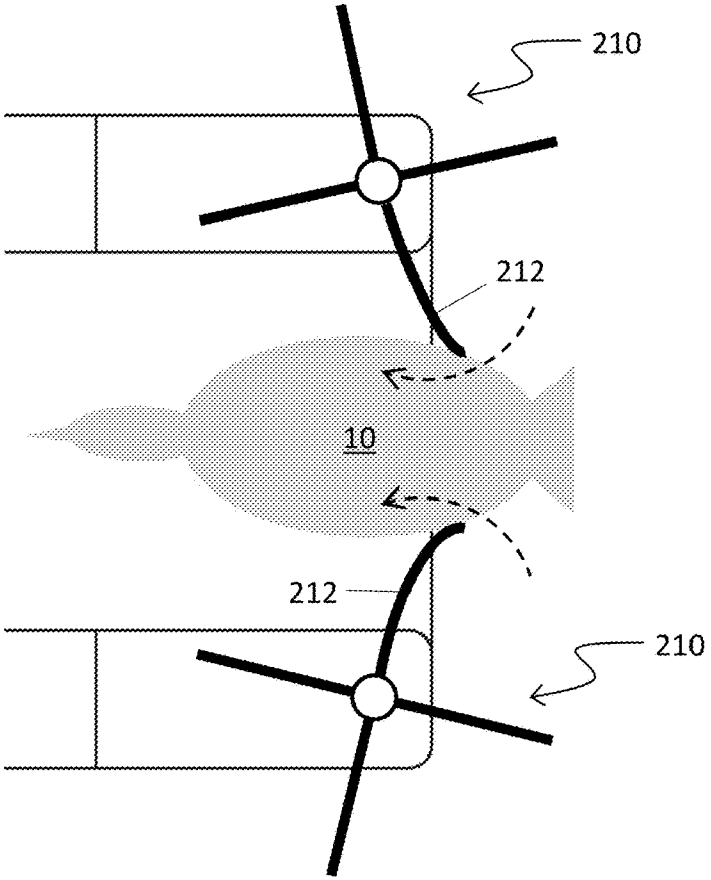
FIGS. 14A-14E illustrate a method for retrieving an object(s) 10 with an embodiment of retrieval system 1000, in accordance with an embodiment of the present disclosure.
Figure 14A:
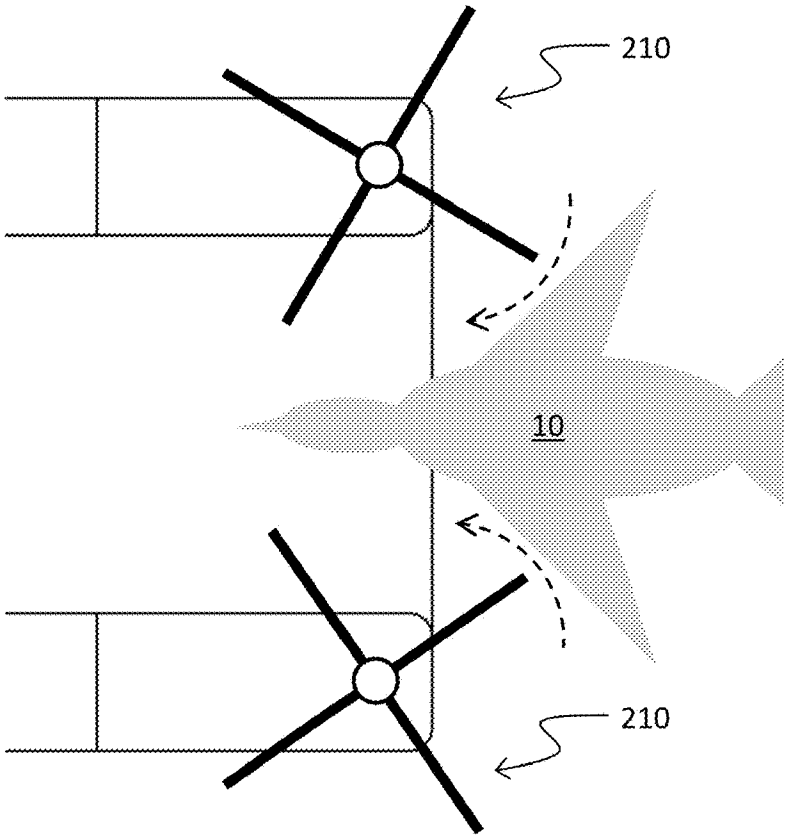

Referring to FIG. 14A, the user may use switches 320 of transmitter 300 to activate capture assemblies 200. In an embodiment, the user may wait until this time to activate capture assembly 200 while, in another embodiment, the user may instead choose to activate capture assembly 200 earlier—e.g., when launching or while navigating watercraft 100 to object 10. Such timing is not critical to retrieval operations, though each may have its own advantages and disadvantages. For example, waiting to activate capture assemblies 200 until watercraft 100 is proximate object 10 may have the advantage of conserving battery power, reducing aerodynamic drag, reducing the chances of sweeping in unwanted debris or snagging vegetation, and potentially avoiding frightening the object 10 (e.g., a crippled duck or goose) into fleeing earlier which could make the retrieve more difficult. That said, waiting could result in distracting the user with activating capture assemblies 200 at one of the more challenging times during the retrieval operation—that is, when attempting to engage object 10 with capture assemblies 200 at a location likely to be most distant from the user. Thus, avoiding such distraction is a potential advantage of activating capture assemblies earlier, as is the ability to confirm capture assemblies 200 are in working order prior to navigating watercraft 100 all the way out to object 10.

Still referring to FIG. 14A, the user may further maneuver watercraft 100 as necessary to cause rotating capture members 210 of capture assemblies 200 to first contact object 10. Initial contact may serve to help center object 10 with the centerline of watercraft 100 and to begin advancing object 10 towards cargo area 120. Depending on the orientation of object 10, initial contact may also help compress object 10, thereby facilitating intake into cargo area 120. For example, when a downed duck falls to the water it often lands with its wings slightly outstretched away from its body; during initial contact with rotating capture member 210, capture arms 212 may press the wings against the body thereby compressing the overall footprint of the downed duck.

Referring now to FIG. 14B, rotating capture members 210 continue to advance object 10 towards cargo area 120. The downed duck 10 is shown here with its wings now fully compressed against its body and being swept between capture arm hubs 214. At this point, both rotating capture arms 212 have engaged object 10 and are attempting to move it through gap 216, which in the present embodiment is narrower than object 10. As such, semi-flexible capture arms 212 bend such that object 10 can fit through, as shown. The bent capture arms 212 apply forces to object 10 in two directions—that is, one force component is tangential to rotation and continues to sweep object 10 into cargo area 120, and the other force component is radial (i.e., towards the opposing capture assembly 200 at this midpoint) and applies a normal force that "grabs" object 10 between capture assemblies 200 and keeps it from escaping.

Figure 14D:
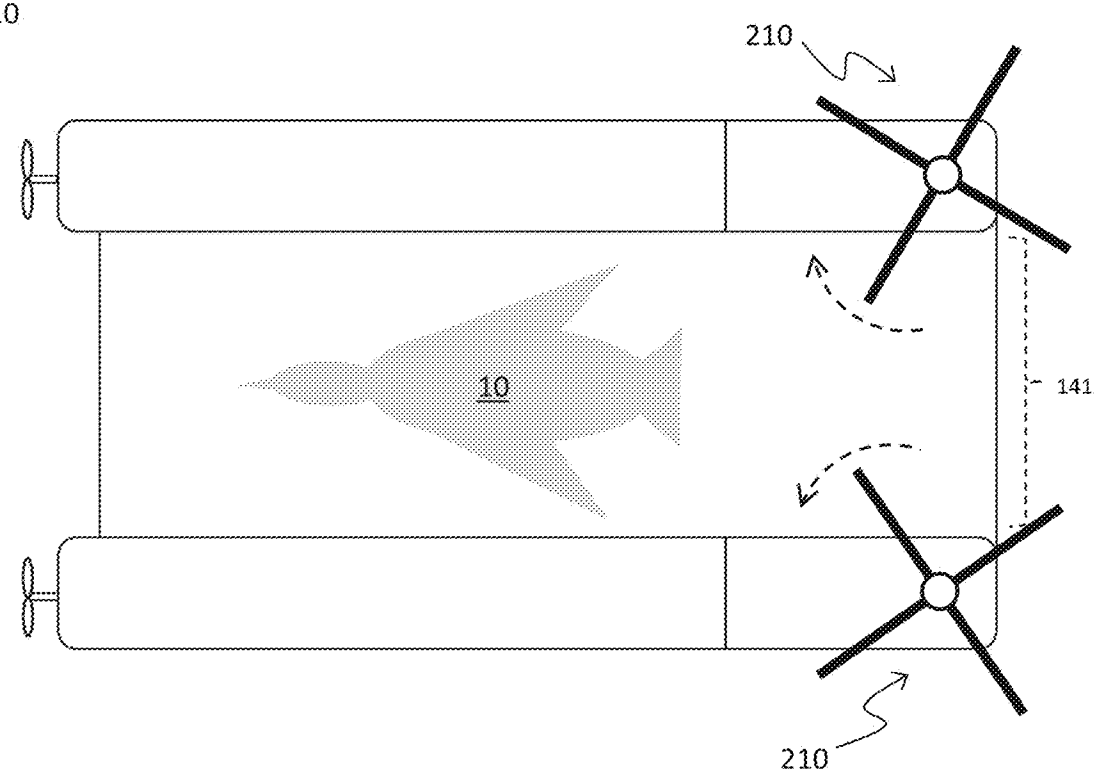
Figure 14C:
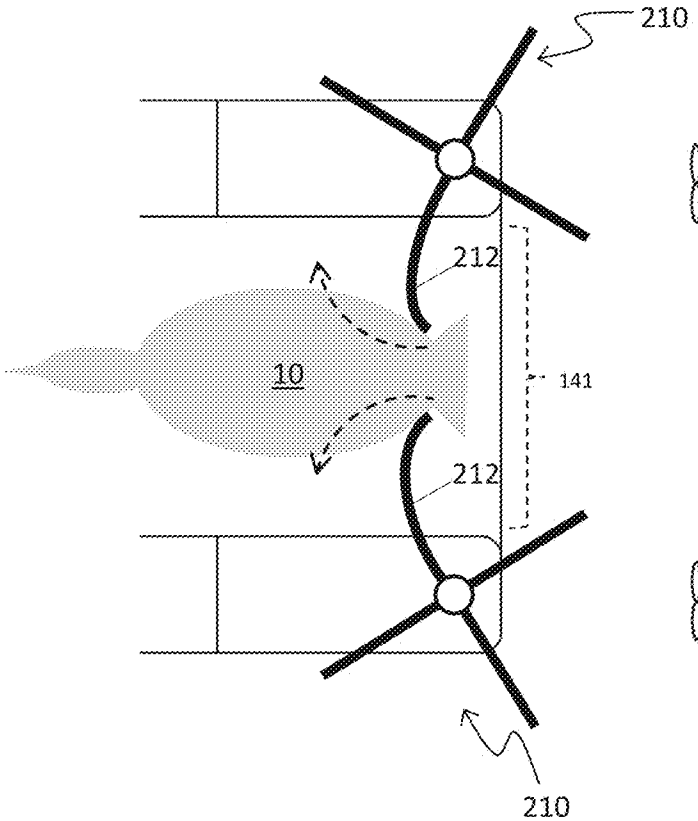

Referring to FIG. 14C, object 10 has been swept past the threshold spanning capture arm hubs 214 and begins to enter cargo area 120. Capture arms 212 continue to engage object 10 during this time and push it further into cargo area 120.

Referring to FIG. 14D, object 10 has been swept into cargo area 120 and is no longer engaged by capture assemblies 200. The user may opt at this time to either turn off capture assemblies 200 or leave them running while navigating watercraft 100 to the next object or back to shore. The advantages and disadvantages discussed above with respect to when capture assemblies 200 are turned on apply here as well. In either event, rotating capture members 210 may serve to keep object 10 contained within cargo area 120. More particularly, if capture assemblies 200 are turned off, the stiffness of capture arms 212 may resist forces applied by object 10 while trying to escape, such that capture arms 212 do not bend far enough to open up gap 216 wide enough for object 10 to pass therethrough. Likewise, if capture assemblies 200 continue to run, the resistance provided by the stiffness of capture arms 212 may be further augmented by rotation of rotating capture member(s) 210, making it even more difficult for object 10 to escape cargo area 120.

Figure 14E:
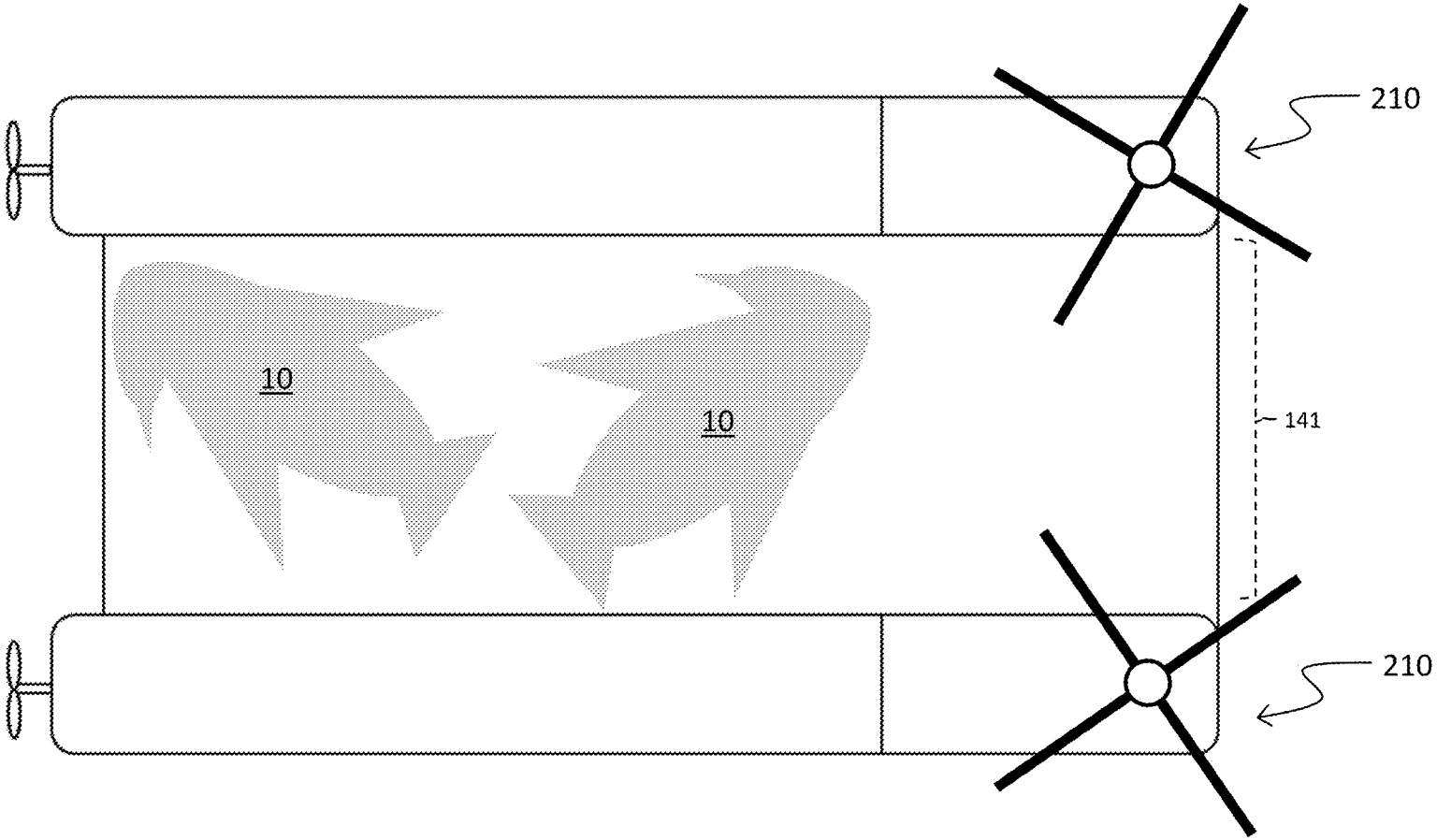

Referring now to FIG. 14E, in an embodiment watercraft 100 may be used to collect another object 10 before navigating back to shore, assuming cargo area 120 is big enough to accommodate two objects. Here, two down ducks 10 have been collected in cargo area 120. Generally speaking, as the second object 10 is swept into cargo area 120 it will push the first object 10 further back in cargo area 120 to make room. It should be recognized that while cargo area 120 is shown as being large enough to accommodate two objects 10 without either touching one another, cargo area 120 may be smaller and still able to accommodate two objects 10 to the extent objects 10 are deformable and/or able to fit within cargo area 120 in a different arrangement. Stated otherwise, the sweeping force provided by capture assemblies 200 may serve to push objects 10 together and pack them in in a manner in which both will fit within cargo area 120.

Once object(s) 10 is collected, the user may navigate watercraft 100 back to shore, where he/she may remove object 10 and prepare to redeploy retrieval system 1000 for a subsequent retrieval operation.

FIG. 15A-15D illustrate a representative method for retrieving an object 10 with the embodiment of FIG. 12B. In the embodiment shown, object 10 is a downed duck and retrieval system 1000 includes two counter-rotating capture assemblies 200 positioned on the fore ends of floatation members 110, each with rigid capture arms 212 and having staggered rotations relative to one another.

Figure 15A:
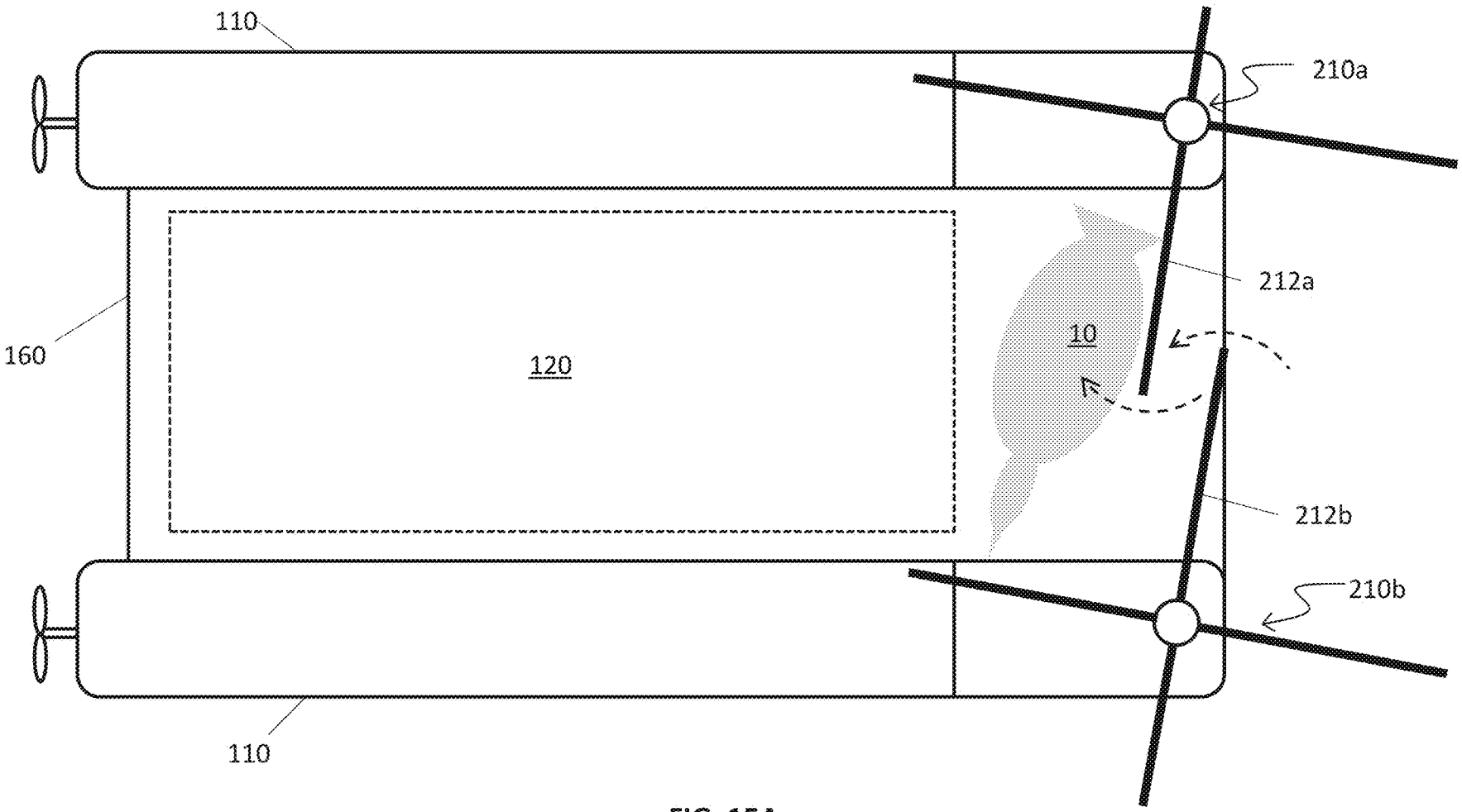
FIGS. 15A-15D illustrate a method for retrieving an object(s) 10 with another embodiment of retrieval system 1000, in accordance with an embodiment of the present disclosure.

Referring to FIG. 15A, the user may maneuver watercraft 100 as necessary to cause rotating capture member 210*a* to first contact object 10. Initial contact may serve to help center object 10 with the centerline of watercraft 100 and to begin advancing object 10 towards cargo area 120. The rotation of rotating capture member 210*b* lags behind that of rotating capture member 210*a*, with capture arm 212*b* trailing capture arm 212*a*.

Figure 15B:
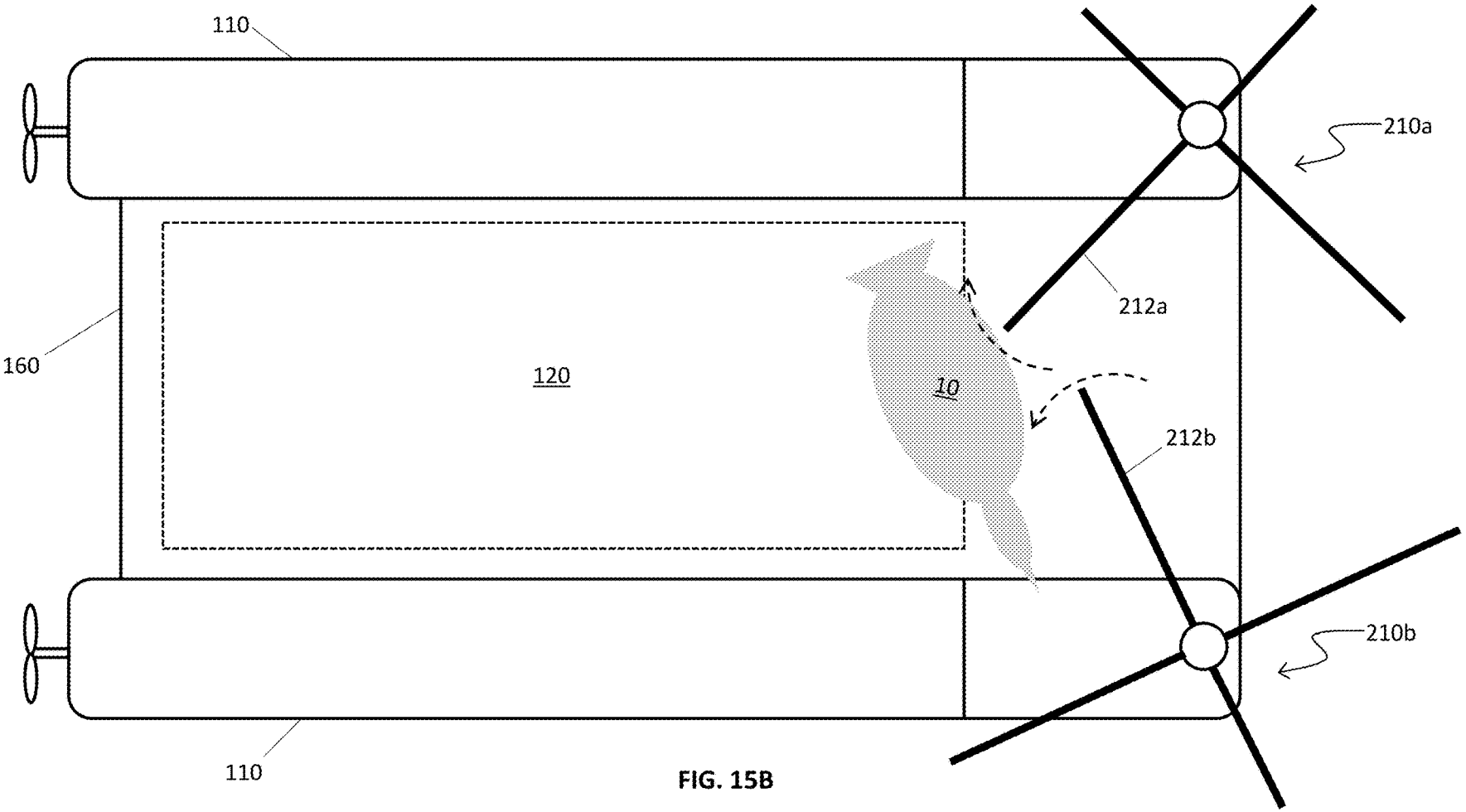

Referring to FIG. 15B, rotating capture member 210*a* continue to advance object 10 towards cargo area 120, causing object 10 to pivot towards rotating capture member 210*b* as the capture arm 212*a* in contact with object 10 clears object 10.

Figure 15C:
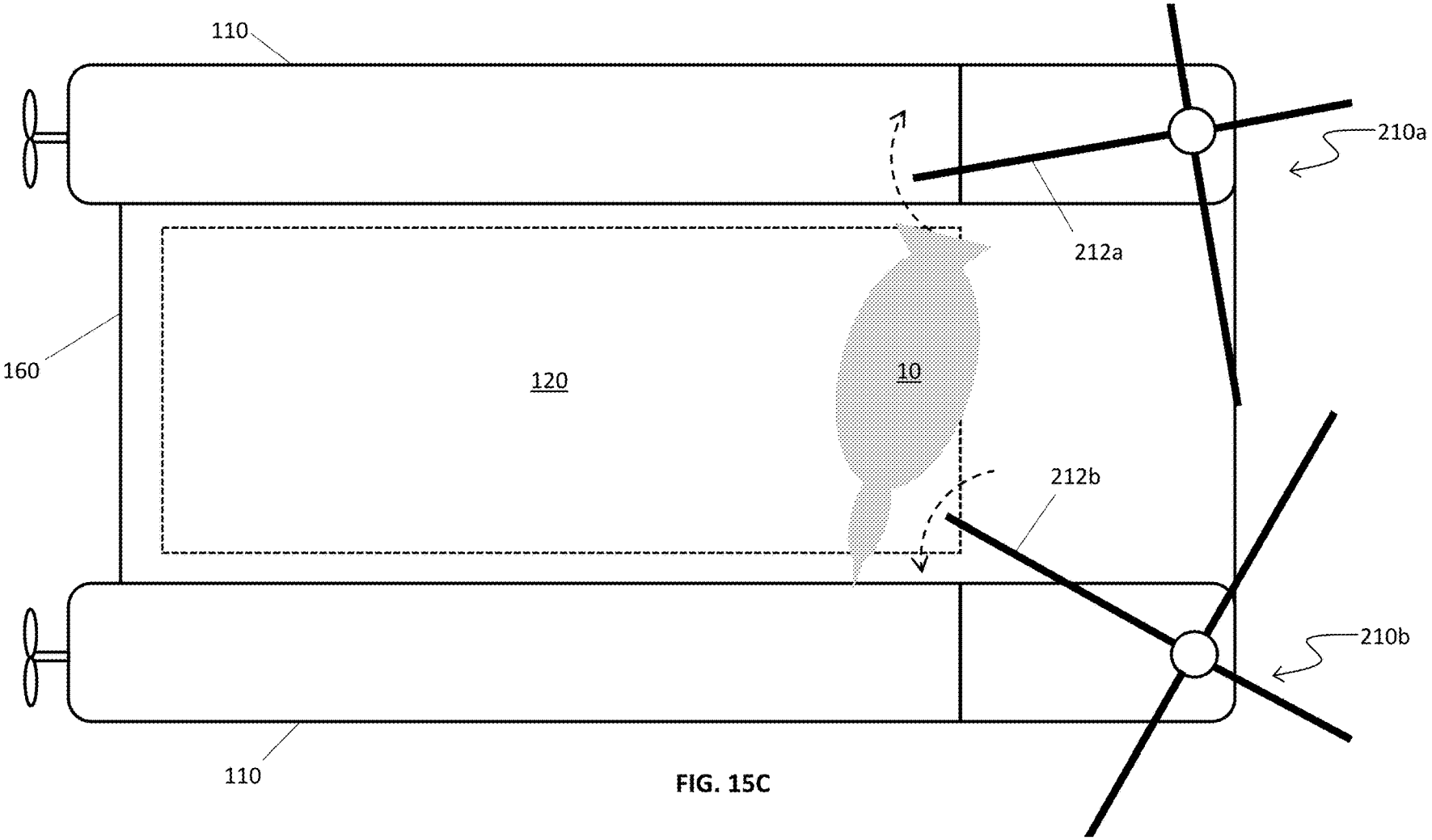
Figure 15D:
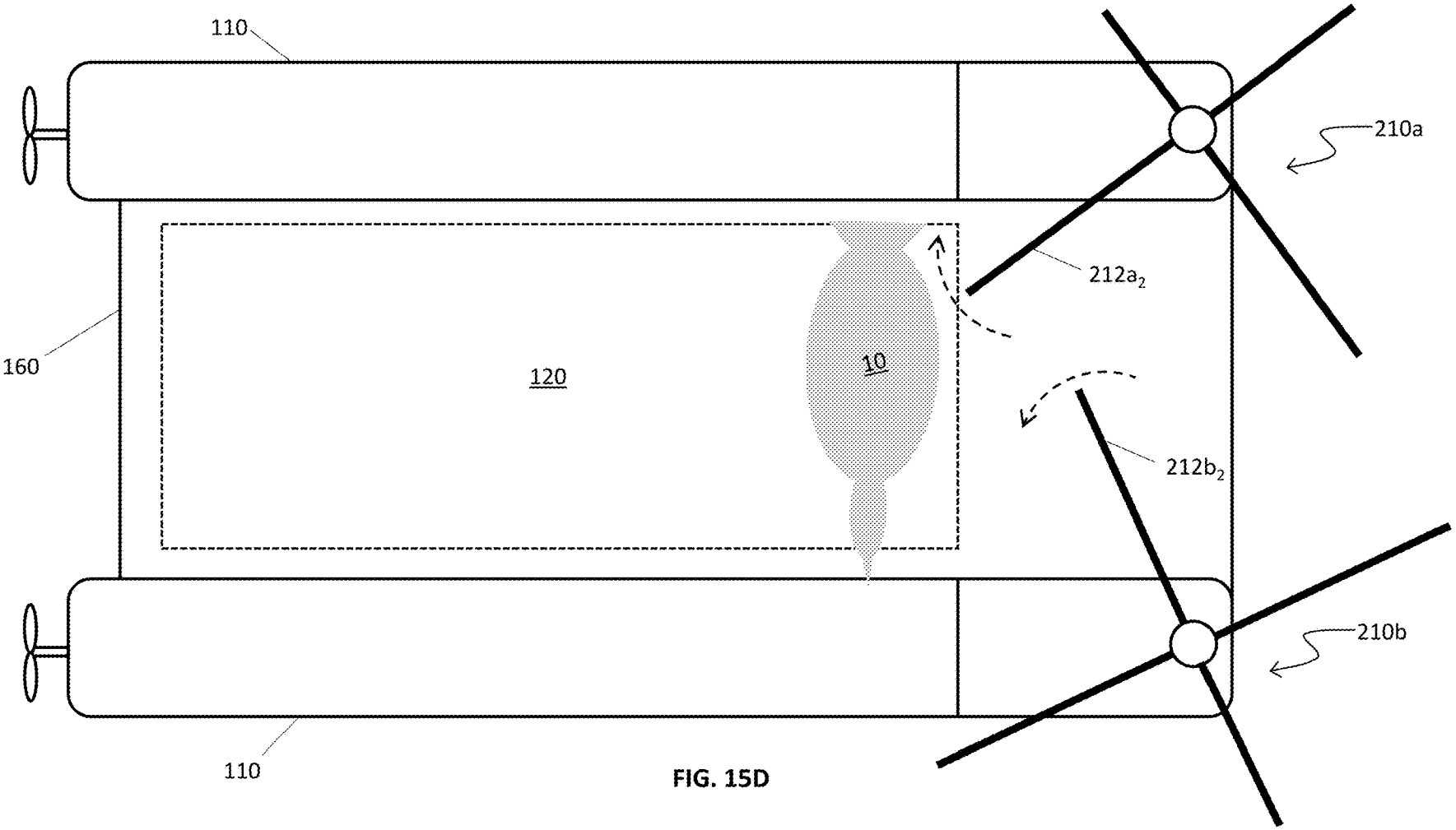

Referring to FIG. 15C, capture arm 212*b* of rotating capture member 210*a* now makes contact with object 10, pushing object 10 further into cargo area 120 while causing object 10 to pivot back towards rotating capture member 212*a*. Referring to FIG. 15D, capture arm 212*a*2 (i.e., the next capture arm 212 of rotating capture member 210*a*) now makes contact with object 10, pushing object 10 further into cargo area 120 while causing object 10 to again pivot back towards rotating capture member 212*b*. This alternating process may continues until object 10 is out of reach of both rotating capture members 210*a*, 210*b*.

The user may opt at this time to either turn off capture assemblies 200 or leave them running while navigating watercraft 100 to the next object or back to shore. The advantages and disadvantages of such timing discussed above with respect to FIGS. 14A-14E apply here as well. In either event, rotating capture members 210 may serve to keep object 10 contained within cargo area 120. More particularly, if capture assemblies 200 are turned off, the stiffness of capture arms 212 may resist forces applied by object 10 while trying to escape.

Deployment System 2000

Figure 16A:
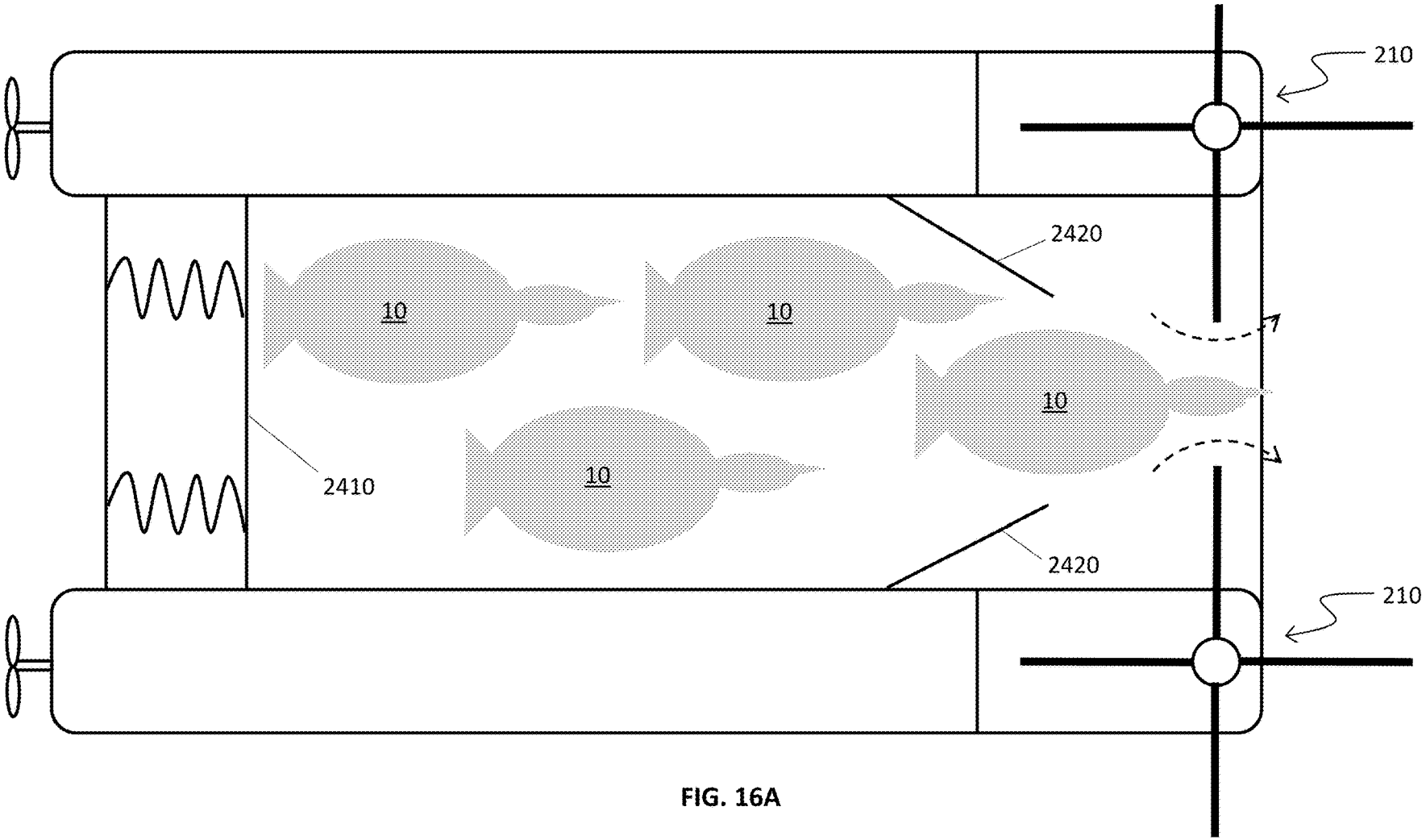
FIG. 16A is a top view of a deployment system 2000, in accordance with an embodiment of the present disclosure.
Figure 16B:
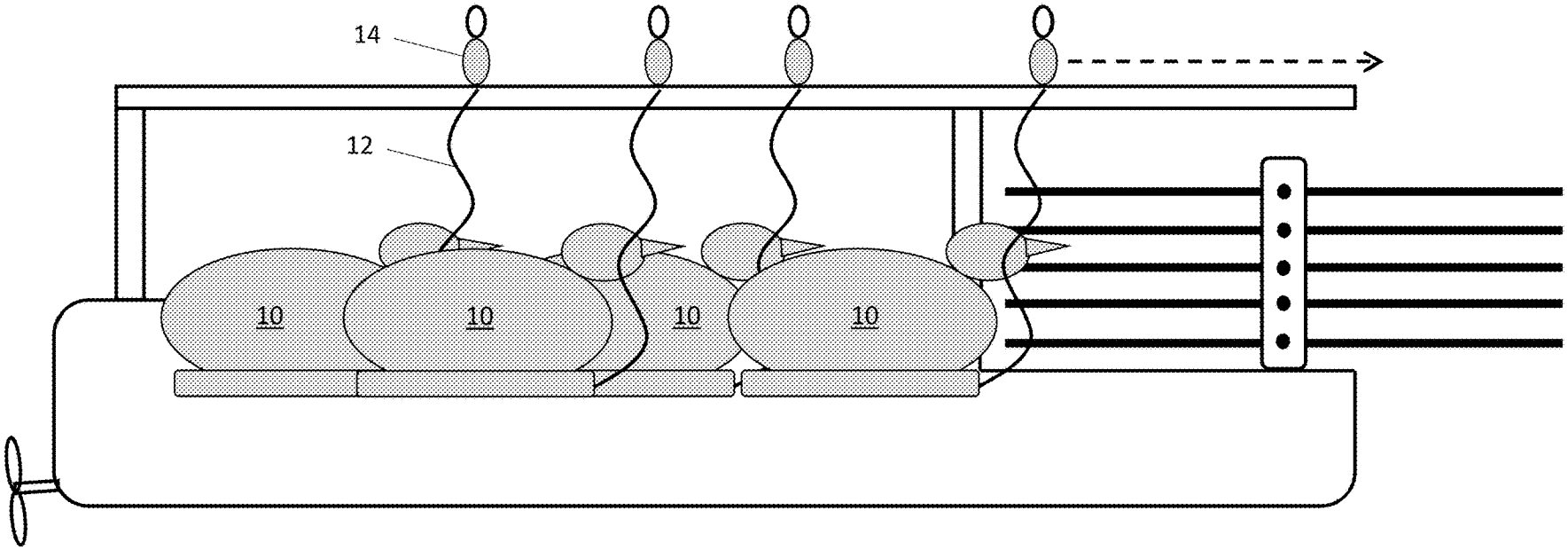
FIG. 16B is a side view of the deployment system 2000 of FIG. 16A, in in accordance with an embodiment of the present disclosure.
Figure 16C:
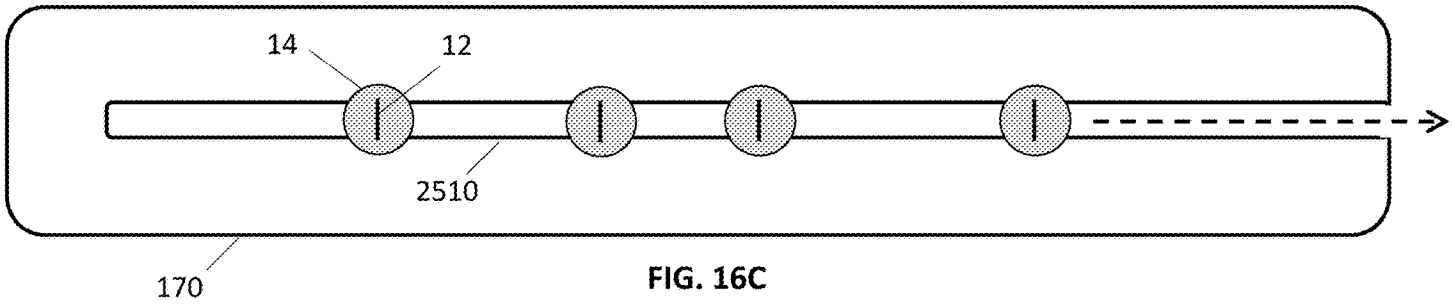
FIG. 16C is a top view of a weight guide 2500 of the deployment system 2000 of FIGS. 16A and 16B, in accordance with an embodiment of the present disclosure.

FIGS. 16A-16C illustrate a representative embodiment of a deployment system 2000 of the present disclosure. Generally speaking, deployment system 2000 may be configured for deploying one or more objects 10 in the water and, in various embodiments, may include the same components of retrieval system 1000 (e.g., a watercraft 2100 with cargo area 2120, one or more capture assemblies 2200, and transmitter 2300), albeit with capture assemblies 2200 being configured to rotate in the opposite directions as capture assemblies 200 so as to sweep object 10 out of cargo area 2120 during a deployment operation. In some embodiments, retrieval system 1000 may be configured to reverse the directions of capture assemblies 200 via transmitter 300 depending on whether a retrieval operation versus a deployment operation is being performed; in such embodiments, the system is both a retrieval system 1000 and a deployment system 2000.

Deployment system 2000, in various embodiments, may further include a loader 2400 in cargo area 2120. Loader 2400, in various embodiments, may include any mechanism suitable for positioning object(s) 10 proximate capture assembly(s) 2200 such that capture assembly(s) 2200 are able to engage and sweep object 10 out of cargo area 2120. In the embodiment shown, loader 2400 includes a spring-loaded plate 2410 configured to push object(s) 10 towards the bow of watercraft 2100 and a centering guide 2420 configured to center object(s) 10 to facilitate engagement by capture assemblies 2200. Loader 2400 is especially helpful when cargo area contains multiple objects 10, or is large enough to contain multiple objects 10 but includes fewer than it is able to accommodate. As configured, loader 2400 ensures object(s) 10 are readily positioned where they can be engaged by capture assemblies 2200. In the embodiment shown, four objects 10 (shown here as floating waterfowl decoys) are stacked within cargo area 2120 between spring-loaded plate 2410 and centering guide 2420. As configured, when one object 10 is swept out of cargo area 2120, spring-loaded plate 2410 pushes the next forward as centering guide 2420 centers that next object between capture assemblies 2200. In a way, loader 2400 operates like a firearm clip—here, a clip with a double stack configuration. Such clips are spring loaded and advance successive cartridges towards an upper end, where they are successively stripped out of the clip and into the chamber of the firearm to be fired. One having ordinary skill in the art will recognize alternative mechanisms that achieve similar functional goals in view of the present disclosure.

Deployment system 2000, in various embodiments, may optionally further include a weight guide 2500. Weight guide 2500, in various embodiments, may be configured to facilitate the orderly deployment of floating decoys without their weight cords becoming tangled with one another. In the embodiment shown, weight guide 2500 includes a slot 2510 in upper containment element 2170 of watercraft 2100 having a width dimension wide enough to accommodate decoy cord 12 therethrough but narrow enough such that decoy weight 14 cannot pass through. As configured, a user may insert the decoy cord 12 of each decoy 10 into slot 2510 through the front opening thereof, making sure to keep decoy weight 14 above slot 2510 such that decoy weight 14 rests on top of slot 2510 during transport. "Hanging" the decoy weights 14 and lines 12 in such a manner helps keep them from tangling during transport while providing a means for deploying a respective decoy's 10 line 12 and weight 14 along with that decoy 10. In operation, when capture assemblies 2200 sweep a given decoy 10 out of cargo area 2120, the decoy body pulls its line 12 and weight 14 forwards and out of slot 2510, where they then fall into the water under decoy 10. With this in mind, the first decoy 10 to be deployed (i.e., the decoy 10 positioned closest to capture assemblies 2200) should have its cord 12 and weight 14 loaded into slot 2510 last so that they may be the first out, and so on. In a way, this approach may be similar to paratroopers lining up within an aircraft for a jump and clipping their parachute tethers to a cable running along the ceiling of the fuselage, such that each may slide forward along the cable as successive paratroopers jump out of the front door of the aircraft. Of course, in that example the tethers remain clipped onto the cable after the paratroopers jump, whereas the cords 12 and weights 14 decouple from slot 2510 (i.e., slide out of the forward opening of slot 2510) when the decoys 10 are deployed from watercraft 2100. It may be necessary to reverse watercraft 2100 slightly to pull cord 12 and weight 14 out of slot 2510 depending on the length of cord 12 and how forcefully decoy 10 is swept out of cargo area 2120.

Figure 17A:
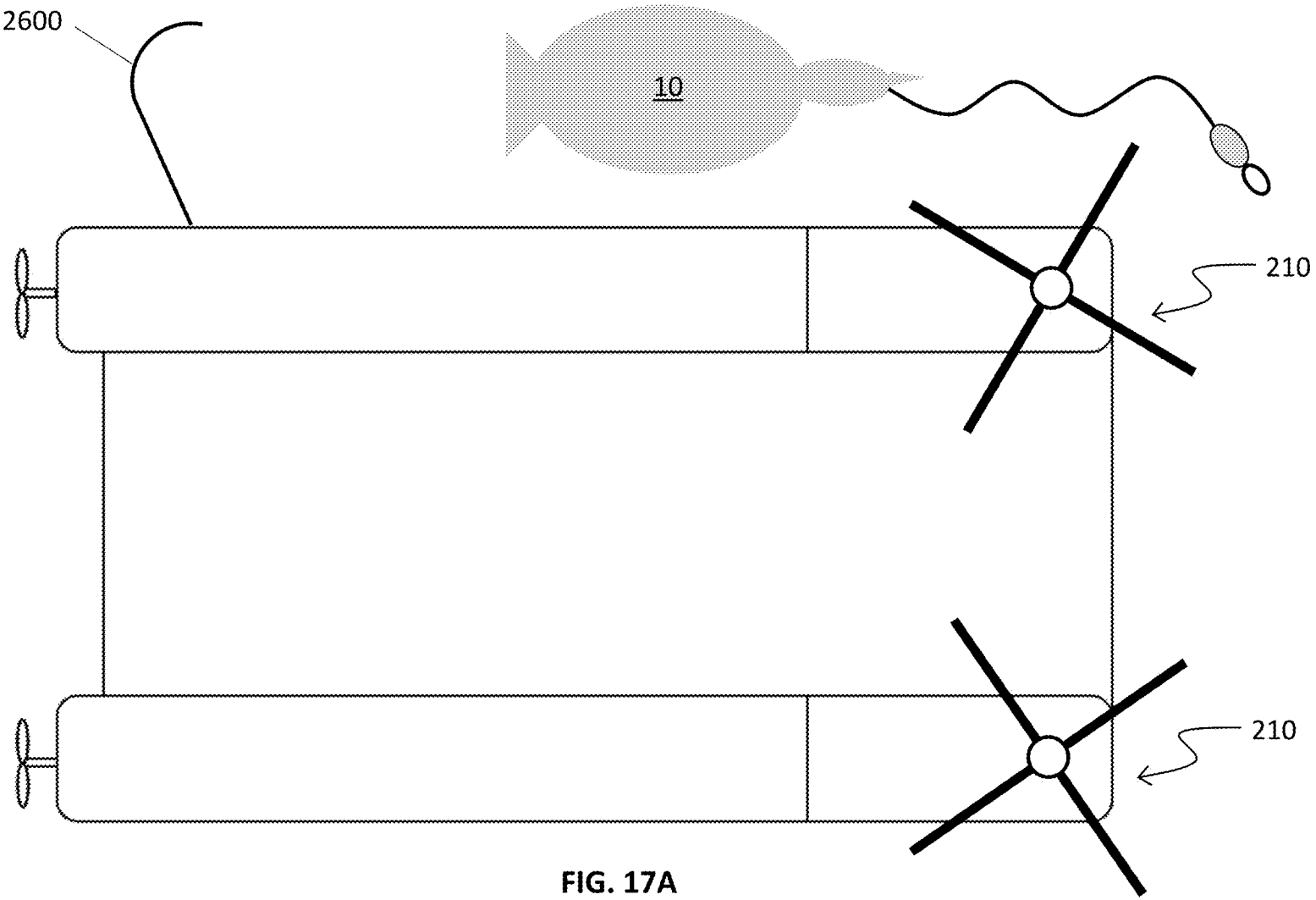
FIGS. 17A-17C illustrate a hook 2600 of a deployment system 2000, in accordance with an embodiment of the present disclosure.
Figure 17B:
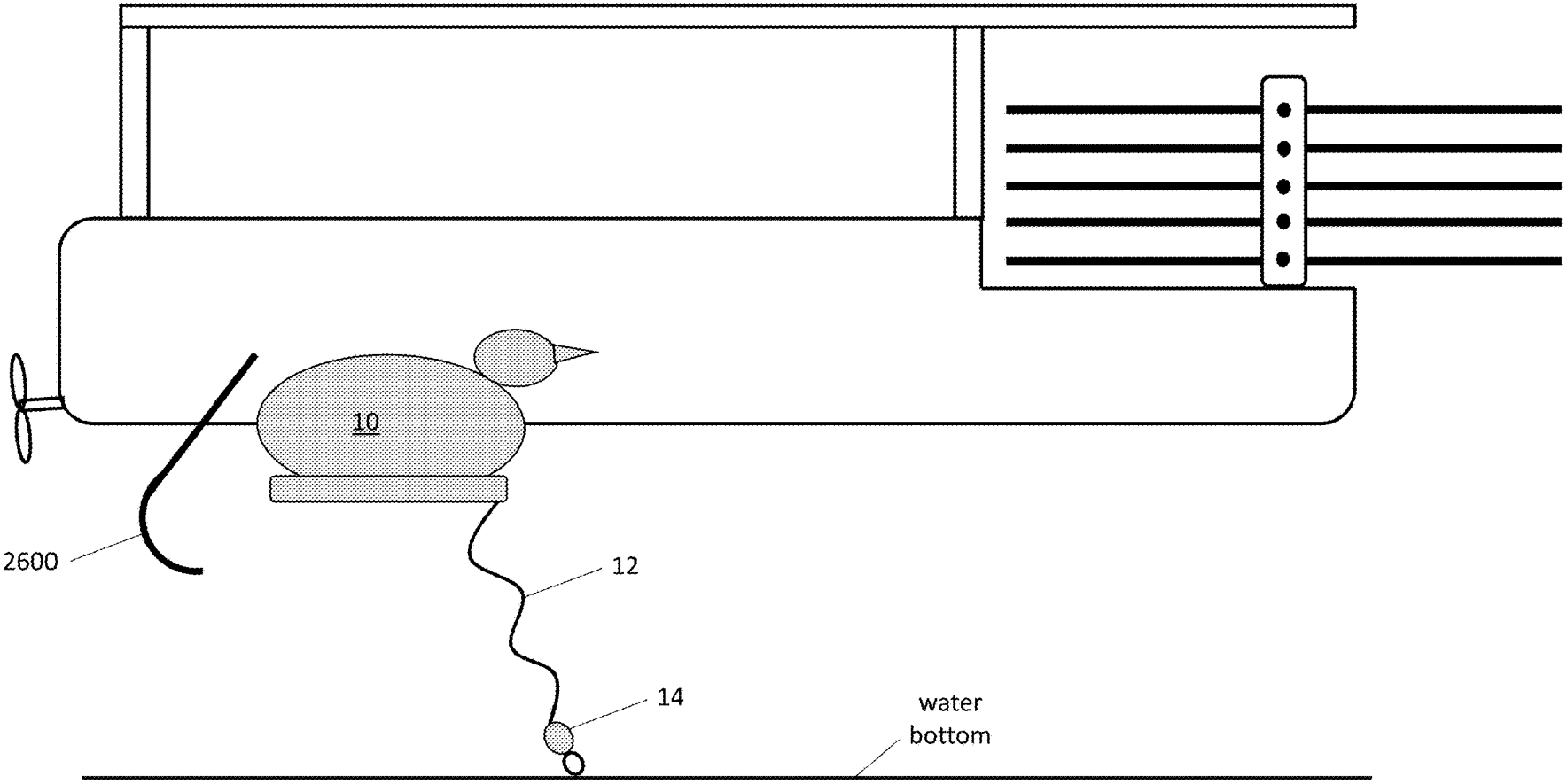
Figure 17C:
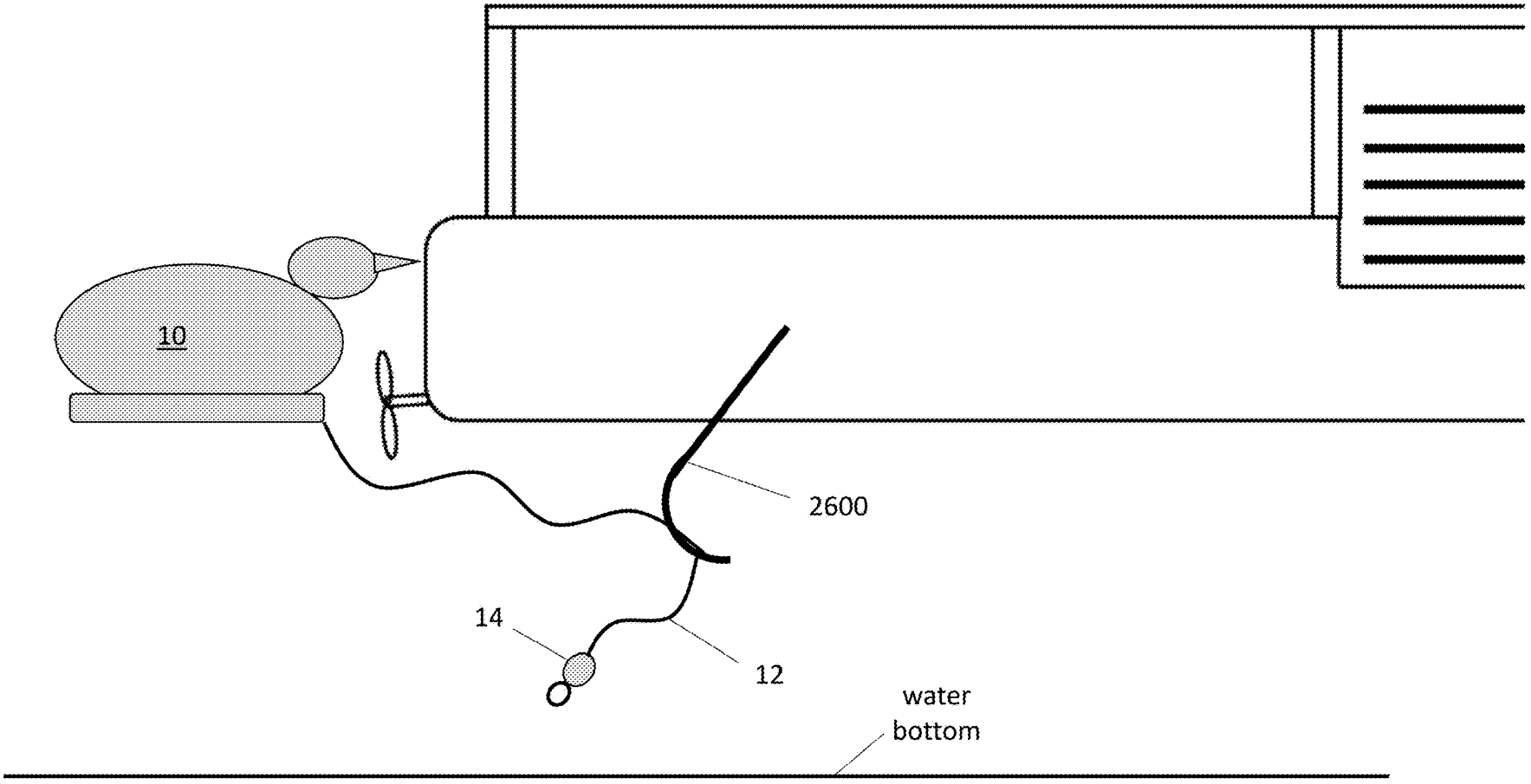

FIGS. 17A-17C illustrate another embodiment of deployment system 2000 including an optional hook 2600 for assisting in the redeployment of objects 10 to alternative locations in the water. In the embodiment shown, object 10 is a floating waterfowl decoy 10 and certain features of hook 2600 are described in that context; of course, one having ordinary skill in the art will understand how to adapt these features to the redeployment of other objects in view of the teachings of the present disclosure.

As shown in FIG. 17A, hook 2600 may be dimensioned to extend further outwards than capture assemblies 2200 such that watercraft 2100 can drive up alongside the object 10 to be redeployed without capture assembly 2200 interfering with hook 2600 being able to snag object 10. Additionally or alternatively, at least a distal portion of hook 2600, in various embodiments, may be partially submerged to enable it to snag a submerged portion of object 10—here, a cord 12 of decoy 10. As configured, a user may navigate watercraft 2100 alongside a decoy 10 to be redeployed and continue to drive forwards until hook 10 snags a proximate portion of cord 12. As the watercraft 2100 continues to move forwards, hook 2600 may slide along cord 12 towards a distal portion of cord 12, all the while raising weight 14 off of the bottom of the body of water. Eventually, hook 2600 may reach weight 14, at which point hook 2600 stops sliding and forward motion of watercraft 2100 pulls decoy 10 to the redeployment location. Such an approach may be particularly advantageous as, by lifting weight 14 off of the bottom it is less likely to snag on any underwater debris as decoy 10 is moved to the redeployment location. Upon reaching the redeployment location, watercraft 2100 may stop and, if necessary, reverse, such that weight 14 falls back towards the bottom and cord 12 decouples from hook 2600.

Additional Embodiments of Watercraft 100/Retrieval System 1000

Feeder 240

Figure 18A:
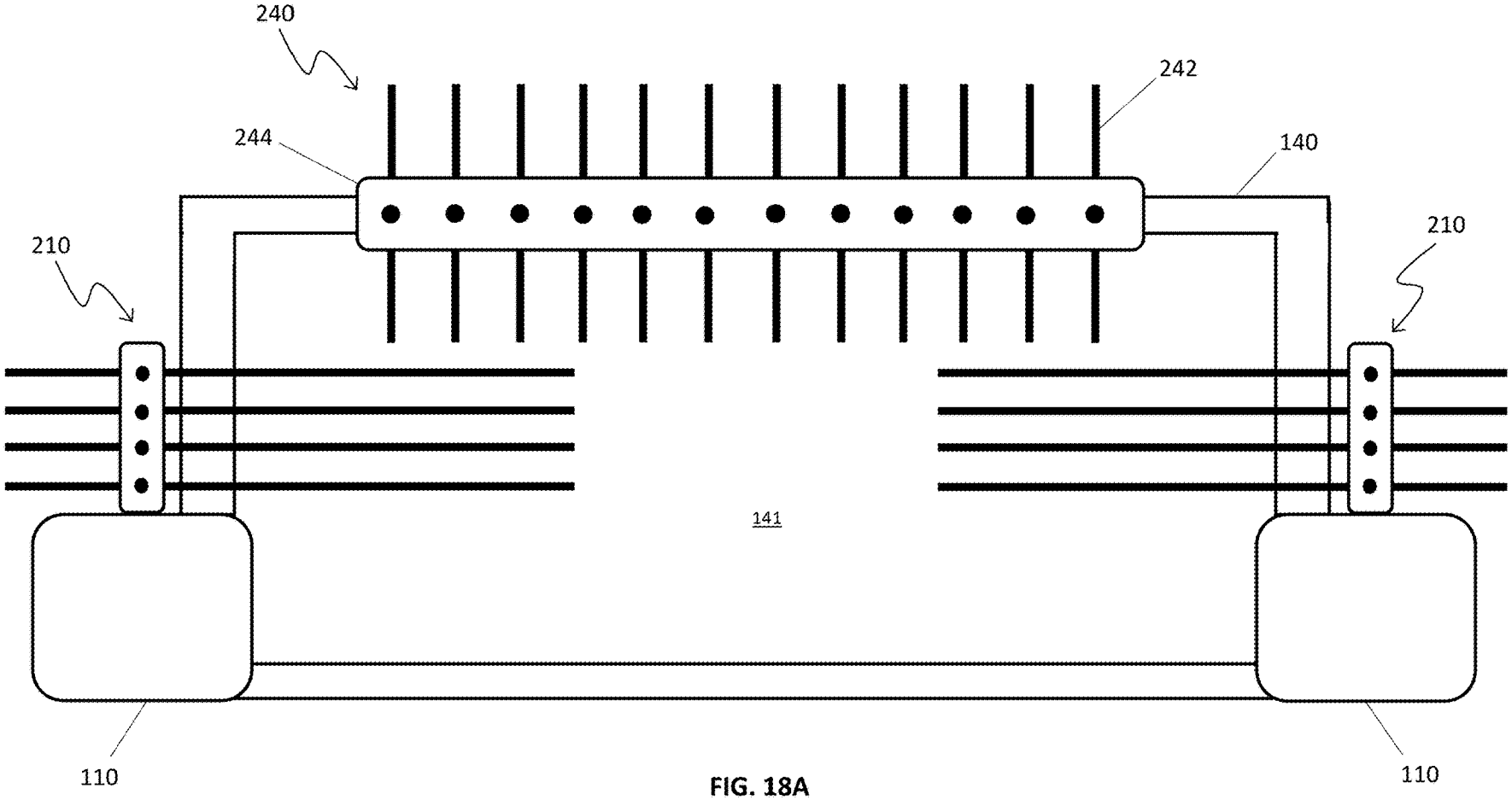
FIGS. 18A-18B illustrate front and side views of an additional embodiment of retrieval system 1000, shown here with a feeder 240 for feeding object 10 into rotating capture assembly(s) 200, in accordance with an embodiment of the present disclosure.
Figure 18B:
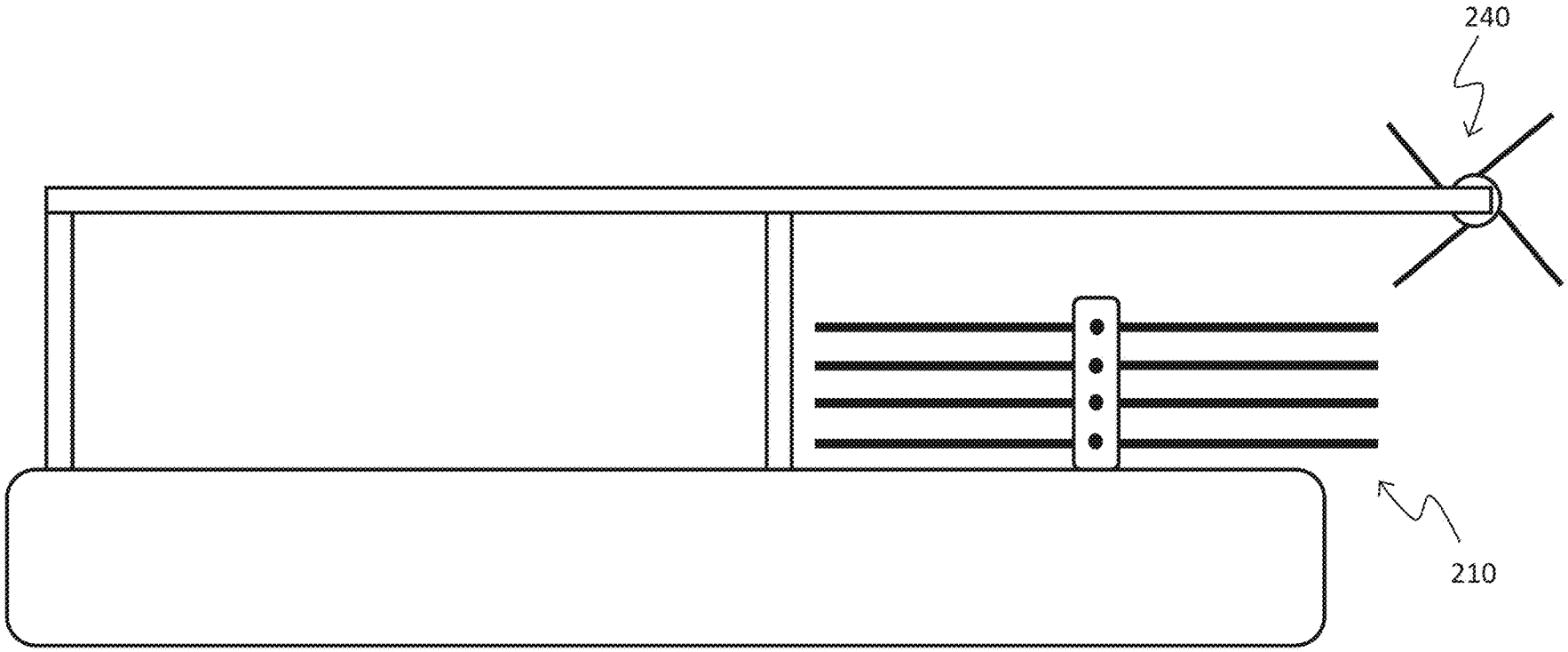

FIG. 18A and FIG. 18B illustrate front and side views of an additional embodiment of retrieval system 1000, shown here with a feeder 240 for feeding object 10 into rotating capture assembly(s) 200. Generally speaking, forward motion of watercraft 100 causes feeder 240 to engage object 10 and prevent it from moving backwards once positioned in the area immediately in front of rotating capture members 210. Holding object 10 near the mouth of counter-rotating capture members 210 may allow capture arms 212 to more easily grasp object 10 and pull it into containment structure 140. In particular, feeder 240 applies reaction forces in response to contact by capture arms 212 which, in turn, allows capture arms 212 to press harder against object 10 thereby generate greater normal forces and resulting friction between capture arms 212 and object 10. Such functionality can be particularly helpful when object 10 is significantly wider than gap 216, or has a shape, smoothness, or other properties that make it difficult for capture arms 212 to initially generate enough friction with object 10 to pull it further into gap 216. Likewise, such functionality can facilitate the capture of living objects 10 that may try to escape, such as injured waterfowl.

Feeder 240, in various embodiments, include one or more feeder arms 242 extending outwards from a feeder hub 244. In the embodiment shown, feeder 240 has a plurality of feeder arms 242 distributed about the circumference and along the length of feeder hub 244. The lengths and distribution of feeder arms 242, in various embodiments, may be selected to such that feeder arms 242 contact object 10 while not interfering with rotation of capture arms 212. Feeder 240, in various embodiments, may be positioned forward of rotating capture members 210 so as to engage object 10 in the area immediately in front of rotating capture members 210. In the embodiment shown, feeder 240 has a horizontal orientation and is positioned above and in front of two rotating capture members 210. In some embodiments, feeder arms 242 may be swept or curved rearwards towards capture members 210 so as to minimize interference with object 10 as it moves rearwards towards capture members 210 while enhancing its ability to "snag" object 10 in response to movement of object 10 in the opposite direction, much like barbs.

Feeder 240, in various embodiments, may be configured to rotate in a single direction—namely, rearwards towards rotating capture members 210. Rearward rotation of feeder 240 allows object 10 to advance towards rotating capture members 210 with minimal resistance despite contact with feeder arms 242, while the inability to reverse that rotation (i.e., rotate forwards away from rotating capture members 210) prevents object 10 from retreating once engaged by feeder arms 242. Unlike rotating capture assemblies 200, rotation of feeder 240 may be unpowered, instead freely rotating in response to being contacted by object 10 as watercraft 100 advances forwards during the initial stages of capturing object 10. Stated otherwise, relative motion of object 10 rearwards towards rotating capture members 210 during such stage causes feeder 240 to rotate rearwards, such that feeder arms 242 maintain contact with object 10 until object 10 is pulled into gap 216 by rotating capture members 210. As configured, any effort of object 10 to retreat is immediately counteracted by rearward-directed reaction forces applied by feeder arms 242 owing to the inability of feeder 240 to rotate in the retreating direction. In various embodiments, feeder arms 242 may be substantially rigid so as to "snag" object 10 and maximize these rearward-directed reaction forces applied to object 10 during any effort to retreat from rotating capture members 210. Of course, in other embodiments, feeder 240 could be powered by a motor to enhance the functionality described herein, though this may unnecessarily increase the complexity and cost of retrieval system 1000 and potentially damage object 10 (especially if feeder arms 242 are rigid), as further described below.

A unique benefit of utilizing a passive feeder 240 with rigid feeder arms 242 together with powered capture assemblies 200 having semi-rigid capture arms 212 is an improved ability to capture object 10 while minimizing any resulting damage to object 10. As configured, watercraft 100 can be piloted aggressively at object 10 to initially snag it with the rigid feeder arms 242 and feed it into capture members 210, where the softer, semi-rigid capture arms 212 more gently advance object 10 through gap 216 and into containment structure 140. This is particularly beneficial in a waterfowl hunting context, especially those in which the waterfowl is injured rather than dead. In such instances, it may be otherwise difficult to capture the injured waterfowl with semi-rigid captures 210 alone. Conversely, while rigid capture arms 212 (or a powered feeder 240 with rigid feeder arms 242) may solve this issue, they may be more apt to damage the plumage and/or skin of the injured waterfowl in the process. This can be undesirable if the hunter wishes to keep the waterfowl in good condition for mounting, pictures, and/or skin-on cooking techniques. Instead, the present combination may make it easier to capture the injured waterfowl without ruffling or breaking feathers or skin. In waterfowl hunting lingo, such an embodiment might be said to have "soft mouth" rather than "hard mouth" if analogized to a retriever dog.

Figure 19A:
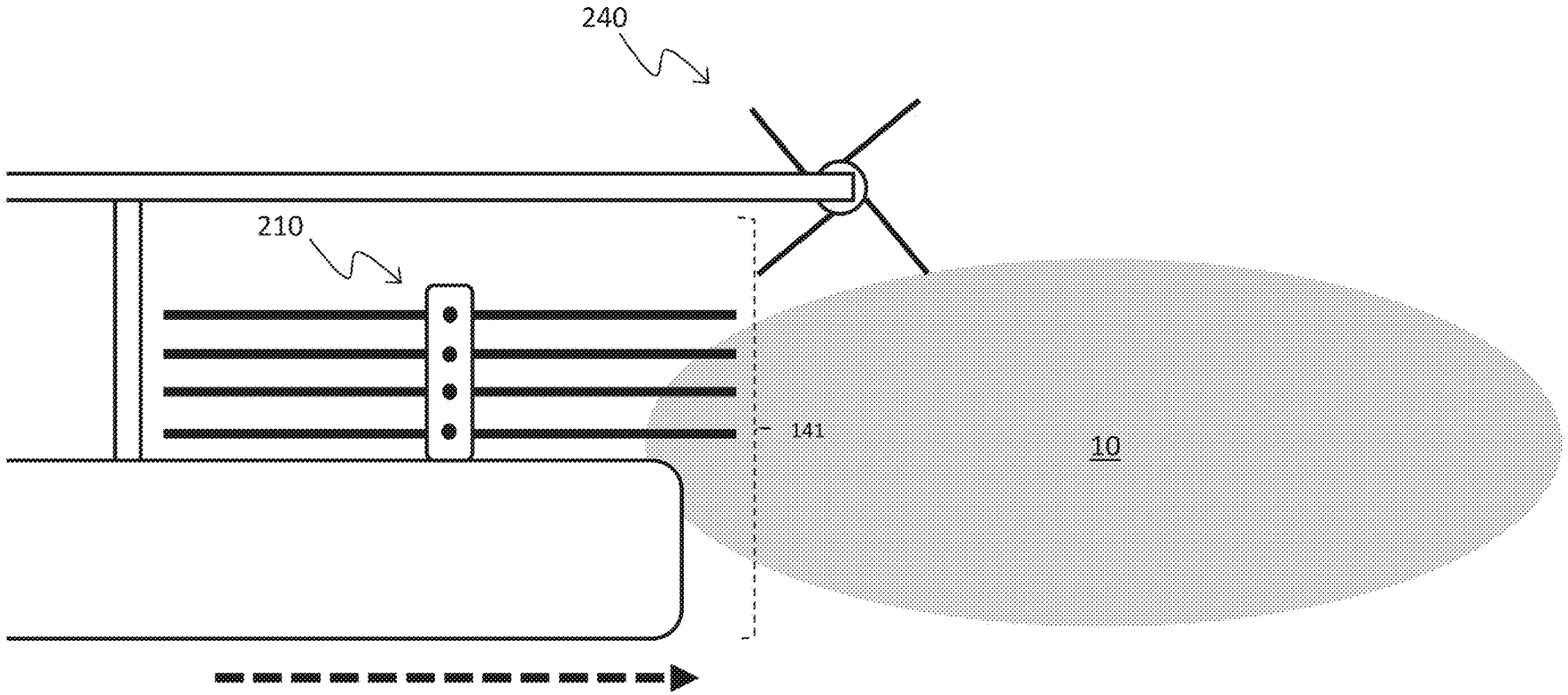
FIGS. 19A-19C depict the embodiment of FIGS. 18A-18B being used to capture an object 10, in accordance with an embodiment of the present disclosure.
Figure 19B:
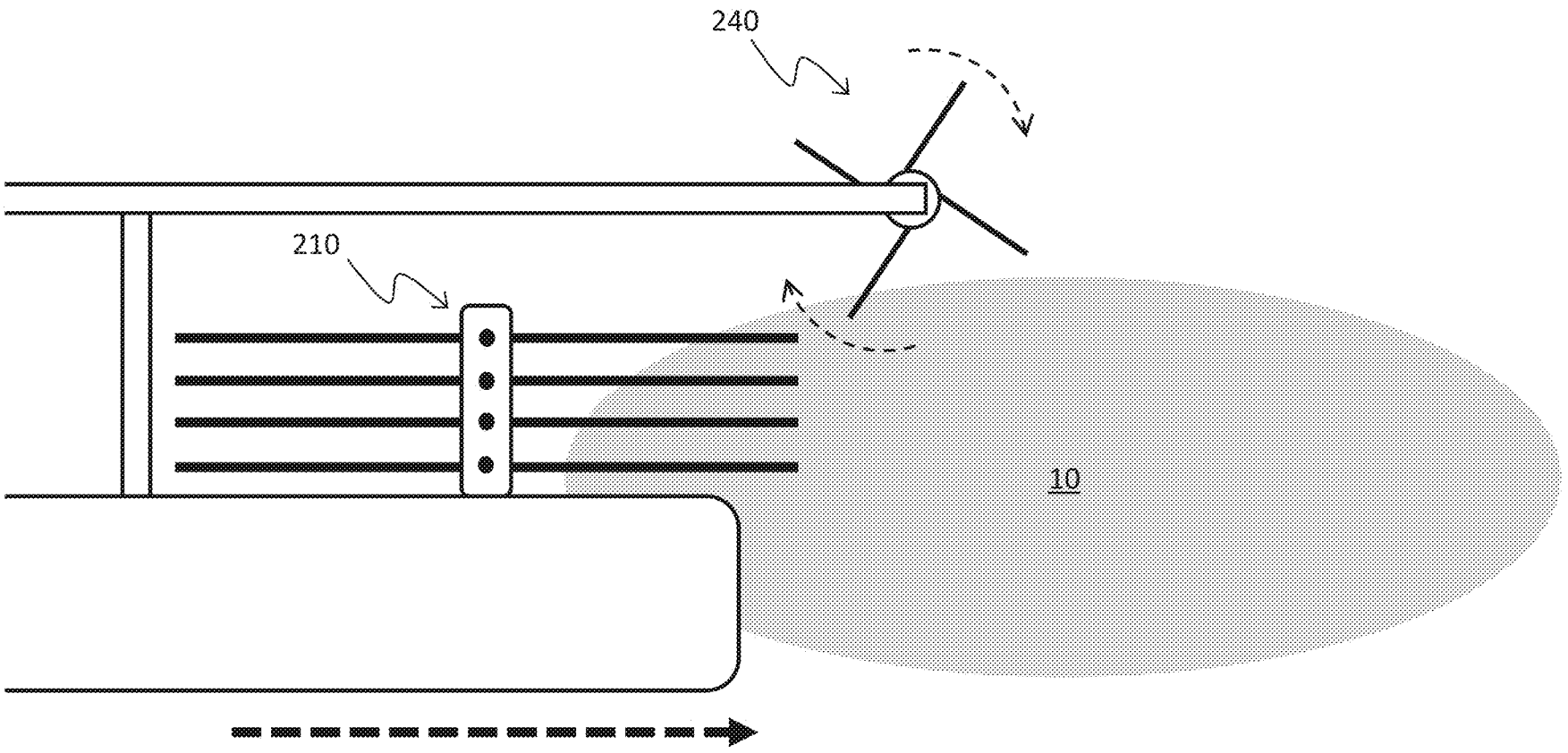
Figure 19C:
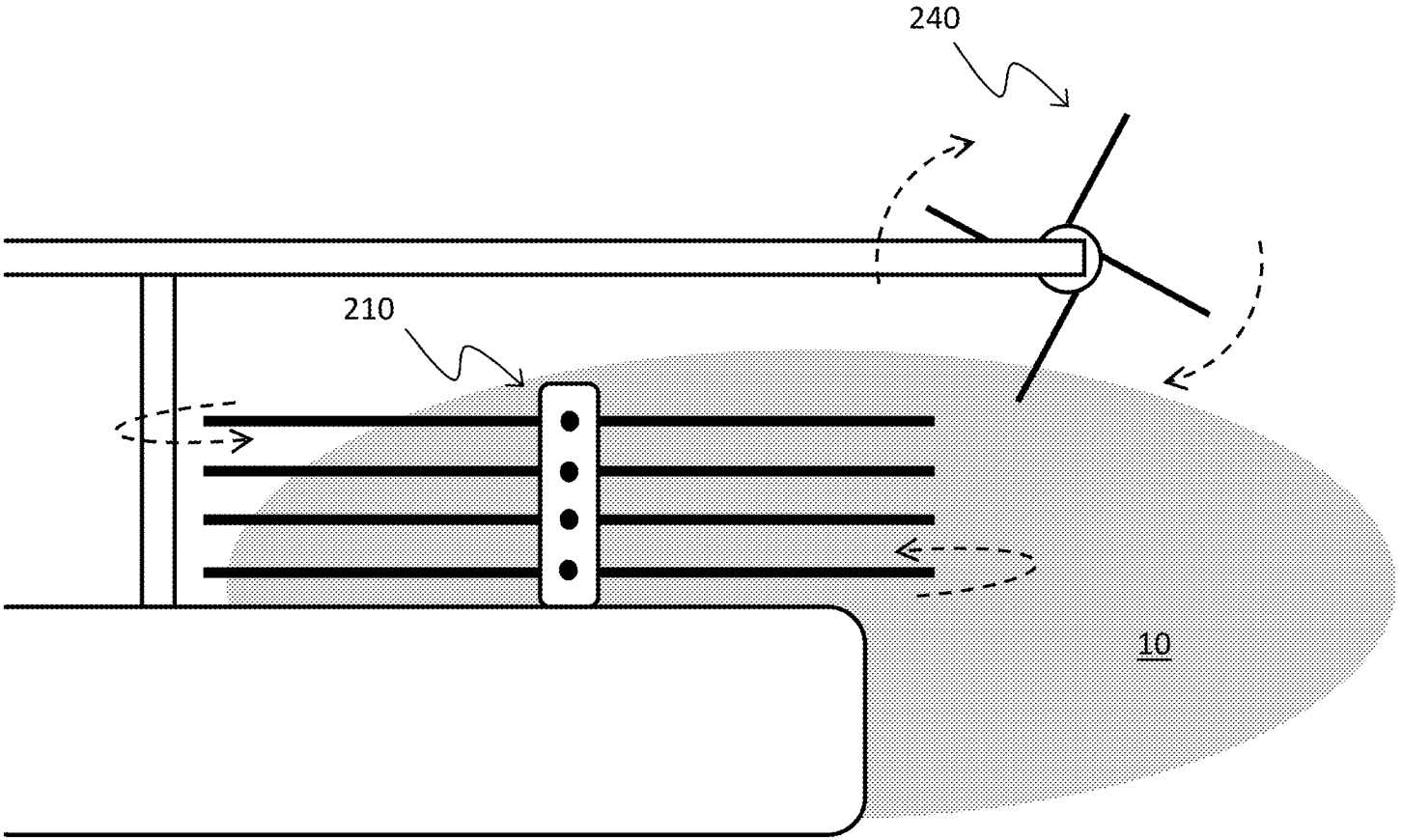

FIGS. 19A-19C depict the embodiment of FIGS. 18A-B being used to capture an object 10. Referring first to FIG. 19A, retrieval system 1000 is piloted towards object 10 until one or more feeder arms 242 contact object 10, as shown. Referring now to FIG. 19B, forward motion f retrieval system 1000 continues, causing feeder 240 to rotate rearwards while feeder arms 242 maintain contact with object 10. As feeder 240 rotates rearwards, the one or more feeder arms 242 in contact with object 10 become oriented in such a manner as to effectively apply rearward-directed reaction forces to object 10 in the event object 10 were to retreat (i.e., "snag" object 10). Referring now to FIG. 19C, forward motion of retrieval system 1000 continues until relative motion causes object 10 to reach the area immediately in front of capture members 210, where rearward-directed reaction forces imparted by feeder 240 help capture members 210 engage object 10 and pull it through gap 216 and into containment structure 140.

Figure 20A:
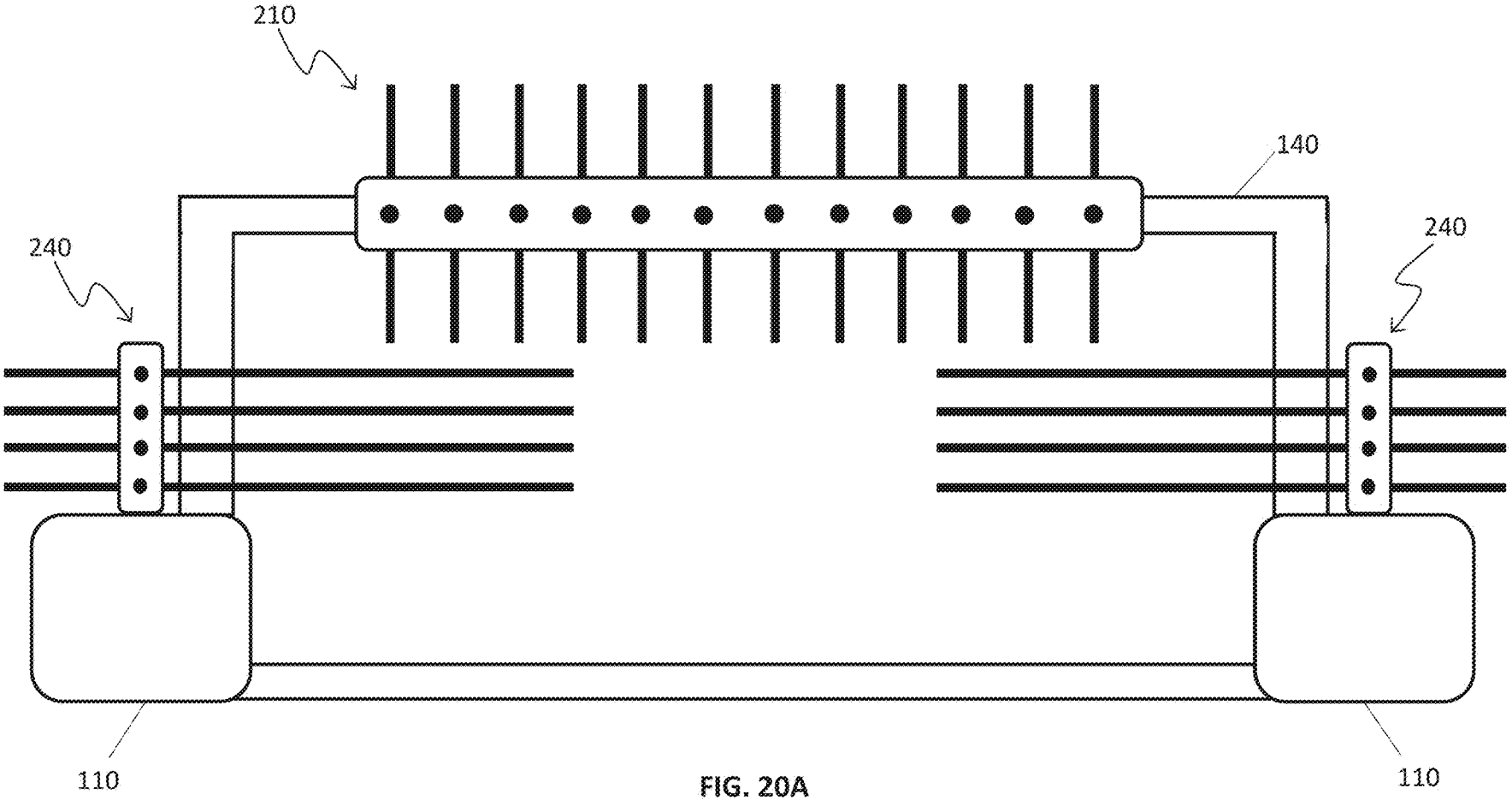
FIGS. 20A-20B illustrate front and side views of another embodiment of retrieval system 1000, shown here with two vertically-oriented feeders 240 for feeding object 10 into one horizontally-oriented rotating capture assembly 200, in accordance with an embodiment of the present disclosure.
Figure 20B:
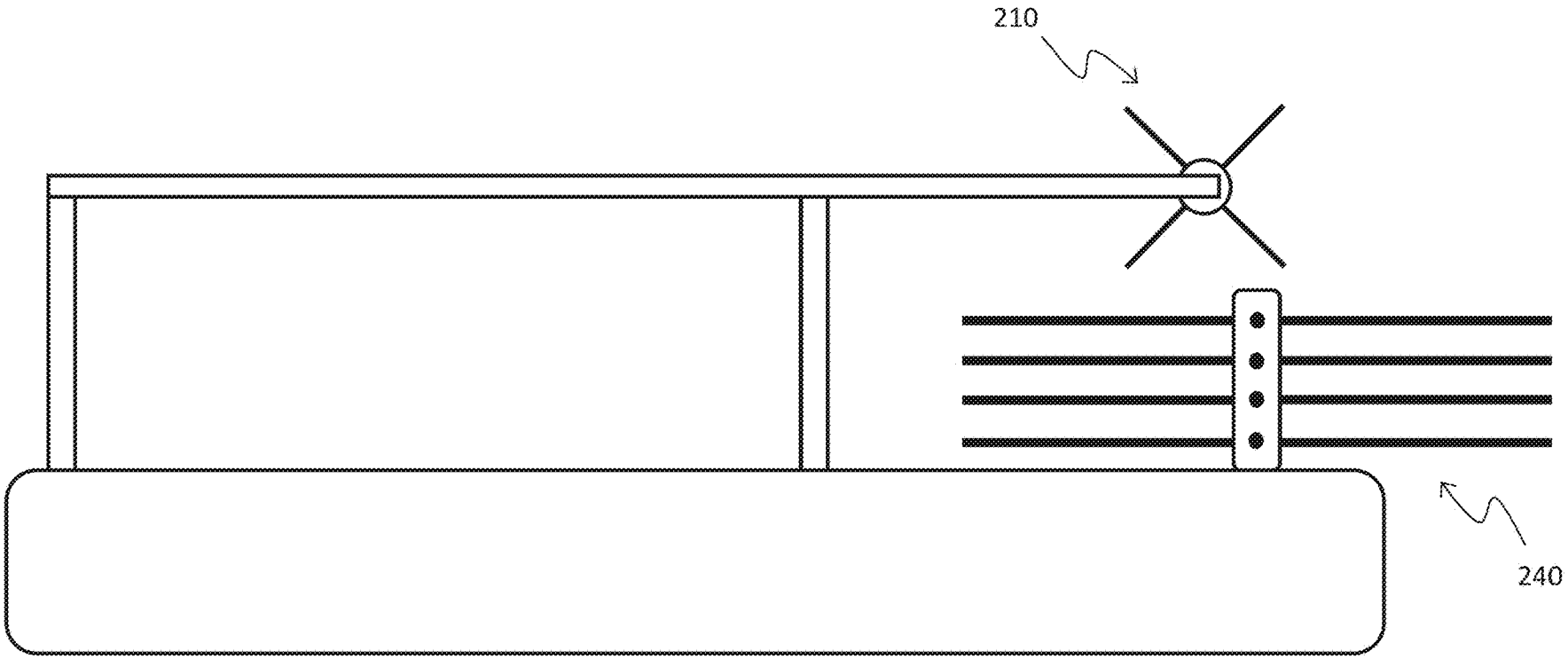
Figure 21C:
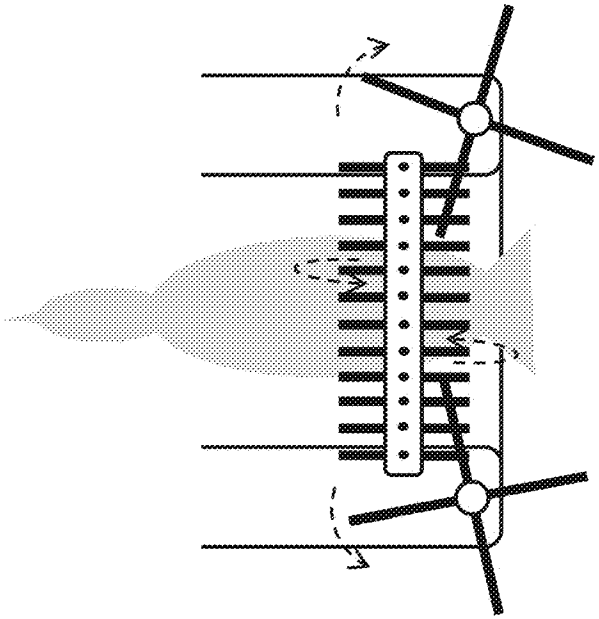
FIGS. 21A-21C depict the embodiment of FIGS. 20A-20B being used to capture an object 10, in accordance with an embodiment of the present disclosure, in accordance with an embodiment of the present disclosure.
Figure 21B:
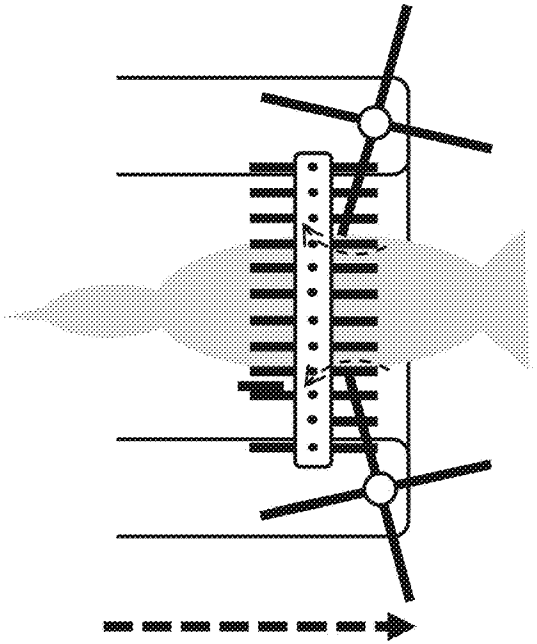
Figure 21A:
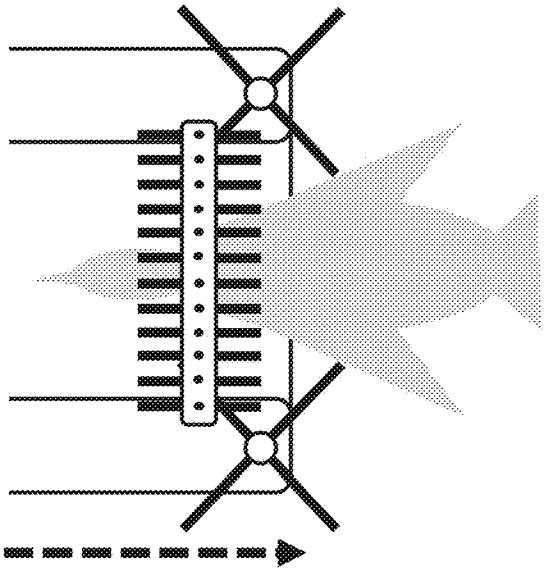

FIG. 20A and FIG. 20B illustrate front and side views of another embodiment of retrieval system 1000, shown here with two vertically-oriented feeders 240 for feeding object 10 into one horizontally-oriented rotating capture assembly 200. One having ordinary skill in the art will recognize the application of the design principles described in the context of FIGS. 18A and 18B, such as the positioning of feeders 240 forward of capture 210 and the provision of a gap through which object 10 can pass between the two feeders 240. Referring to FIGS. 21A-21C, the embodiment of FIGS. 20A-20B operates in a similar manner, with feeders 240 initially engaging object 10 and feeding it into capture 210 to be pulled through the gap and into the containment structure 140. One potential benefit of the present embodiment is that vertically-oriented feeders 240 may serve to center object 10 within the open front side 141 of containment structure 140 and thereby position object 10 near a center of capture member 210. This may improve the effectiveness of capture member 210 and potentially allow capture hub 244 to be shorter (i.e., shorter and centrally located rather than spanning the width between floatation members 110).

Notably, the embodiments of FIGS. 18A-18B and 20A-20B do not contain opposing horizontally-oriented feeders 240 or opposing horizontally-oriented capture members 210, respectively, unlike their opposing vertically-oriented counterparts. While a lower, opposing feeder 240 or capture member 210 could be utilized, the lower mechanism may be apt to collect vegetation such as floating weeds, increase hydrodynamic drag, and/or increase the draft of retrieval system 1000. Likewise, a lower mechanism may not be necessary to accomplish the functionality described. It should be noted that the upper member may in part push downwards on object 10 and the buoyancy of object 10 and/or lower containment element 160 may provide suitable upwards-directed reaction forces to allow the upper member to suitably engage object 10.

Spring-Loaded Capture Members 210

Figure 22B:
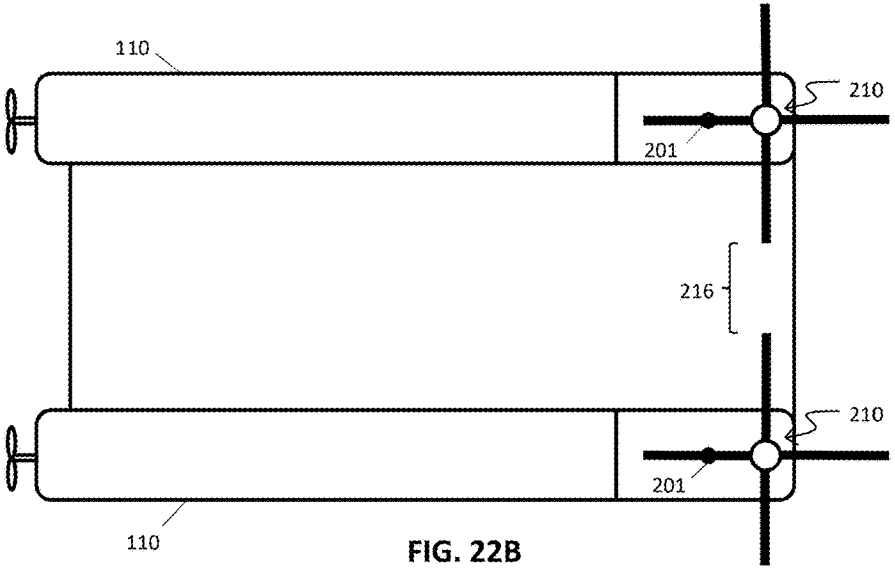
FIGS. 22A-22B depict an embodiment in which capture members 210 may be coupled to a spring-loaded arm 201 to allow each to move outwards from a neutral position (shown in FIG. 22A) to an extended position (shown in FIG. 22B) to accommodate objects wider than gap 216, in accordance with an embodiment of the present disclosure.
Figure 22A:
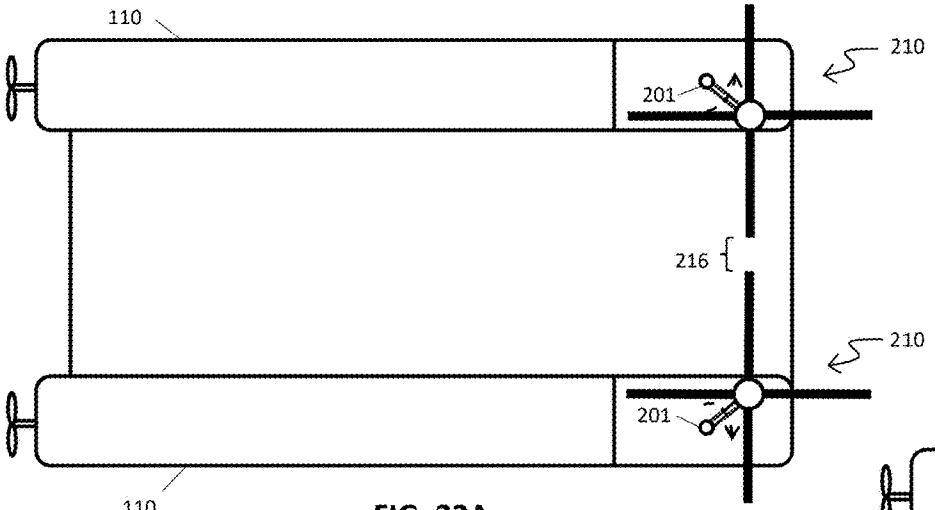

FIGS. 22A and 22B depict an embodiment in which capture members 210 may be coupled to a spring-loaded arm 201 to allow each to move outwards from a neutral position (shown in FIG. 22A) to an extended position (shown in FIG. 22B) to accommodate objects wider than gap 216. Additionally or alternatively, in an embodiment, feeder 240 may be coupled to a spring loaded arm (not shown) to allow feeder 240 to move upwards from a neutral position above the water's surface to an extended position higher above the water's surface. This feature is especially useful for capture members 210 and feeders 240 having rigid arms 212, 242, respectively, and/or a small gap 216, since object 10 may otherwise not be able to pass therebetween. One having ordinary skill in the art will recognize without undue experimentation spring constants that are suitable for accommodating passage of object 10 while simultaneously applying enough inward force on object 10 to engage it in the manners described herein.

It should be recognized that embodiments of the present disclosure are often designed to minimize complexity, and thereby increase reliability and reduce cost. Rotating elements are relatively simple to manufacture and operate, and are unlikely to break or freeze up in icy conditions. Further, rotating elements are constantly in "capture" mode, meaning they do not need to be reset or repositioned for subsequent attempts to capture an elusive object 10. Contrast these with claws, scoops, or other complex mechanisms one might seek to use to grab objects 10. Such mechanisms tend to have more moving parts, cost more, and in many cases may need to be reset or repositioned for subsequent attempts to capture object 10. All of these features may be uniquely desirable for operators, especially in a waterfowl hunting context where icing conditions are common, wetness degrades reliability, and easy and fast capture is preferred so that hunters are not distracted when the next flight of waterfowl approaches.

Modular Floatation Members 110

Figure 23A:
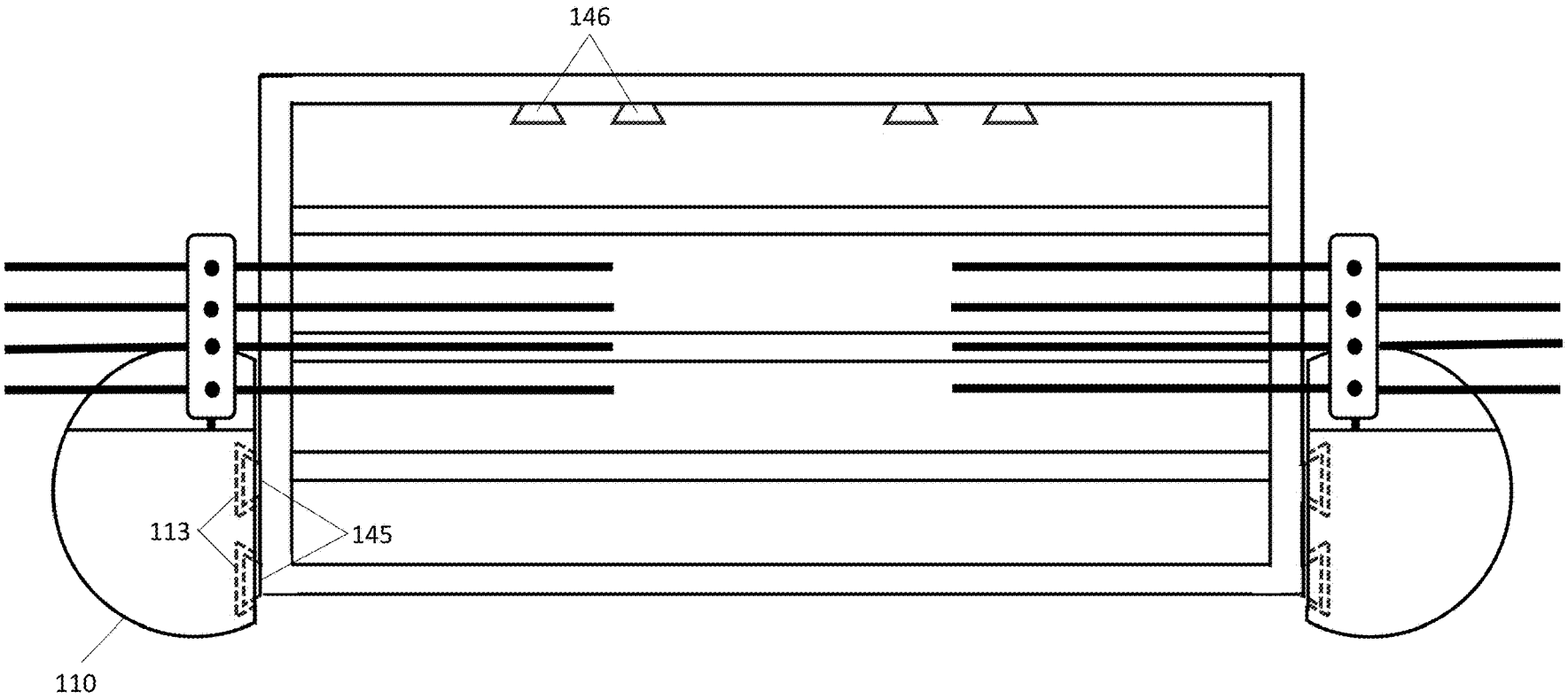
FIGS. 23A-23G illustrate various views of another embodiment in which floatation members 110 can be easily attached and removed from containment structure 140, in accordance with an embodiment of the present disclosure.
Figure 23B:
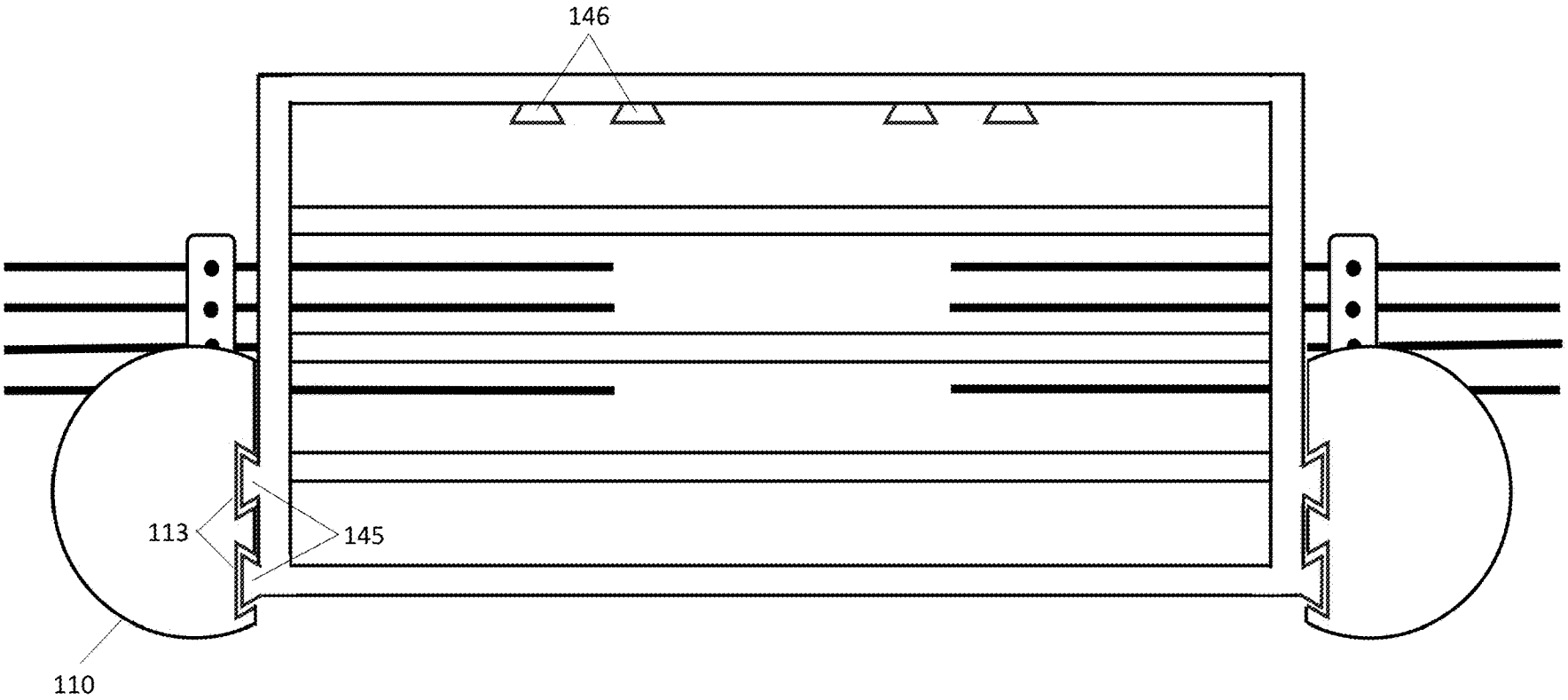
Figure 23C:
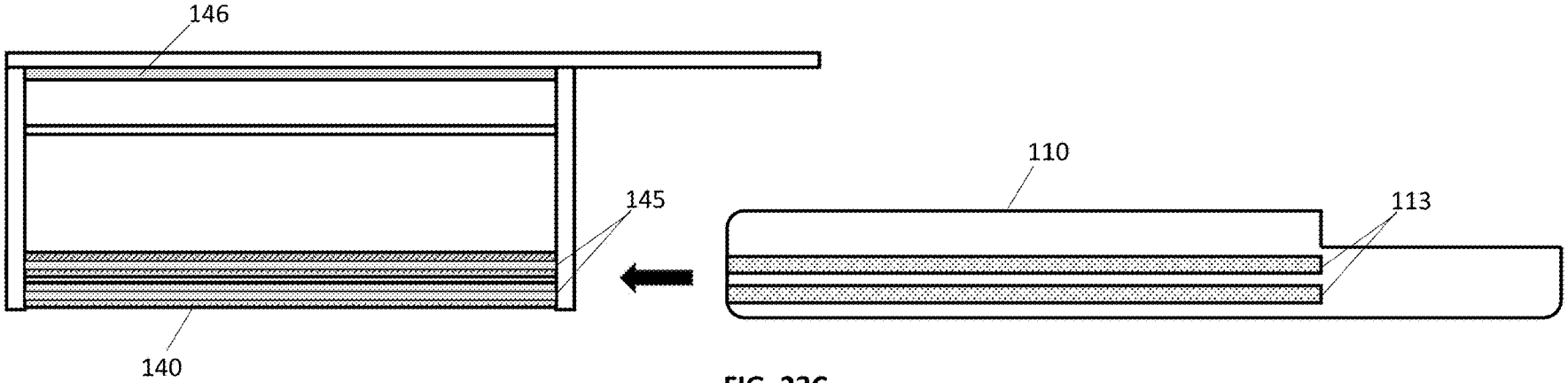
Figure 23D:
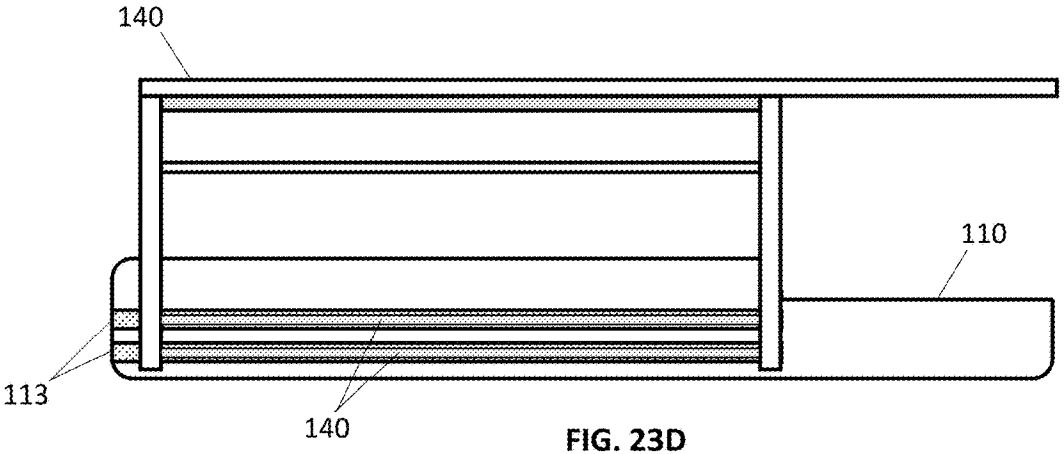
Figure 23E:
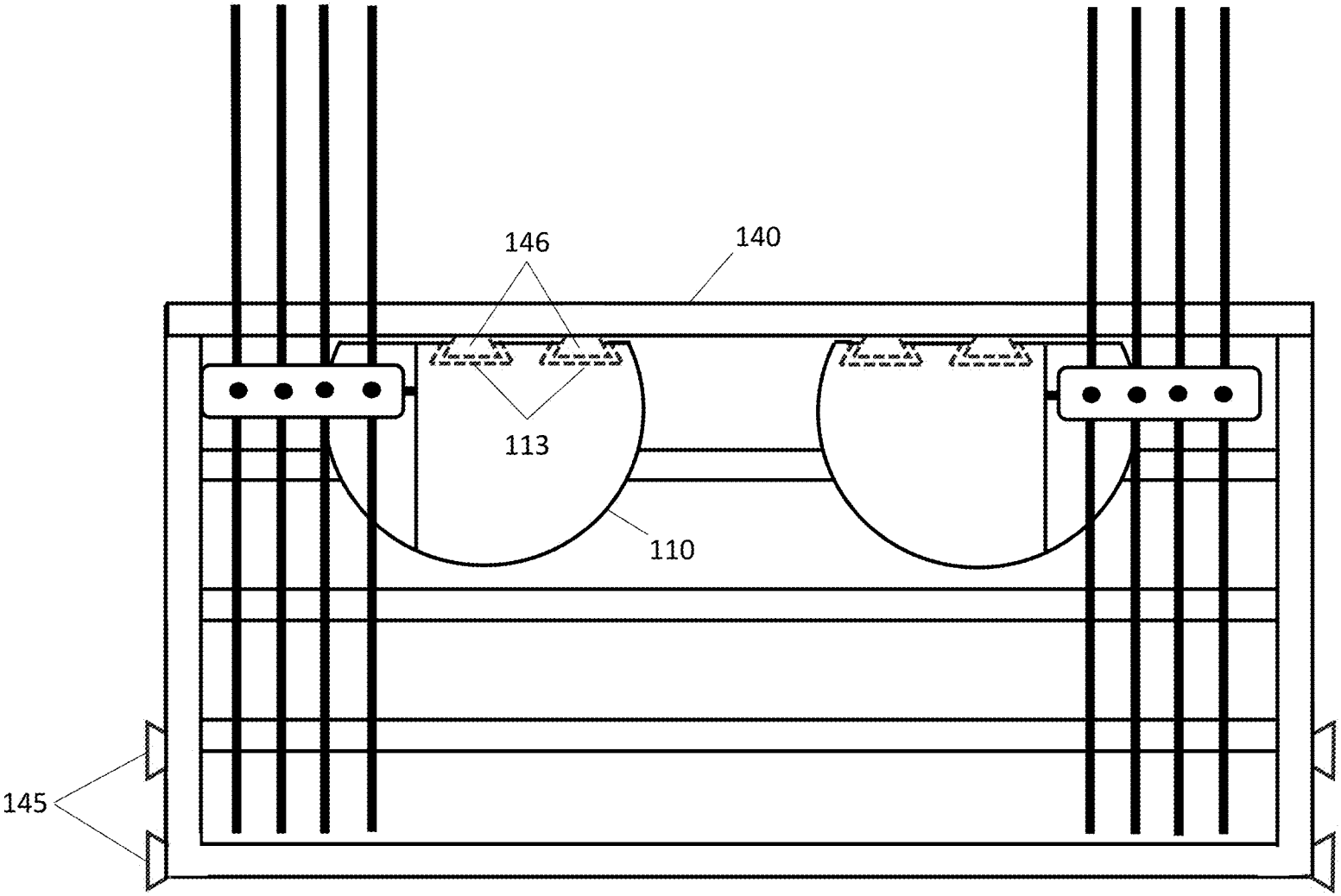
Figure 23F:
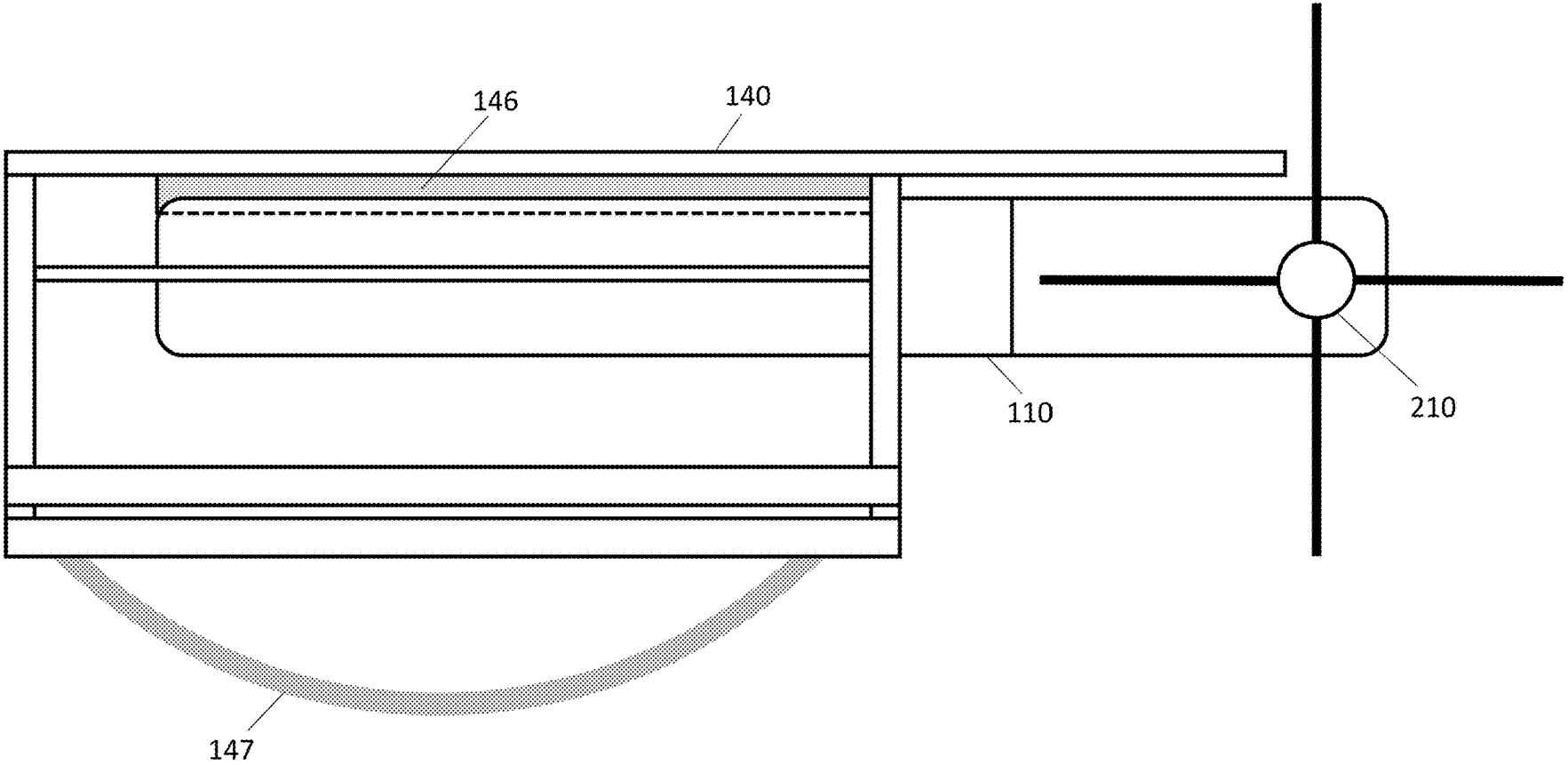
Figure 23G:
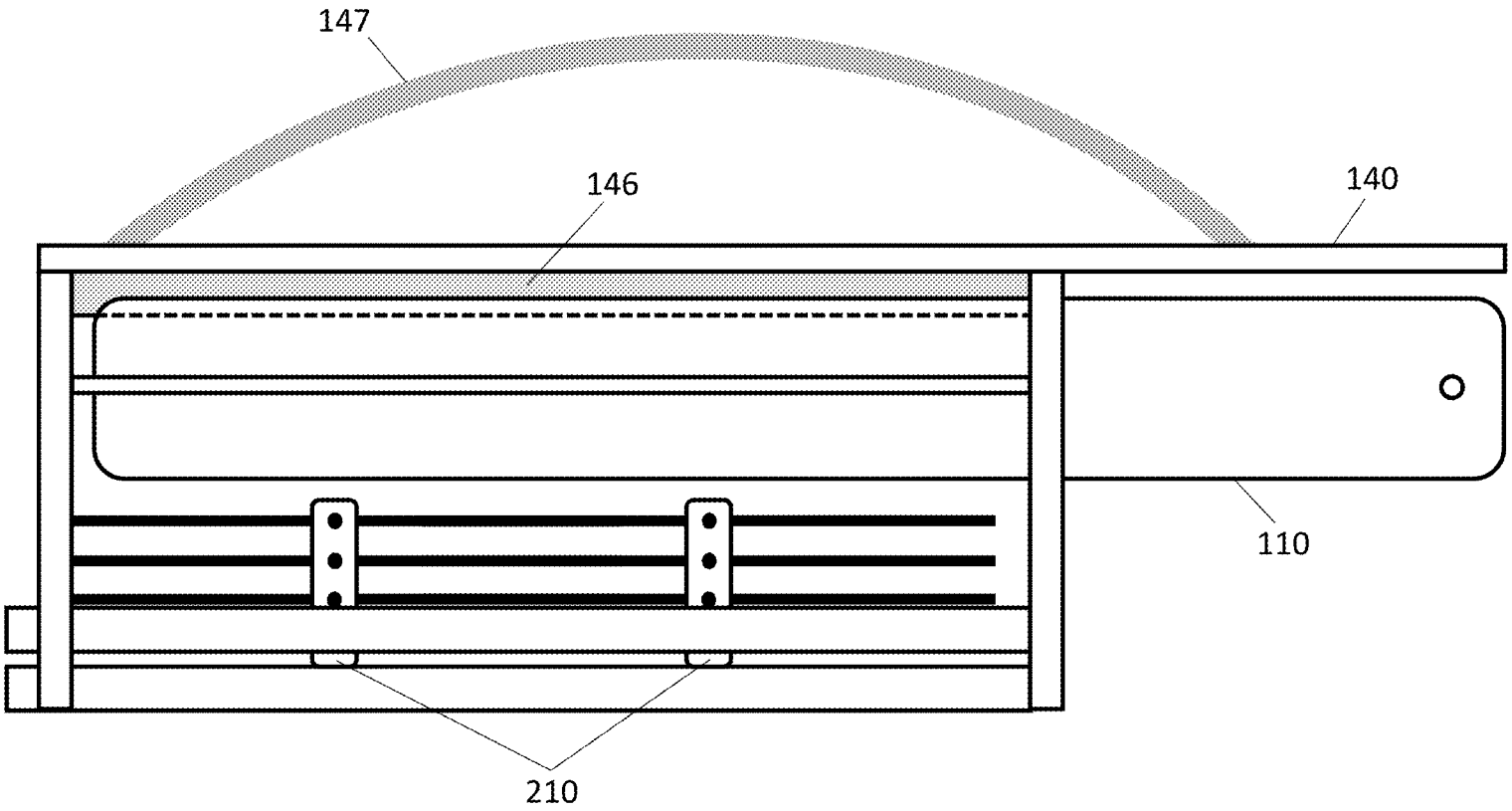

FIGS. 23A-23G illustrate various views of another embodiment in which floatation members 110 can be easily attached and removed from containment structure 140. FIG. 23A and FIG. 23B shown front and rear views of the system 1000 as assembled, FIG. 23C and FIG. 23D show side views of a process for attaching floatation members 110 to containment structure 140, and FIG. 23E-23G show floatation members 110 removed and stowed within containment structure 140 for easy transport.

Referring first to FIG. 23A-23D, containment structure 140, in various embodiments, may comprise one or more rails 145 to which floatation members 110 attach during assembly of the system 1000. In the embodiment shown, two rails 145 are positioned on each side of containment structure 140, where they extend outwards and run along a lower portion of containment structure 140. Each floatation member 110, in various embodiments, may include one or more complementary channels 113 sized to accommodate rails 145 therein. In the embodiment shown, a rear portion of each channel 113 is open such that floatation members 110 can be positioned forward of containment structure 140 and slid onto rails 145 in a rearward direction, as shown in FIG. 23C, thereby securing floatation members 110 to containment structure 140. For disassembly, floatation members 110 can be slid in a forward direction until off of rails 145.

Referring now to FIG. 23E-23G, containment structure 140, in various embodiments, may further comprise one or more rails 146 to which floatation members 110 attach for disassembly and stowage. In the embodiment shown, four rails 146 run along the upper portion of containment structure 140 and extend inwards towards cargo area 160.

It should be noted that embodiments of retrieval system 1000 and deployment system 2000 not having capture assemblies 200 can still utilize the modular hull constructions described herein. Rails 146, in various embodiments, may have the same size and shape as rails 145 such that floatation members 110 can be slid onto rails 146 via channels 113 for stowage, much like floatation members 110 can be slide onto rails 145 during assembly. As configured, floatation members 110 can be removed from the outside of containment structure 140 during disassembly and securely stowed within containment structure 140. This reduces the overall footprint of the system 1000, making storage and transport easier. This also helps protect floatation members 110 (and components thereof, such as propellers 182) from damage since they are largely stowed within and protected by containment structure 140 when not in use. FIG. 23E and FIG. 23F show front and side views of floatation members 110 stowed within containment structure 140 as described, with capture members 210 still attached to each floatation member. As configured, capture members 210 are oriented such that their respective capture arms 212 are parallel to and offset from one another, so that they do not interfere with one another during stowage. In an embodiment, strap(s) 147 (e.g., backpack straps) can be clipped onto mounting points on the lower section of containment structure 140 to facilitate transport. As shown, capture members 210 may protrude beyond the upper section of containment structure 140 but not (or considerably less) beyond the lower section of containment structure 140, so attaching the strap(s) 147 on the lower section of containment structure 140 may keep capture member 140 from contacting the user's neck or head when carried on his or her back. Of course, in another embodiment (not shown), rails 146 could instead run along the lower portion of containment structure 140 and extend inwards towards cargo area 160, such that floatation members 110 attach to the floor rather than the roof. In such an embodiment, strap(s) 147 may be clipped onto mounting points on the upper section of containment structure 140. FIG. 23G shows a side view of another embodiment in which capture members 210 have been removed and placed into containment structure 140 for stowage. Removing capture members 210 and securing floatation members 110 to the roof within cargo area 160 may be preferred, as now strap(s) 147 can be clipped onto the upper section of containment structure 140 and floatation members thereby positioned closer to the user's back for better load balancing. Further, removing capture members 210 can serve to protect them during storage and transport. Also, placing the top of containment structure 140 against the user's back may be preferred as it is less likely to be wet or covered in water weeds.

Retractable Propeller System

FIG. 24A-24B and FIG. 25A-25C illustrate an embodiment of a retractable propeller system for use on systems 1000, 2000. The retractable propeller system, in various embodiments, may allow for propeller 182 to be retracted within a recess 111 in floatation member 110 when not in use. Retracting propeller 182 in this manner may help protect propeller 182 and other components of powertrain 180 (e.g., drive shaft 183) from damage during storage and transport. Likewise, to the extent propeller 182 extends beyond the bottom of floatation members 110 when extended, being able to retract propeller 182 may allow for systems 1000, 2000 to sit flush on the ground when set down, rather than having its rear end elevated to accommodate the protruding propellers. Additionally or alternatively, retrieval system 1000 and deployment system 2000 may be equipped with a "kickstand" to elevate the rear end off the ground such that propellers 182 do not contact the ground, thereby avoiding damage.

Figure 24A:
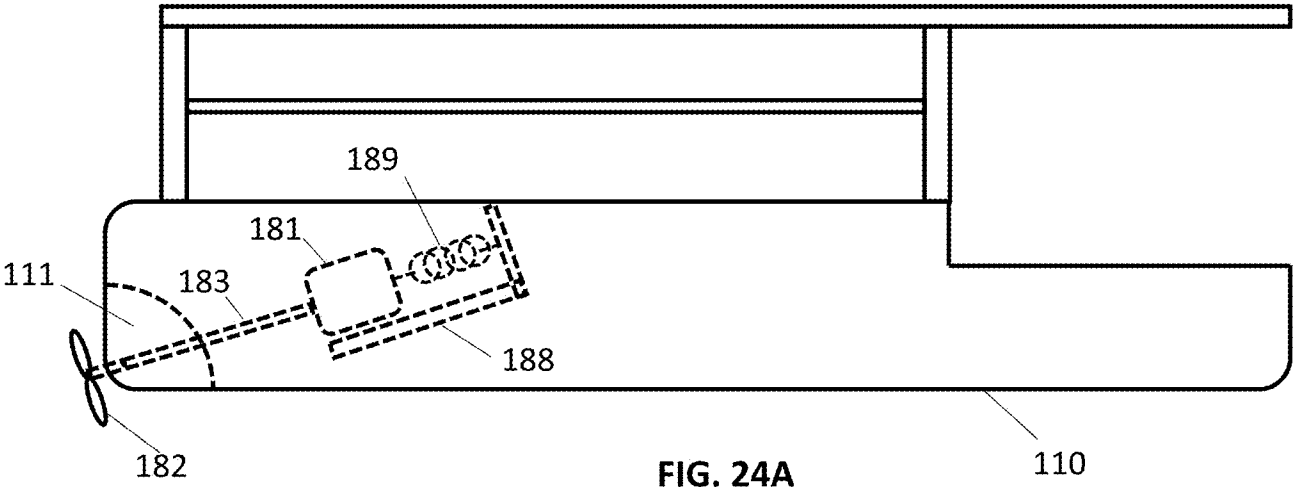
FIGS. 24A-25C illustrate an embodiment of a retractable propeller system for use on watercraft 100, in accordance with an embodiment of the present disclosure.
Figure 24B:
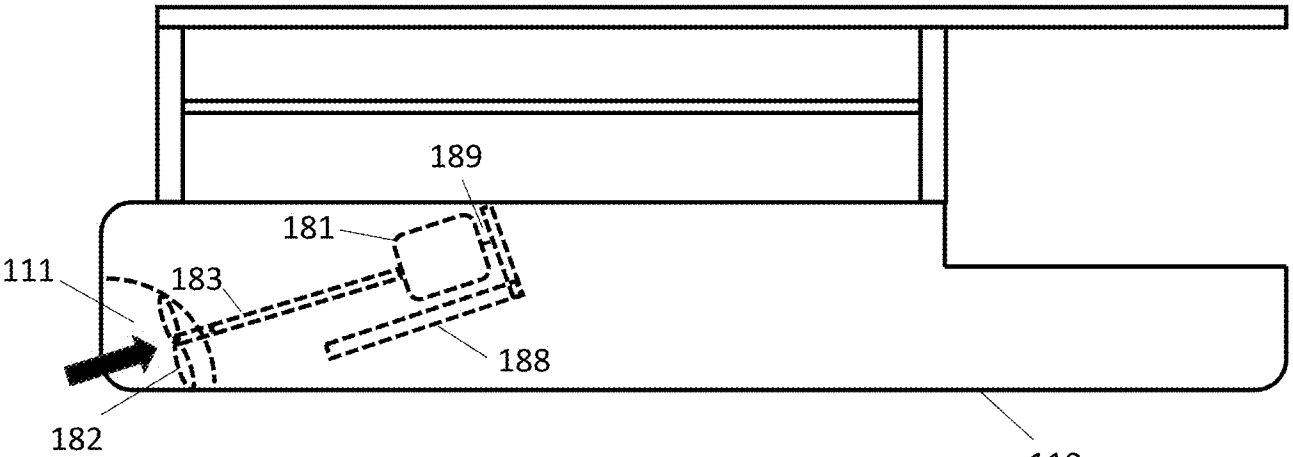

FIG. 24A depicts propeller 182 in an extended position and FIG. 24B depicts propeller 182 in a retracted position. In the embodiment shown, propeller 182 is coupled to drive shaft 183 which in turn is coupled to motor 181, and motor 181 is slidably coupled to a rail 188. Motor 181, in various embodiments, may be moved rearwards to extend propeller 182 to the extended position and moved forwards to retract propeller 182 to the retracted position.

Any number of suitable mechanisms may be selectively employed to move motor 181 between these two positions on rail 188 as desired by the user. For example, in various embodiments, a spring 189 may bias motor 181 rearwards on rail 188 such that propeller 182 is, in turn, biased toward the extended position. During operation, motor 181 may be retained in this position in several ways. In one embodiment, spring 189 may be configured with a spring force greater than the thrust generated by propeller 182, such that propeller 182 does not retract in response to corresponding reaction forces when systems 1000, 2000 are motoring on the water. In another embodiment, a mechanism may be selectively engaged to retain motor 181 in this rearward position during operation. For example, a spring-loaded hook 190 similar to that shown and described in FIGS. 25A-25C (but oriented forward rather than rearward) may be mounted to rail 188 and positioned such that the hook extends into a hole motor 181 at the rearward position.

Figure 25C:
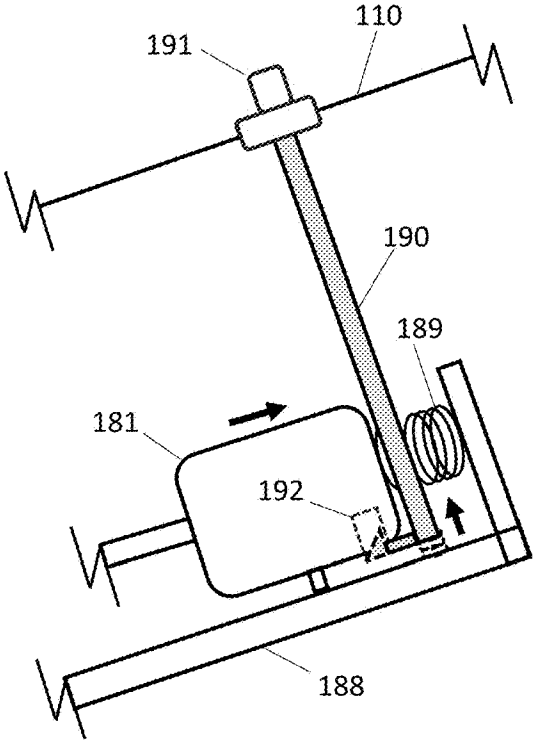
Figure 25B:
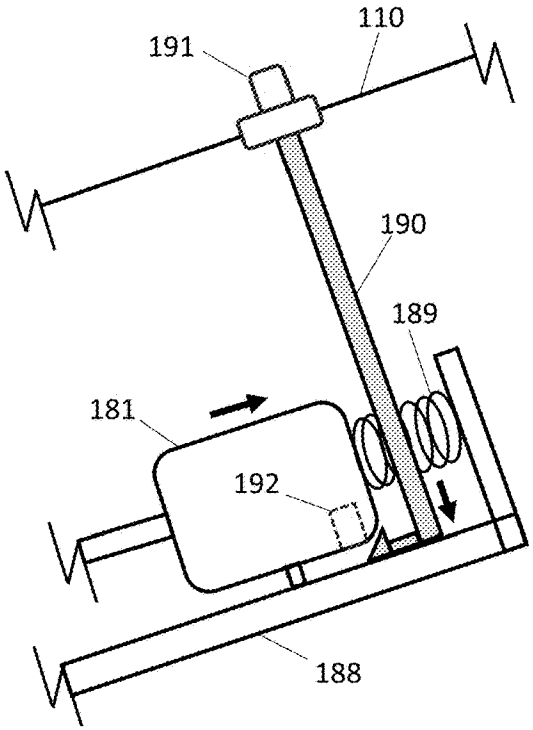
Figure 25A:
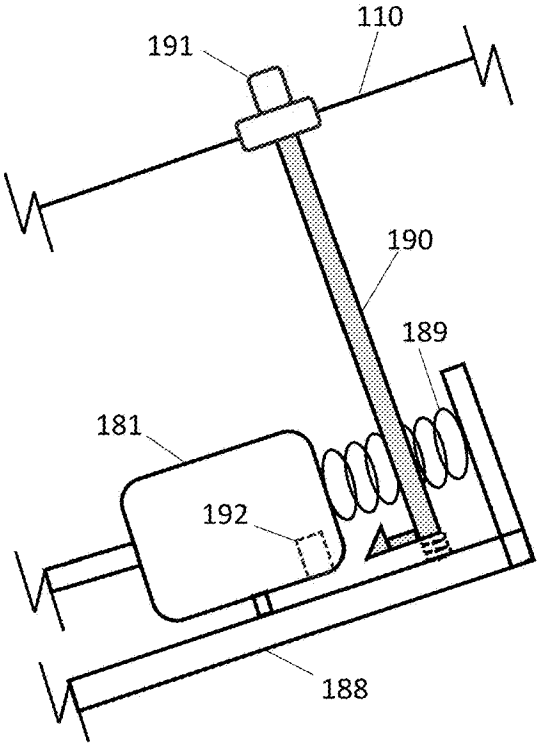
Figure 26A:
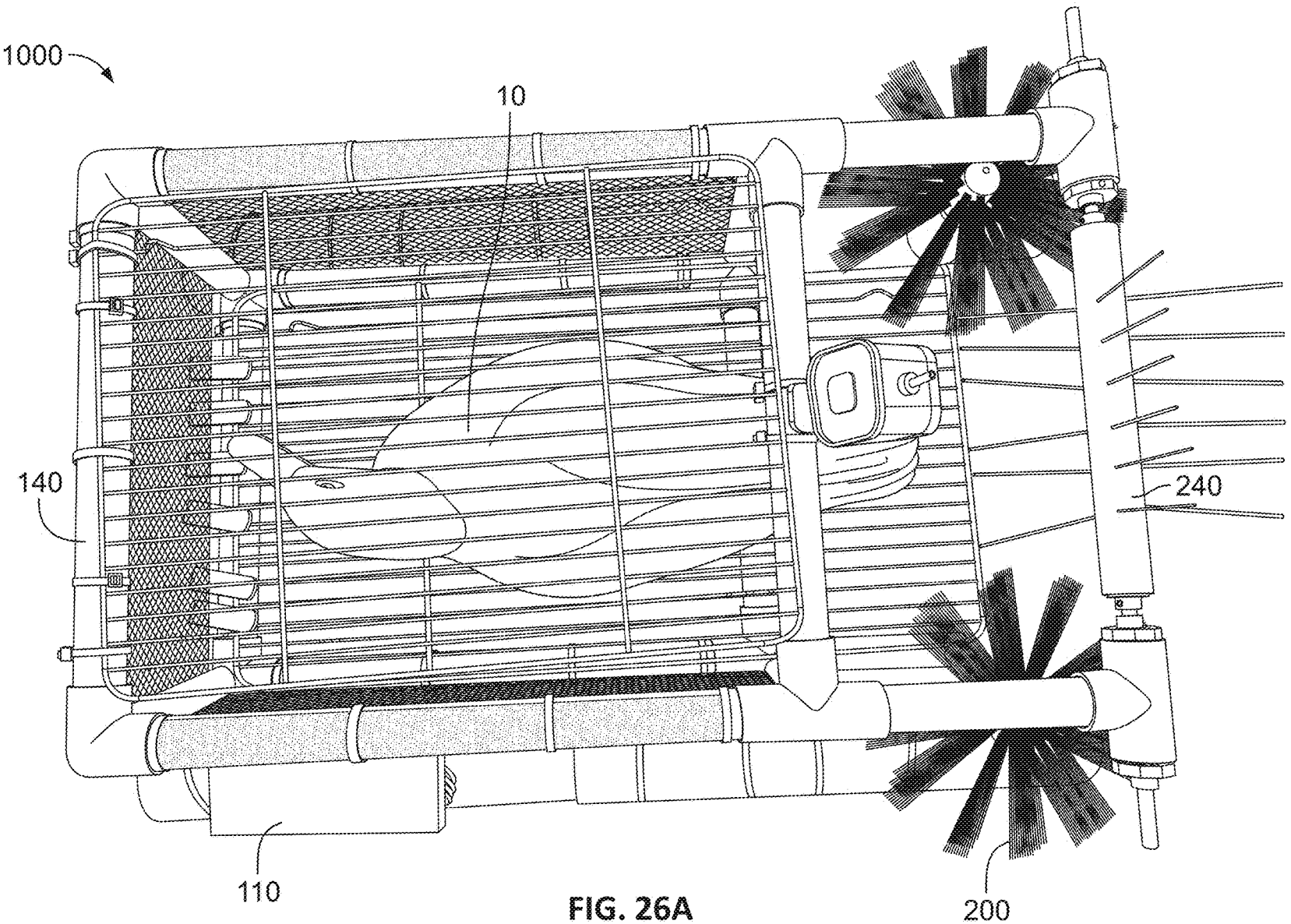
FIGS. 26A-26G show various views of a prototype of system 1000 built for testing and technology demonstration purposes, in accordance with an embodiment of the present disclosure.
Figure 26B:
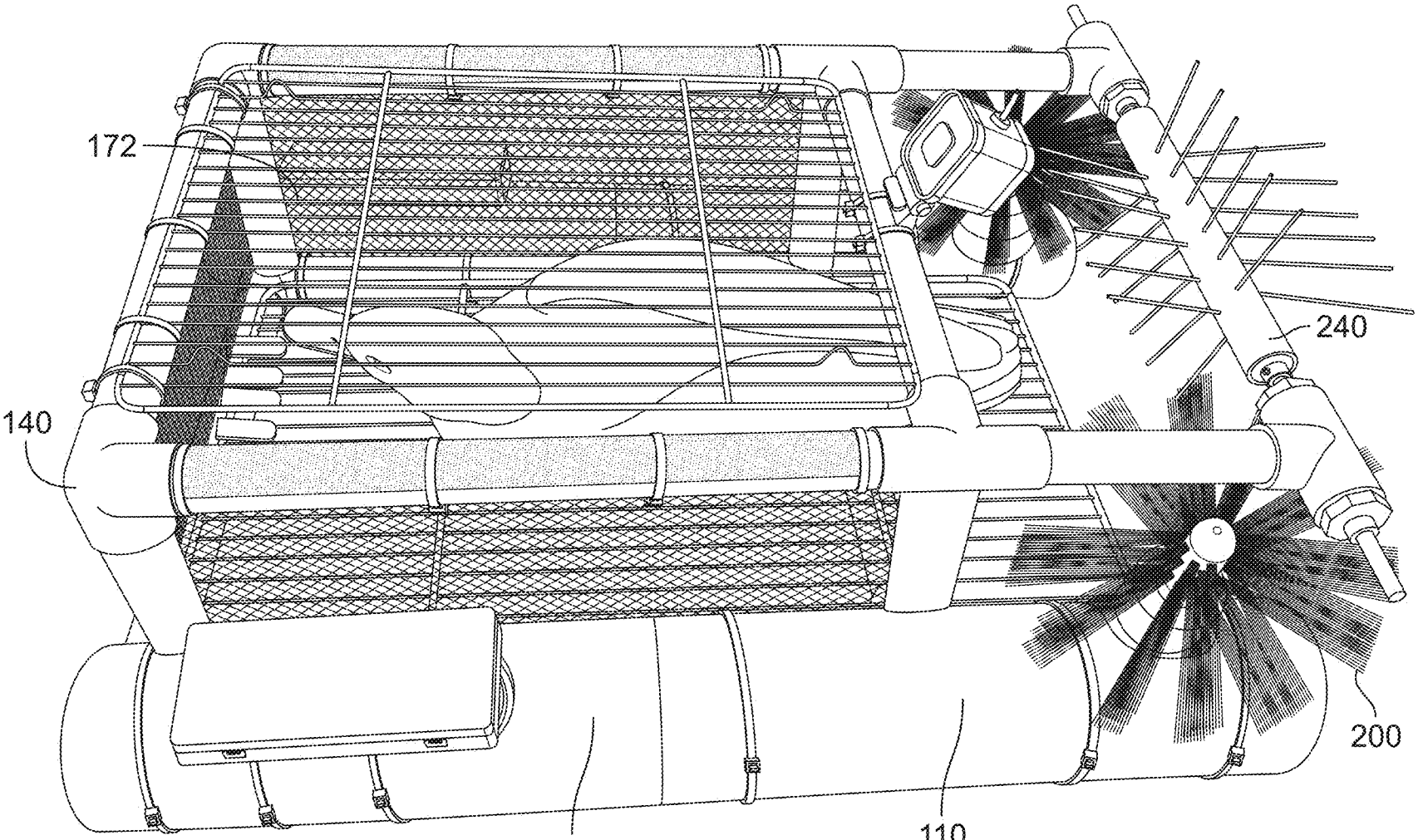
Figure 26C:
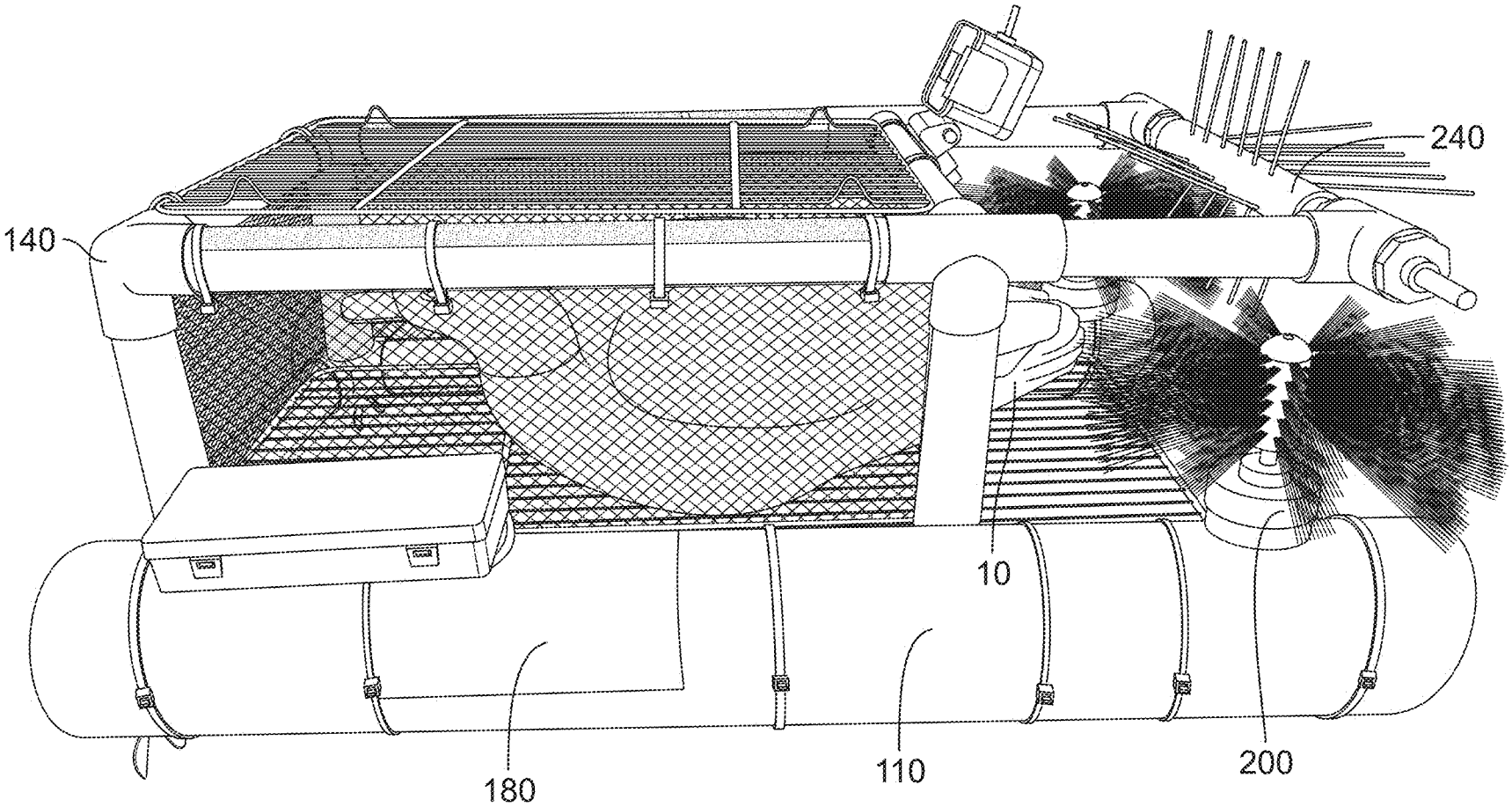
Figure 26D:
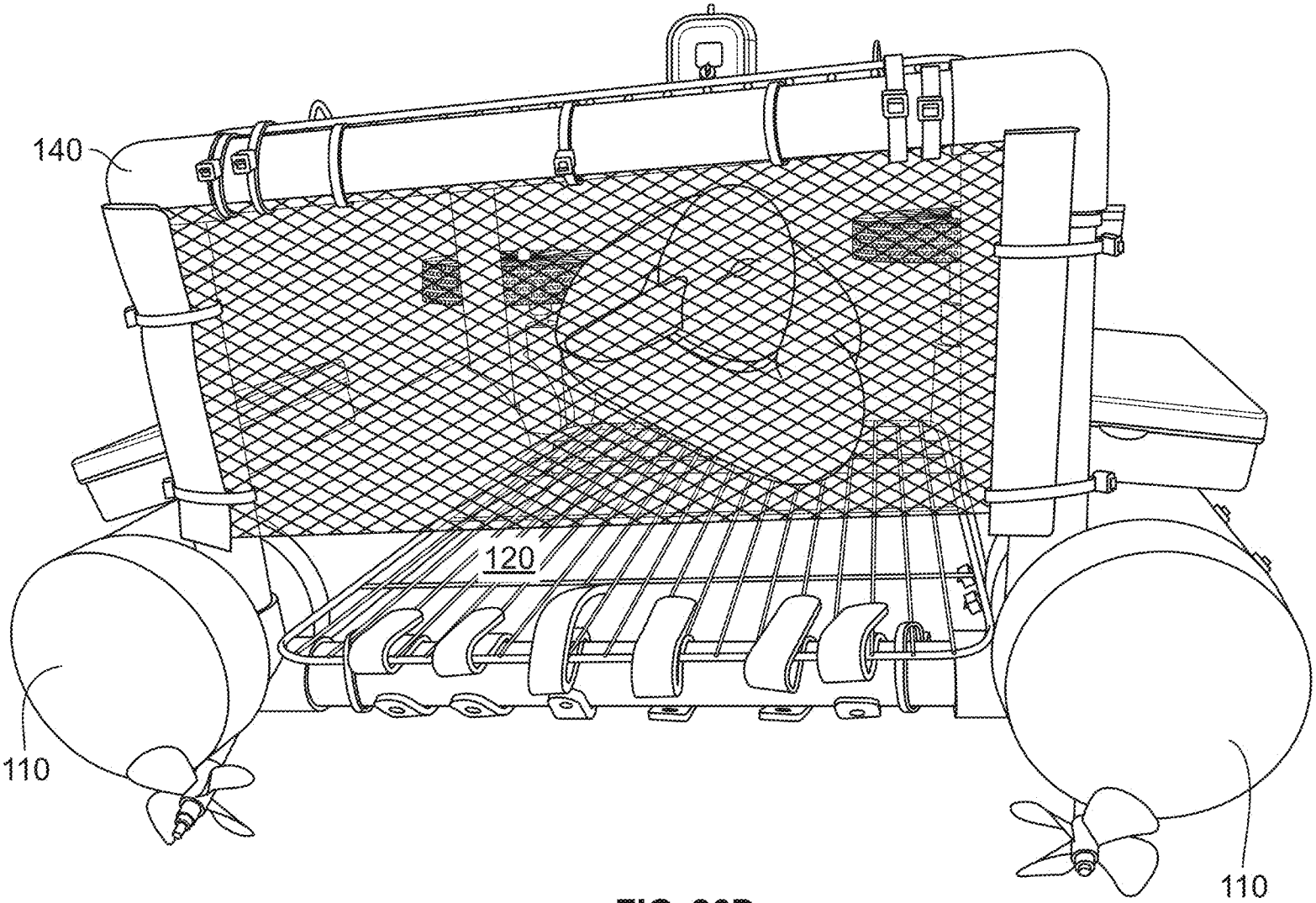
Figure 26E:
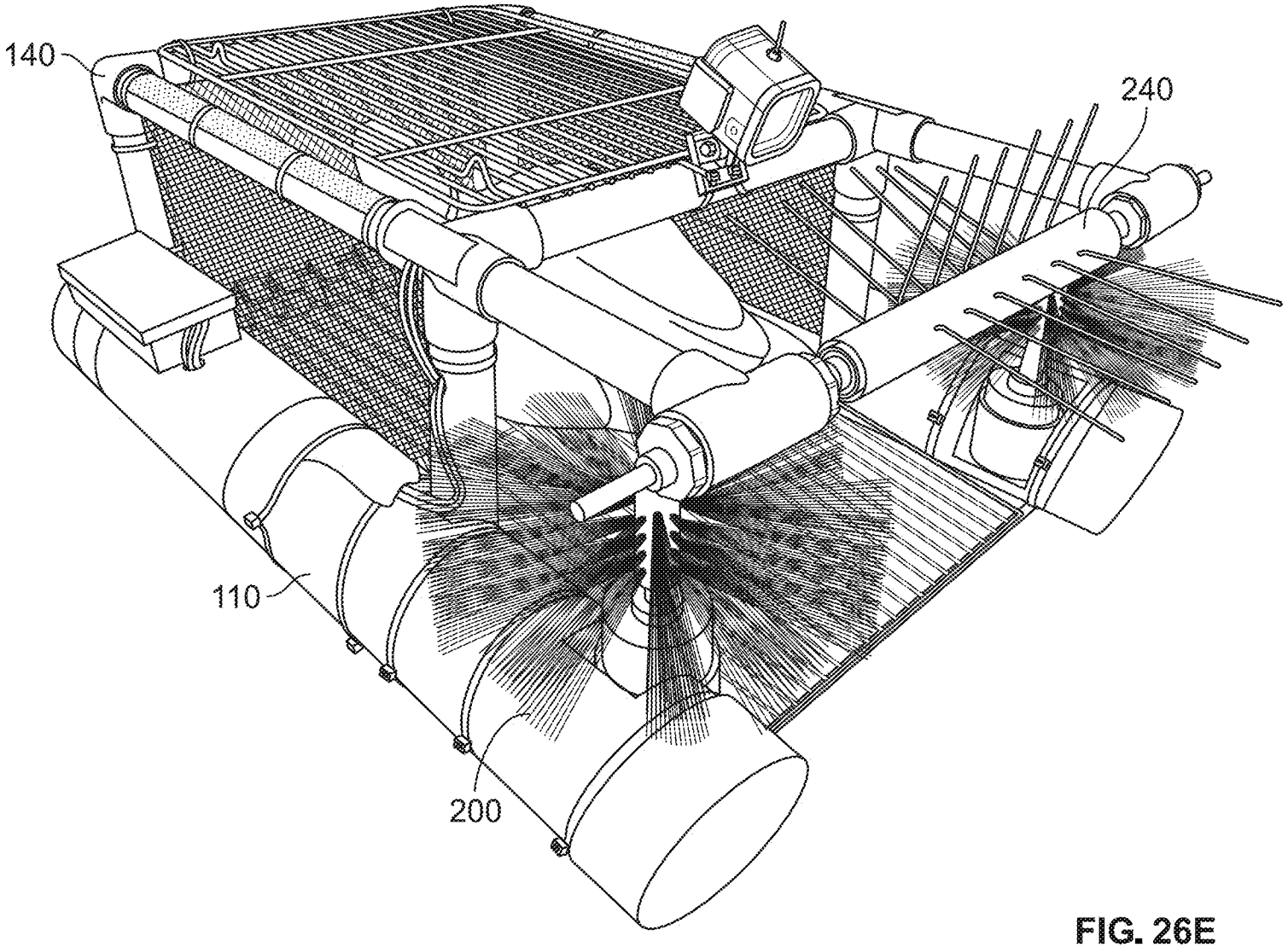
Figure 26F:
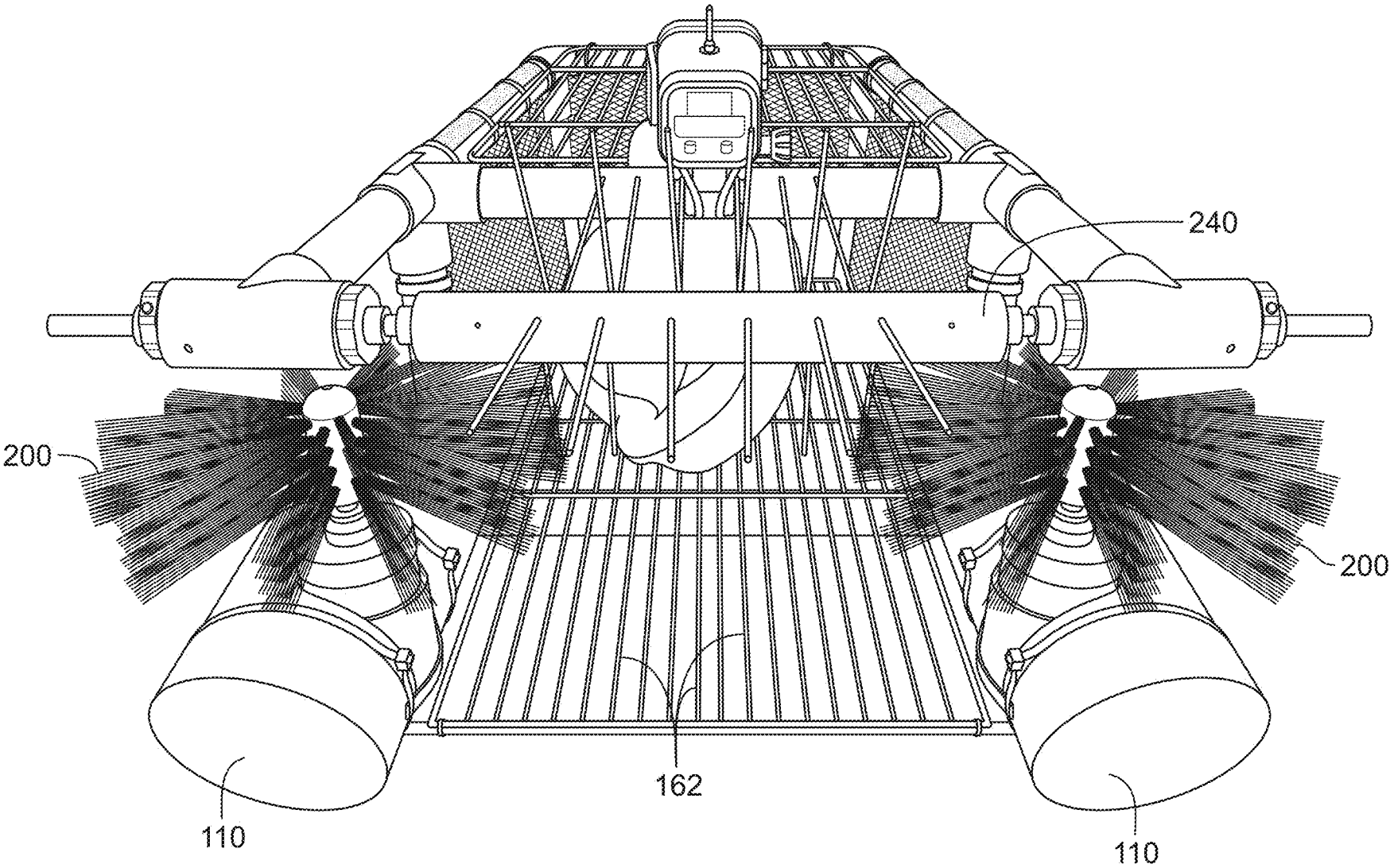
Figure 26G:
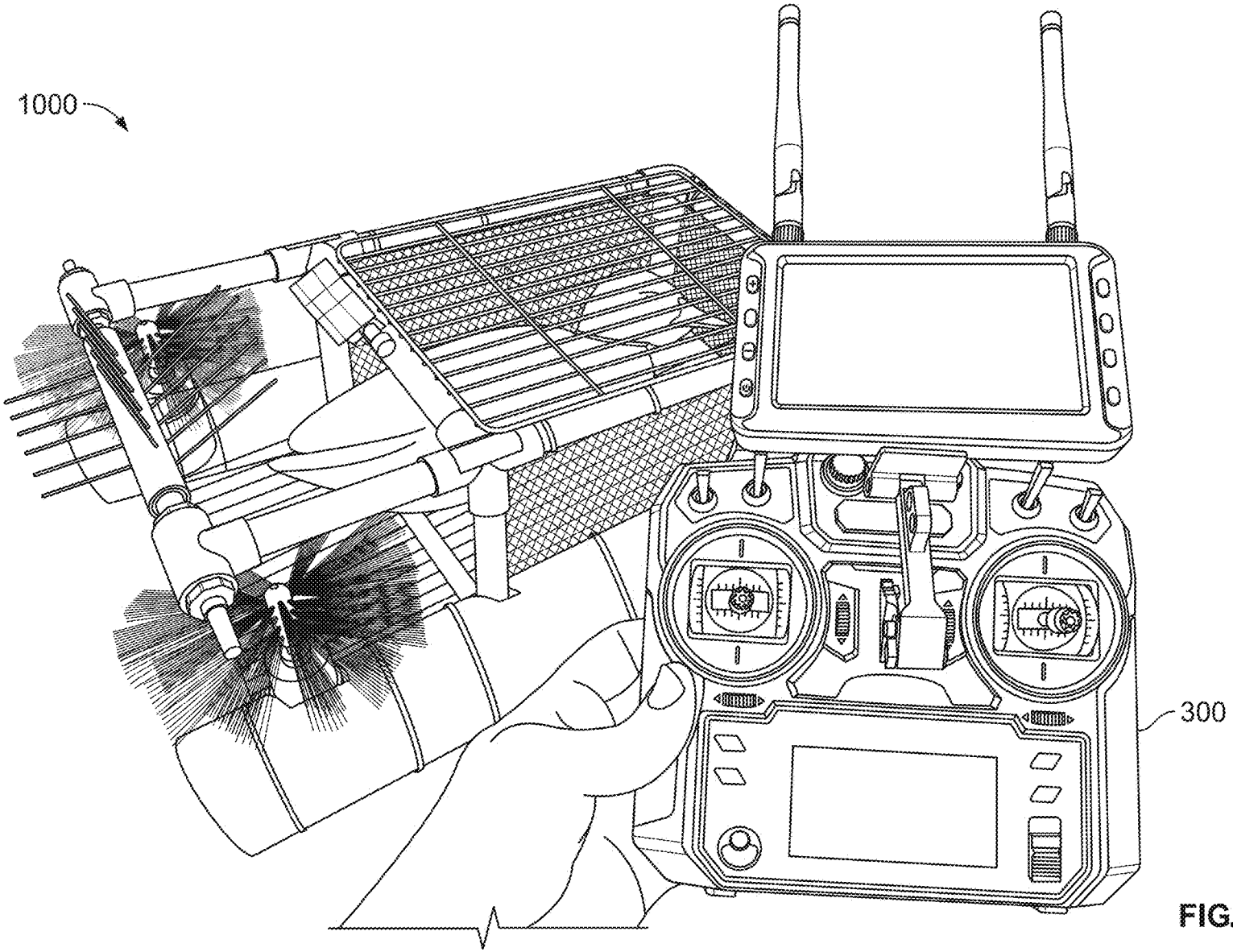

When not in operation, the user may disengage the mechanism (if equipped) and simply press forward on propeller 182 with sufficient force to overcome the force of spring 189 to move motor 181 to a forward position on rail 188. With reference to FIGS. 25A-25C, spring-loaded hook mechanism 190 may be selectively engaged to retain motor 181 in this forward position. In an embodiment, motor 181 may comprise a cavity 192 into which the spring-loaded hook 190 extends when motor 181 is in the forward position on rail 188. FIG. 25A shows motor 181 situated just aft of the forward position on rail 188. In FIG. 25B, motor 181 continues to move forward on rail 188, at which point motor 181 contacts a sloped portion of spring-loaded hook 190, causing spring-loaded hook 190 to move downwards. In FIG. 25C, motor 181 moves fully into the forward position on rail 188, allowing the hook 190 to spring upwards into cavity 192 and thereby secure motor 181 in place. In an embodiment, the mechanism(s) 190 can be mechanically disengaged by pressing a button 191 or other release positioned on an outer surface of floatation member 110 such that the user need not open a hatch to access the inside of floatation member 110 where powertrain is largely situated.

FPV Camera 400

Retrieval system 1000 and deployment system 2000, in various embodiments, may further include one or more cameras 400 (later shown in FIGS. 25A-25B). In various embodiments, camera 400 may be positioned to provide a first-person view to help a user pilot and operate systems 1000, 2000 via streaming the camera feed to a display on transmitter 300 or the user's mobile device. For example, camera 400 could help a user align retrieval system 1000 to properly intake object 10 and to navigate around obstacles in the water, such as stumps, vegetation, waterfowl decoys, etc.

Prototype of System 1000 with Capture Assemblies 200

FIGS. 26A-26G show various views of a prototype of system 1000 built for testing and technology demonstration purposes. These views are a top view, side perspective view, side view, rear view, isometric view, and front view, along with a view of transmitter 300, respectively. The main frame of containment structure 140 is made from ¾" PVC pipe and the sides and back of containment structure 140 are enclosed by wire mesh panels to keep object 10 from escaping. The floor and roof of containment structure 140 comprise multiple longitudinal frame members 162, 172, respectively, which are improvised here using baking cooling racks. The small diameter of the members 162, 172, and the large spacing between them, minimizes hydrodynamic and aerodynamic drag, respectively, yet such spacing is small enough to prevent a duck-sized object 10 from escaping therebetween. The roof is hinged at the rear of containment structure 140 such that the roof can be opened upwards to provide easy access to cargo area 120 within containment structure 140. Floatation members 110 were made from off the shelf polyethelene foam rollers, into which compartments were cut to house powertrain 180 and sealed with waterproof tape (for lack of materials to create an easily removable waterproof access hatch). Other components were either sourced off the shelf and readily available (e.g., drive components; capture motors; capture members) or custom made (e.g., feeder 240 using a linear motion rod, off the shelf one-way bearings, PVC, and stainless steel spring wire). The drive motors are high-rpm brushless motors and the capture assembly motors are brushed motors with speed reduction gearboxes, since torque rather than speed is optimal for rotating the capture members to capture object 10 in the present application for waterfowl retrieval. An off the shelf radio-frequency camera was mounted on top with a view of the capture assemblies (to aid in capturing object 10) and areas in front of the watercraft (to aid in navigation) and an RF receiver display was mounted to the remote controller.

Further Modular Embodiments

Figure 27A:
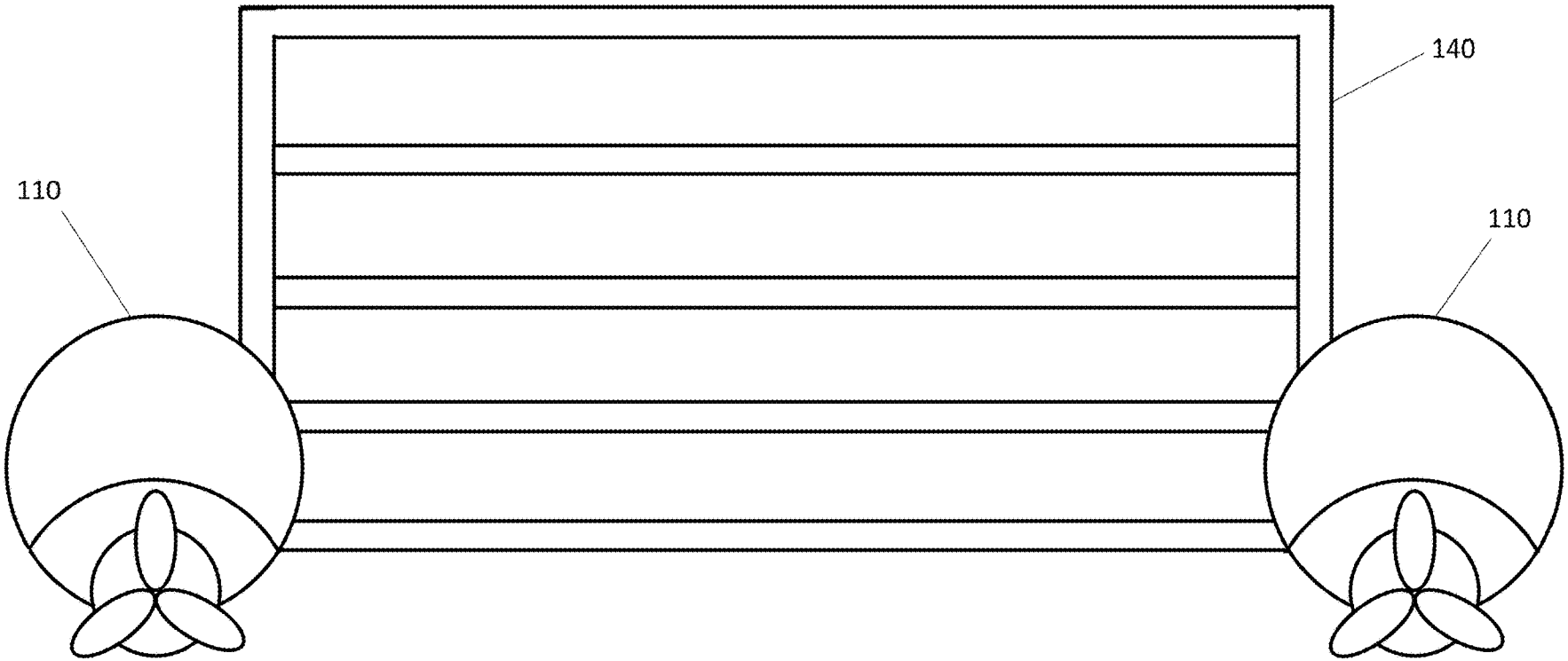
FIGS. 27A-28B illustrate another modular embodiment of the watercraft similar to that shown and described in the context of FIGS. 23A-23G (but without sweeper assemblies 200), in which the floatation members are configured to detach for stowage within the containment structure, in accordance with an embodiment of the present disclosure.
Figure 27B:
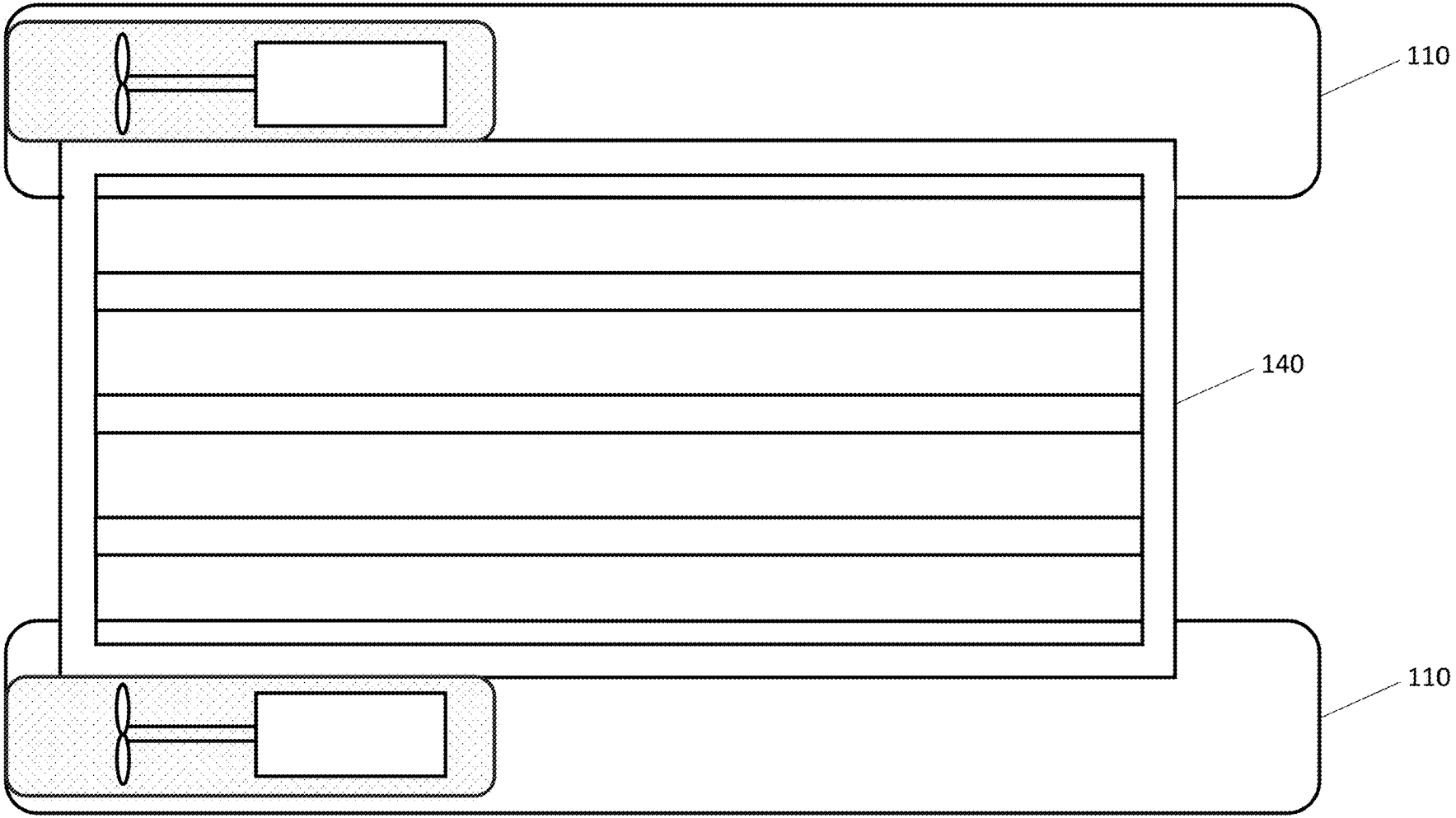
Figure 28A:
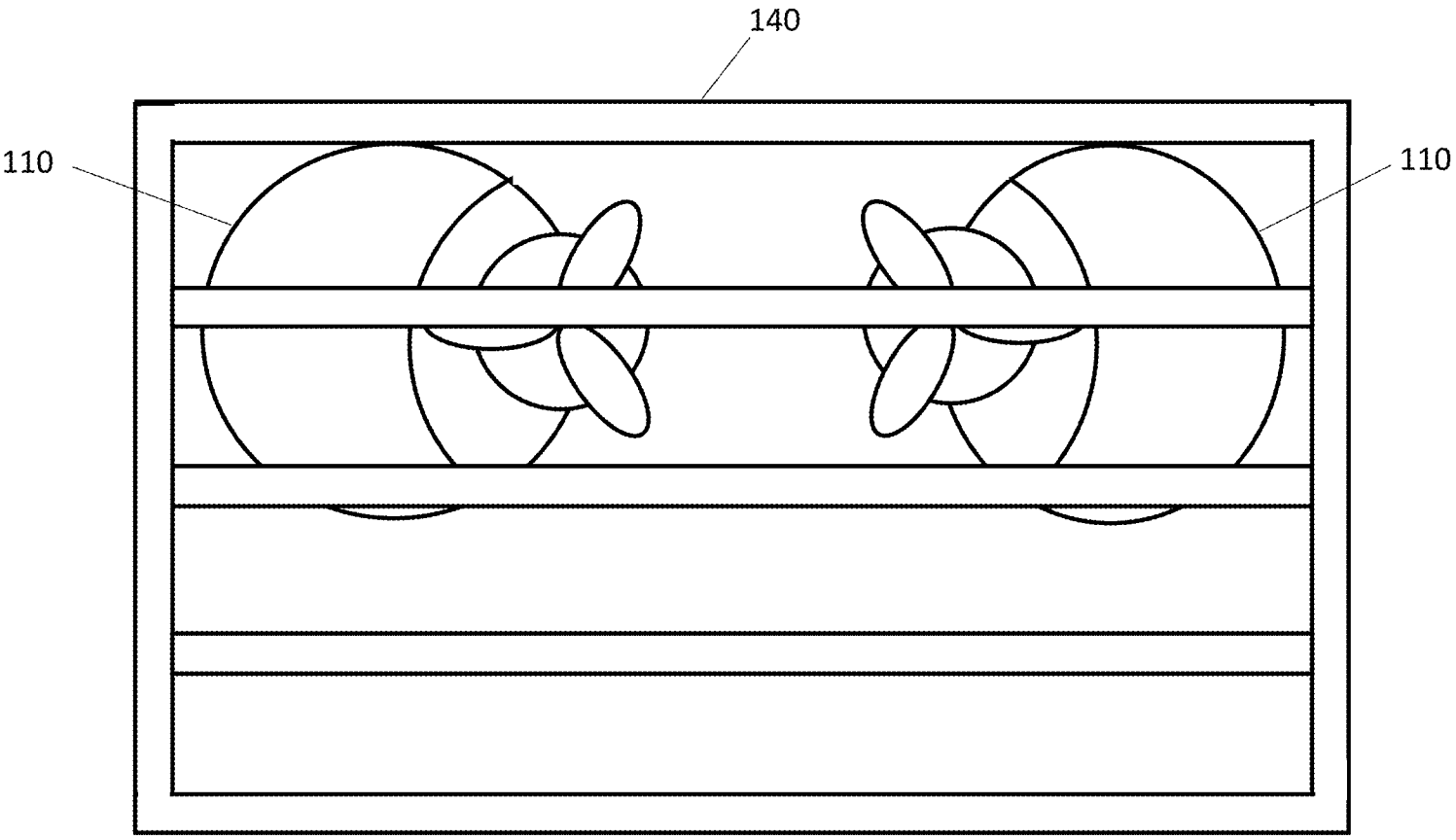
Figure 28B:
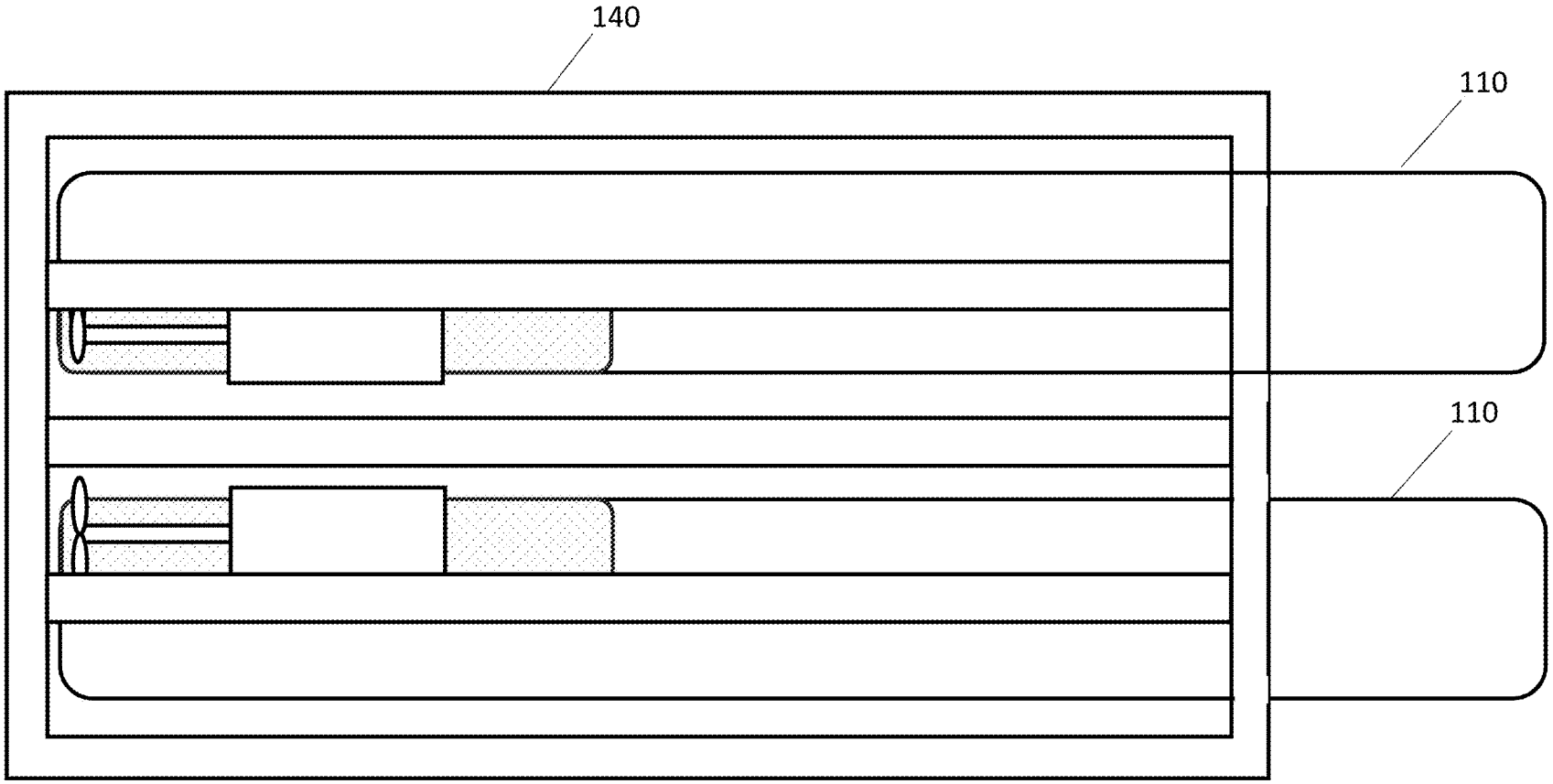

FIGS. 27A-28B illustrate another modular embodiment of system 1000 similar to that shown and described in the context of FIGS. 23A-23G (but without sweeper assemblies 200), in which floatation members 110 are configured to detach for stowage within containment structure 140. FIG. 27A and FIG. 27B are rear and bottom views of system 1000 as assembled for use. FIG. 28A and FIG. 28B are rear and bottom views of system 1000 with floatation members removed and stowed inside containment structure 140 for storage and/or transport. Rails 145, 146 and channels 113 are not shown for the sake of simplicity. In the embodiment shown, powertrains 180 (not shown) are housed within floatation members 110.

Figure 29A:
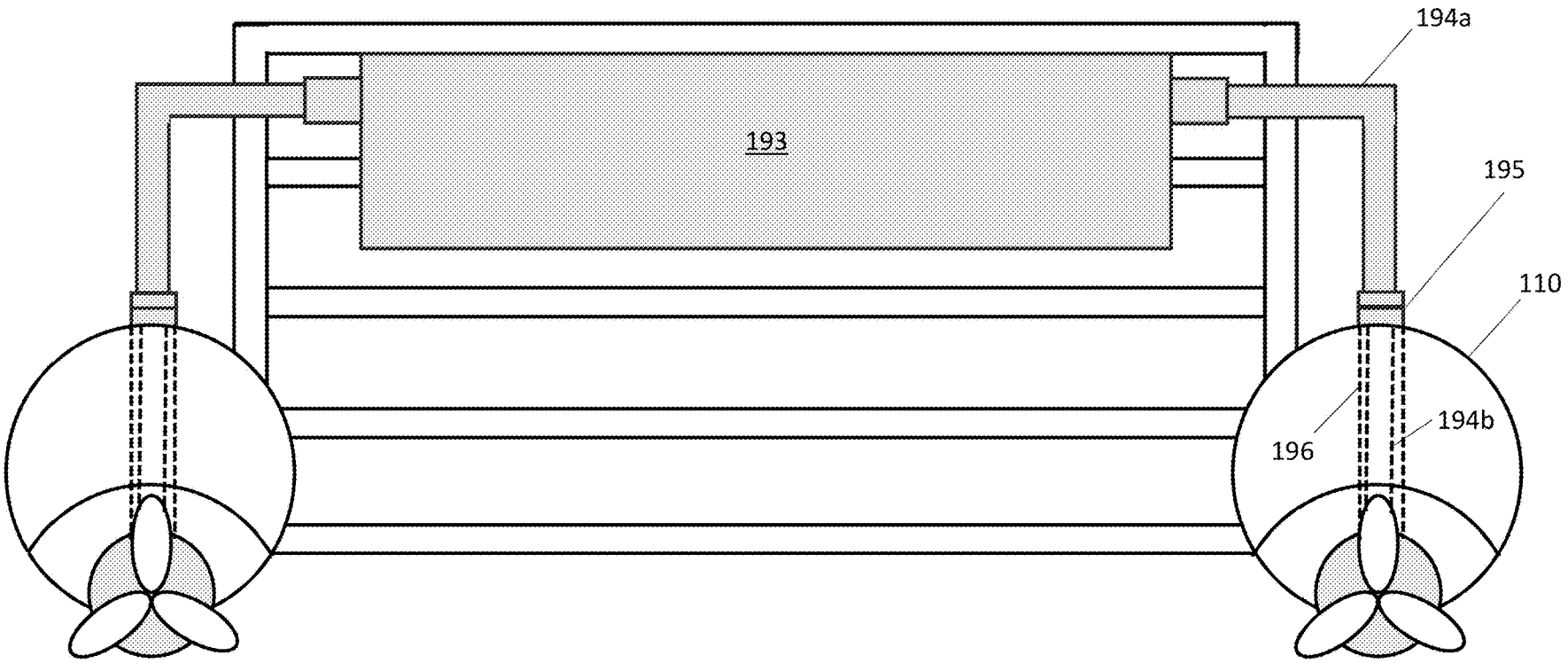
FIGS. 29A-29C illustrate another modular embodiment of the watercraft similar to that shown and described in the context of FIG. 27A-28B, in which various components of the powertrains are housed separate from the floatation members and connected thereto via wiring, in accordance with an embodiment of the present disclosure.
Figure 29B:
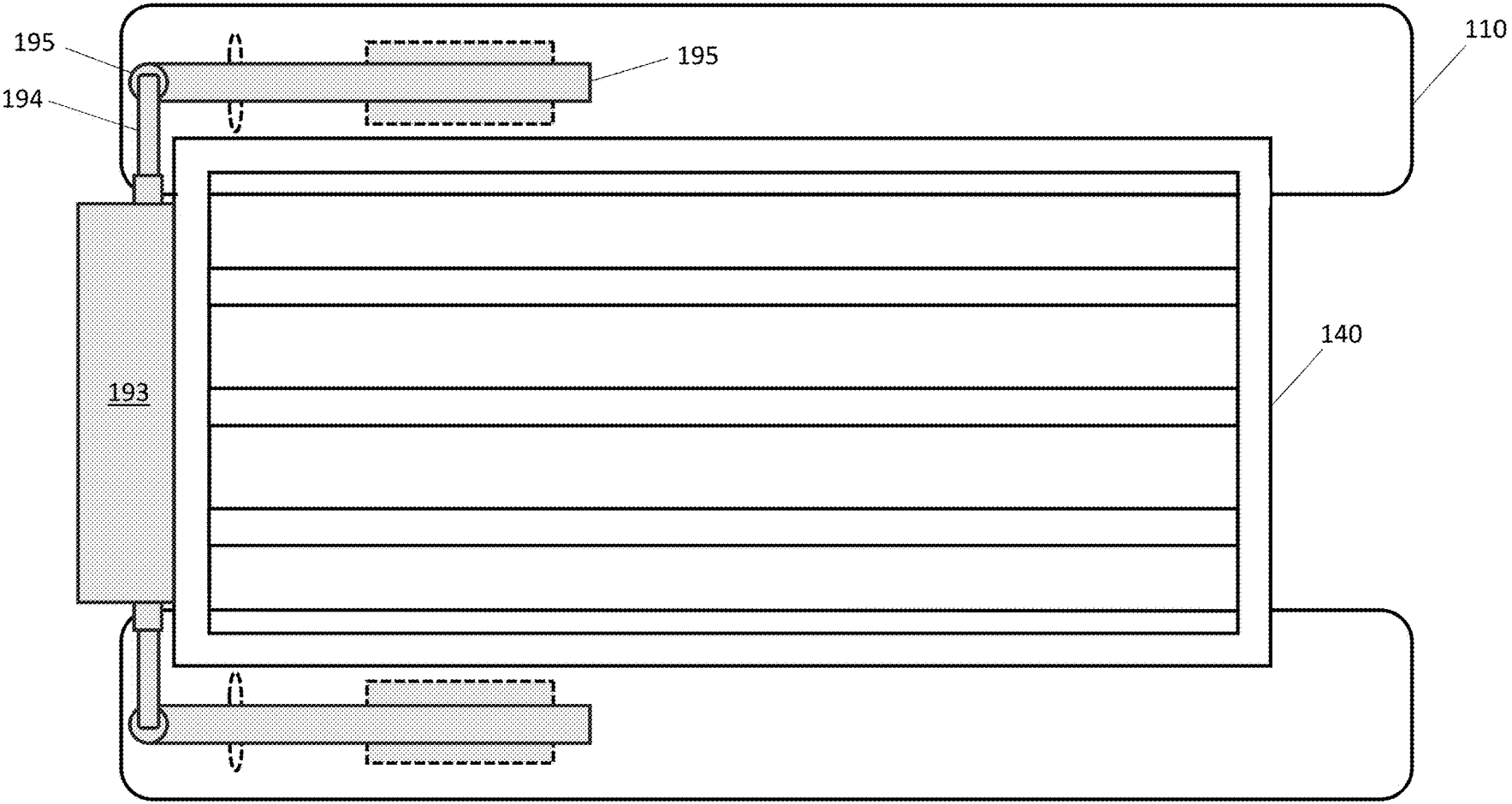
Figure 29C:
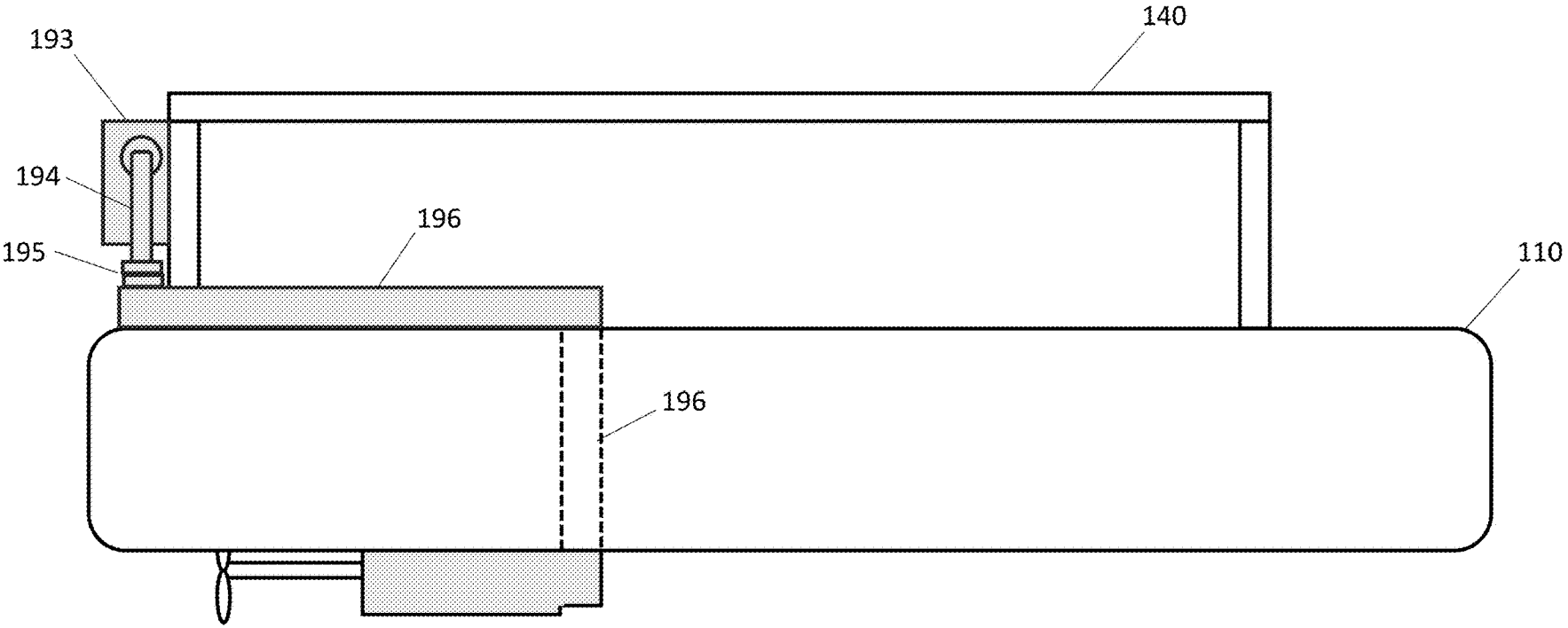

FIGS. 29A-29C illustrate another modular embodiment of system 1000 similar to that shown and described in the context of FIG. 27A-28B, in which various components of the powertrains 180 are housed separate from floatation members 110 and connected thereto via wiring 194. In the embodiment shown, a waterproof junction box 193 is mounted to containment structure 140 and houses receiver 184, electronic speed controllers 185, and batteries 186. Batteries 186 connect to the inputs of electronic speed controllers 185 and electronic speed controllers 185 connect to receiver 184, and wiring 194 connects the outputs of electronic speed controllers 185 to the inputs of motors 181, which are mounted to floatation members 110. First and second portions 194*a*, 194*b* of wiring 190 removably connect to one another via a waterproof connector 195. As configured, the connector 195 can be released to allow floatation members 110 to be stowed inside of containment structure 140 as previously described. Portion 194*b* of wiring 194 runs through conduit 196, which extends from waterproof connector 195 to motor 181. Conduit 196, in the embodiment shown, is rigid and further serves as a housing for mounting motor 181 to floatation member 110. Rails 145, 146 and channels 113 are not shown for the sake of simplicity.

FIGS. 30A-31B illustrate another modular embodiment of system 1000, in which powertrains 180 are fully mounted to containment structure 140 as opposed to having one or more components housed within floatation members 110. This may allow for sourcing simpler, less expensive floatation members 110, thereby reducing the overall cost of system 1000 and allowing for swapping in/out different floatation members 110 for various use cases (e.g., larger floatation members for rougher waters; replacing damaged floatation members).

Figure 30A:
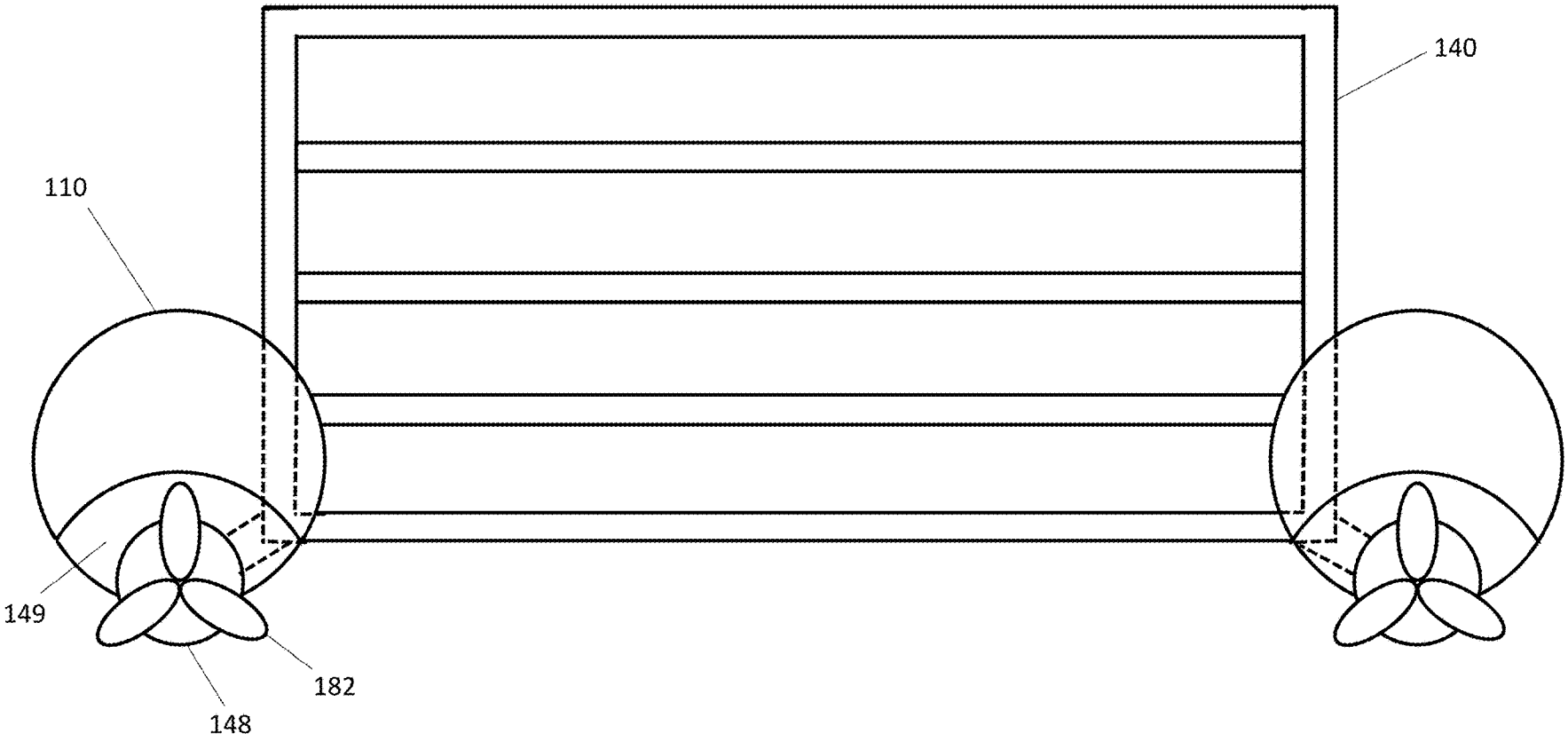
FIGS. 30A-31B illustrate another modular embodiment of the watercraft, in which the powertrains are fully mounted to the containment structure as opposed to having one or more components housed within the floatation members, in accordance with an embodiment of the present disclosure.
Figure 30B:
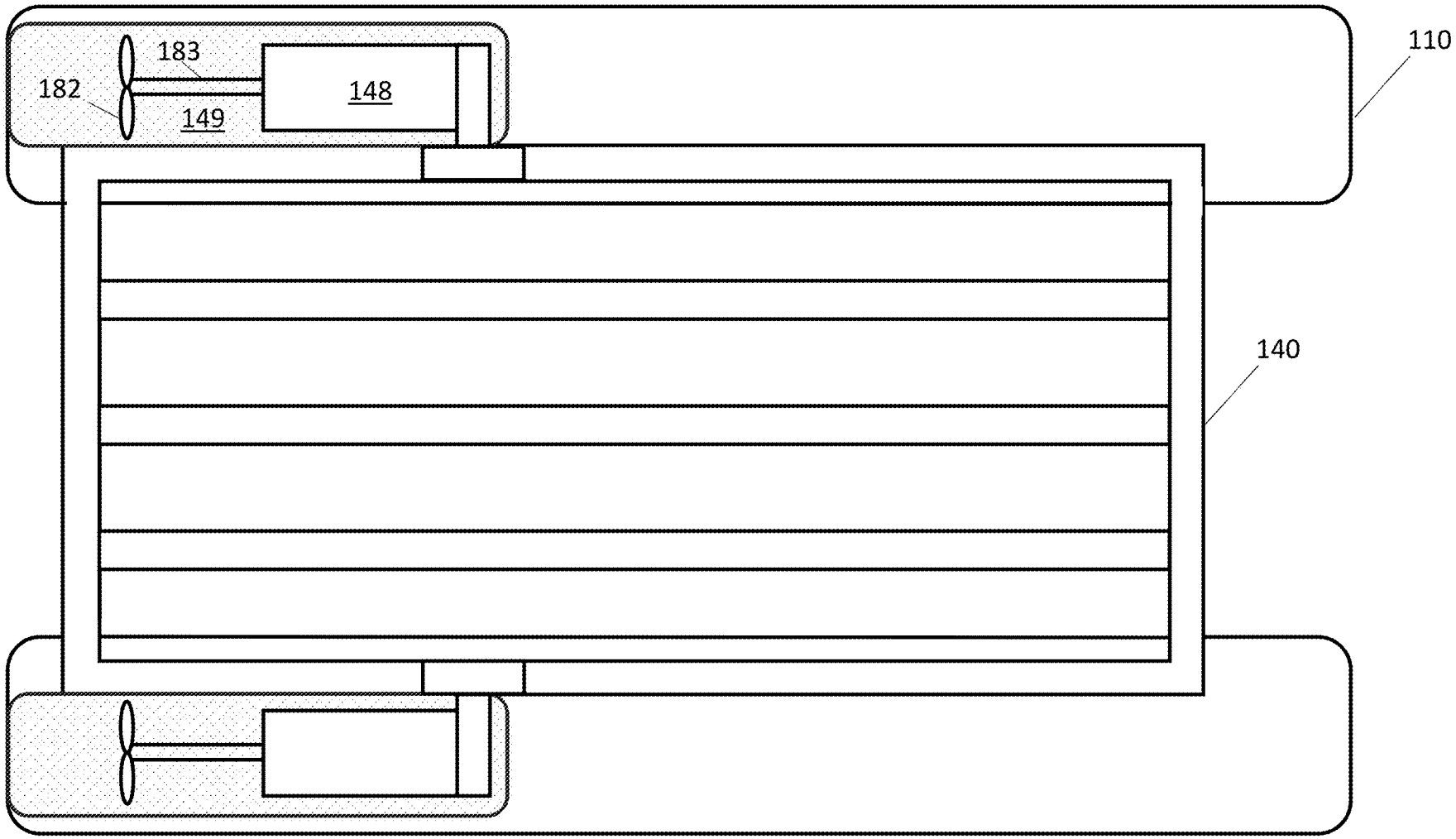

Referring first to FIG. 30A (rear view) and FIG. 30B (bottom view), in various embodiments, motor 181 and propeller 182 (and propeller shaft 183, if equipped) may be included in a module 148 that extends from the lower portion of containment structure 140. The underside of floatation member 110 is shown with an optional recess 149 for accommodating upper portions of module 148, so as to minimize the draft of watercraft 100 without significantly interfering with propulsion.

Figure 31A:
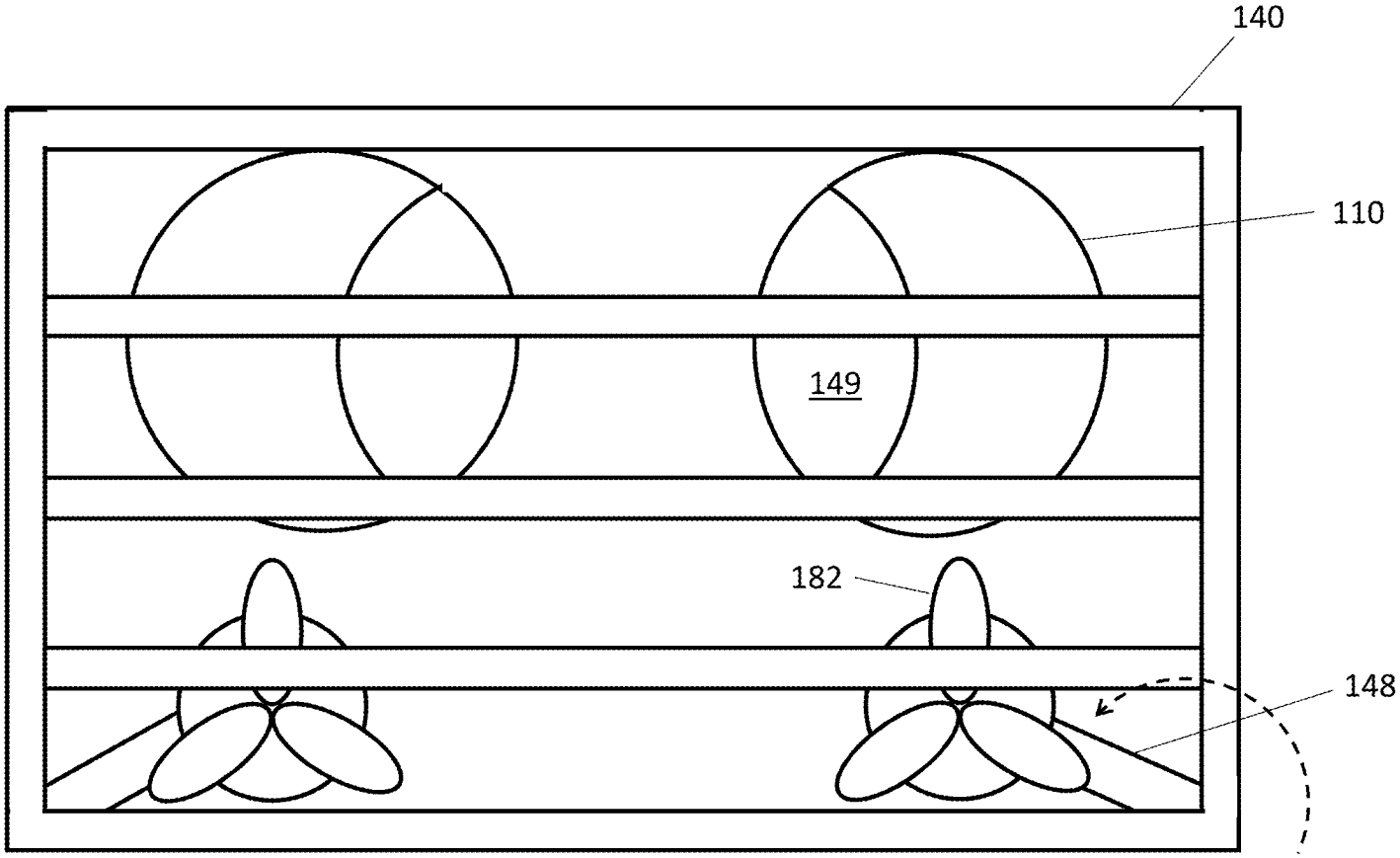
Figure 31B:
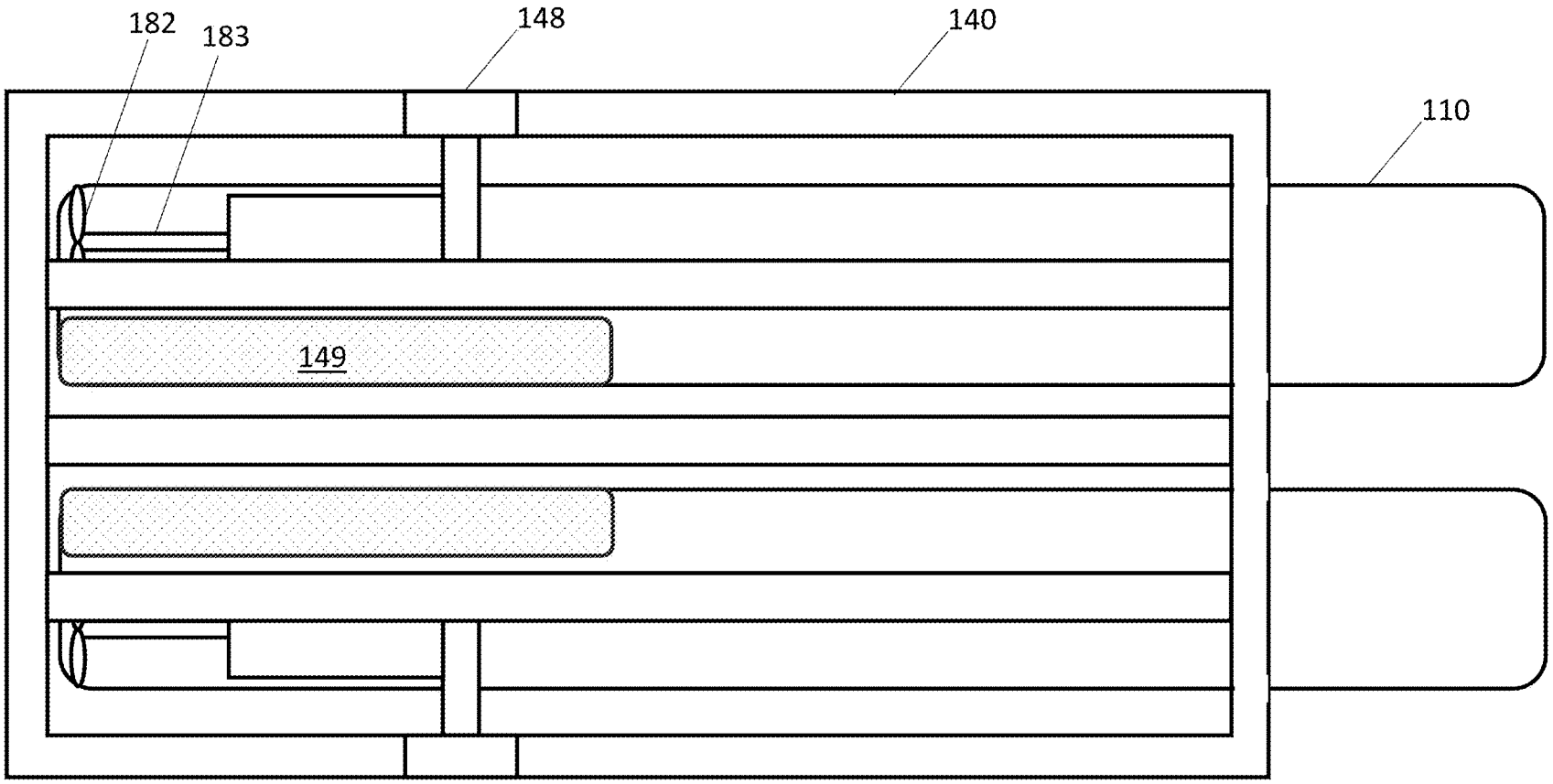

Referring now to FIG. 31A (rear view) and FIG. 31B (bottom view), in various embodiments, module 148 may be rotatably coupled to containment structure 140 such that the module 148 can rotate upwards and into an interior of containment structure 140 for stowage, as shown by the dashed arrow. In operation, floatation members 110 would be removed and stowed first, and then these modules 148 would be rotated into containment structure 140 through the sides of containment structure 140 (these lower portions of the sides could be left open, as floatation members 110 would block object 10 from escaping through these openings when assembled for use, or the sides could be provided with openings shaped and dimensioned such that modules 148 could be rotated into containment structure 140 through side containment elements). Rails 145, 146 and channels 113 are not shown for the sake of simplicity. Additionally or alternatively, in an embodiment (not shown), lower containment element 160 could be provided with openings shaped and dimensioned such that modules 148 could be rotated into containment structure 140 through lower containment element 160.

Figure 32A:
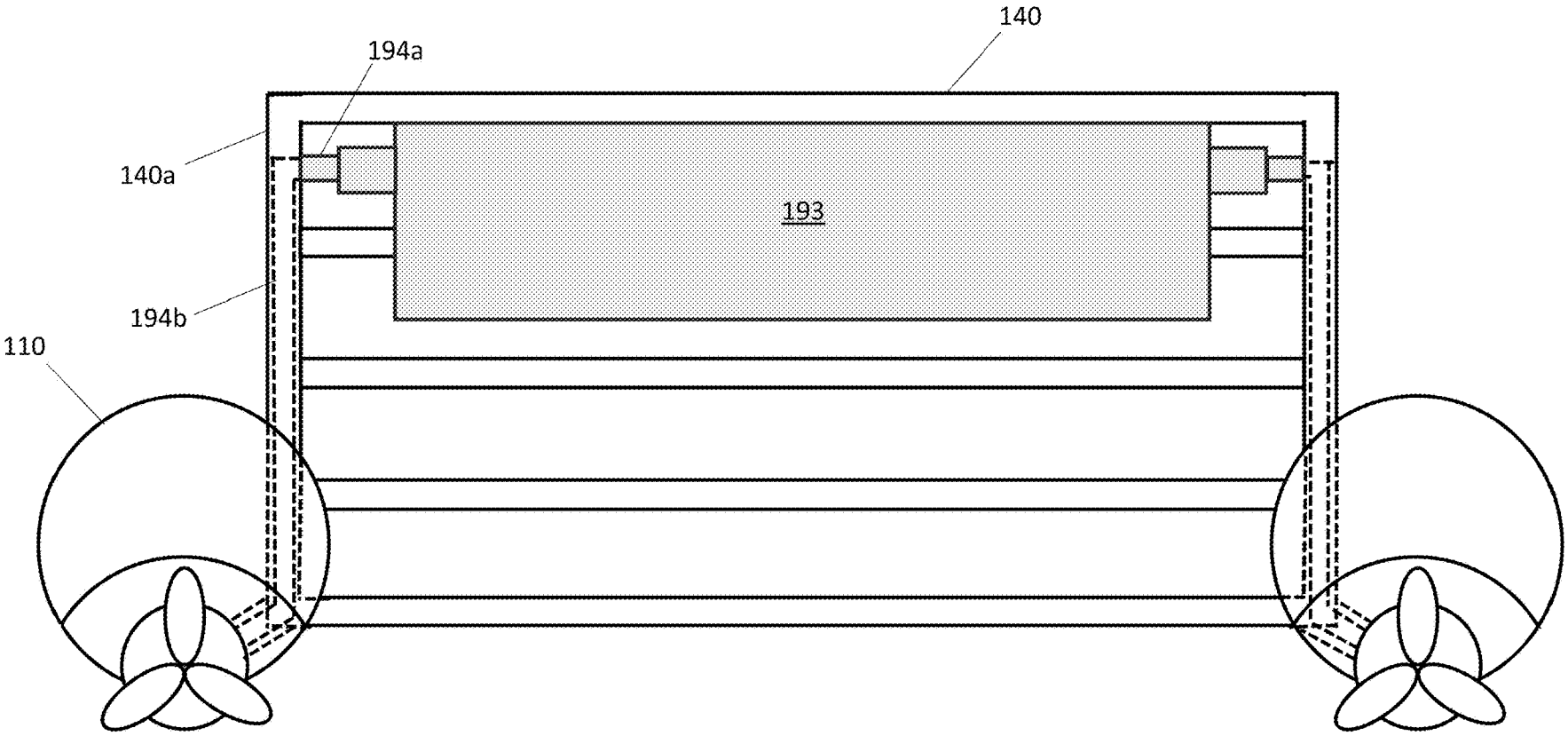
FIGS. 32A-32C illustrate how other components of the powertrain could be mounted and connected in the embodiment of FIGS. 30A-31B, in accordance with an embodiment of the present disclosure.
Figure 32B:
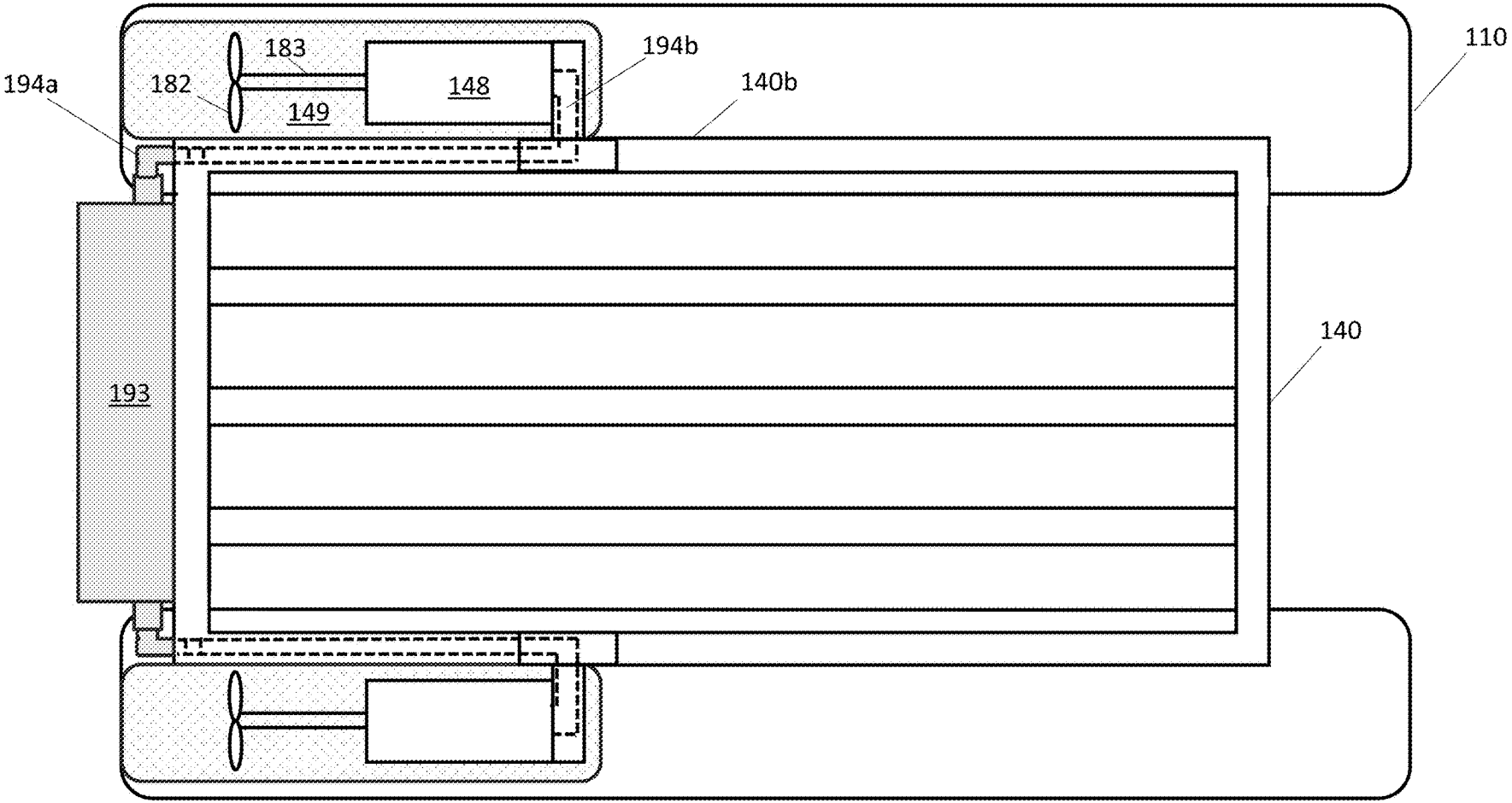
Figure 32C:
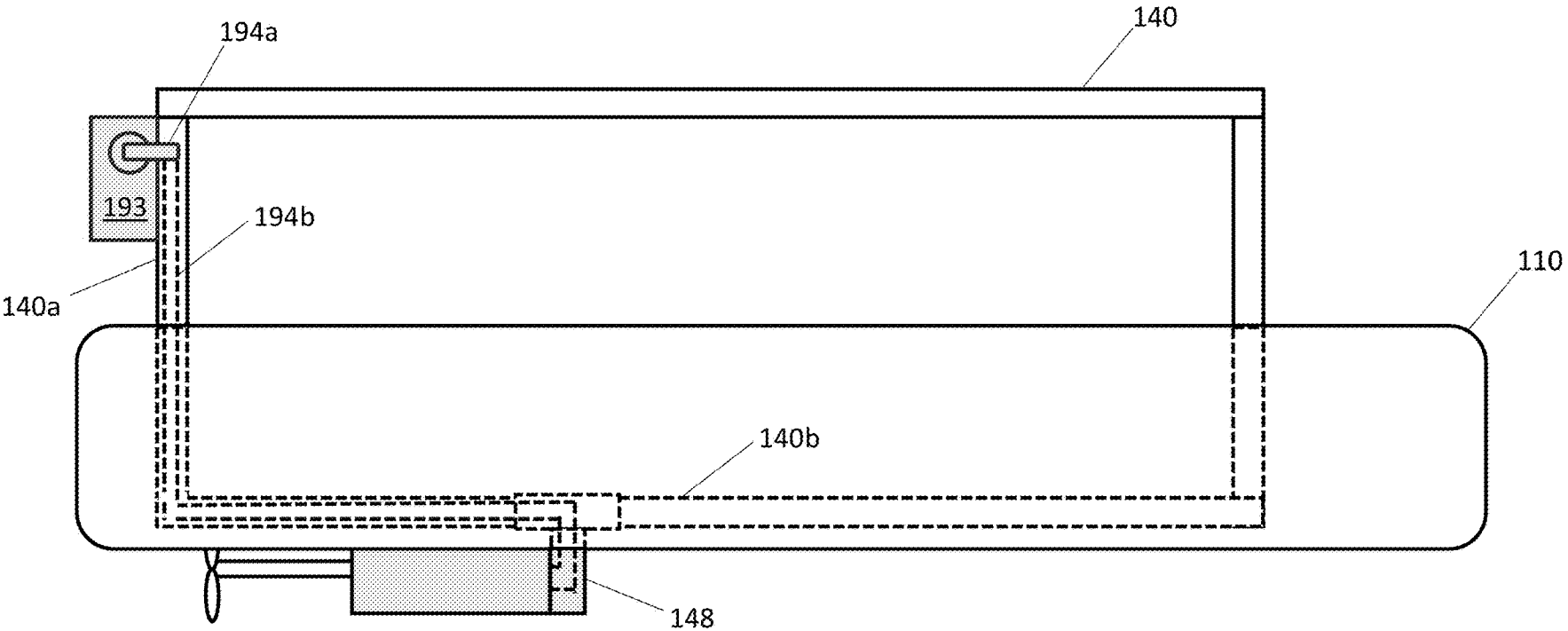

FIGS. 32A-32C illustrate how other components of powertrain 180 could be mounted and connected in the embodiment of FIGS. 30A-31B. The approach is similar to that shown and described in the context of FIGS. 29A-29C; however, wiring 194 can largely be routed through the inside of the containment structure 140 members (if hollow), thereby obviating the need for waterproof connector 195 and portion 194*a* of wiring 194 swinging around when disassembled. As before, a waterproof junction box 193 is mounted to containment structure 140 and houses receiver 184, electronic speed controllers 185, and batteries 186; batteries 186 connect to the inputs of electronic speed controllers 185 and electronic speed controllers 185 connect to receiver 184. Here though, wiring 194 is routed downwards through vertical member 140*a*, rearwards through horizontal member 140*b*, and outwards into module 148, where it connects with the input of motor 181. As routed within members 140*a*, 140*b*, and module 148, wiring 194 should not interfere with the rotation of module 148 between deployed and stowed positions.

The distributed powertrain 180 approaches of FIGS. 29A-29C and FIGS. 32A-32C may allow a user to more easily access batteries 186 for charging, reduce the cost and complexity of manufacturing floatation members 110, and allow for swapping in/out different floatation members 110 for various use cases (e.g., larger floatation members for rougher waters; floatation members with above-water fans instead of underwater propellers 182 when used in water with lots of weeds; replacing damaged floatation members).

To recap, in one aspect the present disclosure is directed to a modular watercraft 100 for retrieving an object 10 on a body of water, the watercraft 100 comprising: a containment structure 140 having an interior defining an internal cargo area 120 of the watercraft 100, the containment structure 140 comprising an open front side 141 dimensioned to accommodate entry of the object 10 into the internal cargo area 120 through the open front side 141 and one or more containment elements (e.g., any one or combination of containment elements 150, 160, 170, and side containment elements) configured to contain the object 10 within the internal cargo area 120; a first floatation member 110*a* and a second floatation member 110*b*; first and second couplers (e.g., rails 145, rails 113) configured to, in a deployed configuration, releasably couple the first and second floatation members 110*a*, 110*b* to an exterior of the containment structure 140 on a port side and a starboard side of the containment structure 140, respectively; and third and fourth couplers (e.g., rails 146) configured to, in a stowed configuration, releasably couple the first and second floatation members 110*a*, 110*b* to the containment structure 140 such that the first and second floatation members 110*a*, 110*b* are at least partially situated within an interior of the containment structure 140, thereby providing the modular watercraft 100 with a smaller footprint in the stowed configuration than in the deployed configuration. The first and second floatation members 110*a*, 110*b*, in an embodiment, may be elongated pontoons. In various embodiments, the first and second floatation members 110*a*, 110*b*, when in the deployed configuration, may define first and second side containment elements of the containment structure 140. The first coupler, in some embodiments, may comprise first and second complementary rail members, the first rail member 145*a* being positioned on the exterior port side of the containment structure 140 and the second rail member 113*a* being positioned on the first floatation member 110*a*, wherein the second rail member 113*a* is configured to slidably couple to and slidably decouple from the first rail member 145*a* so as to couple and decouple the first floatation member 110*a* to and from the exterior port side of the containment structure 140, respectively; and the second coupler may comprise third and fourth complementary rail members, the third rail member 145*b* being positioned on the exterior starboard side of the containment structure 140 and the fourth rail member 113*b* being positioned on the second floatation member 110*b*, wherein the fourth rail member 113*b* is configured to slidably couple to and slidably decouple from the third rail member 145*b* so as to couple and decouple the second floatation member 110*b* to and from the exterior starboard side of the containment structure 140, respectively. In an embodiment, the third coupler may comprise a fifth rail member 146*a* that is complementary to the second rail member 113*a*, the fifth rail member 146*a* being positioned on an interior of the containment structure 140, wherein the second rail member 113*a* is configured to slidably couple to and slidably decouple from the fifth rail member 146*a* so as to couple and decouple the first floatation member 110*a* to and from the interior of the containment structure 140, respectively; and the fourth coupler may comprise a sixth rail member 146*b* that is complementary to the fourth rail member 113*b*, the sixth rail member 146*b* being positioned on an interior of the containment structure 140, wherein the fourth rail member 113*b* is configured to slidably couple to and slidably decouple from the sixth rail member 146*b* so as to couple and decouple the second floatation member 110*b* to and from the interior of the containment structure 140, respectively. The modular watercraft 100, in some embodiments, may comprise first and second powertrains 180*a*, 180*b* for propelling and steering the watercraft 100, the first and second powertrains being fully onboard the first floatation member 110*a* and the second floatation member 110*b*, respectively. Alternatively, in some other embodiments, the modular watercraft 100 may comprise a powertrain 180 for propelling and steering the watercraft 100, the powertrain 180 being fully offboard the first and second floatation members 110*a*, 110*b*. Alternatively, in some other embodiments, the modular watercraft 100 may comprise a powertrain(s) 180 for propelling and steering the watercraft 100, the powertrain(s) 180 being partially onboard and partially offboard the first and second floatation members 110*a*, 110*b*.

In an embodiment, a portion of the powertrain(s) 180 onboard the first and second floatation members 110*a*, 110*b* may comprise a first motor 181*a* and a first propeller 182*a* onboard the first floatation member 110*a*, and a second motor 181*b* and a second propeller 182*b* onboard the second floatation member 110*b*, a portion of the powertrain(s) 180 offboard the first and second floatation members 110*a*, 110*b* may comprise one or more batteries 186 and one or more receivers 184, and one or more electrical connections 194 between the portion of the powertrain(s) 180 onboard the first and second floatation members 110*a*, 110*b* and the portion of the powertrain offboard the first and second floatation members 110*a*, 110*b*, the electrical connection(s) 194 being detachable such that the first and second floatation members 110*a*, 110*b* can be decoupled from the exterior of containment structure 140 and coupled to the interior of the containment structure 140 in the stowed configuration.

The powertrain(s) 180, in embodiments in which the powertrain(s) 180 is not fully onboard floatation member(s) 110*a*, 110*b*, may comprise a first motor module 148*a* rotatably coupled to the port side of the containment structure 140 and a second motor module 148*b* rotatably coupled to the starboard side of the containment structure 140, the first and second motor modules 148*a*, 148*b* each comprising at least a motor 181 and a propeller 182 (and propeller shaft 183, if equipped) and configured to move about the rotatable coupling from a deployed position outside of the containment structure to a stowed position within the interior of the containment structure 140. The containment structure 140 may comprise a first opening on the port side of the containment structure 140 and a second opening on the starboard side of the containment structure 140, the first and second openings dimensioned and positioned relative to the first and second motor modules such that the first and second motor modules 148*a*, 148*b* are configured to move about the rotatable coupling from the deployed position to the stowed position through the first and second openings in the port and starboard sides of the containment structure 140. In an embodiment, the containment structure 140 may not include first and second side containment elements, and the first and second openings are open port and starboard sides of the containment structure 140. Additionally or alternatively, the containment structure 140 may comprise a lower containment element 160, the lower containment element 160 comprising one or more openings dimensioned and positioned relative to the first and second motor modules 148*a*, 148*b* such that the first and second motor modules 148*a*, 148*b* are configured to move about the rotatable coupling from the deployed position to the stowed position through the one or more openings in the lower containment element 160.

Positioning of Lower Containment Element 160

Figure 33A:
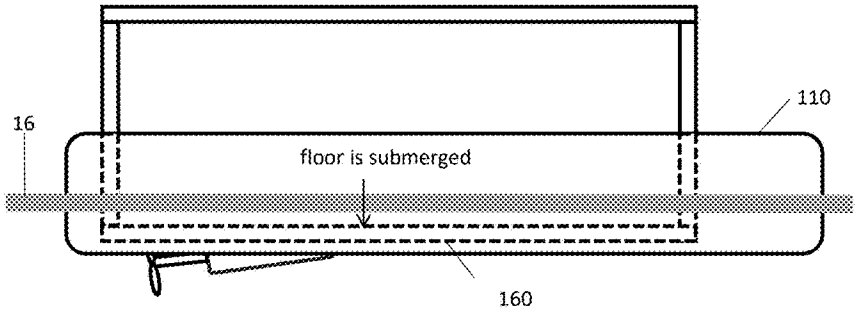
FIGS. 33A-33F illustrate various embodiments of a lower containment element and their positioning relative to the surface of the water, in accordance with various embodiments of the present disclosure.
Figure 33B:
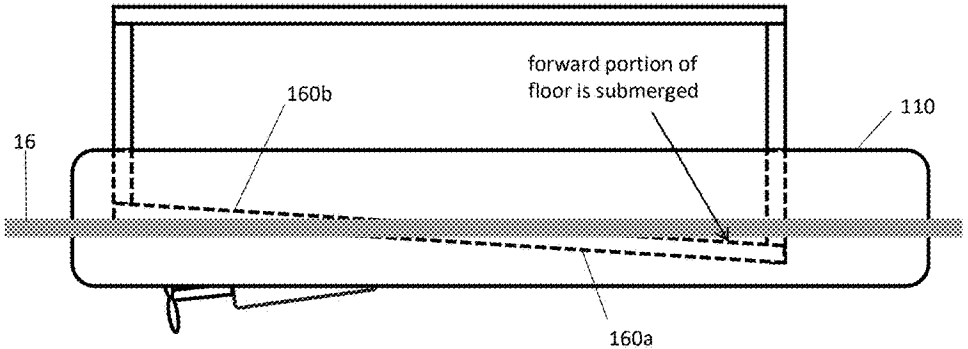
Figure 33C:
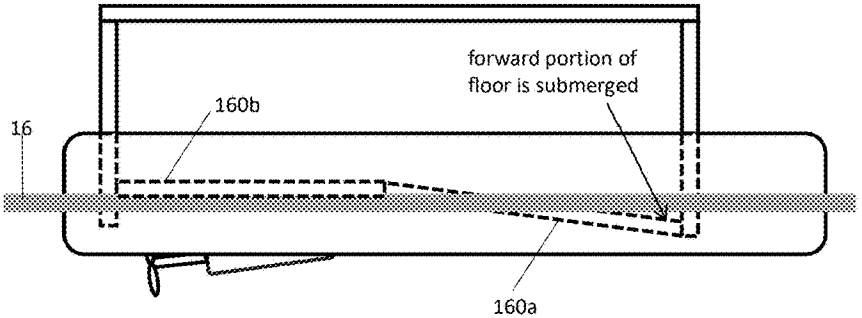
Figure 33F:
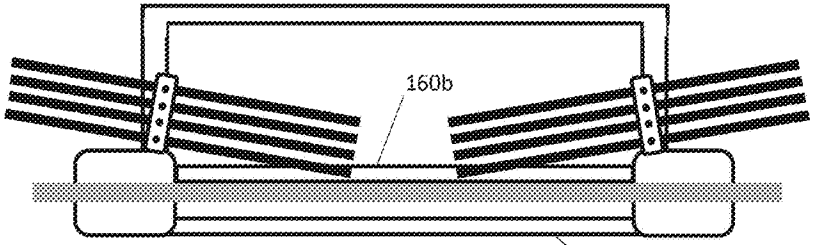
Figure 33D:
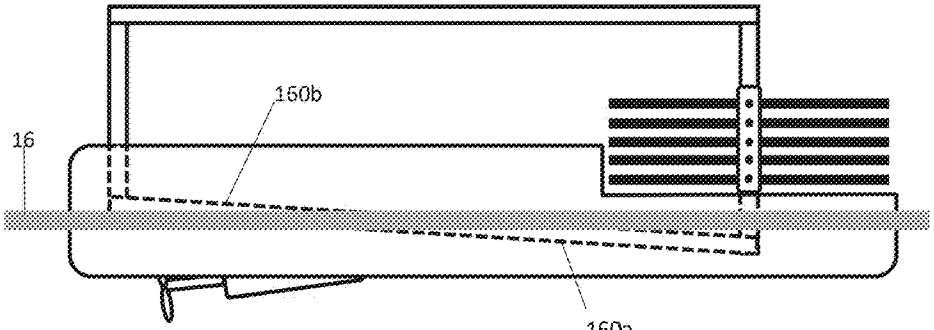
Figure 33E:
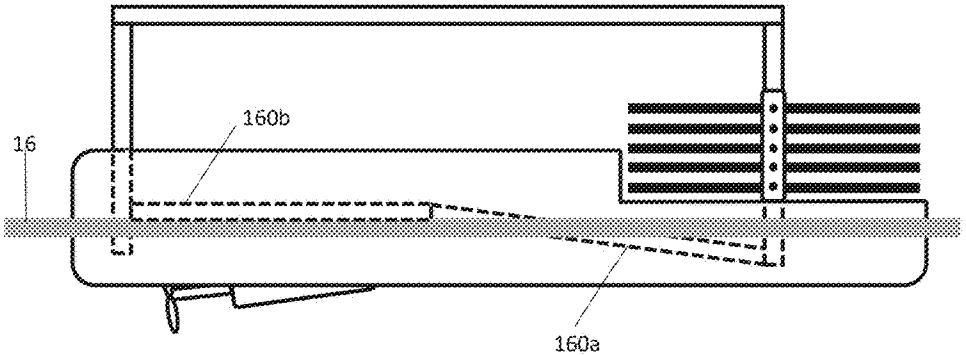

FIGS. 33A-33C illustrate various embodiments of lower containment element 160 and their positioning relative to the surface of the water 16. This positioning is a function of the size and mounting height of floatation members 110 on containment structure 140. That is, the smaller and/or higher floatation members 110 are mounted on containment structure 140, the lower the positioning of lower containment element 160 relative to the water's surface 16; the bigger and/or lower floatation members 110 are mounted on containment structure 140, the higher the positioning of lower containment element 160 relative to the water's surface 16. Generally speaking, embodiments of systems 1000 are preferably configured such that at least a front portion 160*a* of lower containment element 160 is submerged far enough to allow object 10 to enter cargo area 120 without interference as system 1000 drives forwards. FIG. 33A shows one such embodiment in which lower containment element 160 is substantially level and fully submerged. FIG. 33B shows another embodiment in which lower containment element 160 is slanted such that front portion 160*a* is submerged and rear portion 160*b* is above the water's surface 16. FIG. 33C shows yet another embodiment in which lower containment element 160 has a front portion 160*a* that is slanted such that it is submerged and a rear portion 160 that is level and sits at or above the water's surface 16. The latter two configurations may serve to reduce hydrodynamic drag since only a portion of lower containment element 160 is submerged. That said, it is possible that front portion 160*a* acts much like a "lip" on a crankbait fishing lure, serving to generate a downwards pitching moment if large enough and/or heavily slanted. The size of portion 160*a* that is submerged can be minimized if portion 160*a* is at a steep downwards angle; however, if the angle is too steep it may be difficult to get object 10 to ride up over the juncture and into cargo area 120; conversely, reducing the degree at which portion 160*a* is slanted downwards may make it easier to intake object 10; however, doing so likely means portion 160*a* much be longer in order for its leading edge to reach a depth sufficient not to interfere with that portion of object 10 that is submerged. One having ordinary skill in the art will recognize a suitable balance without undue experimentation if pursuing the embodiments of FIG. 33B or FIG. 33C, FIGS. 33D-33F illustrate similar lower containment elements 160 as those shown in FIGS. 33A-33C, only here as equipped on an embodiment of system 1000 having capture assemblies 200.

Lifting Member(s) 500

FIGS. 34A-39B illustrate the use of one or more hydrodynamic lifting members 500 in connection with the embodiments of FIGS. 33A-33C. Generally speaking, hydrodynamic lifting member(s) can be employed to passively raise lower containment element 160 above the water's surface 160 when system 1000 is travelling forwards at higher speeds. As configured, lower containment element 160 (or at least forward portion 160*a* thereof) is submerged when system 1000 is at rest or travelling at lower speeds (and thereby generating no or little lift) such as when nearing and intaking object 10, but raises above the water's surface when system 1000 is travelling at higher speeds (and thereby generating greater lift), such as when being piloted from afar to object 10 and when being piloted back to the user after intaking object 10. This can improve the speed, battery consumption, and handling of system 1000, especially in rough waters, and is completely passive—that is, no motors or moving parts (which could drive up cost, reduce reliability, freeze up in icy conditions, become immobilized by rust or weeds, etc.) are required to transition between these modes.

In some embodiments, such as those of FIGS. 34A-36B, a hydrodynamic lift member 500 may be positioned near the front of system 1000 so as to generate an upwards pitching moment on system 1000. In other embodiments, such as those of FIGS. 37A-39B, multiple hydrodynamic lift members 500 (or perhaps just one if positioned at the center of gravity of system 1000) can be used to lift system 1000 enough that lower containment element 160 raises out of the water entirely. The latter may have the additional benefit of reducing hydrodynamic drag that would otherwise be generated by object 10 moving through the water.

The depth, chord, angle of attack, and other features affecting the performance of lifting member(s) 500 can be optimized for any given application. In one aspect, it may be preferable to minimize depth if operating system 1000 in shallow waters or in waters with shallow obstructions (e.g., stumps), however, doing so may limit how far system 1000 can raise upwards since the lifting member 500 can only generate meaningful lift in the water. This may not be a concern in deeper water. In another aspect, it may be preferable to maximize the amount of lift generated at lower speeds such that the nose of system 1000 raises quickly upon accelerating from rest. This is especially helpful when laden with the weight of object 10. Generally speaking, higher angles of attack generate more lift; however, too high of an angle of attack can cause lifting member 500 to stall and thereby lose lift. Likewise, high angles of attack and greater chord length typically results in more drag. One having ordinary skill in the art will recognize a suitable balance of these factors for a given application without undue experimentation.

In an embodiment, various mechanisms known in the art may allow for adjusting one or a combination of the depth and angle of attack of lifting member(s) 500, either manually (e.g., before putting system 1000 in the water) or electromechanically (e.g., during operation using servos selectably controlled by transmitter 300 and/or automatically controlled by an onboard controller based on throttle). Additionally or alternatively, in an embodiment, lifting member(s) 500 may be configured to detach from system 1000, whether for stowage purposes or if not ideal for given operating conditions (e.g., shallow water; shallow obstructions).

Figure 34A:
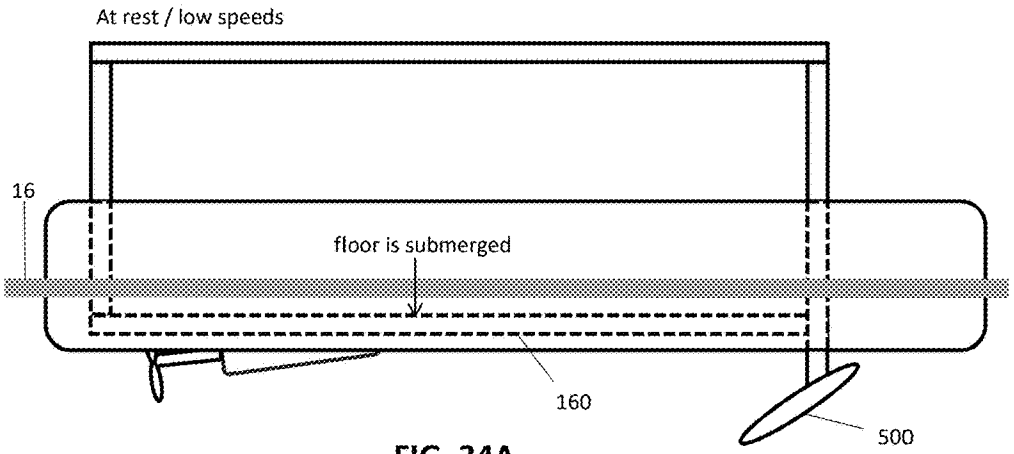
FIGS. 34A-39B illustrate the use of one or more hydrodynamic lifting members in connection with the embodiments of FIGS. 33A-33C, in accordance with various embodiments of the present disclosure.
Figure 34B:
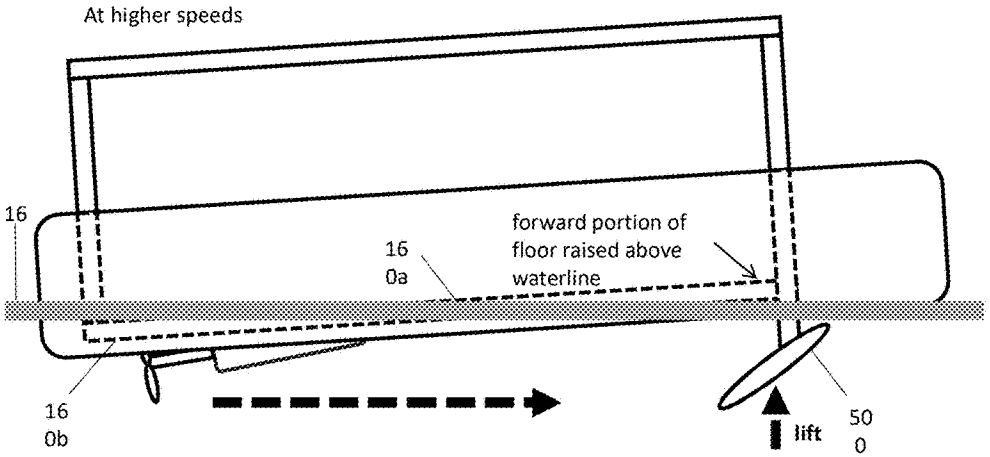
Figure 35A:
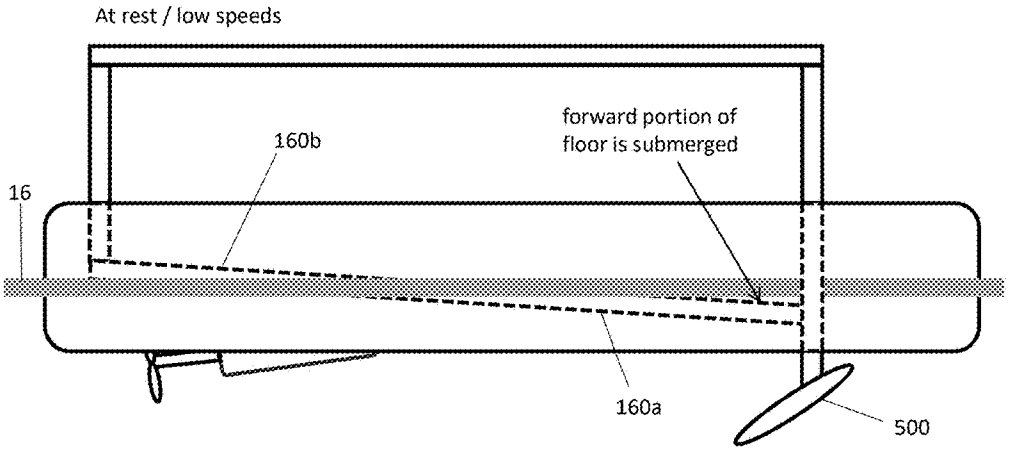
Figure 35B:
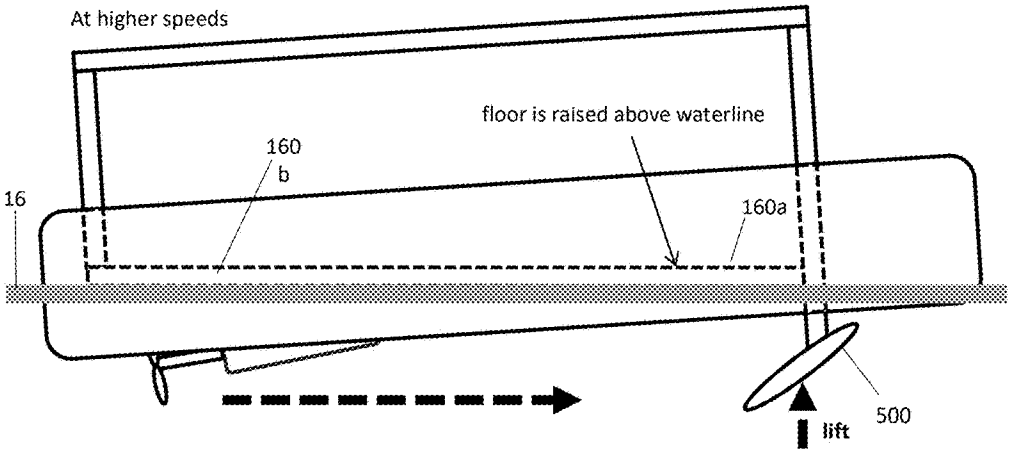
Figure 36A:
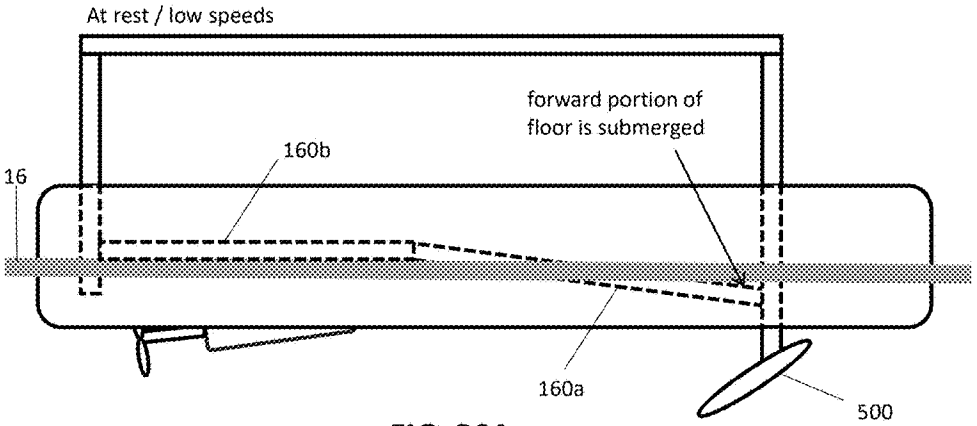
Figure 36B:
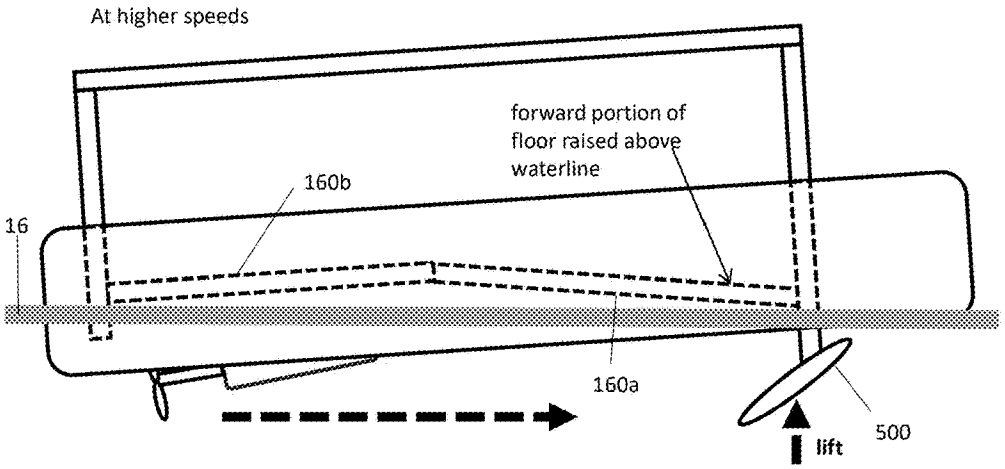

FIG. 34A and FIG. 34B show the embodiment of FIG. 33A, as equipped with a forward lifting member 500, when: (i) at rest (or operating at speeds low enough to not generate sufficient lift to raise portion 160*a* above the water's surface) and (ii) traveling at higher speeds, respectively. Likewise, FIG. 35A and FIG. 35B show the embodiment of FIG. 33B in these respective modes, as do FIG. 36A and FIG. 36B show the embodiment of FIG. 33C in these respective modes. As shown, portion 160*a* or the entirety of lower containment element 160 is submerged when at rest or travelling at low speeds and a lesser portion or the entirety of lower containment element 160 is raised above the water's surface 16 when travelling at higher speeds due to increased lift generated by forward lifting member 500.

Figure 37A:
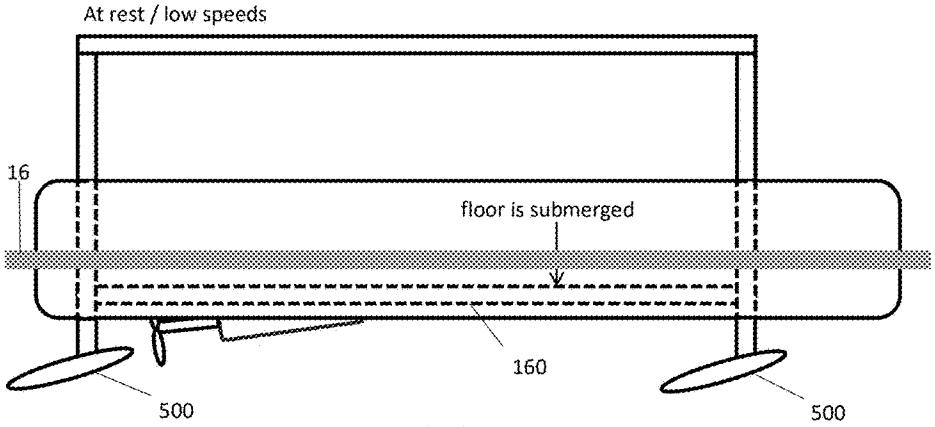
Figure 37B:
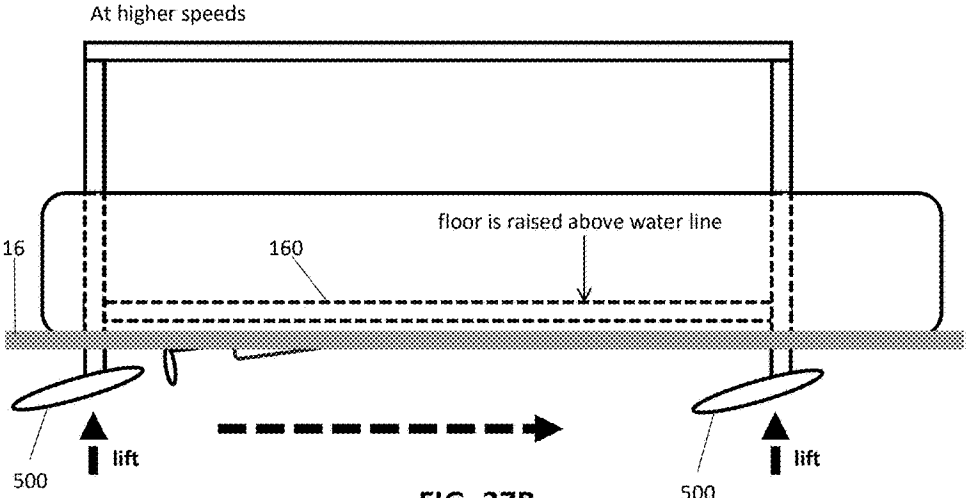
Figure 38A:
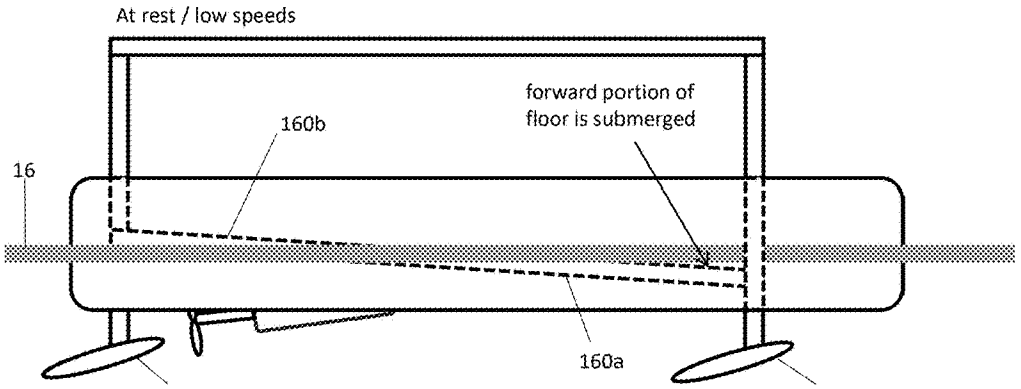
Figure 38B:
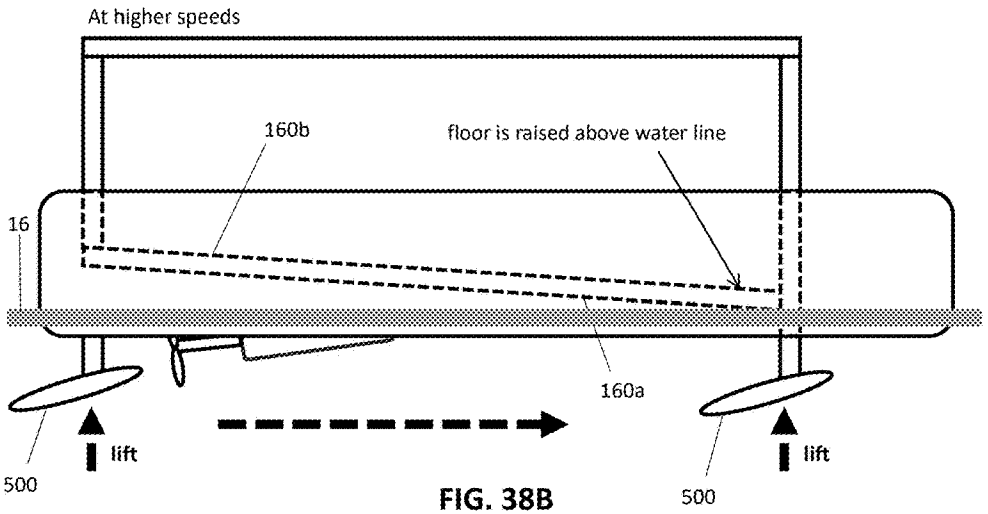
Figure 39A:
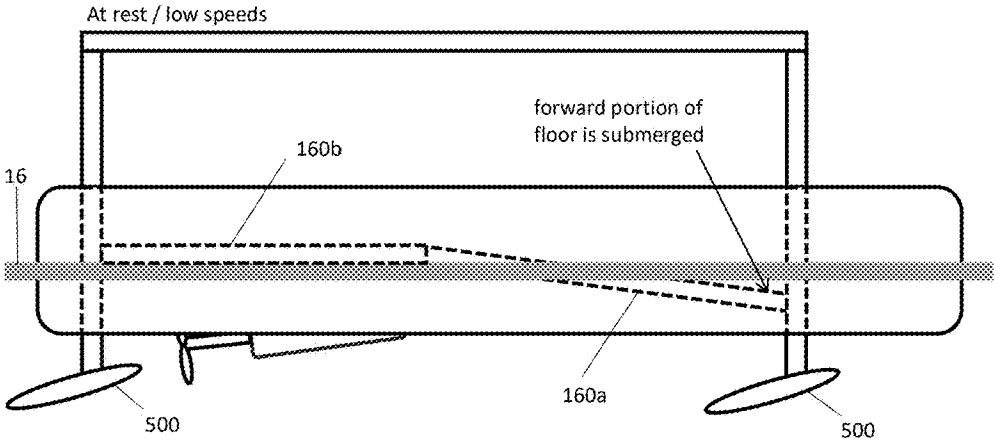
Figure 39B:
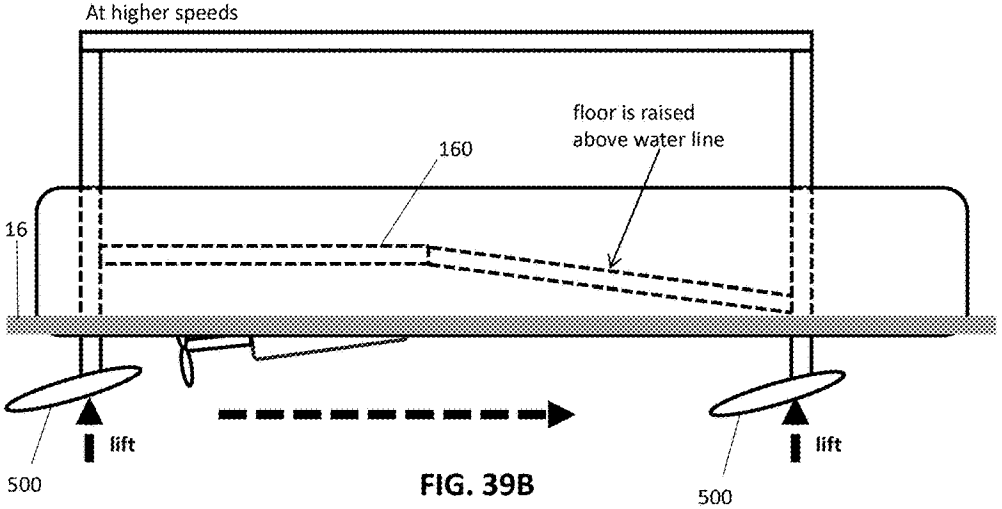

FIG. 37A and FIG. 37B show the embodiment of FIG. 33A, as equipped with forward and rear lifting members 500, when: (i) at rest (or operating at speeds low enough to not generate sufficient lift to raise portion 160*a* above the water's surface) and (ii) traveling at higher speeds, respectively. Likewise, FIG. 38A and FIG. 38B show the embodiment of FIG. 33B in these respective modes, as do FIG. 39A and FIG. 39B show the embodiment of FIG. 33C in these respective modes. In the embodiments shown, lifting members 500 are configured to generate balanced lifting moments about the center of gravity of system 1000 for level attitude; however, it should be understood that lifting members 500 could be configured to generate non-balanced lifting moments to trim the attitude of system 1000 for a given application. As shown, portion 160*a* or the entirety of lower containment element 160 is submerged when at rest or travelling at low speeds and a lesser portion or the entirety of lower containment element 160 is raised above the water's surface 16 when travelling at higher speeds due to increased lift generated by forward lifting member 500.

Passive Drain(s) 167

Figure 40B:
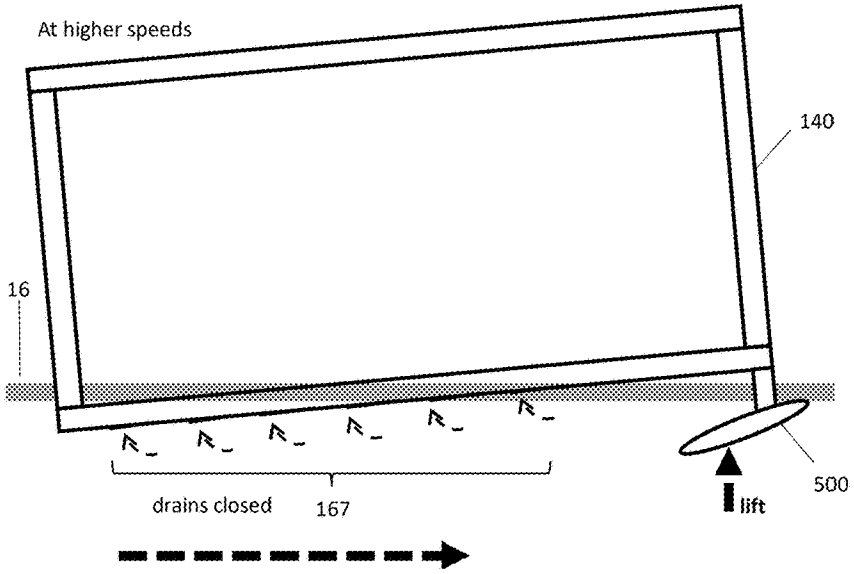
FIGS. 40A-40C illustrate a lower containment element as equipped with a plurality of passively opening/closing drains, in accordance with an embodiment of the present disclosure.
Figure 40A:
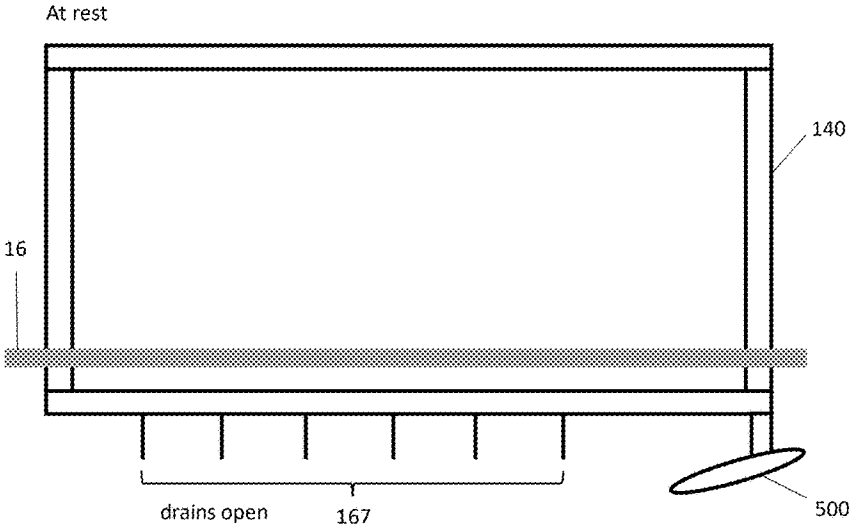
Figure 40C:
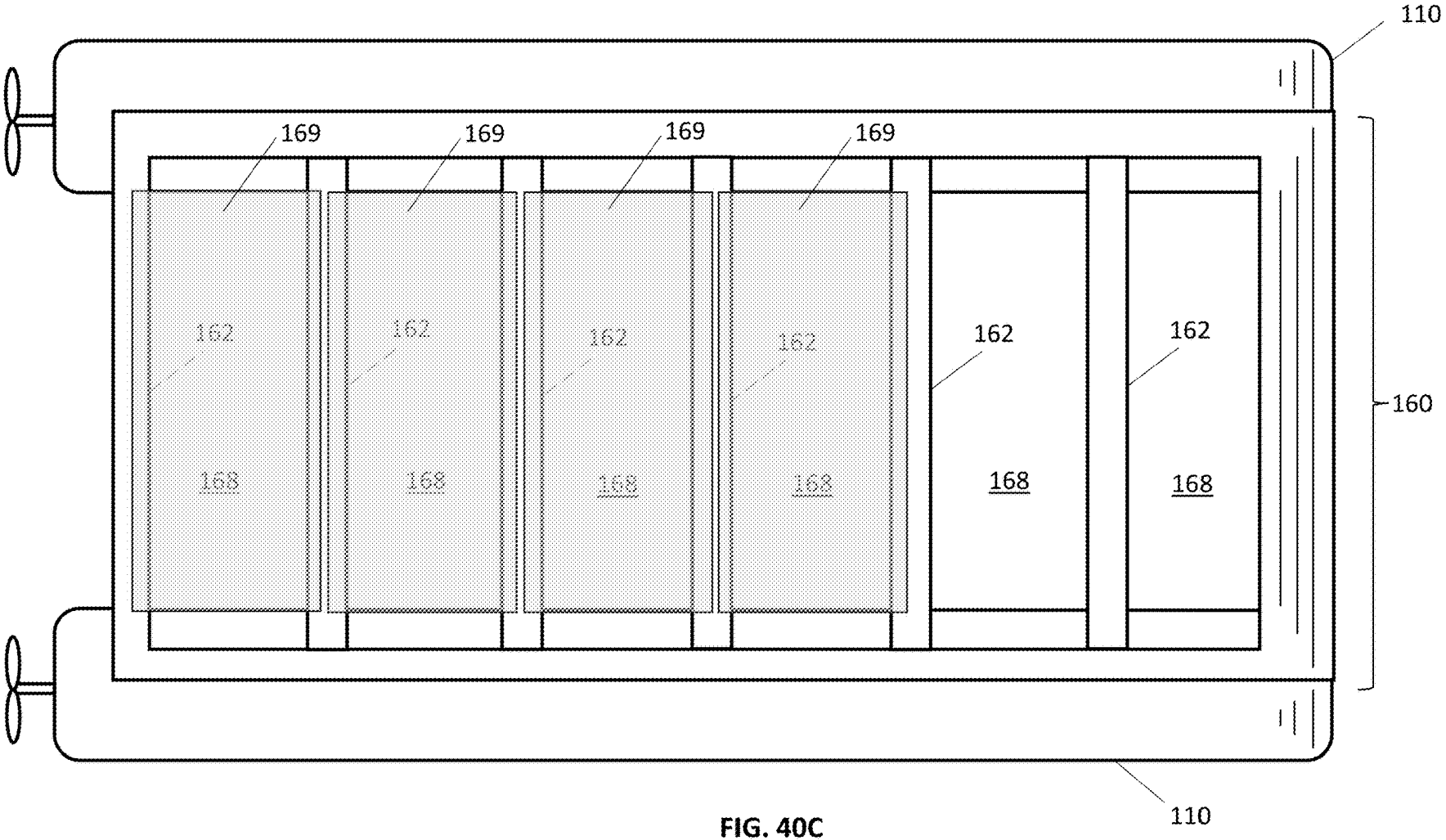

FIGS. 40A-40C illustrate lower containment element 160 as equipped with a plurality of drains 167. In various embodiments, these drains 167 may be configured to open or close based on the speed at which system 1000 is travelling. In particular, drains 167 may be configured to open when system 1000 is at rest, such that lower containment element 160 can submerge and thereby intake object 10; drains 167 may be configured to close when system 1000 is travelling at higher speeds, such that lower containment element 160 can deflect oncoming water much like a normal boat. This may help to further reduce hydrodynamic drag.

In various embodiments, drains 167 may be passive—that is, no motors are required to open and/or close drains 167 (which could drive up cost, reduce reliability, freeze up in icy conditions, become immobilized by rust or weeds, etc.). For example, drains 167 may comprise openings 168 in lower containment element 160, with similarly sized flaps 169 hinged at the leading edge of each opening 168. Gravity causes the flaps 169 to fall open when at rest, ensuring the openings 168 remain open, and hydrodynamic drag causes the flaps 169 to swing closed and thereby cover the openings 168 when system 1000 is moving forward in the water. FIG. 40C is a bottom view showing flaps 169 (transparent grey color) in a closed position.

In an embodiment, flaps 169 are positioned only on that portion of lower containment element 160 that is in contact with the water's surface 16 when travelling at higher speeds. This portion is typically more rearward in embodiments comprising a forward lifting member 500, since the upward pitching moment generated by lifting member 500 raises the bow. Were flaps 169 to be placed forward of this contact area, they may close at lower speeds, thereby transforming forward portion 160*a* into a large, solid "crankbait lip" that generates a significant downward pitching moment. This may increase hydrodynamic drag, especially if lifting member 500 is unable to counteract that downwards pitching moment to raise front portion 160 above the surface of the water 16.

In an embodiment, flaps 169 are configured to swing forward when system 1000 is moving in reverse. This prevents flaps 169 from acting as speed breaks when moving in reverse.

Tilted Rotating Capture Assemblies 200

Figure 41B:
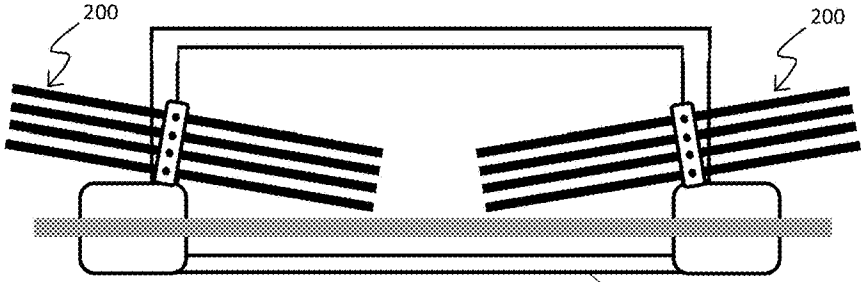
FIG. 41A FIG. 41C, FIG. 41E, and FIG. 41G and FIG. 41B, FIG. 41D, FIG. 41F, and FIG. 41H illustrate side view and front views, respectively, of various embodiments of system 1000 as equipped with tilted rotating capture members, in accordance with various embodiments of the present disclosure
Figure 41D:
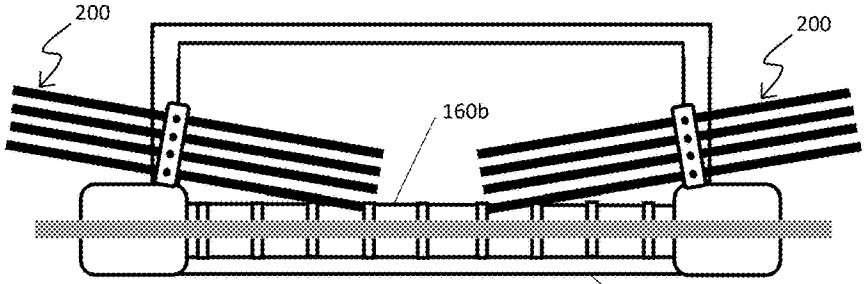
Figure 41A:
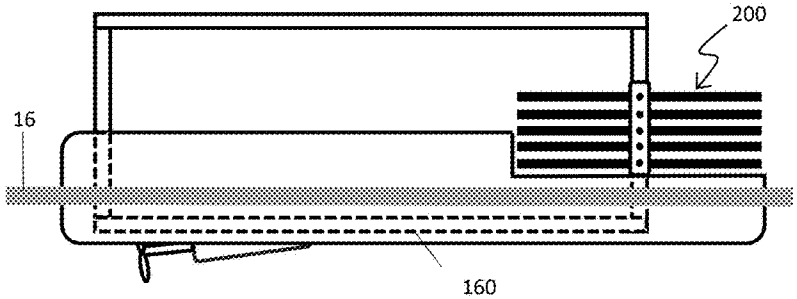
Figure 41C:
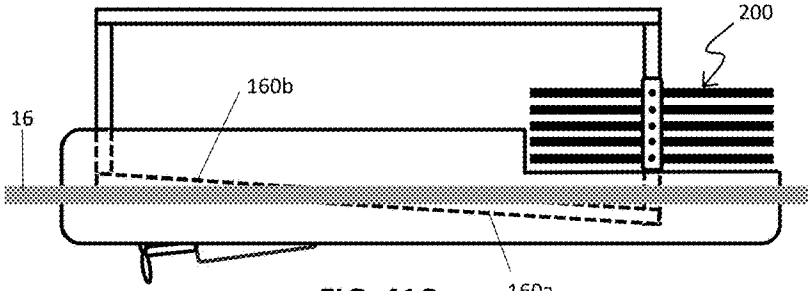
Figure 41F:
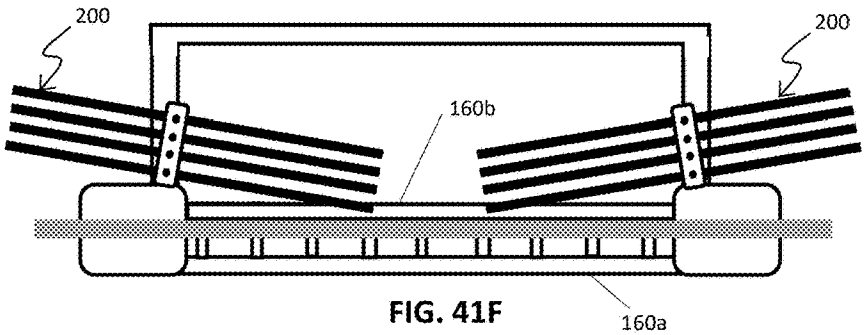
Figure 41H:
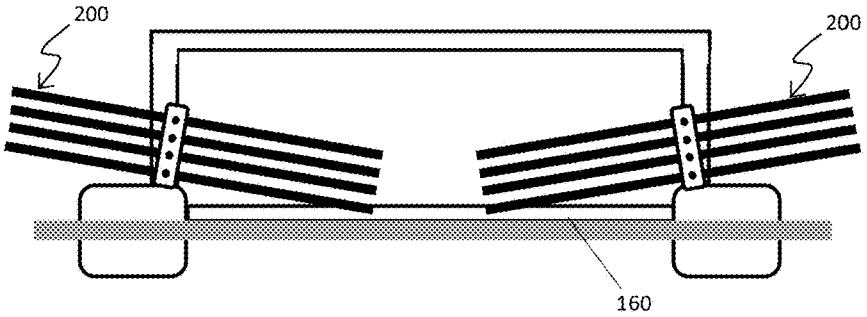
Figure 41E:
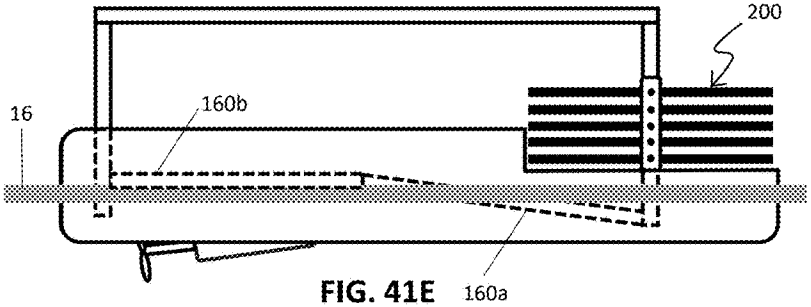
Figure 41G:
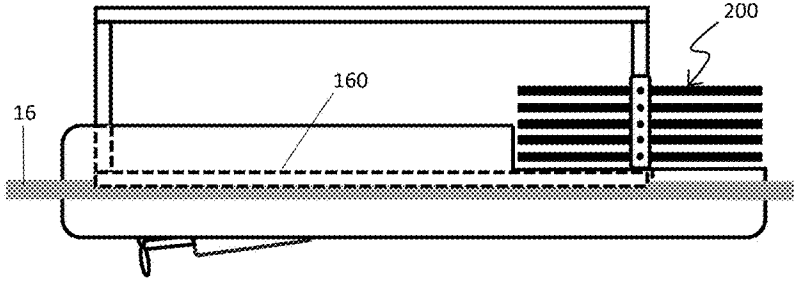

FIG. 41A FIG. 41C, and FIG. 41E and FIG. 41B, FIG. 41D, and FIG. 41F illustrate side view and front views, respectively, of the embodiments of FIGS. 33A-33C as equipped with tilted rotating capture members 210. Tilting rotating capture members 210 towards a longitudinal centerline of watercraft 100, in various embodiments, can bring rotating capture arms 212 closer to the surface of the water than otherwise possible were they oriented vertically, thereby minimizing any cutout necessary in pontoons 110 to position rotating capture member 210 low enough to effectively engage low profile objects, such as a dead duck floating on the surface of the water. Additionally or alternatively, tilting rotating capture members 210 in this manner causes the force vector applied by capture arms 212 to have a vertical component, which can help lift object 10 up inclined portions of lower containment element 160 (as shown in FIGS. 41C, 41D and FIGS. 41E, 41F) or up and over the leading edge of lower containment element 160, whether submerged (as shown in FIGS. 41A, 41B) or unsubmerged (as shown in FIGS. 41G, 41H).

Retainer 600

Figure 42A:
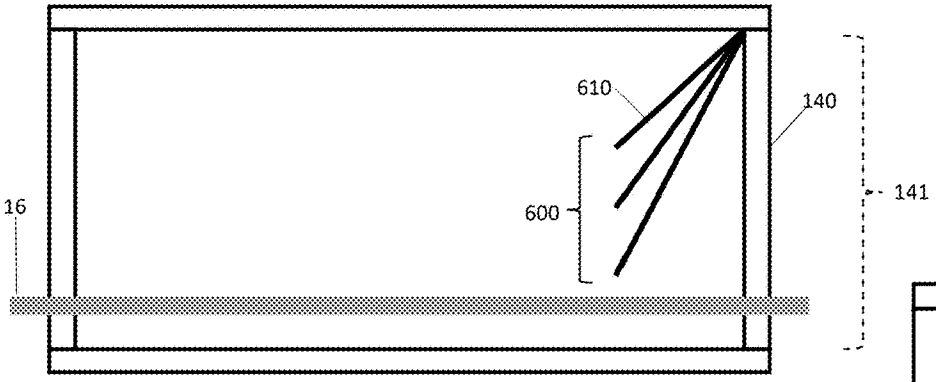
FIGS. 42A-44C illustrate a retainer, in in accordance with various embodiments of the present disclosure.
Figure 42B:
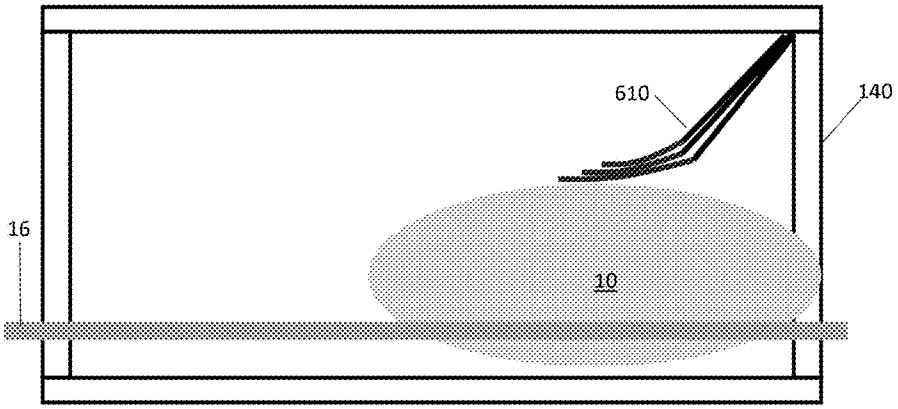
Figure 42C:
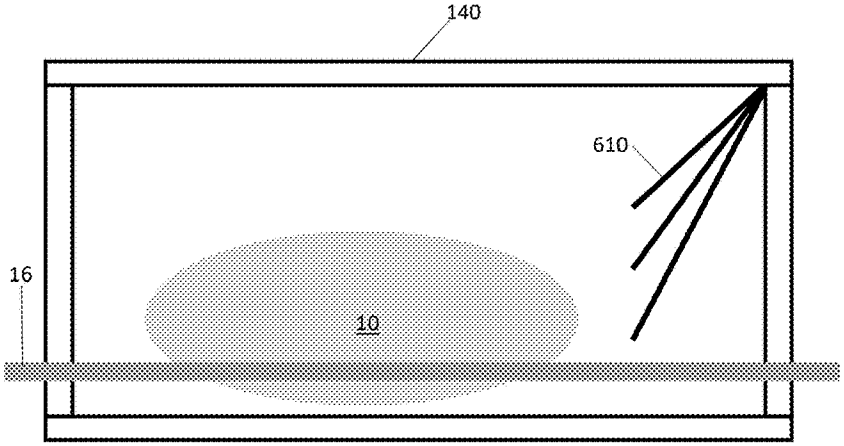
Figure 43B:
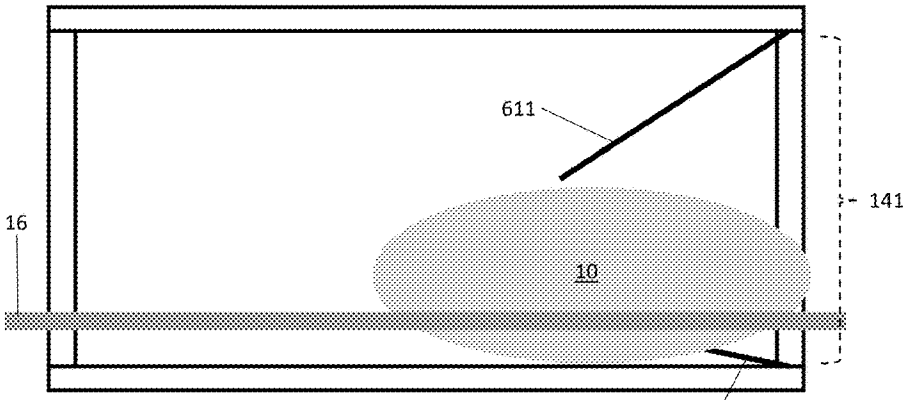
Figure 43A:
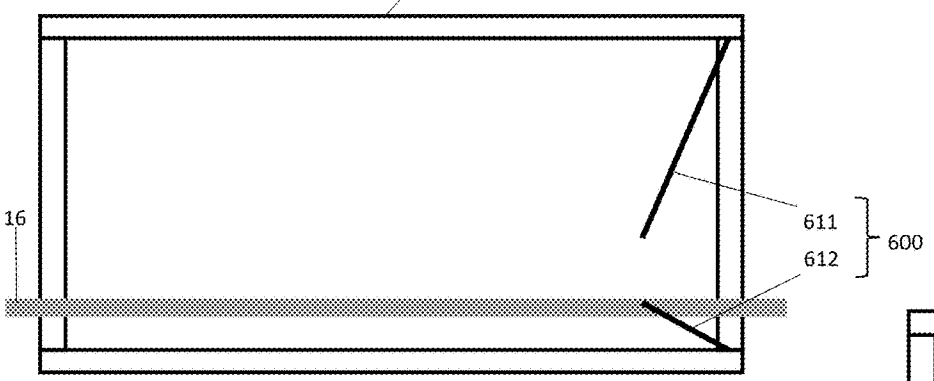
Figure 43C:
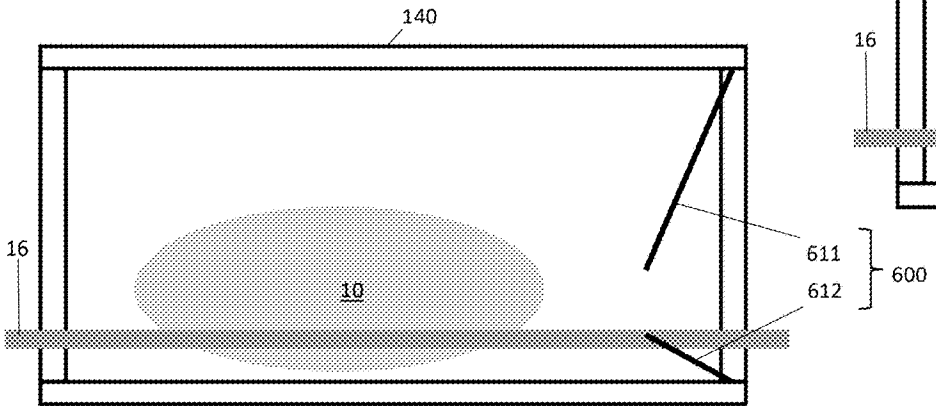
Figure 44A:
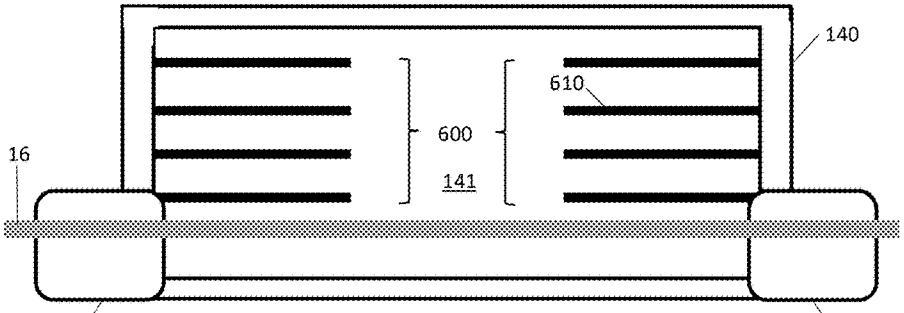
Figure 44B:
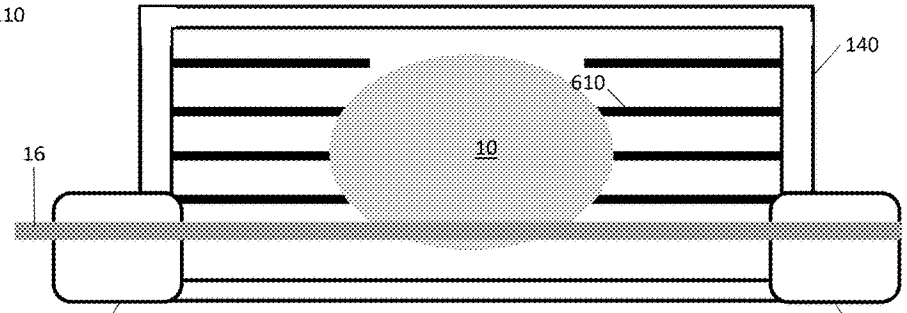
Figure 44C:
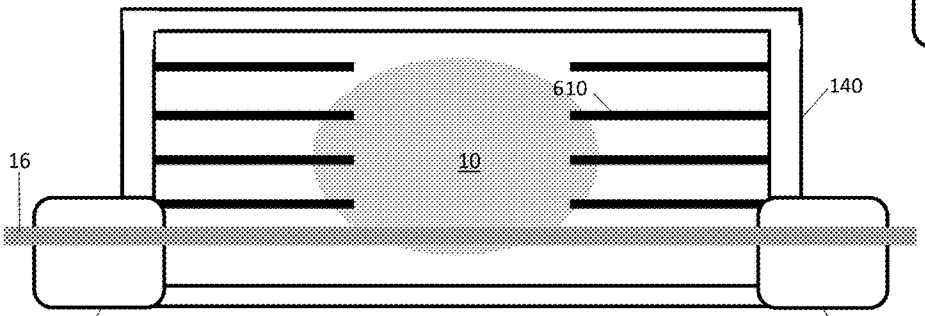

FIGS. 42A-44C illustrate various embodiments of a retainer 600 of the present disclosure. Retainer 600, in various embodiments, comprises one or more semi-rigid members 610 positioned within cargo area 120 configured to bend accommodate passage of object 10 into cargo area 120 and spring back to prevent object 10 from escaping back through the open front side 141. Generally speaking, semi-rigid members extend towards a longitudinal centerline of cargo area 120 (whether orthogonal or swept rearwards) and are flexible enough to bend away from that centerline when pushed by relative rearward motion of object 10 during intake. Whenever object 10 clears a semi-rigid member 610, the semi-rigid member springs back to its original orientation, thereby closing off a path for object 10 forwards towards the open front side 141 of containment structure 140. If semi-rigid members 610 are swept rearwards, they "snag" on object 10, making it more difficult for object 10 to bend the semi-rigid members forwards to escape than it was to bend them rearwards to enter. FIGS. 42A-42C illustrate an embodiment in which retainer 600 is positioned on upper containment element 170 near the open front side 141 of containment structure 140. As object 10 enters it presses on semi-rigid members, causing them to flex upwards. When object 10 clears the semi-rigid members 610, they spring back to their original orientations which, here, is rear swept. One benefit of positioning retainer 600 on upper containment element 170 is that the semi-rigid members 610 are unlikely to snag debris or weeds on the water's surface because they do not necessarily need to extend that far to adequately retain object 10; however, semi-rigid members 610 need to be relatively long so as to adequately span the open front side 141 of containment structure 140 to prevent object 10 from escaping. This may require cargo area 120 to be longer to provide enough room for object 10 to clear the retainer members 610. FIGS. 43A-43C illustrate another embodiment in which retainer 600 is positioned on both the upper containment element 170 and lower containment element 160. More specifically, one or more semi-rigid members 611 may extend downwards from upper containment element 170 and one or more semi-rigid members 612 may extend upwards from lower containment element 160 as shown. Such a configuration may allow semi-rigid members 611 to be shorter than semi-rigid members 610 of FIGS. 42A-42C since lower semi-rigid members 612 help span part of the open front side 141, and thus cargo area 120 may not need to be longer; however, semi-rigid members 612 may snag debris or weeds since they are partially submerged. That said, the rearward sweep of lower semi-rigid members 612 may make it easier to intake object 10 and keep it retained inside cargo area, and may also help shed any debris or weeds that get caught on them. FIGS. 44A-44C illustrate another embodiment similar to that of FIG. 43A-43C, only with semi-rigid members 610 being mounted on the sides of containment structure 140 rather than the top and bottom. Such a configuration may share the benefits of the prior examples without the drawbacks, in that semi-rigid members 610 are relatively short and are not submerged, yet still adequately span the open front side 141 of containment structure 140 to keep object 10 retained inside.

Retainer 700

Figure 45:
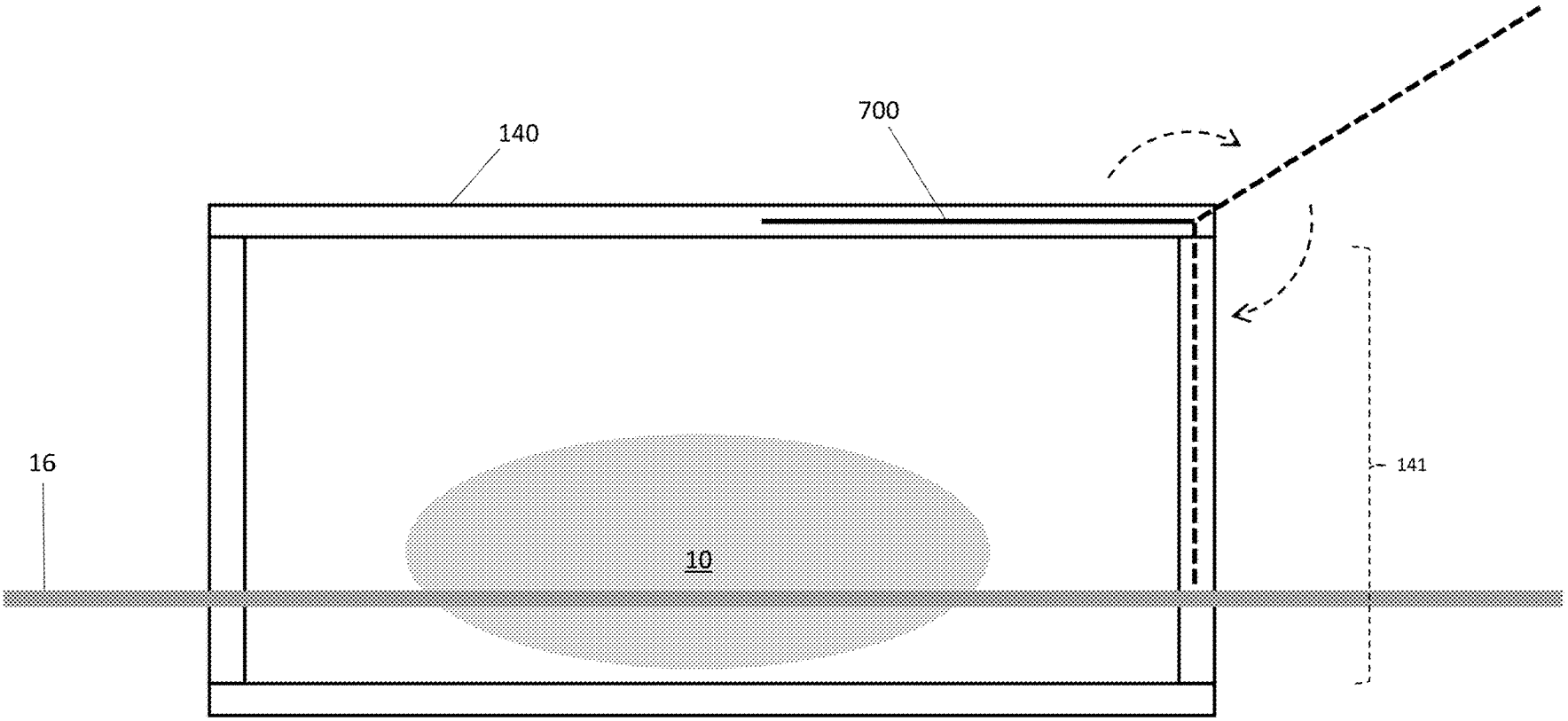
FIGS. 45 and 46 illustrate another retainer, in accordance with various embodiments of the present disclosure.
Figure 46:
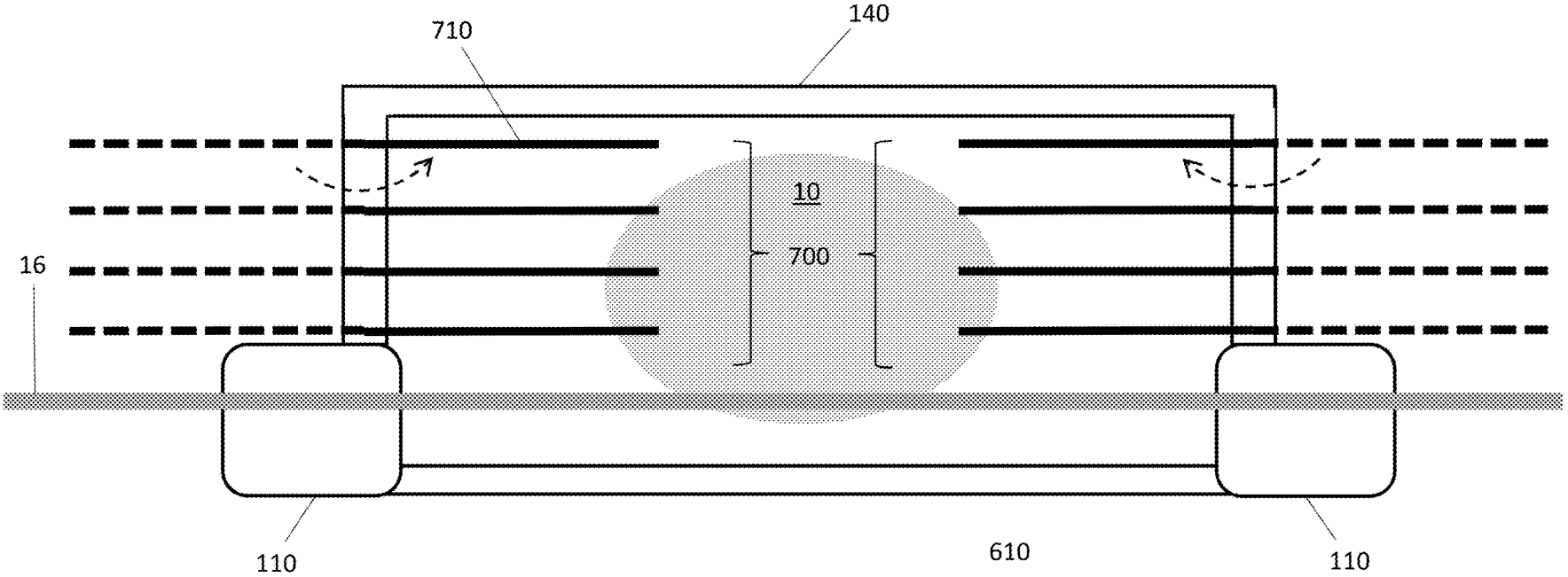

FIGS. 45 and 46 illustrate various embodiments of a retainer 700 of the present disclosure. Retainer 700, in various embodiments, comprises one or more rigid, hinged members 710 positioned at the open front side 141 of containment structure 140 in an open position and an electromechanical mechanism (not shown) configured to close the hinged member(s) 710 to prevent object 10 from escaping back through the open front side 141 once inside. In an embodiment, the electromechanical mechanism is a motor configured to apply a force for closing hinged member(s) 710. In another embodiment, a torsion spring (not shown) biases the hinged member(s) 710 towards the closed position and the electromechanical mechanism is a servo configured to release a latch (not shown) holding the spring-loaded hinged member(s) 710 in the open position. Upon releasing the latch, the torsion spring causes the spring-loaded hinged member(s) 710 to close over the open front side 141 of containment structure 140. In an embodiment, the spring force is sufficient to keep object 10 from pushing the hinged member(s) 710 back open to escape; in another embodiment, the force of closing causes hinged member(s) 710 to engage a locking mechanism (not shown).

FIG. 45 illustrates an embodiment of retainer 700 mounted to upper containment element 170. Hinged member(s) 710 are initially in an open position, folded back onto the top of containment structure 140 as shown. Actuation of the electromechanical mechanism causes hinged member(s) 710 to swing forwards and downwards to close off the open front side 141 of containment structure 140, as shown. In an embodiment, hinged member(s) 710 may be dimensioned such that their distal ends are not submerged when closed, so as to avoid catching debris or weeds yet still keeping object 10 contained within cargo area 120.

FIG. 46 illustrates another embodiment of retainer 700 mounted to the sides of containment structure 140. Hinged members 710 are initially in an open position, folded back along the sides of containment structure 140 as shown. Actuation of the electromechanical mechanism causes hinged members 710 to swing forwards to close off the open front side 141 of containment structure 140, as shown. In an embodiment, hinged member(s) 710 may be positioned such that they remain above the water's surface 16, so as to avoid catching debris or weeds yet still keeping object 10 contained within cargo area 120.

Elevation Mechanism 800

Figure 47A:
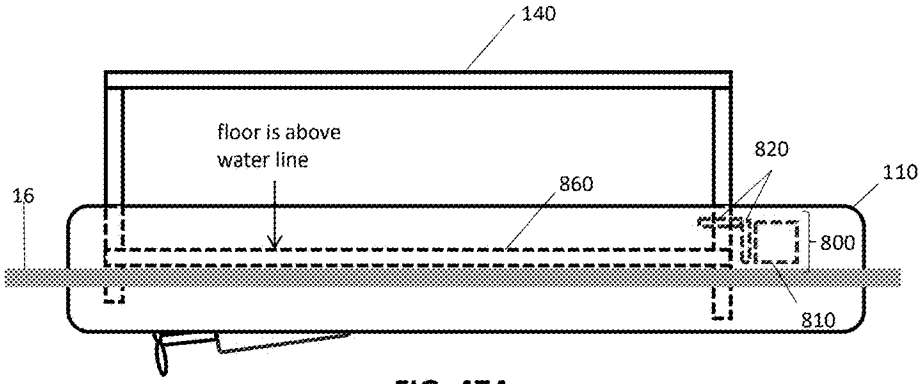
FIGS. 47A-47C illustrate an elevation mechanism, in accordance with an embodiment of the present disclosure.
Figure 47B:
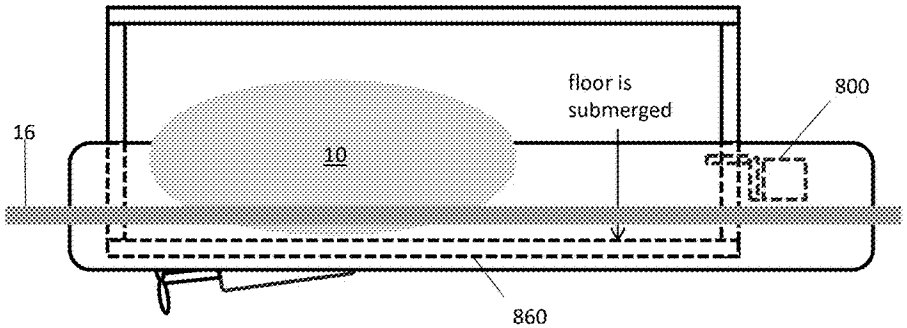
Figure 47C:
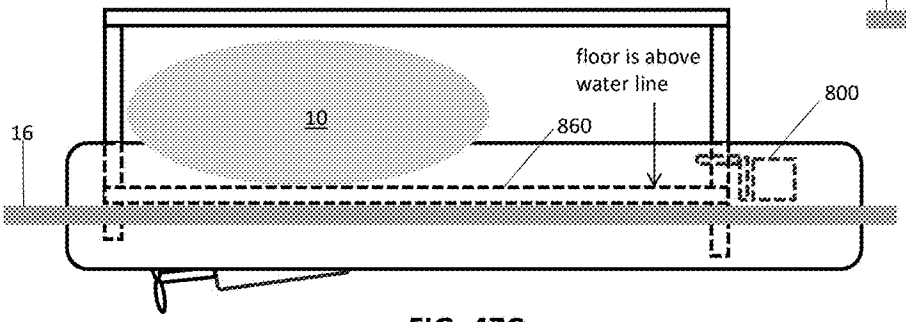

FIGS. 47A-47C illustrate an embodiment of an elevation mechanism 800 of the present disclosure. Elevation mechanism 800, in various embodiments, may include an electromechanical mechanism 800 configured to raise and/or lower containment element 160 (labeled 860 in this particular example) above and below the water's surface 16. Elevation mechanism, in some embodiments, may be operated to transition system 1000 between the two modes mentioned above—that is, one in which all or a portion of lower containment element 860 is submerged when intaking object 10, and one in which at least a portion of that submerged portion/submerged entirety is raised above the water's surface 16 when cruising. Unlike previous embodiments of system 1000 which are able to passively transition between these two modes (e.g., those comprising lifting member(s) 500), elevation mechanism 800 relies on an active solution—that is, electromechanical mechanism 800.

Electromechanical mechanism 800, in various embodiments, may include a motor 810 and a transmission 820 for converting the rotational output of motor 810 into translation of lower containment element 860, such as a drive screw. This would allow the lower containment element 860 to be selectively raised and lowered. As configured, in an embodiment, lower containment element 860 may be in the raised position to minimize drag when cruising to object 10, then lowered to intake object 10 into cargo area 120, and then raised again to minimize drag while cruising back to the user.

Electromechanical mechanism 800, in various embodiments, may include a servo configured to release a spring-loaded version of lower containment element 860, so that it moves from either the raised position to the lowered position, or from the lowered position to the raised position. In an embodiment, the user pulls spring-loaded lower containment element 860 into the raised position initially, so as to minimize drag while cruising to object 10. Upon reaching object 10, the user uses transmitter 300 to transmit a release command, causing lower containment element 860 to submerge prior to intaking object 10. The lower containment element 860 remains submerged when bringing object 10 back to the user. Another embodiment takes the opposite approach—that is, the user pulls spring-loaded lower containment element 860 into the lowered position initially. This incurs drag while cruising to object 10, but upon intaking object 10, the user issues a release command that causes lower containment element 860 to move to the raised position, lifting object 10 out of the water. This may greatly reduce drag during the return trip to the user.

Figure 48A:
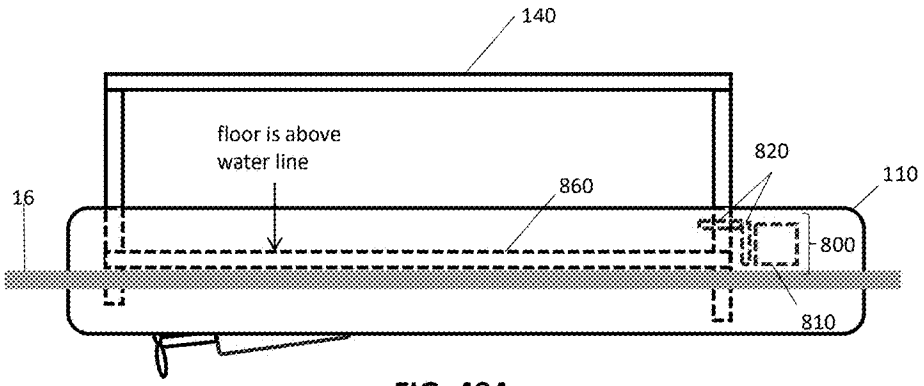
FIGS. 48A-48C illustrate a similar embodiment as that shown in FIGS. 47A-47C, except that the lower containment element swings upwards and downwards about a pivot point near the rear (forming a ramp-like shape to facilitate intake of the object) as opposed to the entirety of the lower containment element translating upwards and downwards, in accordance with an embodiment of the present disclosure.
Figure 48B:
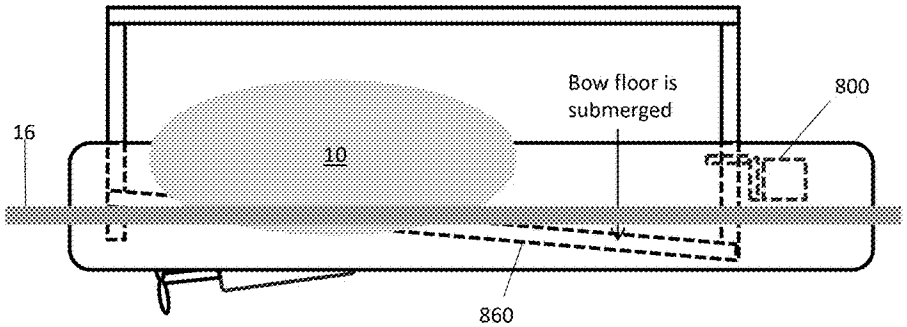
Figure 48C:
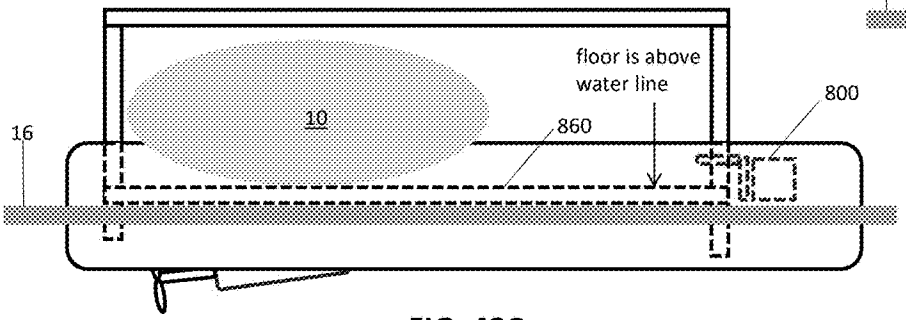

FIGS. 48A-48C illustrate a similar embodiment as that shown in FIGS. 47A-47C, except that lower containment element 860 swings upwards and downwards about a pivot point near the rear (forming a ramp-like shape to facilitate intake of object 10) as opposed to the entirety of lower containment element 860 translating upwards and downwards.

Alternative Floatation Member 110

Figure 49B:
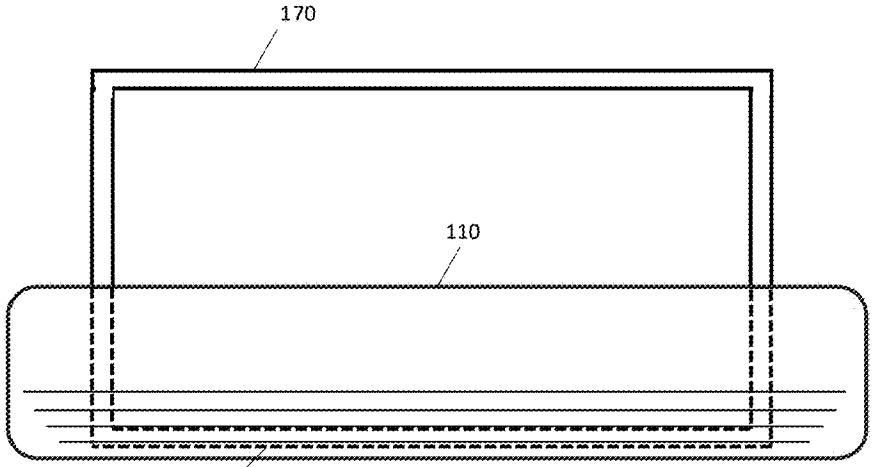
FIG. 49A-49C illustrate top, rear, and front views, respectively, of a system having a substantially U-shaped floatation member as opposed to two separate pontoon-like floatation members, in accordance with an embodiment of the present disclosure.
Figure 49A:
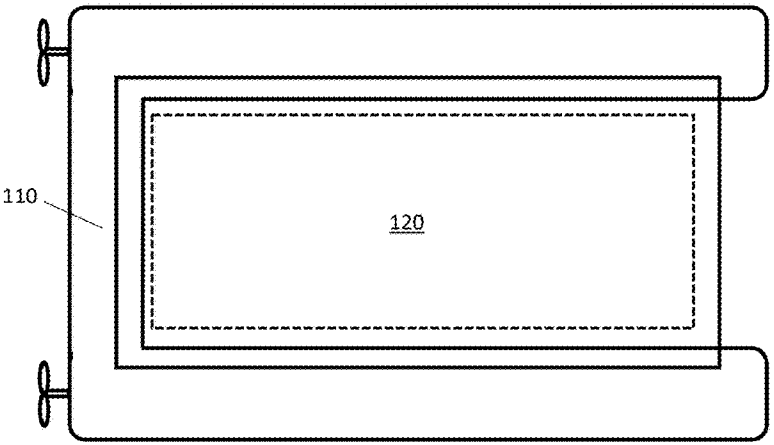
Figure 49C:
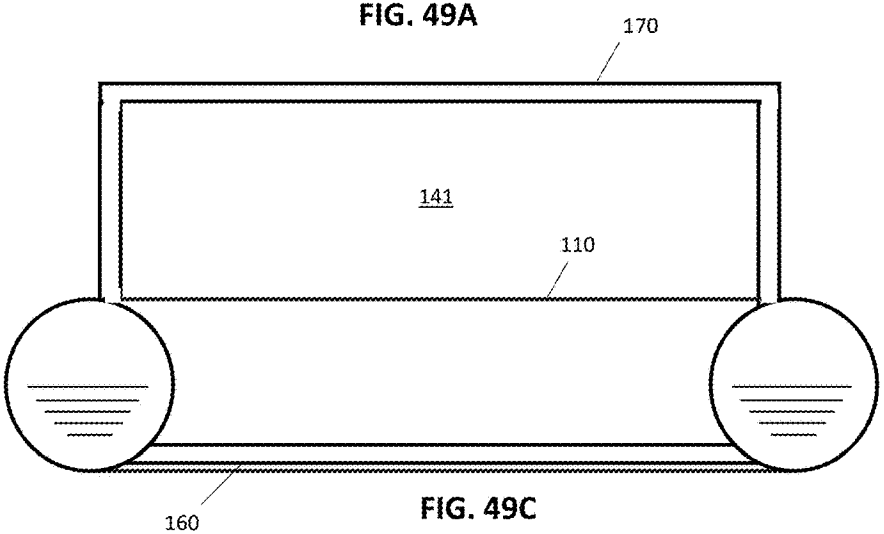

FIG. 49A-49C illustrate top, rear, and front views, respectively, of an embodiment of system 1000 having a substantially U-shaped floatation member 110 as opposed to two separate pontoon-like floatation members 110. Cargo area 120 is situated within the "U" and is thus surrounded on three sides by U-shaped cargo member 110 as opposed to being surrounded on two sides by the pontoon-like configuration described throughout the present disclosure. As such, in some embodiments, containment structure 140 may not include a rear containment element 150 since the bottom of the "U" may be sufficient to prevent object 10 from escaping the cargo area through the rear of system 1000. Generally speaking, it should be recognized that any number and arrangement of floatation member(s) 110 may be utilized without departing from the scope of the present disclosure so long as such flotation member(s) define a cargo area 120 and do not interfere with the intake of object 10 thereinto. U-shaped floatation member 110, in various embodiments, may be configured to detach from connecting structure 130/containment structure 140 much like the pontoon-like floatation members 110.

Additional Prototype

Figure 50B:
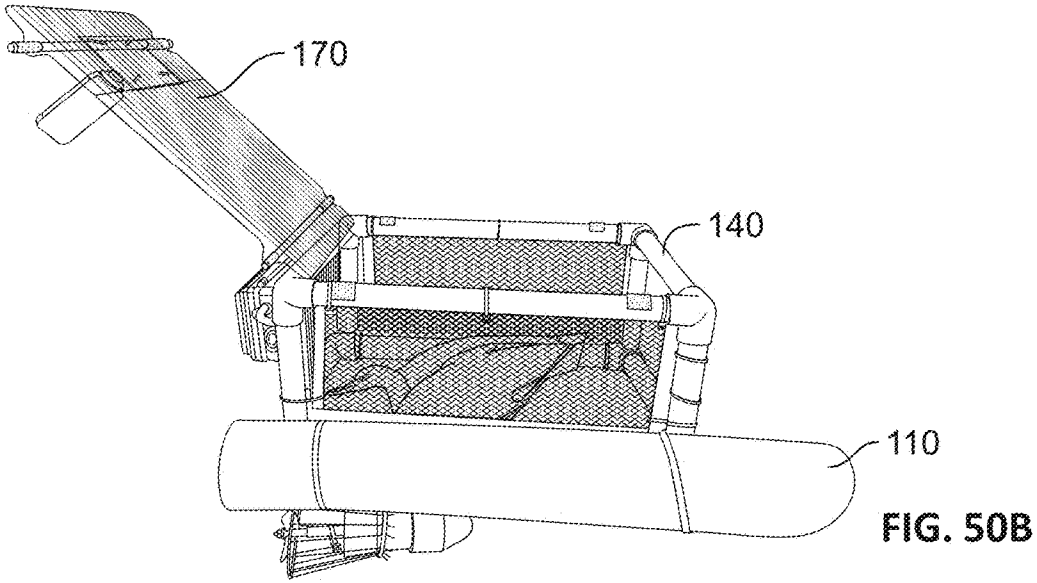
FIGS. 50A-50G show various views of another prototype of the system built for testing and technology demonstration purposes, in accordance with an embodiment of the present disclosure.
Figure 50C:
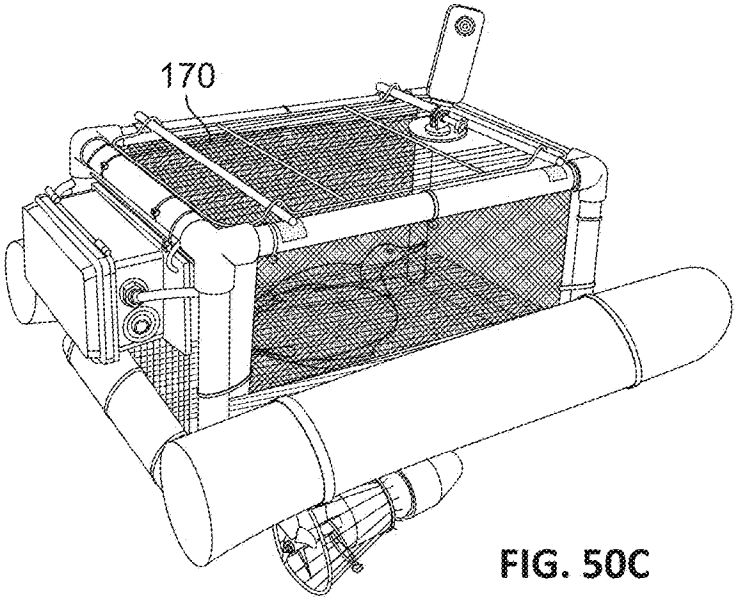
Figure 50A:
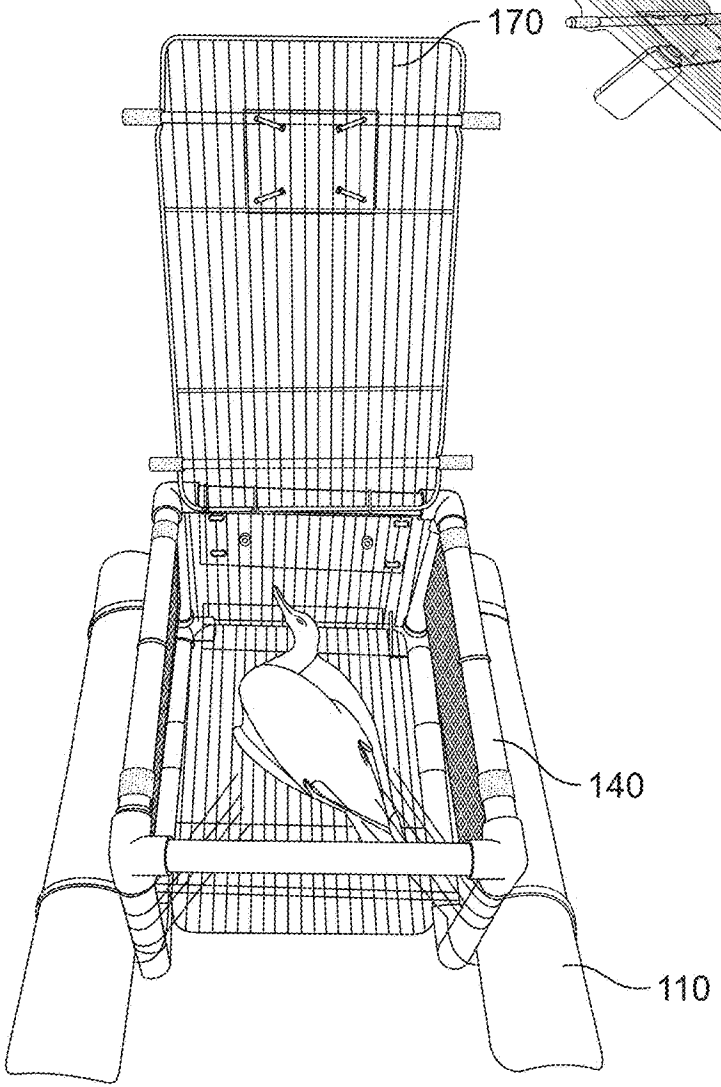
Figure 50E:
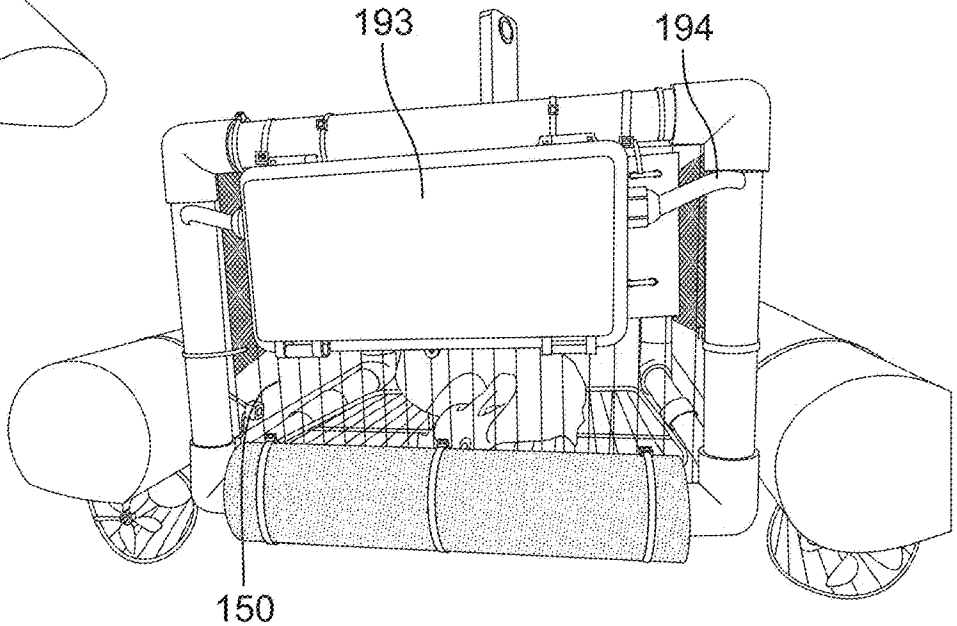
Figure 50D:
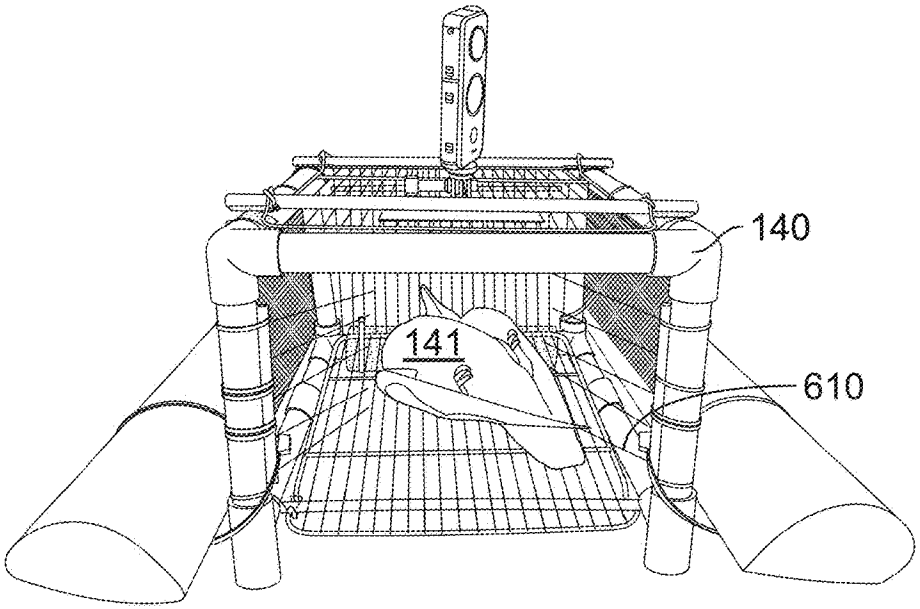
Figure 50G:
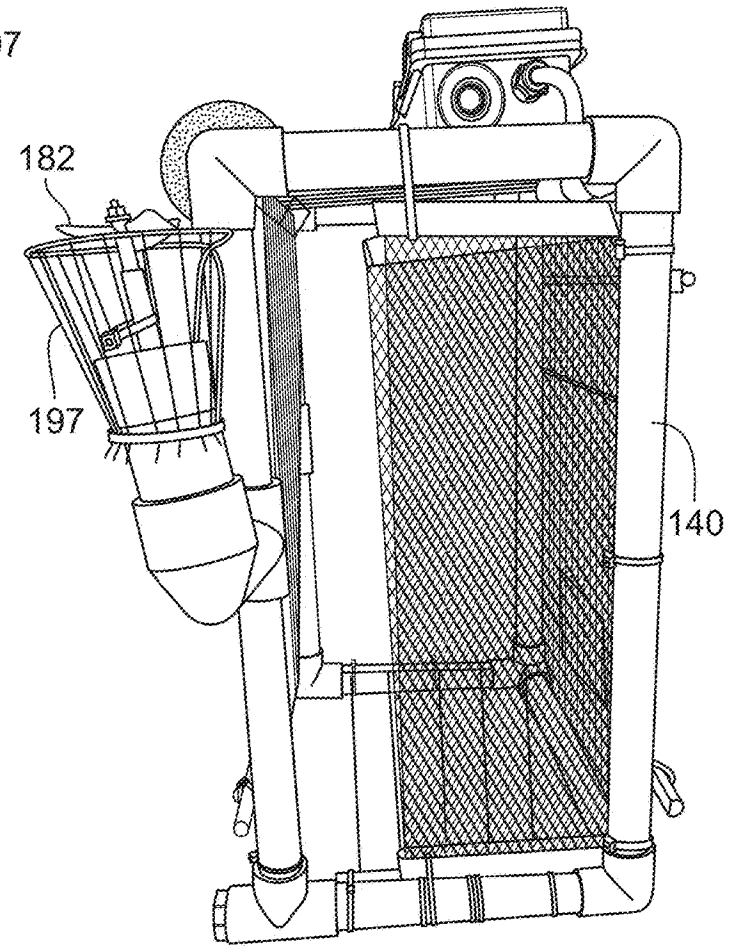
Figure 50F:
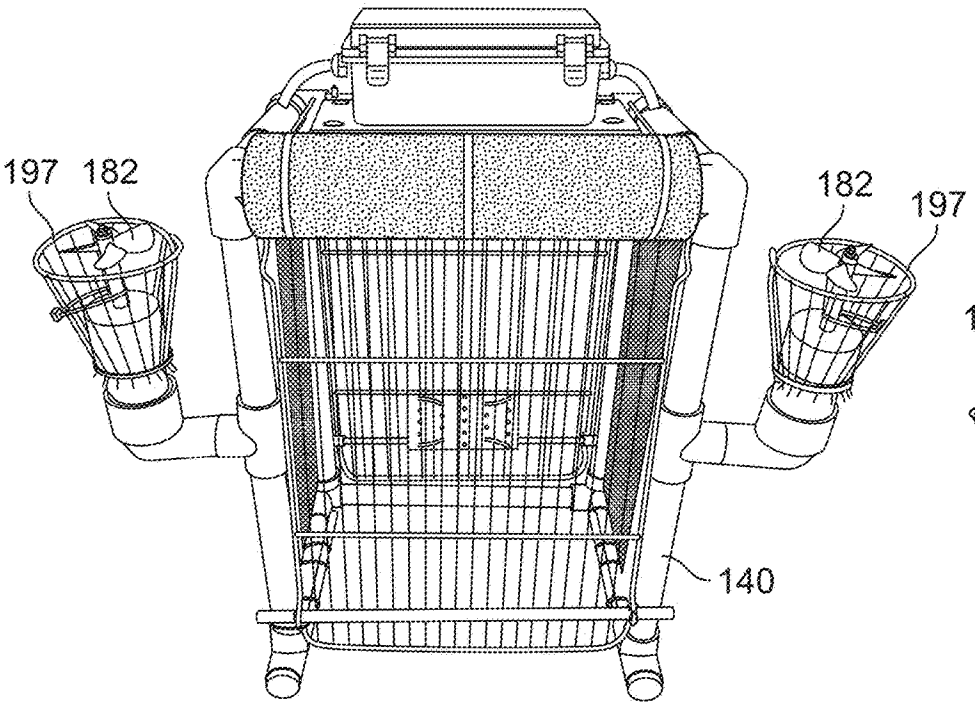

FIGS. 50A-50G show various views of another prototype of system 1000 built for testing and technology demonstration purposes. These views are a top view, side view, side view, rear perspective view, front view, and rear view, respectively. FIG. 50A and FIG. 50B are shown with upper containment element 170 flipped open so that the hunter can easily remove the object 10 (here, a duck) inside. Upper containment element 170 is shown closed in the remaining figures. FIG. 50D best illustrates open front side 141 of containment structure 140, as equipped with an embodiment of retainer 600 similar to that shown in FIGS. 44A-44C. Semi-rigid members 610 have enough bend to allow object 10 to enter containment structure 140 and the rearward sweep of semi-rigid members 610 help retain the object therewithin in cargo area 120. FIG. 50E shows junction box 193, which houses receiver 184, electronic speed controllers 185, and batteries 186. Wiring 194 connects the outputs of electronic speed controllers 185 to the inputs of motors 181 (not shown). FIG. 50F and FIG. 50G show the prototype with pontoons 110 removed, so as to better view containment structure 140 and powertrain 180. Similar to the embodiments of FIGS. 30A-32C, all components of powertrain 180 are offboard pontoons 110—here, they are all mounted to or integrated into containment structure 140. Weed guards 197 shroud propellers 182 to prevent propellers 182 from getting tangled with floating weeds in the body of water and to protect propellers 182 when system 1000 is placed directly on the ground. Extra floatation material was added to the rear to counteract some of the weight of powertrain 180 and thereby keep the leading edge of lower containment element 160 submerged when driven at speeds characteristic of those used to capture object 10. Wakeboard side fins (not shown) were later added to the bottom of lower containment element 160 to improve tracking.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A watercraft for retrieving a downed waterfowl on a body of water, the watercraft comprising:

a first floatation member and a second floatation member; and a containment structure situated between and providing a rigid connection between the first floatation member and the second floatation member, and having an interior defining an internal cargo area of the watercraft, the containment structure comprising:

a partially-submerged open front side dimensioned to accommodate entry of the downed waterfowl into the internal cargo area through the partially-submerged open front side;

a lower containment element defining a lower side of the internal cargo area, wherein (i) a leading edge of the lower containment element defines a lower boundary of the partially-submerged open front side, (ii) the leading edge is submerged to a depth sufficient to allow the downed waterfowl to pass over the leading edge and through the partially-submerged open front side, and (iii) at least a forward portion of the lower containment element extending rearwards from the leading edge is submerged and comprises multiple rigid members spaced apart from one another at distances sufficient to allow water to freely pass therethrough while obstructing the downed waterfowl from passing therethrough; and a rear containment element defining a rear side of the internal cargo area.

2. The watercraft of claim 1, wherein an entirety of the lower containment element is submerged in the body of water.

3. The watercraft of claim 2, wherein the lower containment element is angled downwards in a direction towards the partially-submerged open front side of the containment structure, and wherein the downed waterfowl is at least partially raised above a waterline of the watercraft by a rear portion of the lower containment element.

4. The watercraft of claim 1, wherein a rear portion of the lower containment element is at or above a surface of the body of water, and wherein the submerged forward portion of the lower containment element is angled downwards in a direction towards the partially-submerged open front side of the containment.

5. The watercraft of claim 4, wherein the rear portion of the lower containment element is substantially parallel to the surface of the body of water.

6. The watercraft of claim 1, further comprising an electromechanical mechanism configured to selectively raise and/or lower at least a portion of the lower containment element above and/or below the surface of the water, respectively.

7. The watercraft of claim 1, wherein at least a portion of the rear containment element is positioned above a surface of the body of water.

8. The watercraft of claim 1, wherein at least a portion of the rear containment element is submerged in the body of water and comprises multiple rigid members spaced apart from one another at distances sufficient to allow water to freely pass therethrough while obstructing the downed waterfowl from passing therethrough.

9. The watercraft of claim 1, wherein at least a portion of the rear containment element is defined by a portion of the lower containment element.

10. The watercraft of claim 1, wherein the containment structure further comprises an upper containment element, wherein (i) the upper containment element defines an upper side of the internal cargo area, and (ii) a leading edge of the upper containment element defines an upper boundary of the partially-submerged open front side and is at least as high as a height of the downed waterfowl on the surface of the water.

11. The watercraft of claim 10, wherein at least a portion of the rear containment element is defined by a portion of the upper containment element.

12. A watercraft for retrieving a downed waterfowl on a body of water, the watercraft comprising:

a first floatation member and a second floatation member;

a containment structure situated between the first and second floatation members and having an interior defining an internal cargo area of the watercraft, the containment structure comprising:

a partially-submerged open front side dimensioned to accommodate entry of the downed waterfowl into the internal cargo area through the partially-submerged open front side;

a fully-submerged lower containment element defining a lower side of the internal cargo area, wherein (i) a leading edge of the lower containment element defines a lower boundary of the partially-submerged open front side, (ii) the leading edge is submerged to a depth sufficient to allow the downed waterfowl to pass over the leading edge and through the partially-submerged open front side, and (iii) the lower containment element comprises multiple rigid members spaced apart from one another at distances sufficient to allow water to freely pass therethrough while obstructing the downed waterfowl from passing therethrough; and a rear containment element defining a rear side of the internal cargo area.

13. The watercraft of claim 12, wherein the lower containment element is angled downwards in a direction towards the partially-submerged open front side of the containment structure, and wherein the downed waterfowl is at least partially raised above a waterline of the watercraft by a rear portion of the lower containment element.

14. The watercraft of claim 12, further comprising an electromechanical mechanism configured to selectively raise and/or lower at least a portion of the lower containment element above and/or below the surface of the water, respectively.

15. The watercraft of claim 12, wherein at least a portion of the rear containment element is positioned above a surface of the body of water.

16. The watercraft of claim 12, wherein at least a portion of the rear containment element is submerged in the body of water and comprises multiple rigid members spaced apart from one another at distances sufficient to allow water to freely pass therethrough while obstructing the downed waterfowl from passing therethrough.

17. The watercraft of claim 12, wherein at least a portion of the rear containment element is defined by a portion of the lower containment element.

18. The watercraft of claim 12, wherein the containment structure further comprises an upper containment element, wherein (i) the upper containment element defines an upper side of the internal cargo area, and (ii) a leading edge of the upper containment element defines an upper boundary of the partially-submerged open front side and is at least as high as a height of the downed waterfowl on the surface of the water.

19. The watercraft of claim 18, wherein at least a portion of the rear containment element is defined by a portion of the upper containment element.

20. The watercraft of claim 12, wherein the containment structure provides a rigid connection between the first and second floatation members.

21. A watercraft for retrieving a downed waterfowl on a body of water, the watercraft comprising:

a first floatation member and a second floatation member;

a containment structure situated between the first and second floatation members and having an interior defining an internal cargo area of the watercraft, the containment structure comprising:

a partially-submerged open front side dimensioned to accommodate entry of the downed waterfowl into the internal cargo area through the partially-submerged open front side;

a lower containment element defining a lower side of the internal cargo area, wherein (i) a leading edge of the lower containment element defines a lower boundary of the partially-submerged open front side, (ii) the leading edge is submerged to a depth sufficient to allow the downed waterfowl to pass over the leading edge and through the partially-submerged open front side, (iii) a forward portion of the lower containment element extending rearwards from the leading edge is submerged and angled downwards in a direction towards the open front side, the forward portion comprising multiple rigid members spaced apart from one another at distances sufficient to allow water to freely pass therethrough while obstructing the downed waterfowl from passing therethrough, and (iv) a rear portion of the lower containment element is positioned at or above a surface of the body of water; and a rear containment element defining a rear side of the internal cargo area.

22. The watercraft of claim 21, wherein the downed waterfowl is raised above a waterline of the watercraft by the rear portion of the lower containment element.

23. The watercraft of claim 21, wherein the rear portion of the lower containment element is substantially parallel to the surface of the body of water.

24. The watercraft of claim 21, further comprising an electromechanical mechanism configured to selectively raise and/or lower at least a portion of the lower containment element above and/or below the surface of the water, respectively.

25. The watercraft of claim 21, wherein at least a portion of the rear containment element is positioned above a surface of the body of water.

26. The watercraft of claim 21, wherein at least a portion of the rear containment element is defined by a portion of the lower containment element.

27. The watercraft of claim 21, wherein the containment structure further comprises an upper containment element, wherein (i) the upper containment element defines an upper side of the internal cargo area, and (ii) a leading edge of the upper containment element defines an upper boundary of the partially-submerged open front side and is at least as high as a height of the downed waterfowl on the surface of the water.

28. The watercraft of claim 27, wherein at least a portion of the rear containment element is defined by a portion of the upper containment element.

29. The watercraft of claim 21, wherein the containment structure provides a rigid connection between the first and second floatation members.

30. A watercraft for retrieving a downed waterfowl on a body of water, the watercraft comprising:

a first floatation member and a second floatation member; and a containment structure situated between and providing a rigid connection between the first floatation member and the second floatation member, and having an interior defining an internal cargo area of the watercraft, the containment structure comprising:

a partially-submerged open front side dimensioned to accommodate entry of the downed waterfowl into the internal cargo area through the partially-submerged open front side;

a lower containment element defining a lower side of the internal cargo area, wherein (i) a leading edge of the lower containment element defines a lower boundary of the partially-submerged open front side, (ii) the leading edge is submerged to a depth sufficient to allow the downed waterfowl to pass over the leading edge and through the partially-submerged open front side, and (iii) at least a forward portion of the lower containment element extending rearwards from the leading edge is submerged and comprises multiple rigid members spaced apart from one another at distances sufficient to allow water to freely pass therethrough while obstructing the downed waterfowl from passing therethrough, and (iv) a rear portion of the lower containment element is positioned higher than the leading edge of the lower containment element such that the downed waterfowl is at least partially raised in the water or above a surface of the water by the rear portion; and a rear containment element defining a rear side of the internal cargo area.

* * * * *